US006817667B2

(12) United States Patent
Pennington et al.

(10) Patent No.: US 6,817,667 B2
(45) Date of Patent: Nov. 16, 2004

(54) RECLINABLE CHAIR

(75) Inventors: Mark Rundle Pennington, Wellington (NZ); Jon Leonard Fifield, Wellington (NZ); Robert Bruce Stewart, Lower Hutt (NZ)

(73) Assignee: Formway Furniture Limited, Wellington (NZ)

( * ) Notice: Subject to any disclaimer, the term of this patent is extended or adjusted under 35 U.S.C. 154(b) by 121 days.

(21) Appl. No.: 09/953,816

(22) Filed: Sep. 17, 2001

(65) Prior Publication Data

US 2002/0043843 A1 Apr. 18, 2002

Related U.S. Application Data

(60) Provisional application No. 60/236,933, filed on Sep. 28, 2000.

(51) Int. Cl.[7] ..... A47C 3/025

(52) U.S. Cl. ..... 297/284.4; 297/296; 297/298

(58) Field of Search ..... 297/284.4, 290, 297/291, 295, 297, 298, 284.2, 316, 319, 320

(56) References Cited

U.S. PATENT DOCUMENTS

| | | | | |
|---|---|---|---|---|
| 226,082 A | | 3/1880 | Lemman | |
| 272,579 A | | 2/1883 | Paulding | |
| 323,060 A | | 7/1885 | Moore | |
| 614,235 A | | 11/1898 | Palmer | |
| 662,247 A | | 11/1900 | Vinton | |
| 662,647 A | | 11/1900 | Howe | |
| 1,120,686 A | | 12/1914 | Burrowes | |
| 1,976,793 A | | 10/1934 | Mangold | |
| 2,071,974 A | | 2/1937 | Gunlocke | |
| 2,083,838 A | * | 6/1937 | Goenen | 297/298 |
| 2,471,024 A | | 5/1949 | Cramer | |
| 2,590,995 A | | 4/1952 | Merrill | |
| 2,612,211 A | | 9/1952 | Gielow et al. | |
| 2,796,918 A | | 6/1957 | Luckhardt | |

(List continued on next page.)

FOREIGN PATENT DOCUMENTS

| | | |
|---|---|---|
| DE | 29 40 641 A1 | 4/1981 |
| DE | 30 17 163 A1 | 11/1981 |
| DE | 42 16 358 A1 | 11/1992 |
| DE | 43 17 610 A1 | 12/1994 |
| DE | 94 14 023.5 | 2/1995 |
| DE | 295 02 429 U1 | 12/1995 |
| DE | 196 07 136 A | 8/1996 |
| DE | 297 06 901 U1 | 7/1997 |
| DE | 196 03 789 A1 | 8/1997 |
| DE | 197 16 347 A1 | 10/1998 |
| DE | 198 10 768 A | 9/1999 |
| DE | 198 48 400 A1 | 5/2000 |
| EP | 0 032 839 A2 | 7/1981 |
| EP | 0 154 582 A2 | 9/1985 |
| EP | 0 164 266 A2 | 12/1985 |

(List continued on next page.)

*Primary Examiner*—Anthony D. Barfield
(74) *Attorney, Agent, or Firm*—Workman Nydegger

(57) ABSTRACT

A chair (10) includes a supporting frame (20,22) and a seat portion (14) which is foldable about a transverse fold to define a rearward portion behind the transverse fold and a forward portion, forward of the transverse fold. The seat portion (14) is supported above the supporting frame by its rearward portion. The chair (10) also includes a reclinable back portion (16) and a recline mechanism with which the back portion (16) is connected for reclining action of the back portion (16). The recline mechanism is operably linked to the rearward portion of the seat portion (14) such that on reclining action of the back portion (16), the rearward portion is moved to increase in rearward tilt angle and to obtain a net increase in height above the supporting frame (20,22), with a consequent folding of the seat portion about the transverse fold line under the weight (W) of the occupant.

11 Claims, 86 Drawing Sheets

U.S. PATENT DOCUMENTS

| | | | |
|---|---|---|---|
| 2,804,129 | A | 8/1957 | Propst |
| 2,833,339 | A | 5/1958 | Liljengren |
| 2,845,997 | A | 8/1958 | Waite |
| 2,858,572 | A | 11/1958 | Burdick |
| 2,887,692 | A | 5/1959 | Gosman |
| 2,962,764 | A | 12/1960 | Trojanowski et al. |
| 3,009,578 | A | 11/1961 | Foote et al. |
| 3,015,148 | A | 1/1962 | Haddad |
| 3,030,640 | A | 4/1962 | Gosman |
| 3,041,109 | A | 6/1962 | Eames et al. |
| 3,107,991 | A | 10/1963 | Taussig |
| 3,112,987 | A | 12/1963 | Griffiths et al. |
| 3,115,678 | A | 12/1963 | Keen et al. |
| 3,124,092 | A | 3/1964 | Raynes |
| 3,165,359 | A | 1/1965 | Ashkouti |
| 3,208,085 | A | 9/1965 | Grimshaw |
| 3,214,314 | A | 10/1965 | Rowbottam |
| 3,222,698 | A | 12/1965 | Levenson |
| 3,273,877 | A | 9/1966 | Geller et al. |
| 3,298,743 | A | 1/1967 | Albinson et al. |
| 3,301,931 | A | 1/1967 | Morin |
| 3,314,721 | A | 4/1967 | Smith |
| 3,319,274 | A | 5/1967 | Upton |
| 3,399,883 | A | 9/1968 | McKey |
| 3,399,926 | A | 9/1968 | Hehn |
| 3,431,022 | A | 3/1969 | Poppe et al. |
| 3,434,181 | A | 3/1969 | Benzies |
| 3,534,129 | A | 10/1970 | Bartel |
| 3,546,724 | A | 12/1970 | Bastos et al. |
| 3,589,967 | A | 6/1971 | Shirakawa |
| 3,620,568 | A | 11/1971 | Morrow |
| 3,652,126 | A | 3/1972 | Folling |
| 3,712,666 | A | 1/1973 | Stoll |
| 3,740,792 | A | 6/1973 | Werner |
| 3,770,235 | A | 11/1973 | Klapproth et al. |
| 3,826,456 | A | 7/1974 | Tranter et al. |
| 3,937,518 | A | 2/1976 | Harrison |
| 3,942,835 | A | 3/1976 | Harrison |
| 3,950,026 | A | 4/1976 | Van Seenus |
| 3,974,532 | A | 8/1976 | Ecchuya |
| 4,017,118 | A | 4/1977 | Cawley |
| 4,040,661 | A | 8/1977 | Hogan et al. |
| 4,043,592 | A | 8/1977 | Fries |
| 4,054,317 | A | 10/1977 | Stumpf |
| 4,122,568 | A | 10/1978 | Bastos et al. |
| 4,123,104 | A | 10/1978 | Andres et al. |
| 4,143,910 | A | 3/1979 | Geffers et al. |
| 4,145,020 | A | 3/1979 | Webster |
| 4,154,478 | A | 5/1979 | Cohune |
| 4,158,899 | A | 6/1979 | Budimirov |
| 4,159,148 | A | 6/1979 | Schulz |
| 4,191,422 | A | 3/1980 | Inasawa et al. |
| 4,202,581 | A | 5/1980 | Fleishman |
| 4,205,878 | A | 6/1980 | Wooten |
| 4,265,482 | A | 5/1981 | Nishimura et al. |
| 4,285,545 | A | 8/1981 | Protze |
| 4,345,733 | A | 8/1982 | Ambasz et al. |
| 4,353,595 | A | 10/1982 | Kaneko et al. |
| 4,380,352 | A | 4/1983 | Diffrient |
| 4,390,204 | A | 6/1983 | Fleishman |
| 4,390,206 | A | 6/1983 | Faiks et al. |
| 4,406,496 | A | 9/1983 | Drabert et al. |
| 4,408,797 | A | 10/1983 | Franck et al. |
| 4,411,469 | A | 10/1983 | Drabert et al. |
| 4,415,203 | A | 11/1983 | Cawley |
| 4,418,958 | A | 12/1983 | Watkin |
| 4,429,917 | A | 2/1984 | Diffrient |
| 4,451,081 | A | 5/1984 | Kowalski |
| 4,466,662 | A | 8/1984 | McDonald et al. |
| 4,479,679 | A | 10/1984 | Fries et al. |
| 4,491,364 | A | 1/1985 | Hattori et al. |
| 4,496,190 | A | 1/1985 | Barley |
| 4,498,702 | A | 2/1985 | Raftery |
| 4,502,731 | A | 3/1985 | Snider |
| 4,509,793 | A | 4/1985 | Wiesmann et al. |
| 4,515,406 | A | 5/1985 | Fujiyama et al. |
| D279,635 | S | 7/1985 | Aasen |
| 4,533,174 | A | 8/1985 | Fleishman |
| 4,534,593 | A | 8/1985 | Ojala |
| 4,540,217 | A | 9/1985 | Suzuki |
| 4,552,406 | A | 11/1985 | Ohl |
| 4,555,136 | A | 11/1985 | Dranger |
| 4,560,199 | A | 12/1985 | Sapper |
| 4,570,994 | A | 2/1986 | Lowrey |
| 4,580,837 | A | 4/1986 | Bayley |
| 4,585,272 | A | 4/1986 | Ballarini |
| 4,596,421 | A | 6/1986 | Schmitz |
| 4,603,830 | A | 8/1986 | Franck |
| 4,627,602 | A | 12/1986 | Sporck |
| 4,640,548 | A | 2/1987 | Desanta |
| 4,641,885 | A | 2/1987 | Bräuning |
| 4,652,050 | A | 3/1987 | Stevens |
| 4,660,887 | A | 4/1987 | Fleming et al. |
| D289,591 | S | 5/1987 | Groseth |
| 4,664,445 | A | 5/1987 | Groseth |
| 4,685,730 | A | 8/1987 | Linguanotto |
| 4,691,961 | A | 9/1987 | Rogers, Jr. et al. |
| 4,693,515 | A | 9/1987 | Russo et al. |
| 4,703,974 | A | 11/1987 | Bräuning |
| 4,711,491 | A | 12/1987 | Ginat |
| 4,713,854 | A | 12/1987 | Graebe |
| 4,720,146 | A | 1/1988 | Mawbey et al. |
| 4,730,871 | A | 3/1988 | Sheldon |
| 4,733,910 | A | 3/1988 | Brennan |
| 4,752,101 | A | 6/1988 | Yurchenco et al. |
| 4,758,045 | A | 7/1988 | Edel et al. |
| D296,959 | S | 8/1988 | Gusrud |
| 4,761,033 | A | 8/1988 | Lanuzzi et al. |
| 4,765,679 | A | 8/1988 | Lanuzzi et al. |
| 4,776,633 | A | 10/1988 | Knoblock et al. |
| 4,778,218 | A | 10/1988 | Suman |
| 4,796,952 | A | 1/1989 | Piretti |
| 4,811,986 | A | 3/1989 | Hattori et al. |
| 4,823,417 | A | 4/1989 | Fukuichi |
| 4,830,430 | A * | 5/1989 | Schafer ..... 297/298 |
| 4,848,837 | A | 7/1989 | Völkle |
| 4,848,838 | A | 7/1989 | McCrackin et al. |
| 4,852,943 | A | 8/1989 | Roper |
| 4,863,218 | A | 9/1989 | McCrackin |
| 4,869,448 | A | 9/1989 | Kenyon |
| 4,869,552 | A | 9/1989 | Tolleson et al. |
| 4,871,208 | A | 10/1989 | Hodgdon |
| 4,881,777 | A | 11/1989 | Dorshimer |
| 4,889,385 | A | 12/1989 | Chadwick et al. |
| 4,909,472 | A | 3/1990 | Piretti |
| 4,914,836 | A | 4/1990 | Horovitz |
| 4,915,449 | A | 4/1990 | Piretti |
| 4,943,114 | A | 7/1990 | Piretti |
| 4,962,962 | A | 10/1990 | Machate et al. |
| 4,965,899 | A | 10/1990 | Sekido et al. |
| 4,979,778 | A | 12/1990 | Shields |
| 4,981,326 | A | 1/1991 | Heidmann |
| 4,988,145 | A | 1/1991 | Engel |
| 5,009,466 | A | 4/1991 | Perry |
| 5,013,272 | A | 5/1991 | Watkins |
| 5,015,034 | A | 5/1991 | Kindig et al. |
| 5,022,709 | A | 6/1991 | Marchino |
| 5,024,484 | A | 6/1991 | Buchacz |
| 5,026,120 | A | 6/1991 | Takeda et al. |
| 5,029,822 | A | 7/1991 | Selzer |
| 5,039,567 | A | 8/1991 | Landi et al. |

5,044,027 A 9/1991 Moon
5,044,030 A 9/1991 Balaton
5,046,780 A 9/1991 Decker et al.
5,050,931 A 9/1991 Knoblock
5,050,933 A 9/1991 Tornero et al.
5,052,068 A 10/1991 Graebe
5,052,753 A 10/1991 Buchacz
5,076,643 A 12/1991 Colasanti et al.
5,080,430 A 1/1992 Castro
5,100,201 A * 3/1992 Becker et al. ..... 297/296
5,101,811 A 4/1992 Brunswick
5,102,196 A 4/1992 Kaneda et al.
5,108,150 A 4/1992 Stas et al.
5,113,540 A 5/1992 Sereboff
5,121,934 A 6/1992 Decker et al.
5,137,329 A 8/1992 Neale
5,144,708 A 9/1992 Pekar
5,160,184 A 11/1992 Faiks et al.
5,171,209 A 12/1992 Gamba
5,172,436 A 12/1992 Masuda
5,190,348 A 3/1993 Colasanti
5,195,199 A 3/1993 Sereboff
5,249,839 A * 10/1993 Faiks et al. ..... 297/284.4
5,251,958 A 10/1993 Roericht et al.
5,288,134 A 2/1994 Hewko et al.
D345,060 S 3/1994 Duncan
5,292,097 A 3/1994 Russell
5,304,271 A 4/1994 Gusakov
5,308,028 A 5/1994 Kornberg
5,308,142 A 5/1994 Forslund, III et al.
5,308,145 A 5/1994 Koepke et al.
5,314,235 A 5/1994 Johnson
5,314,237 A 5/1994 Koepke et al.
5,314,240 A 5/1994 Ishi et al.
5,320,409 A 6/1994 Katoh et al.
5,330,255 A 7/1994 Stawicki
5,340,191 A 8/1994 May
5,346,283 A 9/1994 Steininger et al.
5,348,372 A 9/1994 Takamatsu et al.
5,348,415 A 9/1994 Carlsson
5,354,120 A 10/1994 Völkle
5,372,487 A 12/1994 Pekar
5,388,892 A 2/1995 Tornero
5,401,077 A 3/1995 Hosoe
5,417,473 A 5/1995 Braüning
5,419,617 A 5/1995 Schultz
5,439,267 A 8/1995 Peterson et al.
5,444,881 A 8/1995 Landi et al.
5,452,937 A 9/1995 Piretti
5,486,035 A * 1/1996 Koepke et al. ..... 297/320
5,487,591 A 1/1996 Knoblock
5,505,521 A 4/1996 Meiller et al.
5,524,966 A 6/1996 Piretti
5,542,743 A 8/1996 Olson et al.
5,547,252 A 8/1996 Pfenniger
5,558,399 A 9/1996 Serber
5,562,324 A 10/1996 Massara et al.
5,567,010 A 10/1996 Sparks
5,567,011 A 10/1996 Sessini
5,575,534 A 11/1996 Yu
5,577,807 A 11/1996 Hodge et al.
5,580,127 A 12/1996 Piretti
5,584,533 A 12/1996 Schrewe
5,586,810 A 12/1996 Liu
5,595,806 A 1/1997 Korfmacher
5,597,208 A 1/1997 Bonutti
5,611,598 A 3/1997 Knoblock
5,613,736 A 3/1997 Schaked et al.
5,617,595 A 4/1997 Landi et al.
5,630,647 A 5/1997 Heidmann et al.
5,637,076 A 6/1997 Hazard et al.
5,645,317 A 7/1997 Onishi et al.
5,647,638 A 7/1997 Ritt et al.
5,649,740 A 7/1997 Hodgdon
5,660,438 A 8/1997 Tedesco
5,660,439 A 8/1997 Unwalla
5,667,277 A 9/1997 Van De Riet
5,669,665 A 9/1997 Nowak
5,678,891 A 10/1997 O'Neill et al.
5,704,688 A 1/1998 Schrewe et al.
5,711,575 A 1/1998 Hand et al.
5,713,631 A 2/1998 O'Neill et al.
5,725,277 A 3/1998 Knoblock
5,749,628 A 5/1998 Synder et al.
5,755,488 A 5/1998 Beda et al.
5,765,804 A 6/1998 Stumpf et al.
5,765,914 A 6/1998 Britain et al.
5,772,282 A 6/1998 Stumpf et al.
5,775,774 A 7/1998 Okano
5,791,733 A 8/1998 van Hekken et al.
5,791,735 A 8/1998 Helman
5,791,736 A 8/1998 Herbert
5,797,652 A 8/1998 Darbyshire
5,806,927 A 9/1998 Schneider
5,810,439 A 9/1998 Roslund, Jr.
5,823,619 A 10/1998 Heilig et al.
5,826,940 A 10/1998 Hodgdon
5,839,786 A 11/1998 Cvek
5,842,264 A 12/1998 Roossien et al.
5,845,964 A 12/1998 Phoon
5,853,223 A 12/1998 Ritt et al.
5,860,699 A 1/1999 Weeks
5,860,701 A 1/1999 Jungjohann et al.
5,868,466 A 2/1999 Massara et al.
5,868,467 A 2/1999 Moll
5,871,258 A 2/1999 Battey et al.
5,890,245 A 4/1999 Klearman et al.
5,902,011 A 5/1999 Hand et al.
5,904,397 A 5/1999 Fismen
5,909,923 A 6/1999 DeKraker
5,909,924 A 6/1999 Roslund, Jr.
5,918,940 A 7/1999 Wakamatsu et al.
5,927,804 A 7/1999 Cuevas
5,927,811 A 7/1999 Tseng
5,931,531 A 8/1999 Assmann
5,931,536 A 8/1999 Wu
5,931,537 A 8/1999 Gollin et al.
5,934,749 A 8/1999 Pond et al.
5,934,758 A 8/1999 Ritch et al.
D413,875 S 9/1999 Lawrence
5,951,109 A 9/1999 Roslund, Jr. et al.
5,954,393 A 9/1999 Perrin
5,957,534 A 9/1999 Wilkerson et al.
5,964,503 A 10/1999 Inoue
5,967,608 A 10/1999 Van Sickle
5,967,613 A 10/1999 McKeever
5,971,481 A 10/1999 Emmenegger et al.
5,975,632 A 11/1999 Ginat
5,975,634 A 11/1999 Knoblock et al.
5,975,636 A 11/1999 Koch et al.
5,975,637 A 11/1999 Geuss et al.
5,975,639 A 11/1999 Wilson et al.
5,979,984 A 11/1999 DeKraker et al.
D417,793 S 12/1999 Ritch et al.
5,997,094 A 12/1999 Cvek
6,010,189 A 1/2000 Hybarger et al.
6,015,187 A 1/2000 Roslund, Jr. et al.
6,022,078 A 2/2000 Chang
6,027,169 A 2/2000 Roslund, Jr.
6,030,041 A 2/2000 Hsiao
6,035,901 A 3/2000 Stumpf et al.
6,039,397 A 3/2000 Ginat

| | | | | |
|---|---|---|---|---|
| D423,261 | S | | 4/2000 | Ritch et al. |
| 6,045,183 | A | | 4/2000 | Weber |
| 6,053,574 | A | | 4/2000 | Opsvik |
| 6,053,577 | A | | 4/2000 | Arko et al. |
| 6,056,360 | A | | 5/2000 | Schneider |
| 6,056,361 | A | | 5/2000 | Cvek |
| 6,059,363 | A | | 5/2000 | Roslund, Jr. et al. |
| 6,059,368 | A | | 5/2000 | Stumpf et al. |
| 6,059,370 | A | | 5/2000 | Kanyer et al. |
| 6,062,646 | A | | 5/2000 | Bock |
| 6,076,892 | A | | 6/2000 | van Hekken et al. |
| 6,079,785 | A | | 6/2000 | Peterson et al. |
| 6,086,153 | A | | 7/2000 | Heidmann et al. |
| 6,098,000 | A | | 8/2000 | Long et al. |
| 6,106,070 | A | | 8/2000 | Ritt et al. |
| 6,116,688 | A | | 9/2000 | Wilkerson et al. |
| 6,116,695 | A | | 9/2000 | Heidmann et al. |
| 6,120,096 | A | | 9/2000 | Miotto |
| 6,120,099 | A | | 9/2000 | Reikerås et al. |
| 6,129,419 | A | | 10/2000 | Neale |
| 6,139,106 | A | | 10/2000 | Aldridge |
| D433,854 | S | | 11/2000 | Diffrient |
| 6,149,231 | A | | 11/2000 | Wüstholz |
| 6,149,236 | A | | 11/2000 | Bräuning |
| D435,746 | S | | 1/2001 | Diffrient |
| D436,457 | S | | 1/2001 | Ambasz |
| D436,749 | S | | 1/2001 | Arad |
| 6,168,239 | B1 | | 1/2001 | Conner et al. |
| 6,174,031 | B1 | | 1/2001 | Lindgren et al. |
| 6,176,548 | B1 | | 1/2001 | Thole et al. |
| 6,179,384 | B1 | | 1/2001 | DeKraker et al. |
| D437,497 | S | | 2/2001 | Bräuning |
| D437,701 | S | | 2/2001 | Bellini et al. |
| 6,182,315 | B1 | | 2/2001 | Lee |
| 6,186,594 | B1 | | 2/2001 | Valiquette et al. |
| 6,192,565 | B1 | | 2/2001 | Tame |
| D440,068 | S | | 4/2001 | Bräuning |
| 6,209,958 | B1 | | 4/2001 | Thole |
| 6,250,715 | B1 | | 6/2001 | Caruso et al. |
| 6,273,506 | B1 | | 8/2001 | Niergarth et al. |
| 6,279,184 | B1 | | 8/2001 | George, II |
| 6,286,900 | B1 | | 9/2001 | Roark |
| 6,290,295 | B1 | | 9/2001 | Benden et al. |
| 6,295,674 | B1 | | 10/2001 | Smith-McKelvey et al. |
| 6,296,308 | B1 | | 10/2001 | Cosentino et al. |
| 6,318,800 | B1 | | 11/2001 | DeKraker |
| 6,322,146 | B1 | | 11/2001 | Fisher, Jr. |
| 6,349,992 | B1 | | 2/2002 | Knoblock et al. |
| 6,361,110 | B2 | | 3/2002 | Roslund, Jr. et al. |
| 6,367,876 | B2 | | 4/2002 | Caruso et al. |
| 6,367,877 | B1 | | 4/2002 | Knoblock et al. |
| 6,382,719 | B1 | | 5/2002 | Heidmann et al. |
| 6,386,634 | B1 | | 5/2002 | Stumpf et al. |
| 6,386,636 | B2 | | 5/2002 | Caruso et al. |
| 6,394,545 | B2 | | 5/2002 | Knoblock et al. |
| 6,394,546 | B1 | | 5/2002 | Knoblock et al. |
| 6,394,548 | B1 | | 5/2002 | Battey et al. |
| 6,394,549 | B1 | | 5/2002 | DeKraker et al. |
| 6,412,869 | B1 | | 7/2002 | Pearce |
| 6,422,652 | B1 | | 7/2002 | Roslund, Jr. et al. |
| 6,425,633 | B1 | | 7/2002 | Wilkerson et al. |
| 6,450,577 | B1 | | 9/2002 | Roslund, Jr. |
| 6,460,928 | B2 | | 10/2002 | Knoblock et al. |
| 6,523,898 | B1 | * | 2/2003 | Ball et al. ..... 297/284.4 X |
| 2001/0000939 | A1 | | 5/2001 | Roslund, Jr. et al. |
| 2001/0043003 | A1 | | 11/2001 | Knoblock et al. |
| 2002/0096920 | A1 | | 7/2002 | Watson et al. |
| 2002/0113475 | A1 | | 8/2002 | Ehr et al. |
| 2002/0149247 | A1 | | 10/2002 | Diffrient |

FOREIGN PATENT DOCUMENTS

| | | | | | |
|---|---|---|---|---|---|
| EP | 0 164 267 | A2 | | 12/1985 | |
| EP | 0 216 578 | A2 | | 4/1987 | |
| EP | 0 249 584 | A2 | | 12/1987 | |
| EP | 0 277 912 | A1 | | 8/1988 | |
| EP | 0 338 050 | B1 | | 10/1989 | |
| EP | 0 499 594 | A1 | | 8/1992 | |
| EP | 0 383 890 | | | 1/1993 | |
| EP | 0 560 736 | A1 | | 9/1993 | |
| EP | 0 561 518 | A1 | | 9/1993 | |
| EP | 0 587 537 | A1 | | 3/1994 | |
| EP | 0 589 834 | A1 | | 3/1994 | |
| EP | 0 591 932 | A1 | | 4/1994 | |
| EP | 0 591 933 | A1 | | 4/1994 | |
| EP | 0 741 985 | A1 | | 11/1996 | |
| EP | 0 793 929 | A | | 9/1997 | |
| EP | 0 801 913 | A1 | | 10/1997 | |
| EP | 0 857 443 | A2 | | 8/1998 | |
| EP | 0 880 921 | A2 | | 12/1998 | |
| EP | 0 885 575 | A2 | | 12/1998 | |
| EP | 0 937 426 | A2 | | 8/1999 | |
| EP | 0 958 765 | A2 | | 11/1999 | |
| EP | 0 960 586 | A2 | | 12/1999 | |
| EP | 1 013 198 | A2 | | 6/2000 | |
| EP | 1 033 098 | A1 | | 9/2000 | |
| EP | 1 044 634 | A1 | | 10/2000 | |
| EP | 1 059 051 | A1 | | 12/2000 | |
| EP | 1 106 110 | A1 | | 6/2001 | |
| EP | 1 226 773 | A1 | | 7/2002 | |
| FR | 2 558 360 | | | 7/1985 | |
| FR | 2 586 180 | | | 2/1987 | |
| FR | 2 586 541 | | | 3/1987 | |
| FR | 2 641 453 | | | 7/1990 | |
| GB | 1 222 908 | | | 2/1971 | |
| GB | 2 057 257 | A | | 4/1981 | |
| GB | 2 068 717 | A | | 8/1981 | |
| GB | 1 603 355 | | | 11/1981 | |
| GB | 1 603 356 | | | 11/1981 | |
| GB | 2 082 901 | A | | 3/1982 | |
| GB | 2 107 576 | A | | 5/1983 | |
| GB | 2165445 | A | * | 4/1986 | ..... A47C/1/00 |
| GB | 2 165 445 | A | | 4/1986 | |
| GB | 2 189 990 | A | | 11/1987 | |
| GB | 2 232 884 | A | | 1/1991 | |
| GB | 2 255 008 | A | | 10/1992 | |
| GB | 2 255 277 | A | | 11/1992 | |
| NZ | 184194 | | | 2/1981 | |
| WO | WO 80/02791 | | | 12/1980 | |
| WO | WO 87/04909 | | | 8/1987 | |
| WO | WO 89/03648 | | | 5/1989 | |
| WO | WO 90/00871 | | | 2/1990 | |
| WO | WO 90/02504 | | | 3/1990 | |
| WO | WO 91/03969 | | | 4/1991 | |
| WO | WO 92/03073 | | | 3/1992 | |
| WO | WO 92/06622 | | | 4/1992 | |
| WO | WO 93/03653 | | | 3/1993 | |
| WO | WO 93/25121 | | | 12/1993 | |
| WO | WO 94/08491 | | | 4/1994 | |
| WO | WO 94/24904 | | | 11/1994 | |
| WO | WO 95/00052 | | | 1/1995 | |
| WO | WO 96/02166 | | | 2/1996 | |
| WO | WO 96/07344 | | | 3/1996 | |
| WO | WO 96/39900 | | | 12/1996 | |
| WO | WO 96/39902 | | | 12/1996 | |
| WO | WO 96/39903 | | | 12/1996 | |
| WO | WO 97/23152 | | | 7/1997 | |
| WO | WO 98/02067 | | | 1/1998 | |
| WO | WO 98/08424 | | | 3/1998 | |
| WO | WO 98/32353 | | | 7/1998 | |
| WO | WO 98/47413 | | | 10/1998 | |
| WO | WO 98/48668 | | | 11/1998 | |

| | | |
|---|---|---|
| WO | WO 98/48670 | 11/1998 |
| WO | WO 99/21456 | 5/1999 |
| WO | WO 00/22959 | 4/2000 |
| WO | WO 00/22960 | 4/2000 |
| WO | WO 00/23027 | 4/2000 |
| WO | WO 00/24295 | 5/2000 |
| WO | WO 00/24296 | 5/2000 |
| WO | WO 00/64311 | 11/2000 |
| WO | WO 00/72730 A1 | 12/2000 |
| WO | WO 00/74531 A2 | 12/2000 |
| WO | WO 01/91614 A1 | 12/2001 |
| WO | WO 02/32261 A2 | 4/2002 |

* cited by examiner

RECLINABLE CHAIR

CROSS-REFERENCE TO RELATED APPLICATIONS

This application claims priority to U.S. Provisional Application No. 60/236,933, filed Sep. 28, 2000 and entitled A RECLINABLE CHAIR, and Australian Application No. 54083/01, filed Jun. 28, 2001, which applications are hereby incorporated by reference.

BACKGROUND OF THE INVENTION

1. The Field of the Invention

The present invention relates to a reclinable chair. In particular, although not exclusively, the invention relates to a synchro-tilt type chair in which the seat portion tilts rearwardly in synchronism with reclining action of the back portion. The invention is described primarily in the context of commercial office chairs. However, the invention is not limited in its application to commercial office chairs and may have application to any other type of seating such as public seating for theatres, aircraft or domestic seating.

2. The Relevant Technology

Reclining office chairs are well known. There are certain disadvantages associated with the conventional form of reclining office chair. One of the disadvantages is that as the occupant of the chair reclines rearwardly, his head drops in height. Therefore, the eye level of the chair's occupant will not be maintained constant. This may pose a difficulty if the occupant is working at a computer terminal where it is desirable to maintain a constant eye level relative to the screen. Additionally, in meetings it is also desirable to maintain a constant eye level relative to the other attendees of the meeting. Any person who undergoes a dip in eye level may effectively drop out of the conversation.

Another difficulty with conventional reclining chairs is that relative movement between the back portion and the seat portion may lead to frictional grabbing of occupant's shirt, thereby pulling out the occupant's shirt from his trousers.

U.S. Pat. No. 5,871,258 is in respect of a reclining office chair. The seat portion of the chair has a front portion connected to a rear portion by a resilient section in order that the rear portion carries most of the occupant's weight. The seat portion is operably connected to the reclining mechanism such that as the back portion reclines, the rear portion of the seat also tilts but additionally moves in a downward and forward motion. It will be appreciated that this further only serves to exacerbate the problem of tipping eye level. In this case, not only is the occupant's head dropping on account of their reclining action but also, the rear portion of the seat supporting the occupant's weight is also moving downwardly, with the practically certain result that the eye level of the occupant will dip during reclining action.

U.S. Pat. No. 5,314,237 raises the vertical height of the seat support during recline and thereby claims to achieve consistent vertical eye level. However, the chair disclosed in this US patent suffers from another shortcoming. As the seat portion lifts, the forward edge of the seat portion will accordingly be raised and thereby act as a hard edge bearing against the back of the occupant's knees. This can lead to circulatory problems for the occupant and/or lifting of the users feet from the floor with consequent poor posture.

Flexing of seat backs in the lumbar region of the user is also a desirable feature of modern office chairs. Chair occupants come in a wide range of different sizes and weights and it is therefore necessary for chair manufacturers to produce a chair which caters for a wide range of occupant sizes and weights. A larger, weightier person will be able to flex a chair back easily. On the otherhand, a person of light build may only be able to flex the back portion with a high degree of force. Accordingly, a person of light build may not receive much satisfaction from the feature of a flexible back portion.

Another common feature of reclinable chairs is the use of recline springs to resist rearward recline. Adjustment mechanisms are often provided to adjust the spring tension of the recline springs to suit the build of the occupant of the chair. Where such adjustment mechanism operate directly against the action of the spring, e.g., by way of a rotatable knob, generally a large number of turns of the knob are required in order to gradually stiffen the spring. Otherwise, the knob would be too stiff to turn in order to bring about the required adjustment.

It is therefore an object of the present invention to provide a chair which overcomes or at least addresses some of the foregoing disadvantages.

BRIEF SUMMARY OF THE INVENTION

In accordance with a first aspect of the present invention there is provided a chair including: a supporting frame; a seat portion which is foldable about a transverse fold to define a rearward portion behind the transverse fold and a forward portion, forward of the transverse fold, the seat portion being supported above the supporting frame by its rearward portion; a reclinable back portion; and a recline mechanism with which the back portion is connected for reclining action of the back portion, the recline mechanism being operably linked to the rearward portion of the seat portion such that on reclining action of the back portion, the rearward portion is moved to increase in rearward tilt angle and to obtain a net increase in height above the supporting frame, with a consequent folding of the seat portion about the transverse fold line under the weight of the occupant.

In order to achieve a foldable seat portion, the seat portion may be flexible. The seat portion may be constructed of a flexible material such as plastic. In a preferred form of the invention, the seat portion may comprise a panel which has apertures, e.g., slots to enhance its flexibility. The slotted pattern may extend across the entirety of the panel with a specific arrangement of slots provided to increase comfort for the seat occupant. For example, the slotted panel may have the slots arranged to accommodate the ischial protuberosities of the occupant. Alternatively, the slotted pattern may simply exist in a specific zone to provide flexing about the transverse fold. The transverse fold may be shaped as a straight line, depending upon the arrangement of the slots or apertures in the seat panel or according to the manner in which the seat portion is supported. The transverse fold may alternatively take the shape of a curve lying in the plane of the seat portion.

Where the seat portion takes the form of a panel, stiffening webs may be provided which offer little resistance to flexing towards the forward edge of the seat portion and greater resistance to flexing towards the rear of the seat portion. The resistance offered may progressively increase from the front edge of the seat portion towards the rear. Accordingly, the stiffening webs may be tapered to offer the varying resistance.

In an alternative less preferred form of the invention, the seat portion may comprise the forward portion and the rearward portion being articulated.

In a preferred form of the invention, the rearward portion of the seat portion is supported, at least in part, by the recline mechanism while the forward portion is unsupported. The depth position of the seat portion may be adjustable relative to the back portion and/or the supporting base. Accordingly, the positioning of the transverse fold may be variable as a function of the seat depth position. For example, the seat portion may be moveable forward/backward relative to guides forming part of the recline mechanism with the forward edge of the guides or a transition in curvature defining the transverse fold. The ease of folding may be dependent upon the depth position of the seat portion. As described above, this may be achieved by the seat portion having an increased resistance to folding in the directly rearwardly from the forward edge of the seat portion.

The recline mechanism preferably interconnects the seat portion, the supporting frame and the back portion. In a most preferred form, the recline mechanism is in the form of a four bar linkage. The four bar linkage may be replicated on each side of the chair. Therefore, the following description of the four elements of the four bar linkage may apply to single elements or alternatively to duplicated elements on opposite sides of the chair. The first linkage is in the form of a main support. The main support may be selectively height adjustable by the user. However, the main support is in normally fixed disposition relative to the supporting frame. In the most preferred form of the invention, the main support is supported at the top of a height adjustable gas spring extending upwardly as part of the supporting frame.

The second linkage of the four bar linkage may be the seat portion itself. Where the seat portion is depth adjustable, then the second linkage may comprise a guide for the depth adjustment.

The third linkage of the four bar linkage preferably comprises a front support linkage extending between the main support and the second linkage.

The fourth linkage is preferably in the form of a drive linkage which is pivotable about a drive axis through the main support, being connected to the second linkage and being operably linked to be driven about the drive axis by rearward recline action of the back portion.

Preferably, the back portion is also supported from the main support. The back portion is preferably attached to a back attach portion which is pivotally connected to the main support at a recline axis. The recline axis of the back portion is preferably below the seat portion. In a most preferred form of the invention, the recline axis is below the ischial protuberosities of the occupant.

Preferably, the back portion is biased against reclining action by a recline biasing device. This may be in the form of a one or more springs. In a most preferred form of the invention, the biasing force is adjustable. In a preferred embodiment of the invention there may be two back extension arms extending from the back portion. These extension arms could be an integral part of the back attach portion or alternatively could be rigidly connected thereto. With the two extension arms pivotally connecting the back portion to the main support, the one or more springs are preferably held by one or both of the back extension arms, with the spring(s) acting against the main support.

Preferably there are two springs in the form of leaf springs. Preferably, the first spring has a predetermined spring rate (or spring constant). The second spring may be clamped against the first spring with the combination having a resultant spring rate with the degree of clamping being variable to adjust the resultant spring rate. Preferably, the second spring has a high spring constant in its unclamped state in order that only a small clamping adjustment is required to bring about an appreciable change in the resultant spring rate of the combination.

One or more recline abutment surfaces may define the recline limit of the back portion. Preferably, the recline abutment surfaces are provided on one or both of the back extension arms and the main support.

Furthermore, there may be provided one or more forward abutment surfaces which define the forward position of the back portion. Preferably, the forward abutment surfaces are disposed on one or both of the back extension arms and the main support. In a most preferred form of the invention, one or both of the back extension arms include a pin which travels within a slot of the main support. The slot has a base which engages against the pin when the pin reaches a position of travel within the slots corresponding to the forward position of the back portion. Additionally, cushioning may be provided to cushion the abutment between the forward abutment surfaces. This may comprise an O-ring encircling the pin.

Desirably, the invention also includes a recline lock, to lock the back portion against reclining action. The recline lock may be selectively lockable by the user. In a preferred form of the invention, the recline lock acts against a lock abutment surface on one or both of the back extension arms. Preferably, the recline lock is in the form of a push rod/bar which, when selectively operated by the user acts against the lock abutment surfaces of both extension arms at the same time.

Another preferred feature of the invention is that the back portion is flexible or at least flexible at a part corresponding to the lumbar region of the occupant. Preferably the flexibility, i.e., the stiffness is adjustable. The flexibility may be adjustable selectively, although it is preferred that the adjustment takes place automatically in response to the weight imparted by the occupant on the seat portion. Preferably, the larger the weight, the greater the stiffness imparted to the back portion.

Preferably, the adjustment can be achieved through the use of a tensionable biasing device provided to act against the flexible back portion, with a varying degree of tension to impart a varying degree of stiffness to the back portion. For example, the biasing device may be in the form of a spring. Preferably, there are two flat springs lying against the back portion at a lower region thereof adjacent the connection of the back portion to the back attach portion.

Preferably, the tensioning of the biasing device is achieved by means of an interconnecting linkage which in response to the occupant's weight on the seat portion, tensions the biasing device by a corresponding amount. Preferably, the interconnecting linkage interconnects the biasing device with the drive linkage. In a most preferred form of the invention, where the biasing device is in the form of a leaf spring lying against the back portion, the leaf spring is connected to a spring carrier forming part of the interconnecting linkage, the spring carrier being pivotally mounted to the back attached portion in a manner whereby the weight of the occupant on the seat portion is transferred through to the spring carrier so as to bend the leaf spring against the back portion. As there may be two four bar linkages provided on opposite sides of the chair, there may accordingly be provided two interconnecting linkages with two spring carriers receiving two leaf springs, The back portion may include a back frame which, in its lower regions defines a rearwardly facing channel. Preferably, each leaf spring engages within the channel on a respective side of the back frame. Preferably, each interconnecting linkage also includes two push links, each interconnecting the associated spring carrier with the associated drive linkage. The back attach portion may be in the form of a housing, i.e., the back attach housing. The spring carrier(s) and the push link(s) may be at least partly received within the back attach housing. Each leaf spring and associated spring carrier may be of integral construction.

The supporting frame may be of any type. Preferably, the supporting frame is of the conventional type with a central support and a plurality of radiating legs with castors. The supporting frame may incorporate a height adjustable gas spring.

A tension limit may be provided to prevent over-tensioning of the tensionable biasing device. For example, rotation of the spring carrier may be stopped against the back attach housing.

In accordance with a second aspect of the present invention there is provided a chair having: a supporting frame; a seat portion supported above the supporting frame; and a back portion having a flexible portion, wherein the flexibility of the flexible portion is adjustable as a function of the weight of an occupant on the seat portion.

The seat portion and the back portion could be integral or alternatively could be discrete portions of the chair. Preferably, a recline mechanism is provided which interconnects the seat portion, the back portion and the supporting base.

The flexibility of the flexible portion may be adjustable by way of a stiffness adjustment device. This may be in the form of a tensionable biasing device. The tensionable biasing device preferably acts against the flexible portion to impart stiffness thereto with the tension of the biasing device being adjustable as a function of the weight of an occupant on the seat portion. The tensionable biasing device may be interconnected by a means of an interconnection with the seat portion, the seat portion being moveable on the application of weight from an occupant whereby the weight of the occupant acts through the interconnection to adjust the biasing device as a function of the weight of the occupant. Preferably, the interconnection comprises a series of links to transfer the weight of the occupant into increased tension of the biasing device. Preferably, the biasing device is in the form of one or more springs such as leaf springs and the interconnecting linkage acts to bend the one or more springs against the flexible portion of the back, thereby increasing the stiffness of the flexible portion.

In a most preferred form of the invention, the interconnection includes a four bar synchro-tilt mechanism which tilts the seat portion synchronously with back recline. The four bar synchro-tilt mechanism may take the form of the four bar linkage described above in accordance with the first aspect of the present invention. The drive link of the four bar linkage may be connected to a push link which is in turn connected to a spring carrier as described above in accordance with the first aspect of the invention.

A tension limit may be provided to prevent over-tensioning of the tensionable biasing device. This may be in the form of a physical stop which acts against the spring carrier.

In accordance with a third aspect of the present invention there is provided a chair having: a supporting frame; a main support supported by the supporting frame; a seat portion supported above the supporting frame; a reclinable back portion operably connected with the main support for reclining action relative to the main support; a first recline spring operably connected between the main support and the reclinable back portion for resisting reclining action of the back portion; and a second recline spring operably connected between the main support and the reclinable back portion; the second recline spring being selectively adjustable to impart a varying amount of resistance to the reclining action of the back portion.

The resistance imparted by the second spring may be adjustable between a nil amount and a predetermined amount.

The first recline spring may be in the form of a leaf spring or spring bar. The second recline spring may also be in the form of a leaf spring or spring bar. The leaf springs may be flat or bent. Preferably, the first leaf spring is substantially flat when untensioned, although desirably the first leaf spring is pretensioned into a curved configuration in order to provide an initial resistance to reclining action. A forward limit may be provided to define the forward active position of the back portion. The first recline spring and selectively the second recline springs bias the back portion into the forward active position. Additionally, a rearward recline limit may also be provided to define the rearmost position of the back portion.

In one form of the invention, the adjustment device brings about adjustment of the length of the second leaf spring. Alternatively, the adjustment device may bring about adjustment of the curvature of the second leaf spring. This may be achieved by way of a cam having a cam surface bearing against the second spring, the position of the cam being moveable to adjust the curvature of the second spring. Preferably, the cam is pivotable about a pivot axis with the cam surface including a plurality of distinct portions of progressively increasing distance from the pivot axis in either a clockwise or anticlockwise direction. The cam surface may also include a stop to limit rotation of a cam about the pivot axis.

The first and second springs may be spaced from each other and may operate independently of each other. However, in a most preferred form of the invention, the first and second springs lie against each other for at least a portion of the length of the springs. In this form of the invention, the cam may be incorporated into a clamp to clamp the second recline spring against the first recline spring.

The main support may be in the form of a transversely extending main transom. Furthermore, the back portion may include two spaced arms pivotally mounted to the main transom. In this form of the invention, preferably the first leaf spring extends between the two spaced arms and bears against the side of the main support to bias the back portion against reclining action. The ends of the first leaf spring may be received in aligned, facing slots in each arm. Preferably, the second spring is shorter than the first spring with one end being received in one of the slots.

In addition to the action of the first and optionally second recline springs, the back portion may be operably connected to the seat portion whereby the weight of the occupant resists reclining action of the back portion. This may be achieved by way of a four-bar linkage supporting the seat portion with the back portion being operably connected to the four-bar linkage so that reclining action of the back portion brings about a net increase in height of the seat portion.

In accordance a fourth aspect of the present invention there is provided a chair having: a supporting frame; a main support supported by the supporting frame; a seat portion supported above the supporting frame; a reclinable back portion operably connected with the main support for reclining action relative to the main support; a first recline spring comprising an elongate spring portion having dimensions of length, width and thickness wherein the width is greater than the thickness and further having a longitudinal axis aligned with the length of the elongate spring portion, the recline spring being operably connected between the main support and the reclinable back portion for resisting reclining action of the back portion through bending about an axis transverse to the longitudinal axis, wherein the first recline spring is rotatable about the longitudinal axis to adopt any one of a plurality of spring positions, at each of which the spring portion exhibits a differing spring rate in resistance to bending about the transverse axis.

The back portion may be reclinable between a forward active position and a rear most position. For this purpose, a forward limit may be provided to define the forward active position and a rearward recline limit may also define the rear most position. In recline action, the main support and the back portion move relative to each other. The first recline spring may be arranged such that as the main support and the back portion move relative to each other, they bear against the first recline spring, tending to flex the elongate spring portion about the transverse axis thereby biasing the back portion toward the forward active position through the inherent resistance of the spring. However, at the forward active position, the arrangement may be such that the main support and the back portion exert no pretension on the first recline spring. This enables the first recline spring to be easily rotated about the longitudinal axis.

In a preferred form of the invention, an intermediate portion of the first recline spring bears against the main support with an end portion of the first recline spring bearing against the back portion. In a more preferred form of the invention, the ends of the first recline spring bear against the back portion with a central part of the first recline spring bearing against the main support. More specifically, the main support may be in the form of a transversely extending main transom. Furthermore, the back may include two spaced arms pivotally mounted to the main transom. In this form of the invention, the first recline spring may extend alongside the main transom with the two ends journaled in each arm and with a central part of the first recline spring bearing against the main transom. However, the invention is not limited to such an arrangement. It is conceivable that in an alternative arrangement the two ends of the first recline spring could be rotatably journaled in the main support with an intermediate part bearing against the back portion.

Preferably, the elongate spring portion of the first recline spring is in the form of a flat bar which may be rotated about its longitudinal axis. It will be appreciated that the flat bar can be rotated into a number of positions. There may be three positions, the first with the width dimension of the flat bar arranged to be substantially aligned with the transverse bending axis. This exhibits an easy resistance to bending. In a second adoptable spring position, the flat bar may be arranged with its width dimension diagonally to the transverse bending axis. This exhibits a medium resistance to bending. In a third adoptable position, the width of the flat bar is arranged transverse to the bending axis. With the whole of the width resisting bending, this correlates to the hardest spring position.

The spring portion is not limited to being in the form of a flat bar and other cross-sections are possible including elliptical or oval cross-sections. There may be more than one elongate spring portion incorporated into the first recline spring.

Where the first recline spring bears against the back portion and the main support, cylindrical bosses may be incorporated into the first recline spring. For example, the ends of the first recline spring may be fitted with cylindrical bosses to be journaled in the arms of the back portion. Similarly, a cylindrical boss may also be provided at an intermediate portion of the first recline spring where the first recline spring bears against the main support. In this connection, the main support may also incorporate a bearer against which the cylindrical boss bears. This may be in the form of a complementary bore or recess. In particular, the main support may have a rearward extension which incorporates a semi-cylindrical recess to accommodate the central cylindrical boss of the first recline spring.

The first recline spring may be integrally formed with the spring portion(s) and the cylindrical boss(es). However, most preferably the bosses slide onto the spring portion.

Furthermore, the invention may include an actuator to selectively rotate the recline spring. The actuator may be in the form of a paddle Advantageously, locators are also provided to define each of the plurality of adoptable spring positions. The spring positions may be defined by complementary projections and detents provided in one or more of the cylindrical bosses and the corresponding bearer. For example, grooves may be provided in the central cylindrical boss with a rib provided in the bearer, the engagement between the rib and each one of the grooves defining each of the adoptable spring positions.

The invention may also provide a second recline spring. The second recline spring may be adjusted as with the first recline spring and accordingly may include all of the features described above in connection with the first recline spring. However, in a most preferred form of the invention the second recline spring is non-adjustable. Preferably, the arrangement is such that the second recline spring has a pre-load in the forward active position. The second recline spring may be already bent or flexed to achieve the pre-load. The second recline spring may extend alongside the first recline spring. The second recline spring may be journaled in a similar fashion as described above for the first recline spring. The second recline spring may be in the form of flat bar. However, in a preferred form of the invention, the second recline spring is in the form of a rod, preferably a cylindrical rod.

In addition to the action of the first and optional second recline springs, the back portion may be operably connected to the seat portion whereby the weight of the occupant resists reclining action of the back portion. This may be achieved by way of a four-bar linkage supporting the seat portion with the back portion being operably connected to the four-bar linkage so that reclining action of the back portion brings about a net increase in height of the seat portion.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

In order that the invention may be more fully understood, some embodiments will now be described by way of example with reference to the Figures in which.

DETAILED DESCRIPTION OF THE PREFERRED EMBODIMENTS

First Embodiment

Since the Figures illustrate the chair from various different angles as convenient to explain certain parts, an arrow marked "F" has been inserted into the drawings where appropriate. Accordingly the terms forward, rearward, left side and right side should be construed accordingly.

Figure 1:
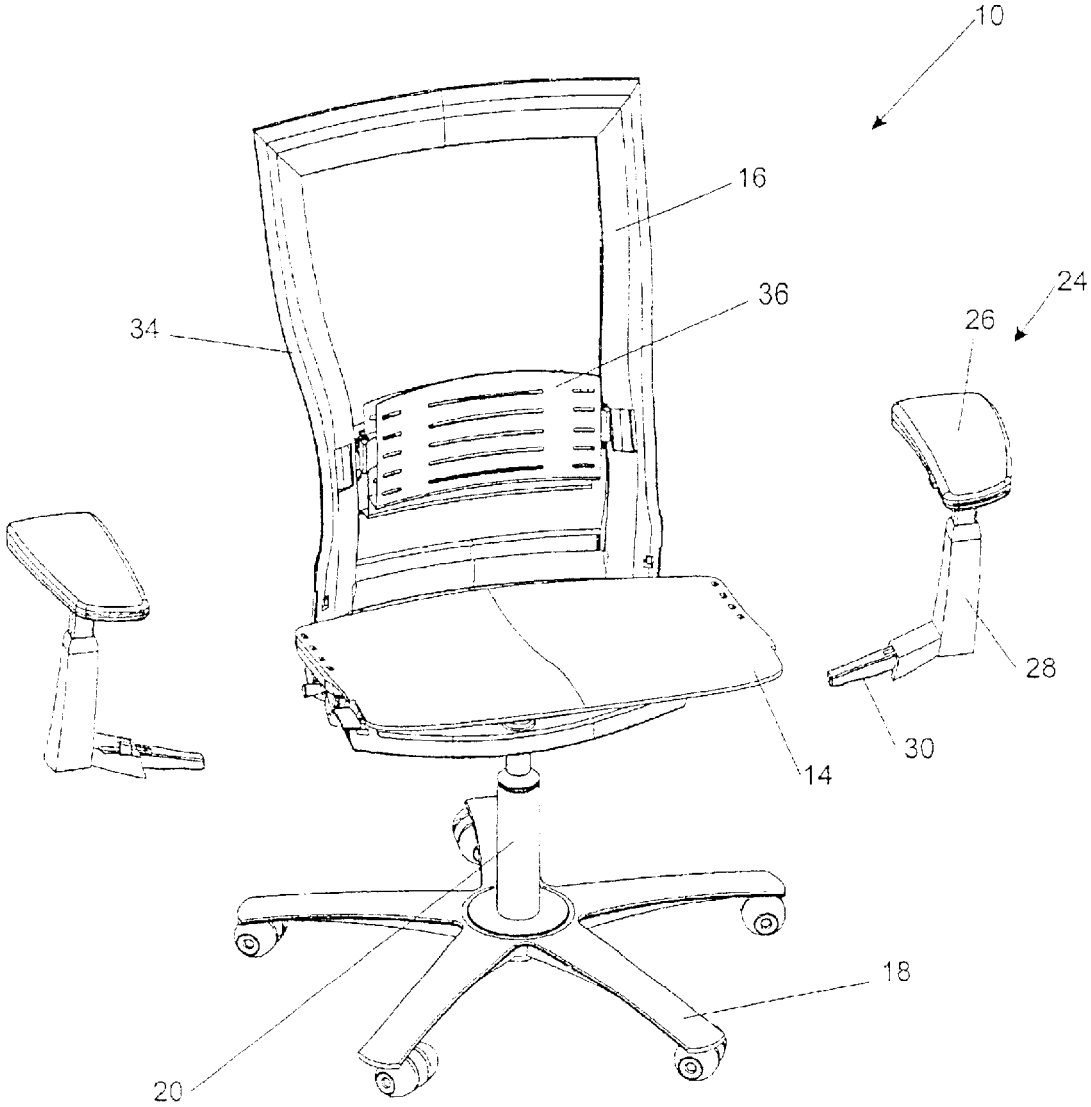
FIG. 1 is a perspective, partially exploded view of a chair in accordance with a first preferred embodiment of the chair.
Figure 4:
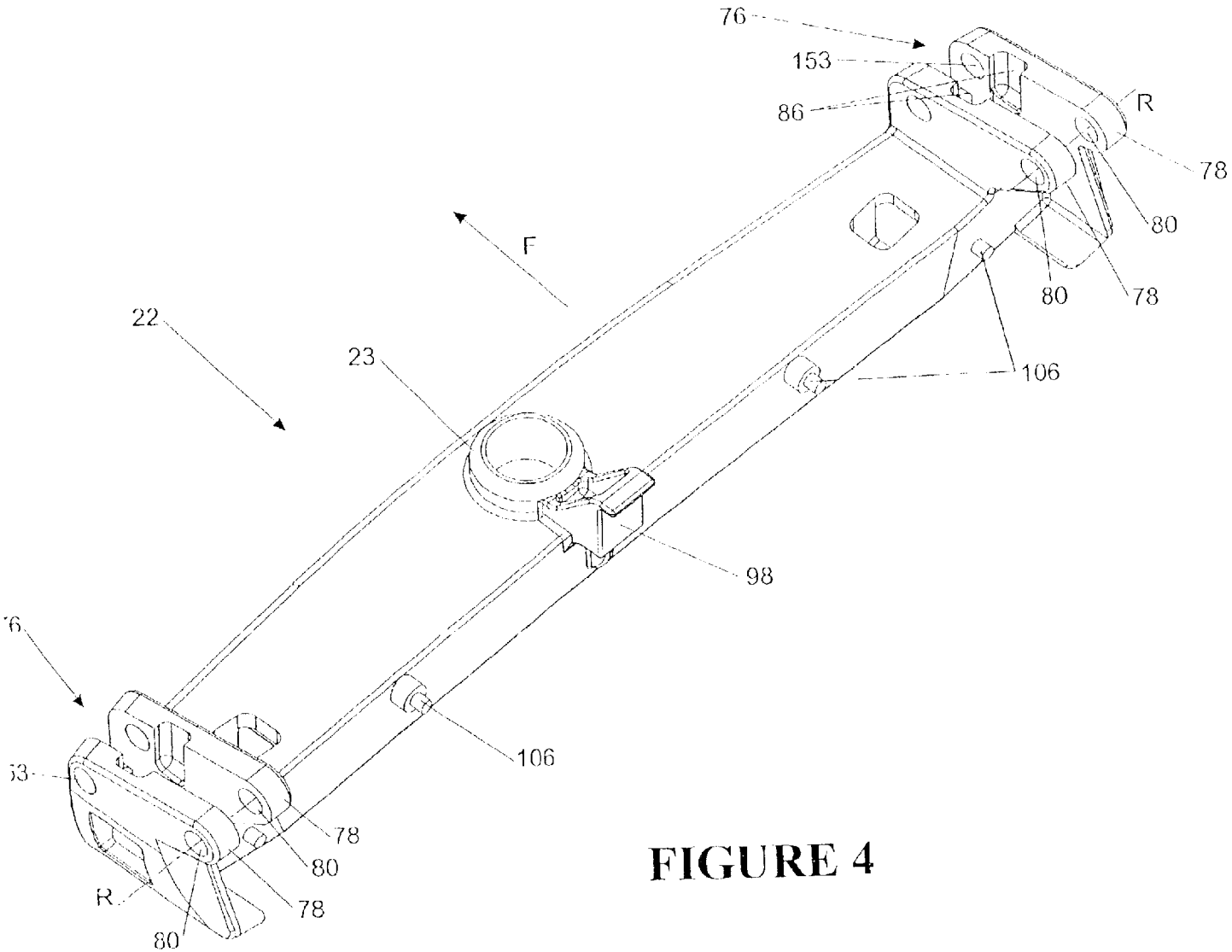
FIG. 4 is a perspective view of a main transom of the chair of FIG. 1.

FIG. 1 illustrates an office chair 10 including a main assembly having a seat portion 14 and a back portion 16. The seat portion 14 and the back portion 16 are supported above the ground by a supporting frame including a wheeled base 18 and a central support column 20. The central support column 20 houses a pneumatic spring (not shown) for height adjustment of the seat portion 14 in conventional fashion. The pneumatic spring is connected to the main transom 22 of the chair which is illustrated in FIG. 4. The main transom 22 extends transversely across the chair and is connected to the pneumatic spring by way of central spring connection ring 23.

FIG. 1 also illustrates two detachable arm assemblies 24. The arm assemblies 24 each include an upper armrest 26 which is padded for user comfort. Each arm assembly 24 includes an upright support structure 28. The armrest 26 is mounted to the upper end of the upright support structure 28. The lower end of the upright support structure has an elongate attachment portion 30 extending inwardly therefrom at a downwardly inclined angle relative to the upright support structure 28.

The elongate attachment portion 30 is releasably engaged within one end of the main transom 22. The manner of attachment is not significant to the present invention but further disclosure relative thereto is found in U.S. patent application Ser. No. 09/953,850, filed concurrently with the present application in the names of Jonathan William Prince and Paul Michael Wilkinson, and entitled Ann Assembly for a Chair, the disclosure of which is incorporated herein by specific reference.

Back Portion

Figure 2A:
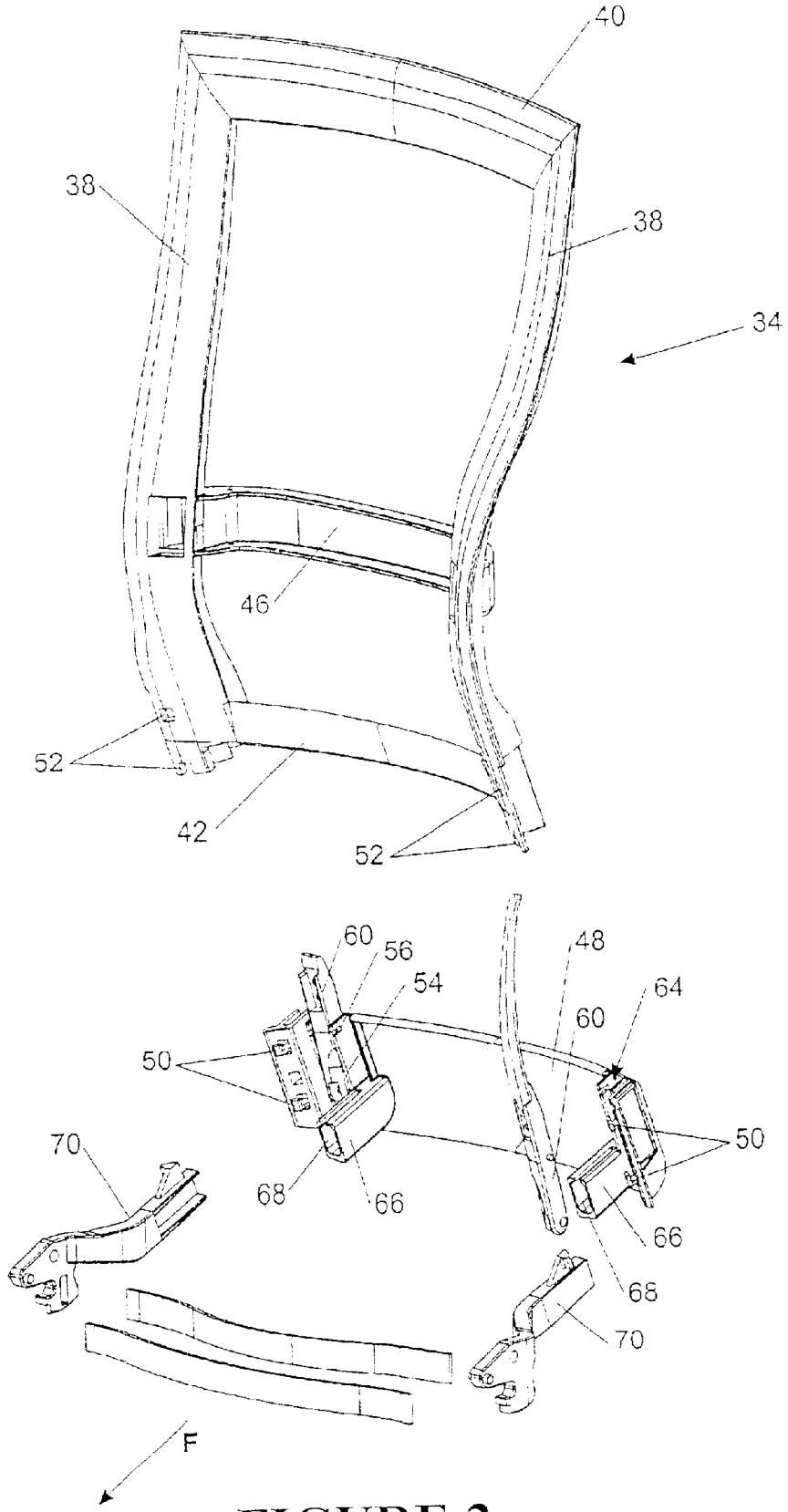
FIG. 2*a* is an exploded perspective view of a back portion of the chair shown in FIG. 1.
Figure 82:
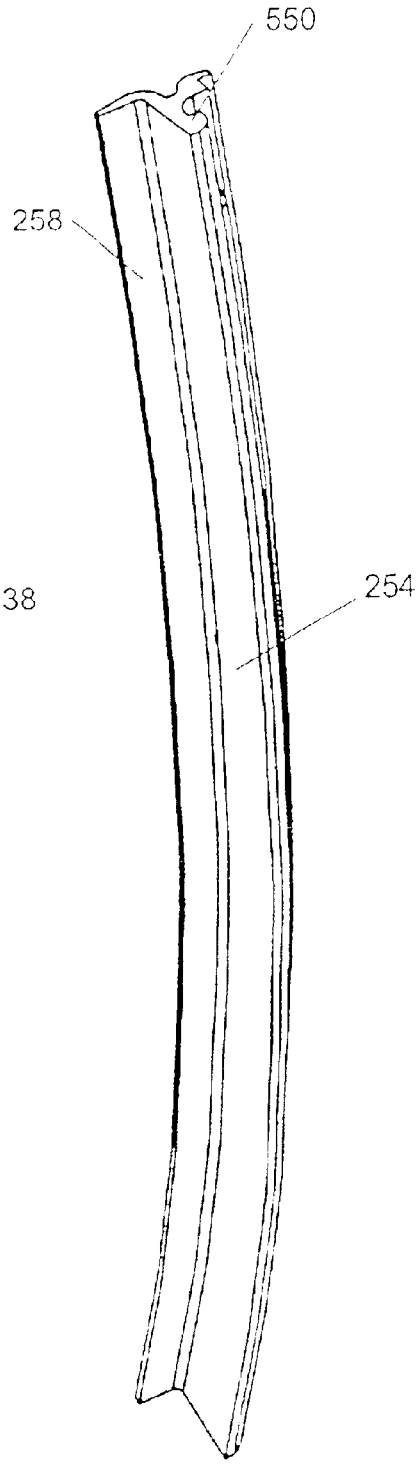
FIG. 82 is a perspective view of a piece of insert strip.
Figure 83:
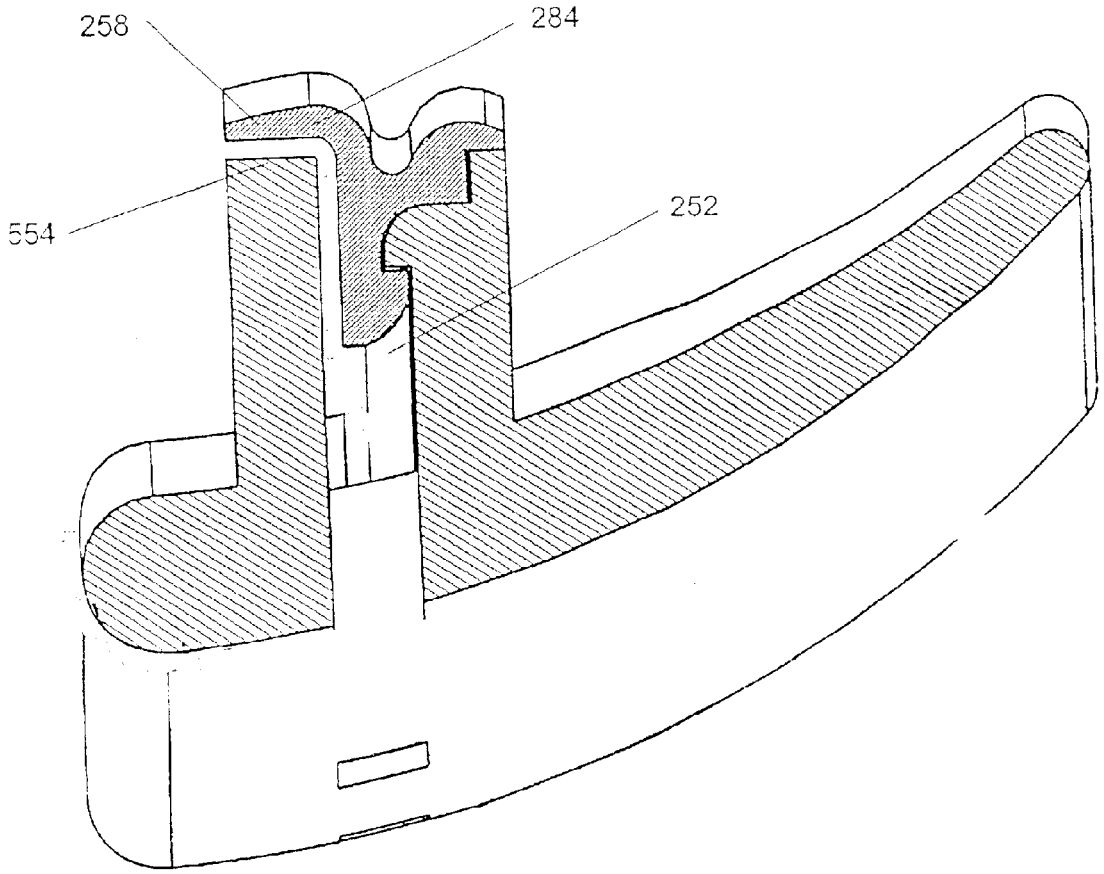
FIG. 83 is an assembled view in cross-section of the upright member of the back frame and the insert strip.

The back portion 16 is defined by a peripheral frame 34 which is approximately rectangular in shape, as shown in FIG. 2. In the finished chair the peripheral frame 34 has a mesh fabric stretched over it in a manner described more fully in connection with FIGS. 81 to 83. Within the opening defined by the rectangular peripheral frame 34, a lumbar support mechanism 36 is provided which is described in more detail in connection with FIGS. 66 to 74.

Figure 28:
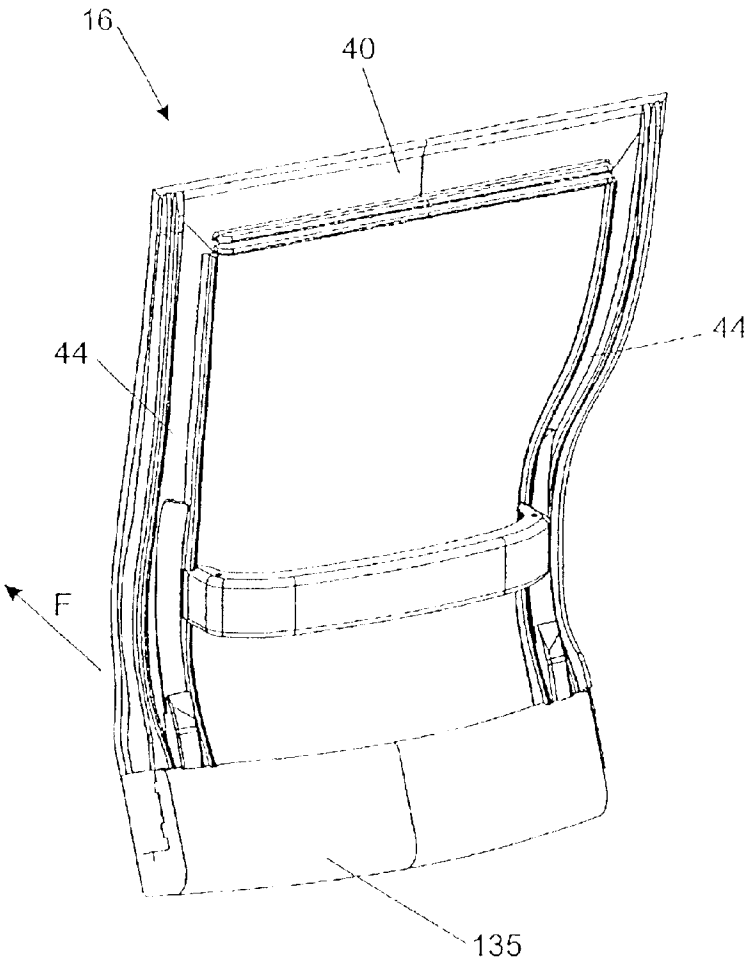
FIG. 28 is a perspective view from the rear of the assembled parts illustrated in FIG. 27.

FIG. 2 illustrates more clearly the form of the peripheral frame 34. The peripheral frame 34 is constructed of a flexible plastics material such as injection moulded reinforced polyester. The peripheral frame 34 is of integral construction and comprises two upright members 38, a top beam 40 and a bottom beam 42. The upright members 38 are bowed with a gentle serpentine curve sweeping forwardly in the upward direction and then rearwardly beyond the lumbar region. This is a shape which is comfortable to the chair occupant. The upright members 38 include channels 44 which are open in the direction facing rearwardly as shown in FIG. 28. The upright members 38 are also joined by an intermediate back beam 46. The back beam 46 supports the lumbar support mechanism 36 in a manner more fully described in connection with FIGS. 66 to 74

Figure 2B:
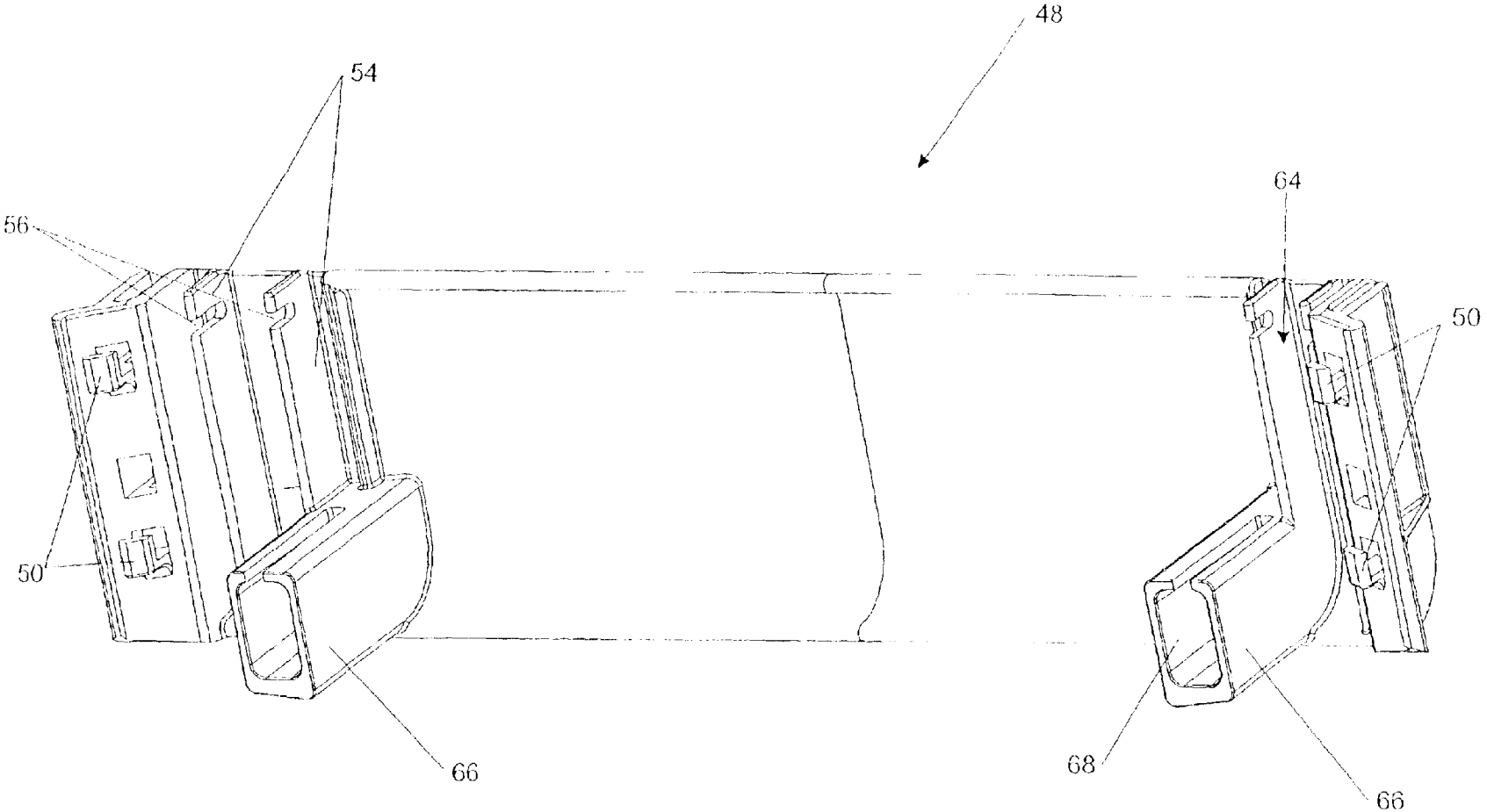
FIG. 2*b* is a perspective view of a back attach casting forming part of the back portion of the chair illustrated in FIG. 2*a;*

Rigidly connected to the lower end of the peripheral frame 34 is a back attach casting 48. The back attach casting 48 is an integrally cast component as shown in FIG. 2*b*. The back attach casting 48 includes two pairs of sprigs 50 which engage with aligned apertures 52 provided at the bottom of the upright members 38. This enables the lower region of the peripheral frame 34 to be securely fixed to the back attach casting 48. An additional snap fitting (not shown) may be provided.

Figure 27:
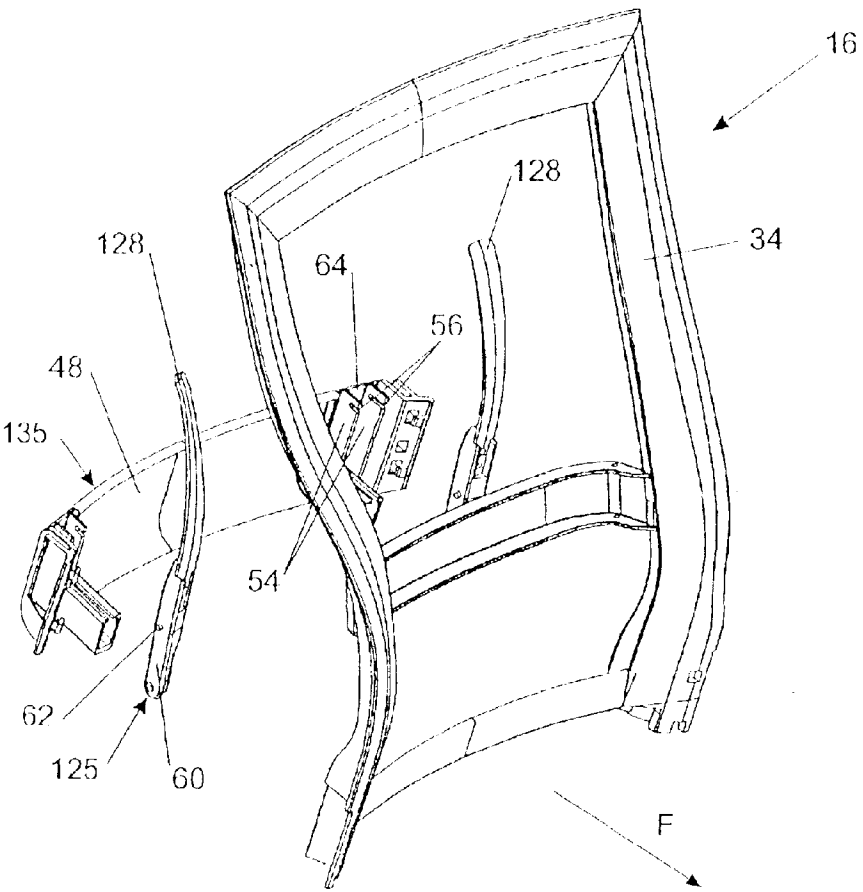
FIG. 27 is a further exploded view of parts making up the back portion of the first embodiment.

The back attach casting 48 also includes 2 pairs of opposed walls 54 on opposite sides (more clearly seen in FIG. 27). Each pair of spaced walls 54 defines a forwardly extending channel 64 in which a spring carrier 60 is received. Each pair of opposed walls 54 includes aligned slots 56. The spring carrier 60 (to be described more fully in connection with FIG. 27) has pins 62 on opposite sides to engage with the aligned slots 56.

Furthermore, the back attach casting 48 includes two forwardly extending hollow projections 66. The hollow projections 66 each define a socket 68. Two back extension arms 70 are welded within respective sockets 68 of the hollow projections 66.

Figure 3:
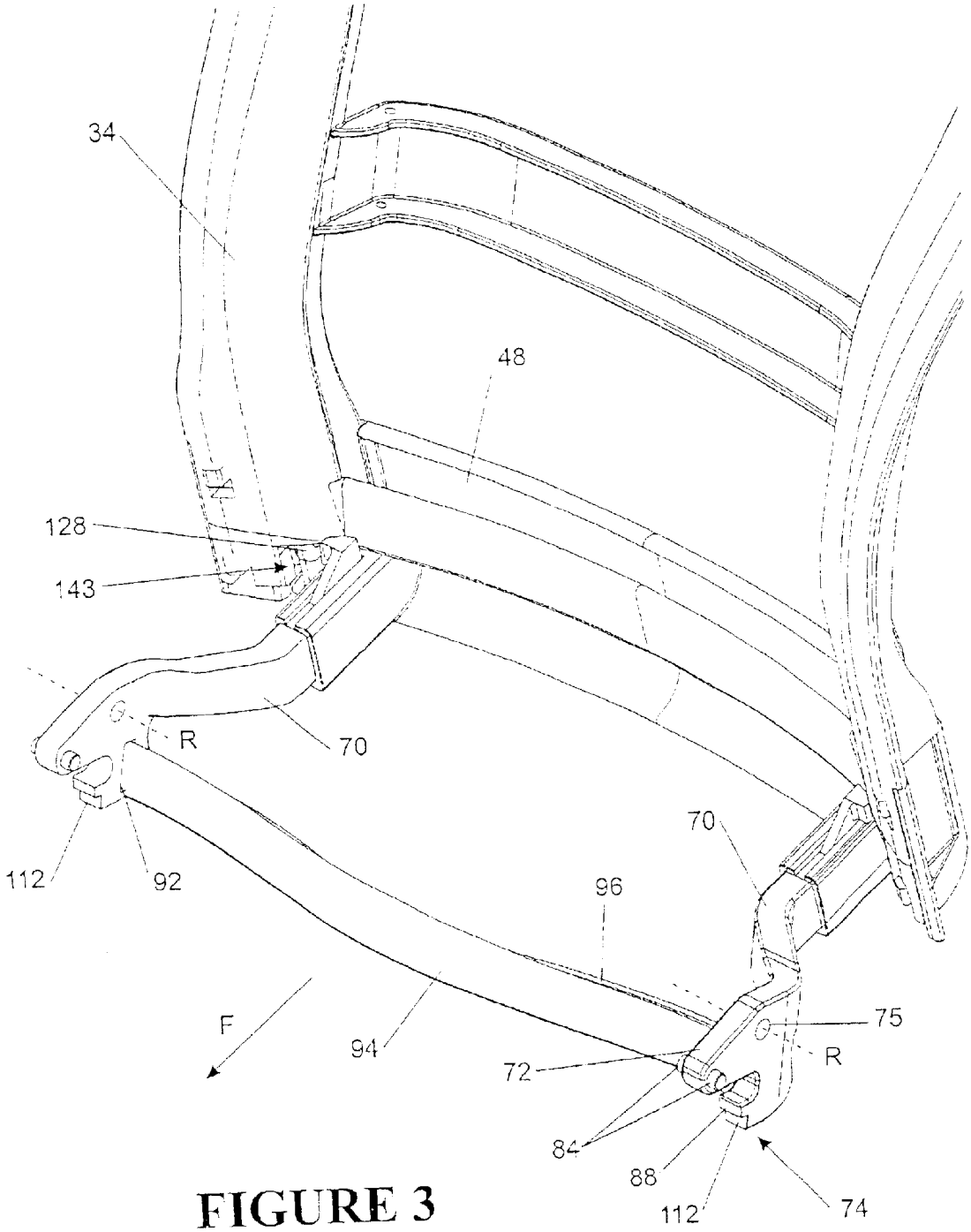
FIG. 3 is an assembled view of a lower portion of the back portion of the chair illustrated in FIG. 2.

Referring to FIG. 3 for greater clarity, each back extension arm 70 includes a forward nose portion 72 and a chin portion 74. An extension arm aperture 75 extends through the back extension arm 70 in a position rearwardly of the nose portion 72 and the chin portion 74.

Reference is now made to FIG. 4 which illustrates the main transom 22 which extends transversely across the chair as already explained. The main transom 22 is supported on a pneumatic spring at central spring support ring 23. The main transom is a beam-like construction of diecast aluminium with pivot features 76 formed at opposite ends. At each end, the pivot features comprise opposed supporting webs 78. The opposed supporting web 78 have rear aligned apertures 80. In the assembled chair, the extension arm aperture 75 of one of the back extension arms is aligned with the rear aligned apertures 80 on one side of the main transom to receive a main pivot pin (not shown) therethrough. Likewise the other back extension arm 70 is pivotally attached to the main transom 22 on the other side. Each back extension arm is pivotable about the associated main pivot pin and the recline axis R of the back portion 16 is thereby defined.

Recline Limits

As mentioned above, a nose portion 72 is defined forwardly of each back extension arm 70. The nose portion 72 has two bosses 84 extending sideways from the flanks of the nose portion 72. The bosses 84 are receivable within facing slots 86 in the opposed supporting webs 78. Each of the facing slots 86 has a base formed therein. During rotation of the back extension arm 70 about pivot R, the bosses 84 move within respective ones of the facing slots 86. In the forward most position of the back portion 16 in its pivoting action about the recline axis R, the bosses 84 will bottom out at the bases of the slots 86 thereby defining forward limits. This is referred to as the forward active position of the back portion 16.

Figure 9:
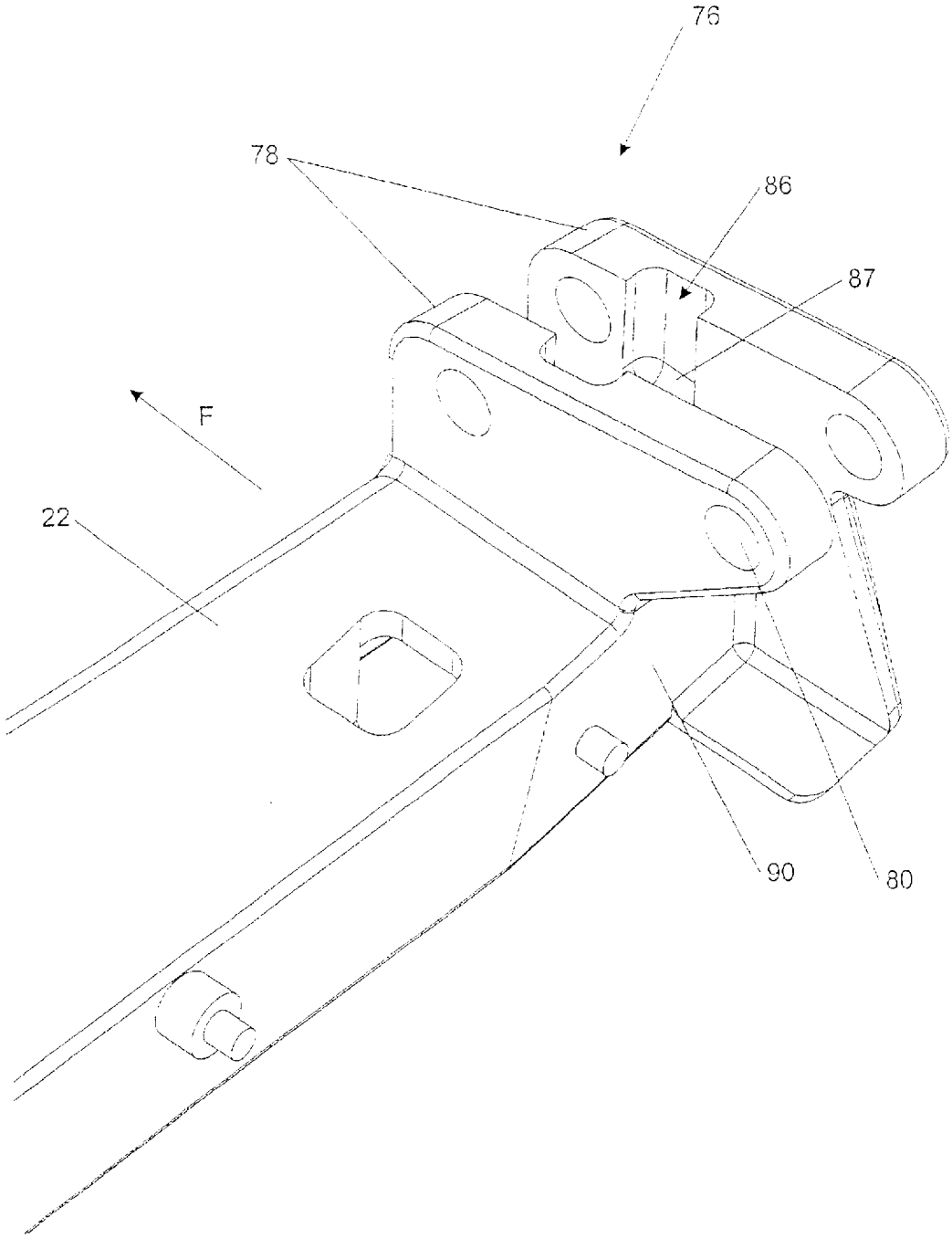
FIG. 9 is an enlarged perspective view of a portion of the main transom on illustrated in FIG. 4.

The chin portion 74 of each back extension arm 70 includes a first abutment surface 88 for engagement with a second abutment surface 90 (see FIG. 9) provided as part of the rear wall of the main transom 22. On each side, when the first abutment surface 88 engages with the second abutment surface 90, the rearward recline limit of the back portion 16 of the chair will be thereby defined. It would not be possible for the chair portion 16 to recline back any further once the two abutment surfaces come into engagement although flexing of the peripheral frame is still possible in this position. One end of the main transom 22 illustrating the pivot features 76 in greater detail can be seen in FIG. 7.

Recline Biasing Device

Referring to FIG. 3 the inner flanks of the chin portions 74 of both back extension arms 70 include facing aligned slots 92, the left one of which can be seen in the Figure. A first recline spring 94 in the form of an elongate bar or leaf spring has each end received in a respective one of the facing slots 92. As shown in FIG. 4, the main transom 22 has a reaction surface 98 against which the first spring 94 engages. The reaction surface 98 is centrally disposed and has a depth corresponding to the depth of the first spring 94. The reaction surface 98 forms part of an integrally formed projection extending rearwardly from the main transom 22. As the back portion 16 reclines rearwardly about the recline axis R, the first recline spring 94 engages against the reaction surface 98, thereby biasing the back portion 16 against reclining action.

A second recline spring 96 also has one end received in one of the facing slots 92. However, the second recline spring 96 is somewhat shorter than the first recline spring 94 so the second end of the second recline spring 96 is not received within the other facing slot 92 (see FIG. 10). As shown, the second spring is also in the form of an elongate spring bar or leaf spring. The second spring 96 lays behind the first spring 94, against the first spring 94, for at least half the length of the first spring 94. An adjustable clamp 100 (see FIG. 7) is provided to clamp the free end of the second spring 96 against the first spring 94 and thus alter the curvature of the second spring 96 and thereby alter its spring resistance. The second spring 96 is disposed such that increased clamping against the first spring will act to increase its resistance to bending. The net force biasing the back portion against recline will thereby be the sum of the spring force provided by the first spring 94 and the spring force provided by the second spring 96. With the second spring more tightly clamped to the first spring 94, the resultant spring resistance will be higher than for a more relaxed clamping between the two springs. The first spring 94 has a factory set spring rate. The second spring 96 is selected to have a high spring rate, greater than the spring rate of the first spring 94. Thereby, a small adjustment of the clamping between the first spring 94 and the second spring 96 will bring about an appreciable change in the spring resistance of the second spring 96.

Figure 7:
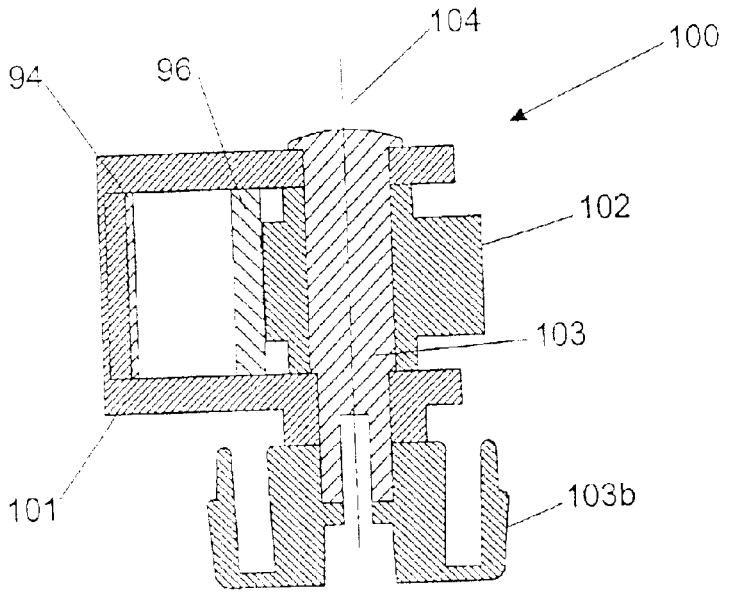
FIG. 7 illustrates an adjustable clamp.
Figure 8:
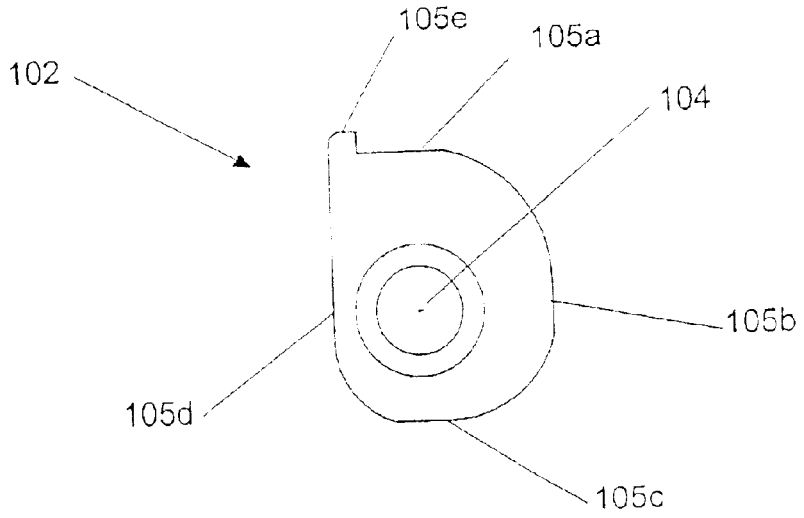
FIG. 8 is a plan view of the cam for the adjustable clamp.

The adjustable clamp 100 is illustrated in FIG. 7. The adjustable clamp 100 includes a U-shaped bracket 101 which extends around the two recline springs 94, 96. A cam 102 is mounted on axle 103 extending between the two legs of the U-shaped bracket 101. The axle 103 is journaled for rotation about an axis 104. The cam 102 includes four cam surface portions 105*a*, 105*b*, 105*c* and 105*d* as shown in FIG. 8. The cam surface portions are substantially flat as indicated and each is spaced a different amount from the cam axis 104. The spacing decreases in the clockwise direction around the cam 102 from 105*a* through to 105*d*. The cam 102 bears against the free end of the second spring 96. The chair occupant can adjust the position of the cam to determine which of the cam surface portions 105*a*–105*d* will bear against the free end of the second spring 96. A progressively higher clamping force and hence higher resultant spring rate of the second spring can be obtained as the occupant rotates the cam 102 through to the maximum setting at 105*a*. At 105*e*, an extension to the cam 102 is provided to prevent over rotation of the cam 102. A knob 103*b* is provided for user adjustment of the cam 102.

Figure 11:
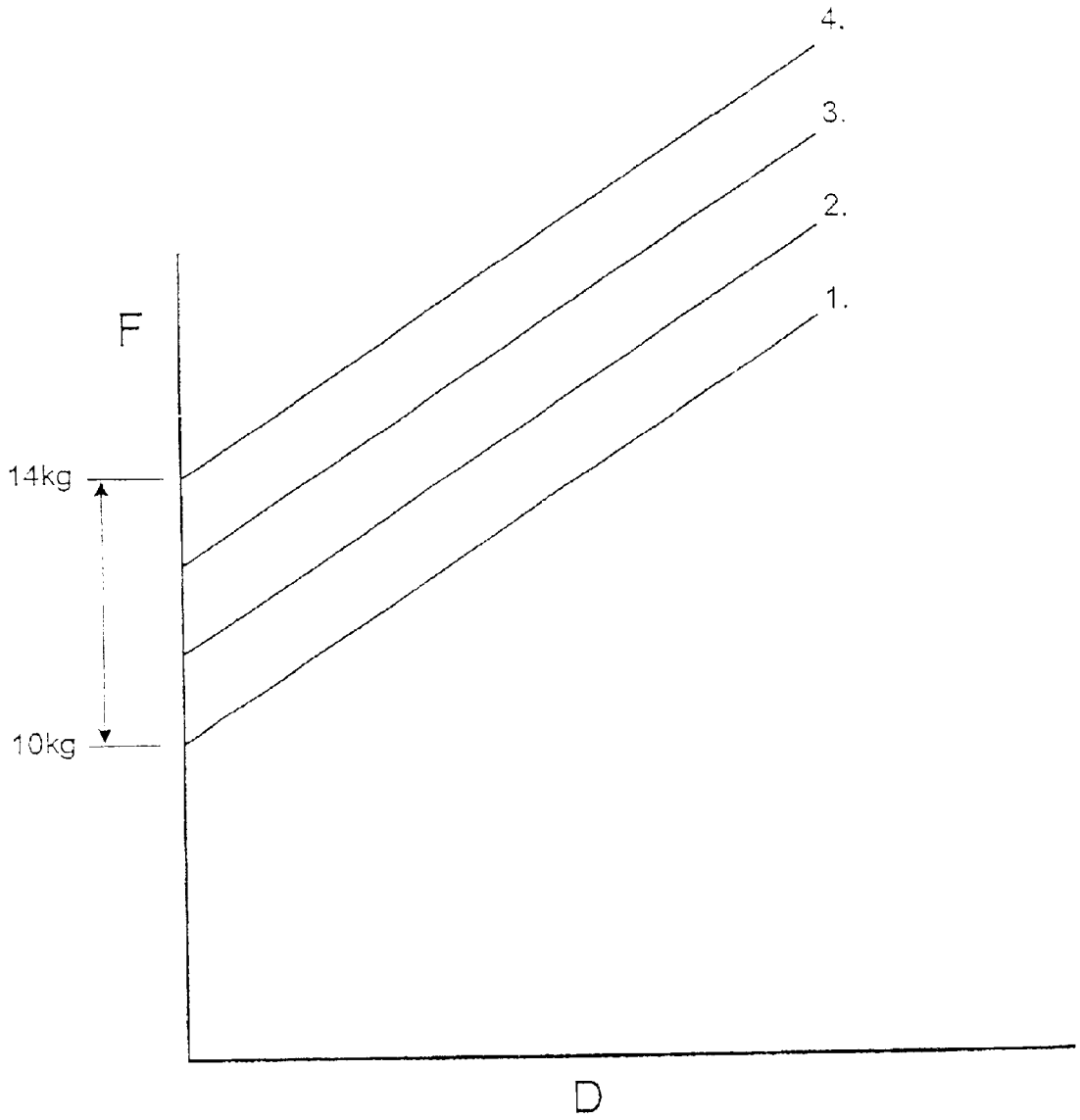
FIG. 11 is a graph illustrating the change in resistance to backward recline achievable by the adjustable clamp illustrated in FIGS. 6–8.

The change in the net spring force over distance is illustrated graphically in FIG. 11 for each of the positions of the cam 102. In position 1, the clamping is such that no force is contributed from the second spring 96. The first spring thereby offers an initial resistance of typically 10 kg. As the cam position is adjusted, the second spring contributes to the overall force so that the initial resistance to recline is increased above 10 kg, say approximately 11 kg. It will be appreciated that in changing the force offered by the second spring from 0 kg to approximately 1 kg, it is only necessary to act against a maximum of approximately 1 kg of force offered by the second spring 96. This is considerably lesser force than if the first spring 94 was adjusted to increase its initial resistance from 10 kg to 11 kg since the whole of the spring force would need to be acted against to bring about the required adjustment. In the particular embodiment described in which the first and second springs 94, 96 lay flat against each other, adjustment of the second spring 96 may bring about some change in the spring constant of the first spring. However, this is not graphically illustrated in FIG. 9.

Recline Lock

Figure 5:
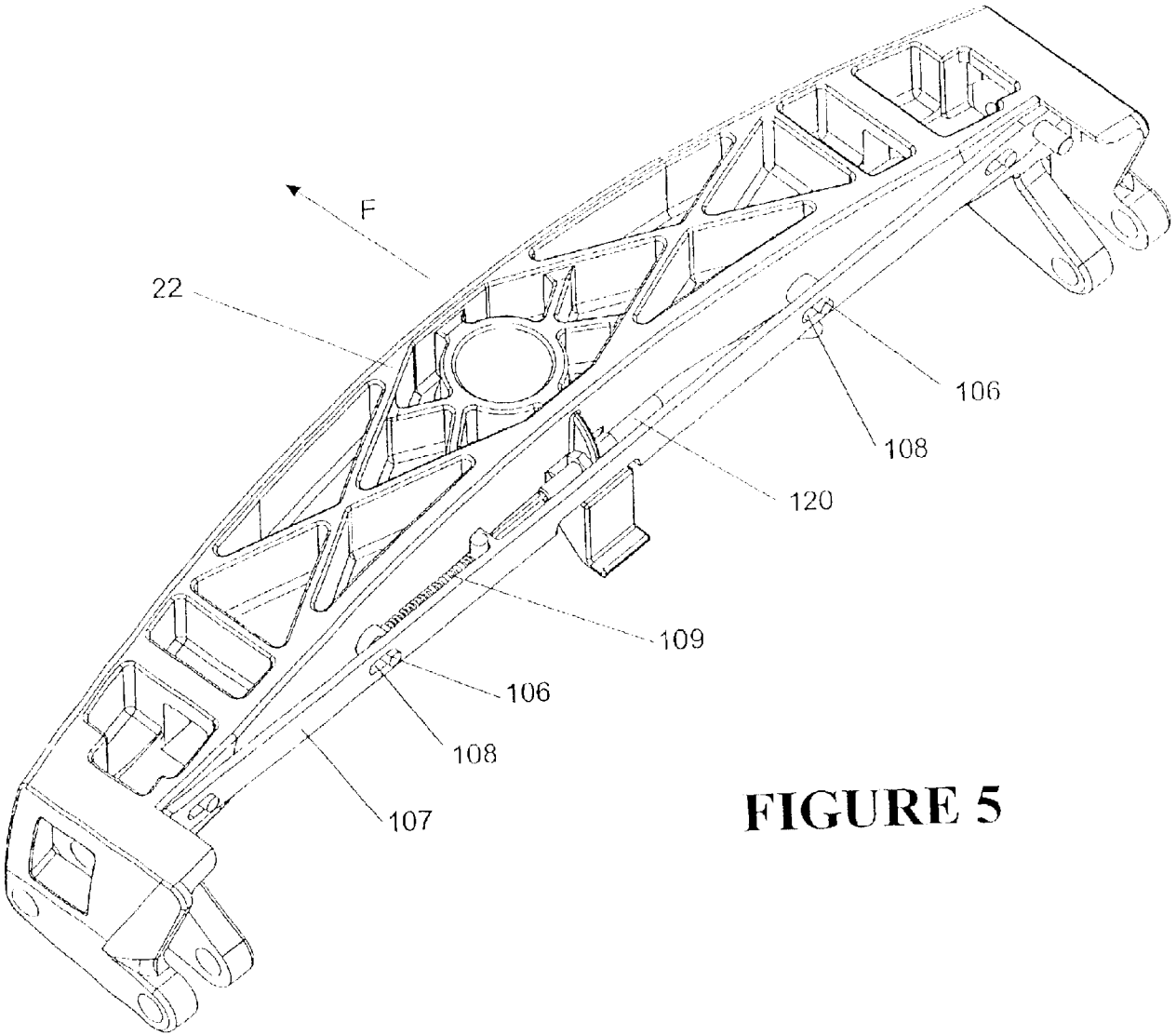
FIG. 5 is a perspective view of an assembly from the underside of the main transom illustrated in FIG. 4.
Figure 6:
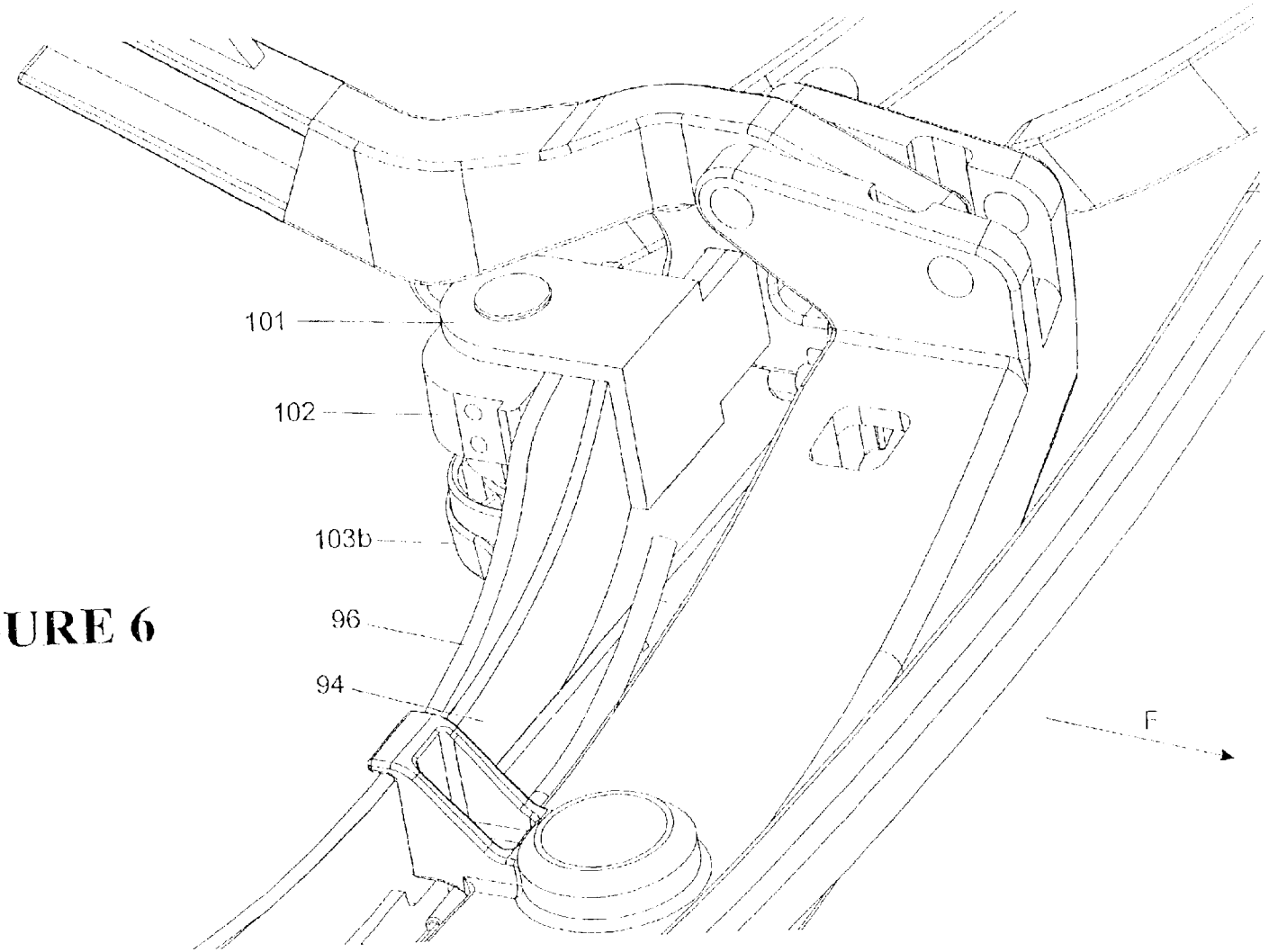
FIG. 6 is a perspective view of the assembled chair looking down upon the main transom illustrated in FIG. 4.

FIG. 5 illustrates a recline lock which may be operated selectively by the user to prevent the back portion from reclining. As can be seen in FIG. 4, the main transom 22 includes four rearwardly extending projections 106. The recline lock comprises an elongate lock bar 107 which has four slots 108 arranged therein, with the lengthwise direction of the slots 108 arranged in the lengthwise direction of the bar 107. The slots 108 each receive one of the rearwardly extending projections 106 as shown in FIG. 5. The elongate lock bar 107 is slidable from side to side between a recline lock position and a recline operative position. The projections 106 received in the slots 108 thereby define the limit of travel of the elongate lock bar 107. The elongate lock bar 107 is biased toward the recline operative position by spring 109.

Figure 10:
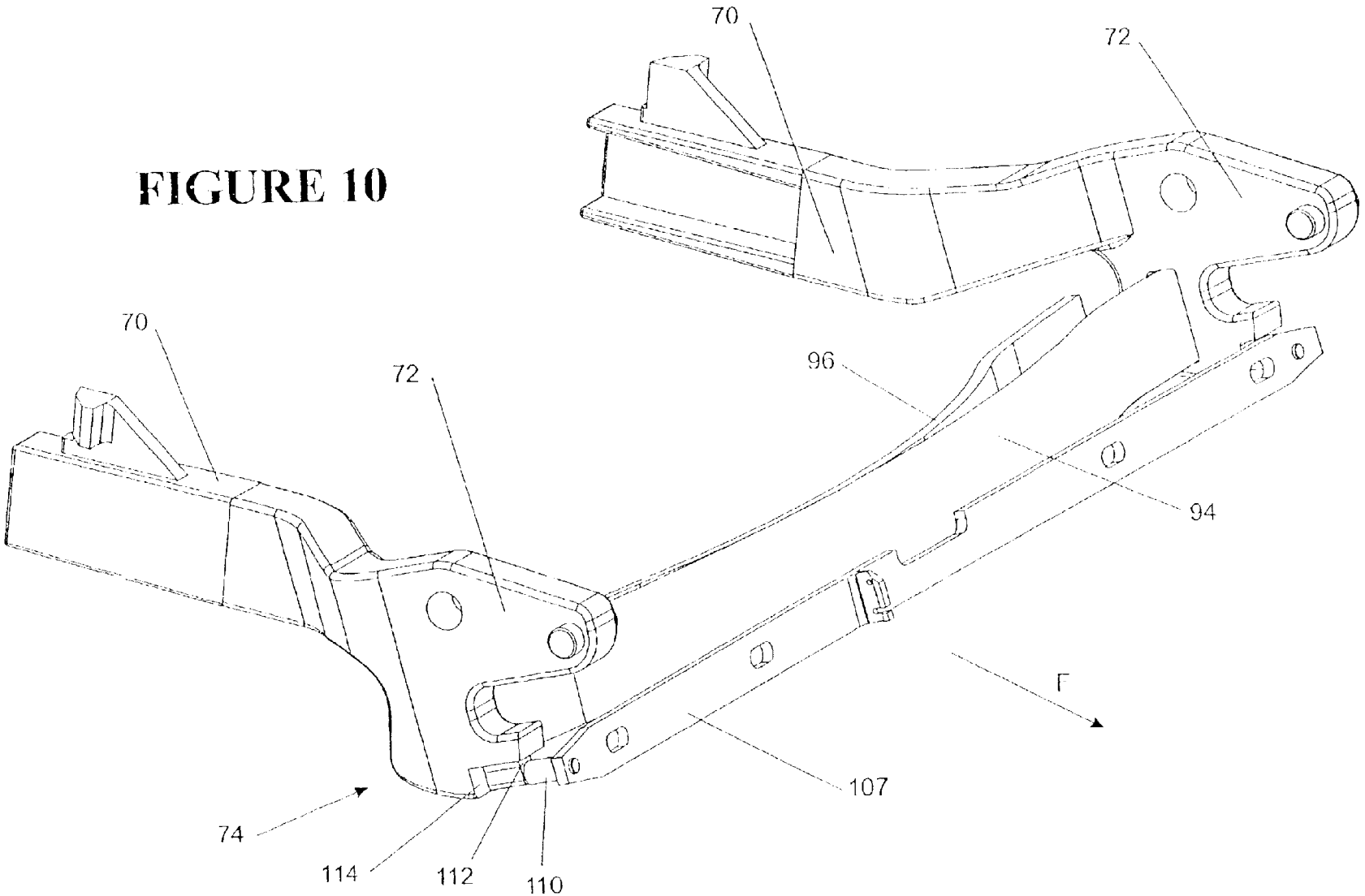
FIG. 10 is a perspective view of the chair of FIG. 1 from the underside with the main transom removed, illustrating certain components of a recline lock.

The elongate lock bar 107 can be seen in FIG. 10 in which the main transom 22 has been removed for greater clarity. The lock bar 107 has at each end a rearwardly extending lock bit 110. The lock bits 110 thereby move from side to side with the movement of the elongate lock bar 107. Each lock bit is moveable into a recline lock position whereby the lock bit 110 is engaged against a recline locking face 112 provided on the chin portion 74 of the back extension arms. The left-hand side lock bit 110 (shown on the right in the figure) moves from a recline operative position in which is it clear of the associated back extension arm 70, to a position in which it is engaged against the recline lock face 112 on the associated arm 70.

The arrangement in connection with the right hand lock bit 110 (shown in the left in the figure) is slightly different. It can be seen that the associated extension arm 70 has the recline lock face 112. Additionally, the associated arm 70 is provided with the rebate 114 adjacent to the recline lock face 112. In the recline lock position, the lock bit 110 is engaged with the recline lock face 112 whereas in the recline operative position, the left lock bit 110 is received within the rebate 114. When the lock bit is received within the rebate 114, the associated back extension arm 70 can still pivot freely about the recline axis.

Figure 12:
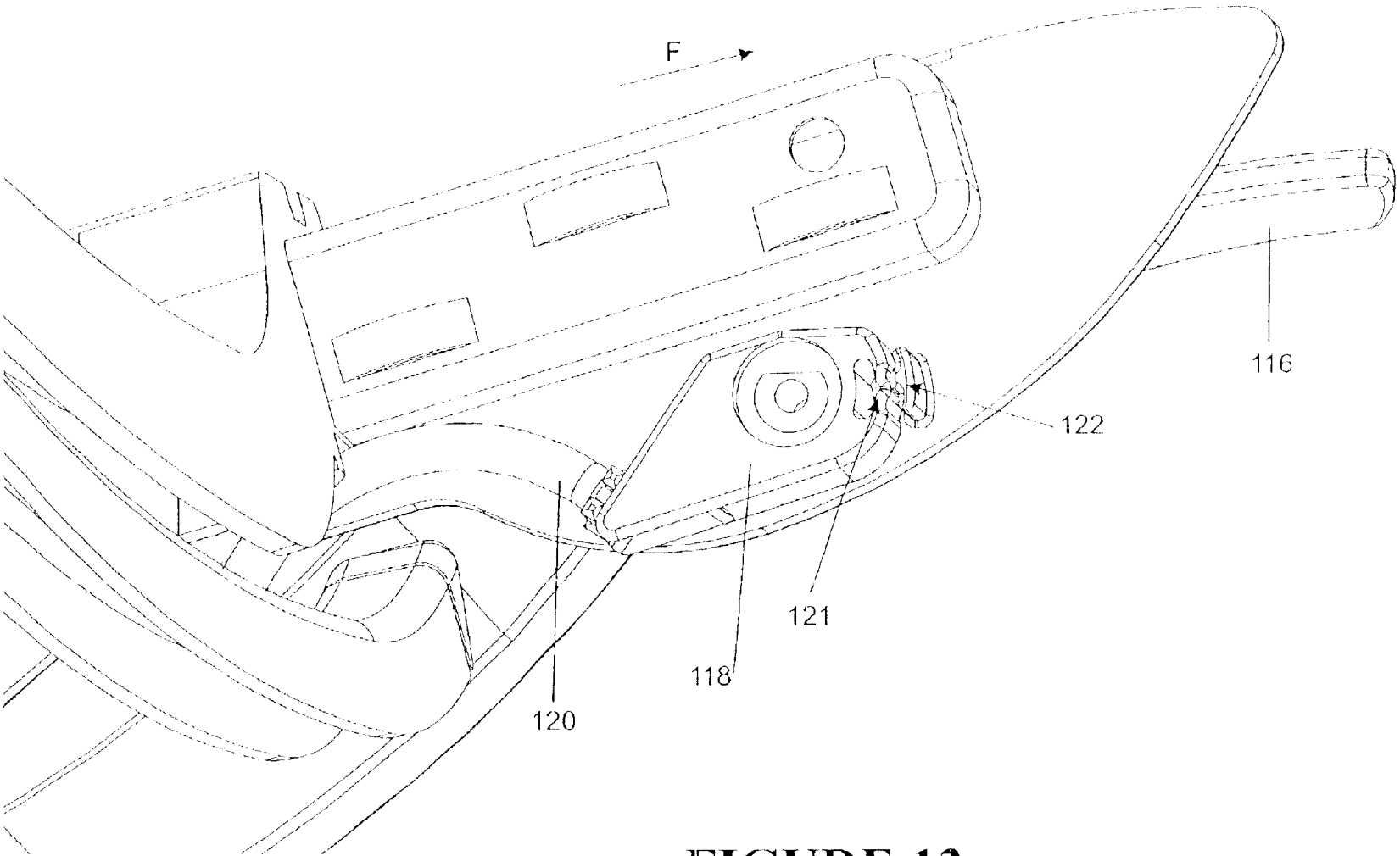
FIG. 12 is a perspective view of a control lever for the recline lock.

FIG. 12 illustrates the lock bar control lever 116 which is mounted underneath the seat portion 14 in a forward position on the left hand side. The lever 116 is connected to cable actuator 118. The cable actuator 118 is connected to a control cable 120 which operates in the conventional fashion. The control cable 120 controls the position of the elongate lock bar 107 (see FIG. 5). The cable actuator 118 is rotatable by operation of the control lever 116. The cable actuator 118 has a dimple provided on the forward edge which is engageable with the two position detent 122. The dimple 121 is locatable in either of two positions, the first of which corresponds to the recline lock position of the elongate lock bar 107, and the second of which corresponds to the recline operative position of the elongate lock bar 107. The user thus selects whether the recline lock is on or off according to the position of the lock bar control lever 116.

Modified Form of Back Extension Arms, Main Transom, Recline Springs and Recline Lock—Second Embodiment Many of the parts described in connection with the second embodiment will be similar in many respects to corresponding parts in the first embodiment. Where the parts are essentially equivalent, like reference numerals are used. Where the parts differ in construction but perform an equivalent or analogous function, a prime (') will be used following the relevant reference numeral.

Figure 13:
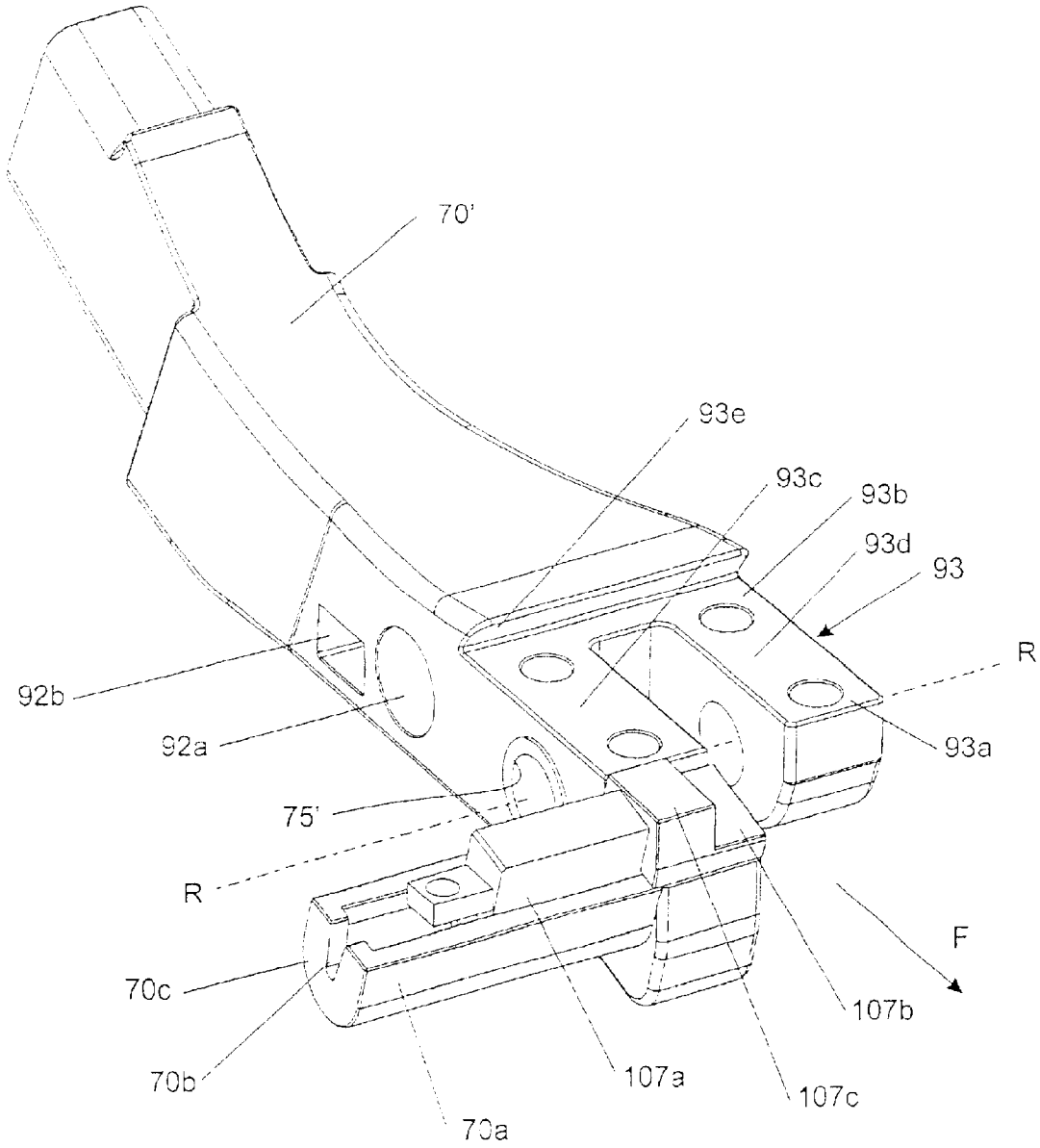
FIG. 13 is a perspective view of a modified form of the back extension arm in accordance with the second preferred embodiment of the chair.

FIG. 13 illustrates a modified form of one of the back extension arms 70'. The back extension arm 70' has a forked forward end forming a right fork 93*c* and a left fork 93*d* with an extension arm aperture 75' extending transversely through both forks. Two such back extension arms 70' are rotatably mounted about the recline axis R to the main transom 22' as shown in its modified form in FIG. 14. From FIG. 15, it can be seen that the main transom 22' has pivot features 76' formed at opposite ends. At each end, the pivot features include a pair of spaced supporting webs in the form of inner and outer lobes 78' through which extends aligned apertures 80'. The alignment of the apertures 80' defines the recline axis R about which the back extension arms 70' pivot. A pin inserted through each pair of apertures 80' mounts each back extension arm 70' to the main transom 22'. The inner lobe 78' is inserted between the forks 93*c*, 93*d* of the associated back extension arm 70'.

Figure 16:
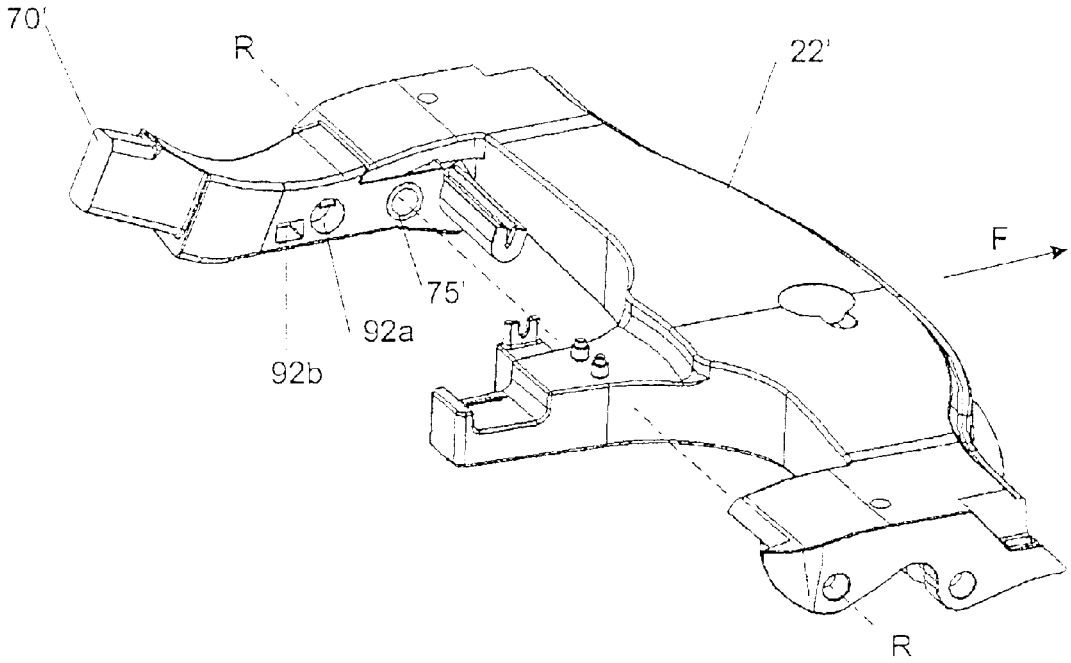
FIG. 16 is a perspective view illustrating the modified form of the back extension arm of FIG. 13 in assembly with the modified form of the main transom of FIGS. 14 and 15.

From FIG. 13, it can be seen that the rearward end of the upper abutment surface 93 has a skid 93*e* which engages with complementary ramp 76*a* on the main transom 22'. The ramp 76*a* is curved with a centre of curvature centred on the recline axis R. This defines a potential pinching point where the occupant of the chair might jam his fingers or shirt tails etc. Therefore outer lobe 78' extends rearwardly beyond the ramp 76*a* to act as a guard. FIG. 16 illustrates one of the back extension arms 70' rotatably mounted to the main transom 22'.

FIG. 13 illustrates an alternative form of recline lock mechanism. It can been seen that the forward end of the back extension arm 70' is provided with a substantially flat upper abutment surface 93 comprised of a forward surface portion 93*a,* forward of the recline axis R and a rearward surface portion 93*b,* rearward of the recline axis R. In assembly of the back extension arm 70' with the main transom 22', the abutment surface 93 lies underneath an upper portion of the main transom (see FIG. 16). The rearward surface portion 93*b* thus defines the forward recline limit which will be reached when the back extension arm 70' pivots so that the rearward surface portion 93*b* abuts the underside of the main transom 22'. Conversely, the rearward recline limit will be defined when arm 70' rotates such that the forward surface portion 93*a* abuts the underside of the main transom 22'. The engagement between the forward surface portion 93*a* and the underside of the main transom 22' thus defines the rearward recline limit.

A recline lock may be operated selectively by the user to prevent the back portion from reclining or to set an intermediate recline limit. As seen in FIG. 13, the forward end of the back extension arm 70' is formed with a transversely extending slide 70*a* in which is slidably mounted a key 107*a*. The slide 70*a* has a substantially closed inner end 70*c* which has an V-shaped slot 70*b*. A spring (not shown) is received in the slide 70*a* between the key 107*a* and the closed end 70*c* to bias the key 107*a* outwardly away from the closed end 70*c*. The key 107*a* is slidable within the slide against the action of the spring by means of a cable connected to the inner end of the key 107*a* which is adjustable in the same manner described in FIG. 12 (see also FIG. 62). The key has first and second abutment surfaces 107*b* and 107*c*. When the key 107*a* is in the innermost position (relative to the chair as a whole) illustrated in FIG. 13, then the first abutment surface 107*b* does not interfere with the reclining action of the back extension arm 70' as already described. This is referred to as the hyper-recline position, allowing recline of 15°.

As already explained, the forward end of the back extension arm 70' is forked as shown to define right and left forks 93*c,* 93*d*. As the key 107*a* is moved into a position whereby the first abutment surface 107*b* is aligned with the right fork 93*c* then the first abutment surface 107*b* will interfere with the recline action of the back extension arm because the first abutment surface 107*b* will hit the underside of the main transom 22' before the forward surface portion 93*a* normally would. This allows recline of 12°. When the key 107*a* is moved so that the second abutment surface 107*c* is aligned with the right fork 93*c* then the second abutment surface 107*c* is disposed such that any recline of the back extension arm 70' is prevented or at least largely prevented. A recline lock is thereby defined.

Figure 14:
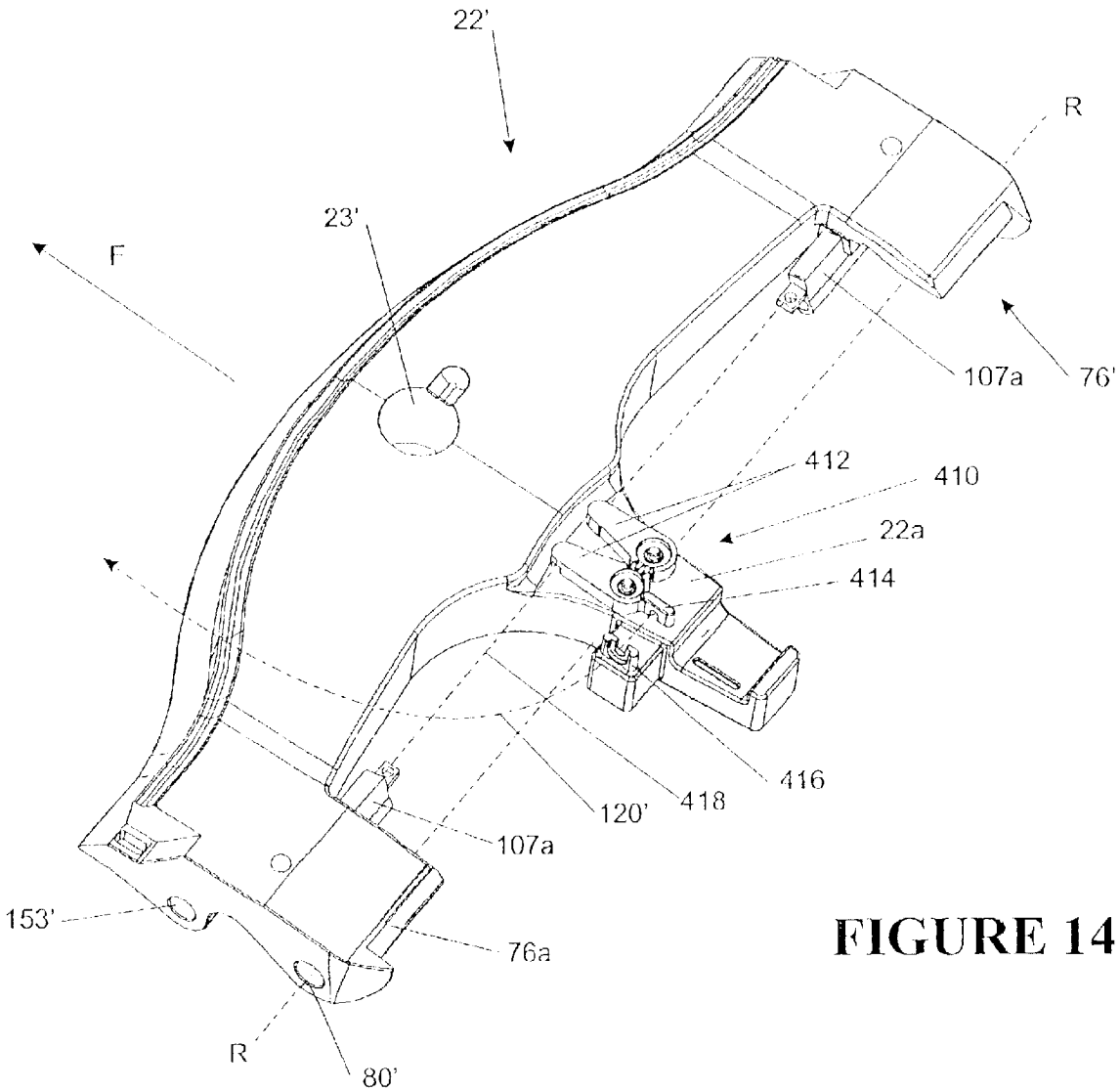
FIG. 14 is a perspective view of a modified form of the main transom from above in accordance with the second preferred embodiment of the chair.
Figure 15:
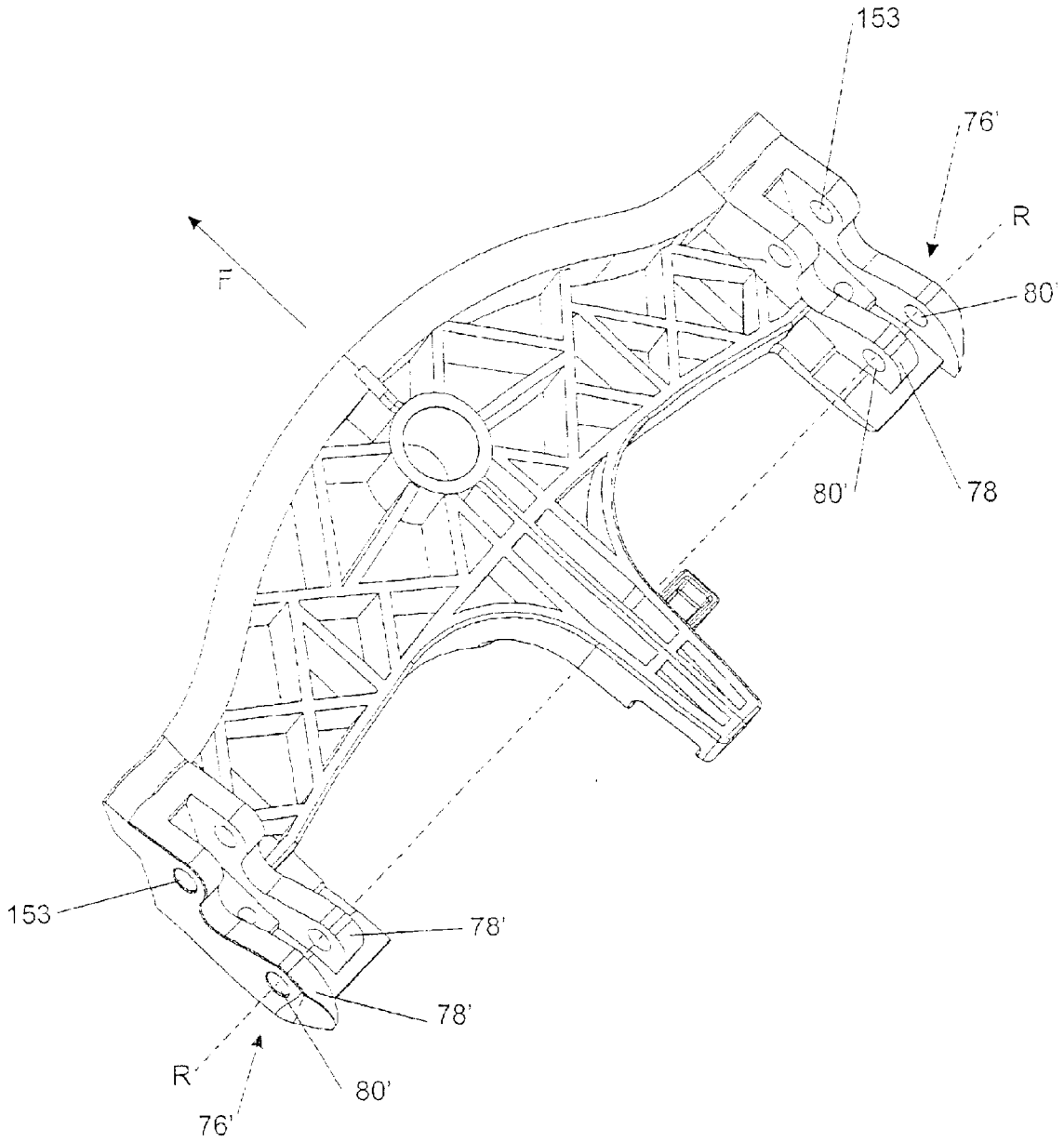
FIG. 15 is a perspective view of a modified form of the transom of FIG. 14 from below.

FIG. 14 illustrates the manner by which the keys 107*a* may be moved in unison. A cable 120' is connected between a cable actuator 118' (see FIG. 62) and cable amplification mechanism 410 mounted on the rearward extension 22*a* of the main transom 22. The cable amplification mechanism 410 includes a pair of pivotally mounted amplifiers 412 which have intermeshed teeth for synchronous operation. One of the amplifiers 412 has a rearward amplifier extension 414 to which the end of the cable 120' is connected. The cable 120' passes through cable guide 416. As the cable 120' operates on the rearward amplifier extension 414 to move it downwardly from the perspective shown in FIG. 14, the intermeshing amplifiers 412 will be driven to rotate so that their remote ends move towards each other. The remote ends of the amplifiers 412 are connected by respective cables to respective ones of the keys 107*a*. This cable connection is depicted by phantom line 418.

Figure 18:
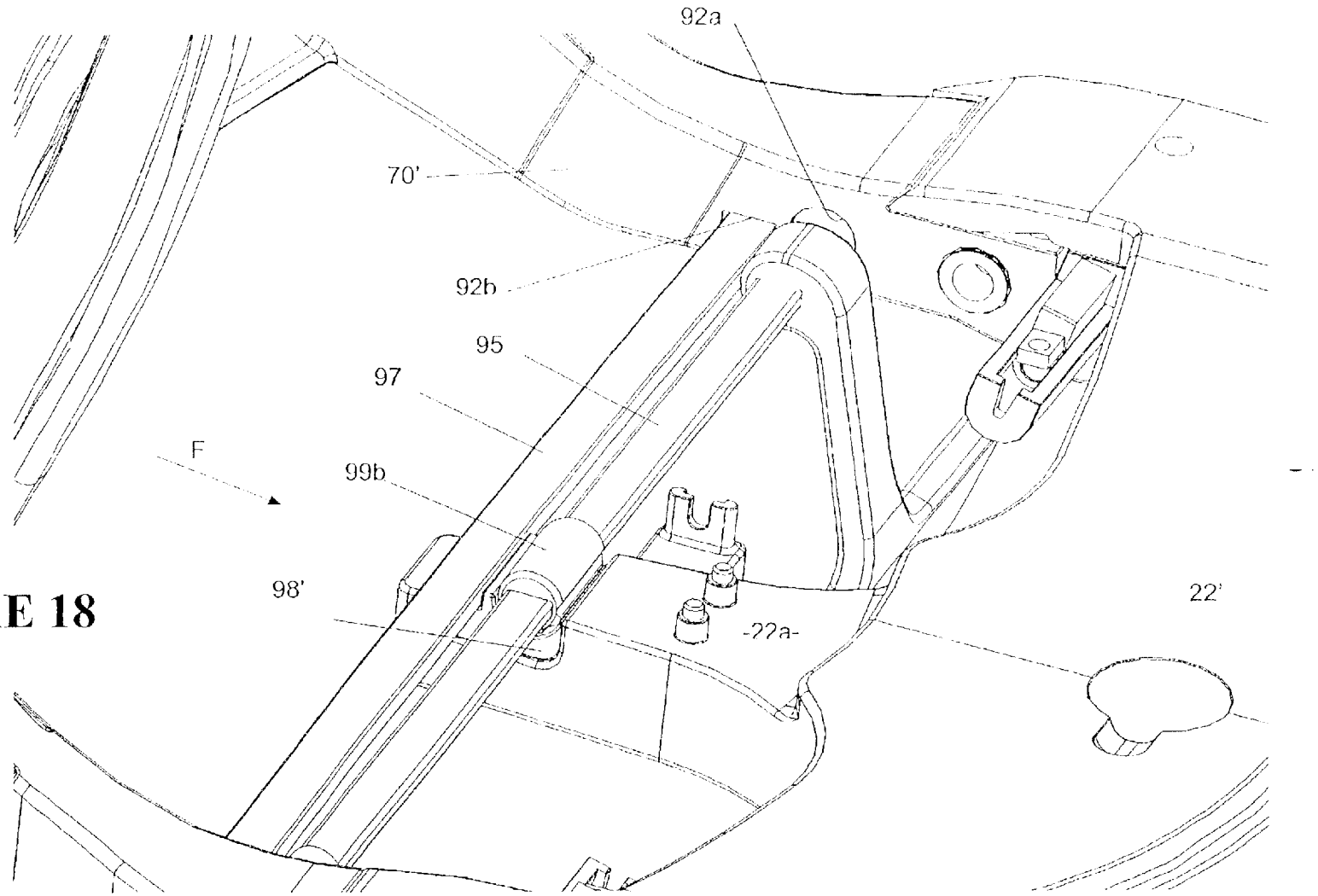
FIG. 18 is a perspective view illustrating the first recline spring of FIG. 17 in assembly with the back extension arms and the main transom together with a second recline spring.

In FIG. 13, it can be seen that the side of the back extension arm 70' includes two bores 92*a* and 92*b* which face like bores on the facing side of the other back extension arm (not shown). Bore 92*a* is cylindrical and bore 92*b* is rectangular as shown. As shown in FIG. 18, first and second recline springs 95, 97 extend between the facing bores. The second recline spring 97 is in the form of an elongate bar, the ends of which are received in facing bores 92*b* of the two back extension arms 70'.

The main transom 22' includes a rearward extension 22*a* having a bearing block 98' seated in a complementary recess on the upper surface of the rearward extension 22*a*. The bearing block 98' defines a complementary recess to receive a central portion of the second recline spring 97. As the back extension arms 70' recline relative to the main transom 22', the second recline spring 97 is caused to bend downwardly at its ends while the intermediate portion is held fixed by being seated in the bearing block 98' on the main transom 22'. The second recline spring 97 thus resists rearward recline and biases the back extension arms 70' toward the forward recline limit. The second recline spring 97 is pre-loaded at the forward recline limit by being slightly bent. This is achieved by having the centres of the bores 92*b* slightly below the centre of the spring in the recess of the bearing block 98'.

Figure 17:
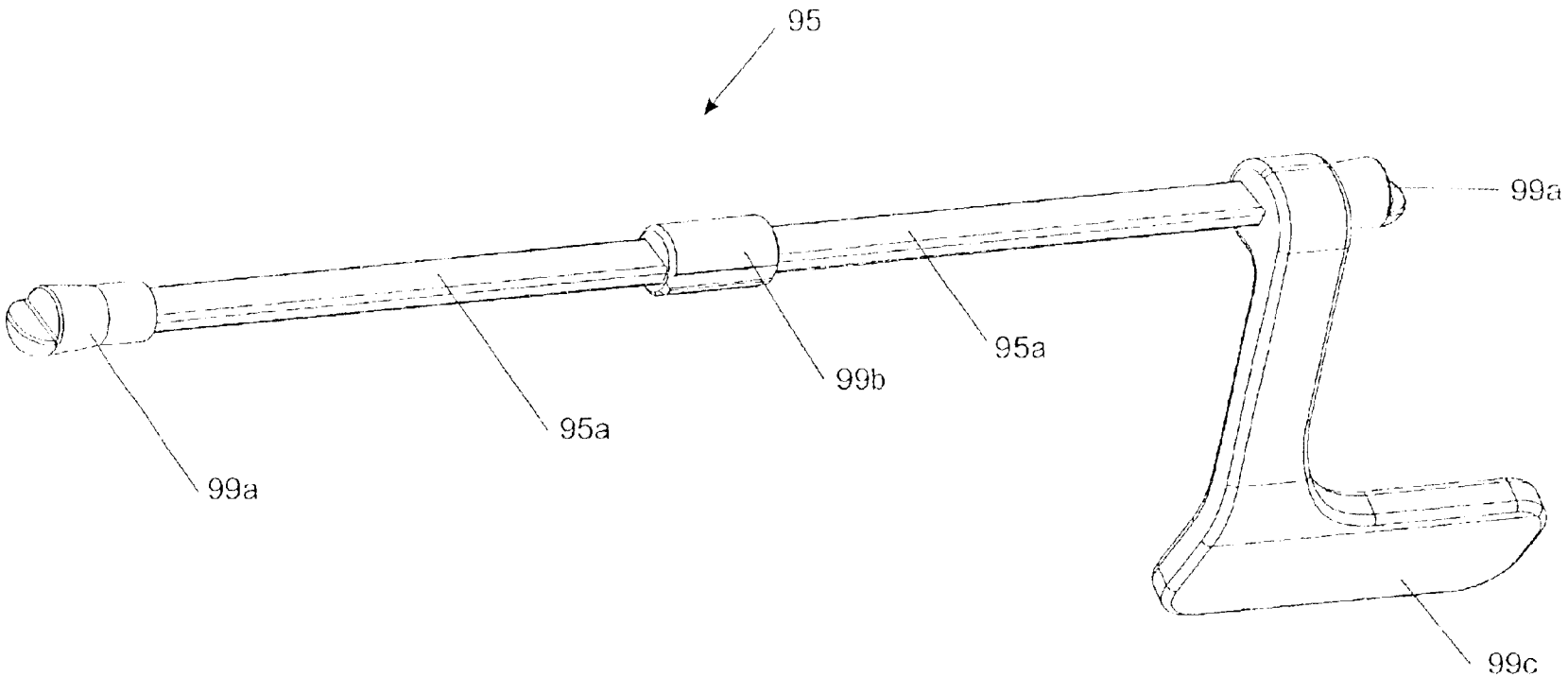
FIG. 17 is a perspective view of a modified form of a first recline spring in accordance with the second preferred embodiment of the chair.

The first recline spring 95 operates on a similar principle but is somewhat more complex. The first recline spring 95 is illustrated in greater detail in FIG. 17 and comprises a spring portion 95*a,* in the form of a flat bar. The outer ends of the first recline spring 95 are fitted with cylindrical bosses 99*a* to be received in the facing cylindrical bores 92*a* provided in the back extension arms 70'. Additionally, a central cylindrical boss 99*b* is fitted onto the bar 95*a*. The central boss 99*b* is slotted to allow the bar 99*a* to pass through. As shown in FIG. 18, the central cylindrical boss 99*b* is seated in a semi-cylindrical recess provided in the bearing block 98' on the main transom 22'. The bearing block 98' may be provided with upstands at its sides to locate the boss 99*b* relative to its seat in the bearing. The flat bar spring portion 95*a* provides resistance to recline through its inherent resistance to bending about a bending axis arranged transversely to the length of the spring 95. It will be appreciated that with the configuration of the ends of the first spring 95 and the central cylindrical boss 99*b* bearing against the main transom 22', the bending axis will be defined which extends generally transverse to the longitudinal axis of the spring 95. The arrangement is such that no pre-load is applied to flat spring portion 95*a* in the forward active position. The central recess in the bearing block 98'and the cylindrical bores 92*a* are thus aligned for this reason.

Figure 19:
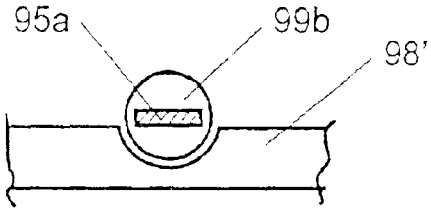
FIG. 19 is a diagrammatic illustration of a first adoptable position of the first recline spring.
Figure 20:
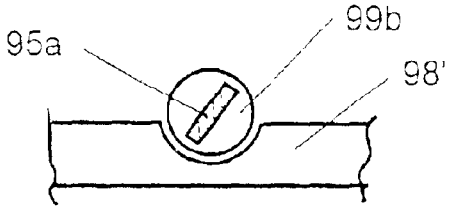
FIG. 20 is a diagrammatic illustration of a second adoptable position of the first recline spring.
Figure 21:
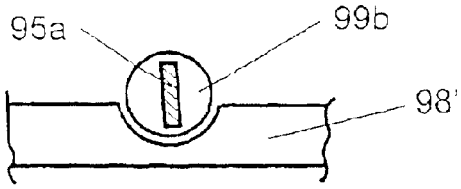
FIG. 21 is a diagrammatic illustration of a third adoptable spring position of the first recline spring.
Figure 22:
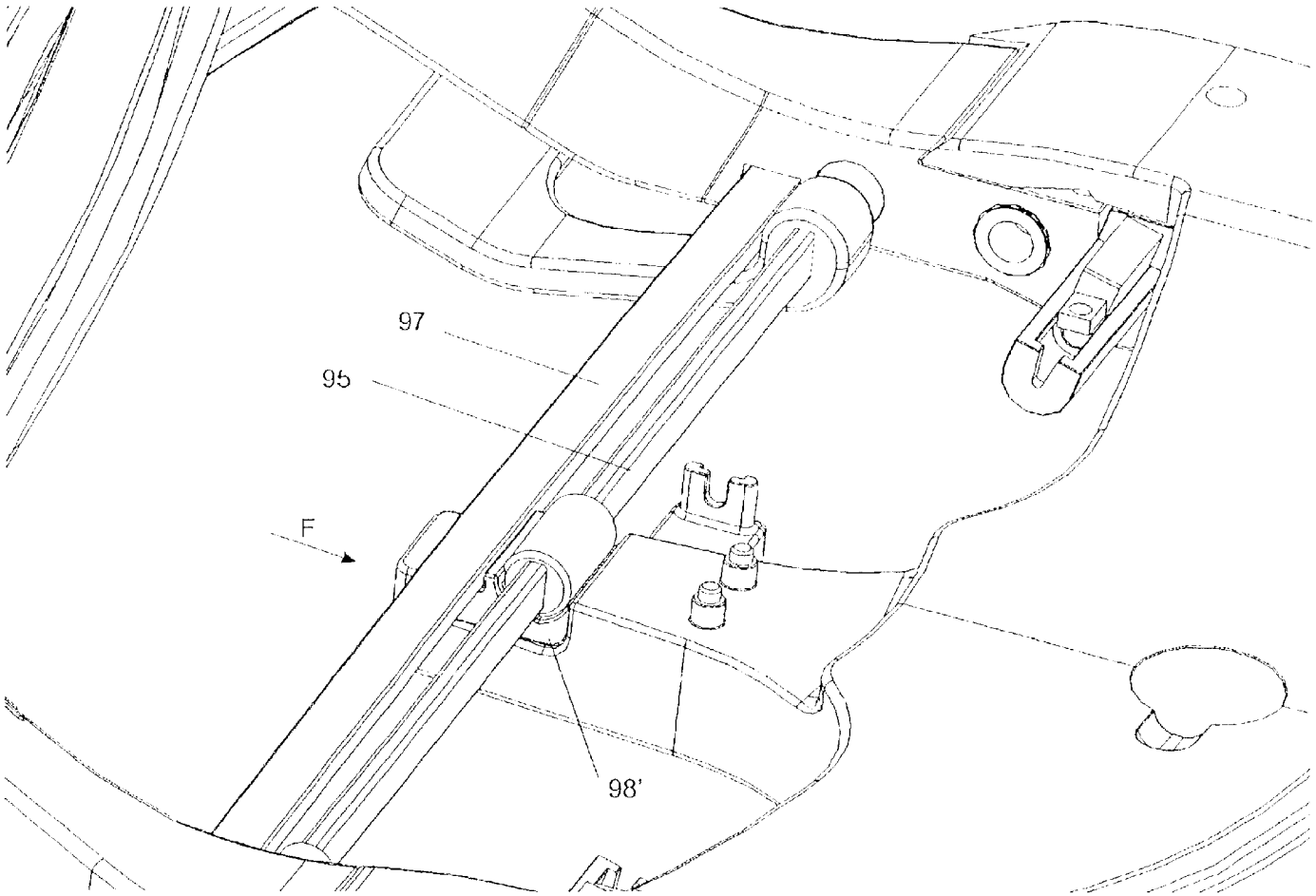
FIG. 22 is a perspective view similar to FIG. 18 with the first recline spring in the third adoptable spring position.
Figure 24:
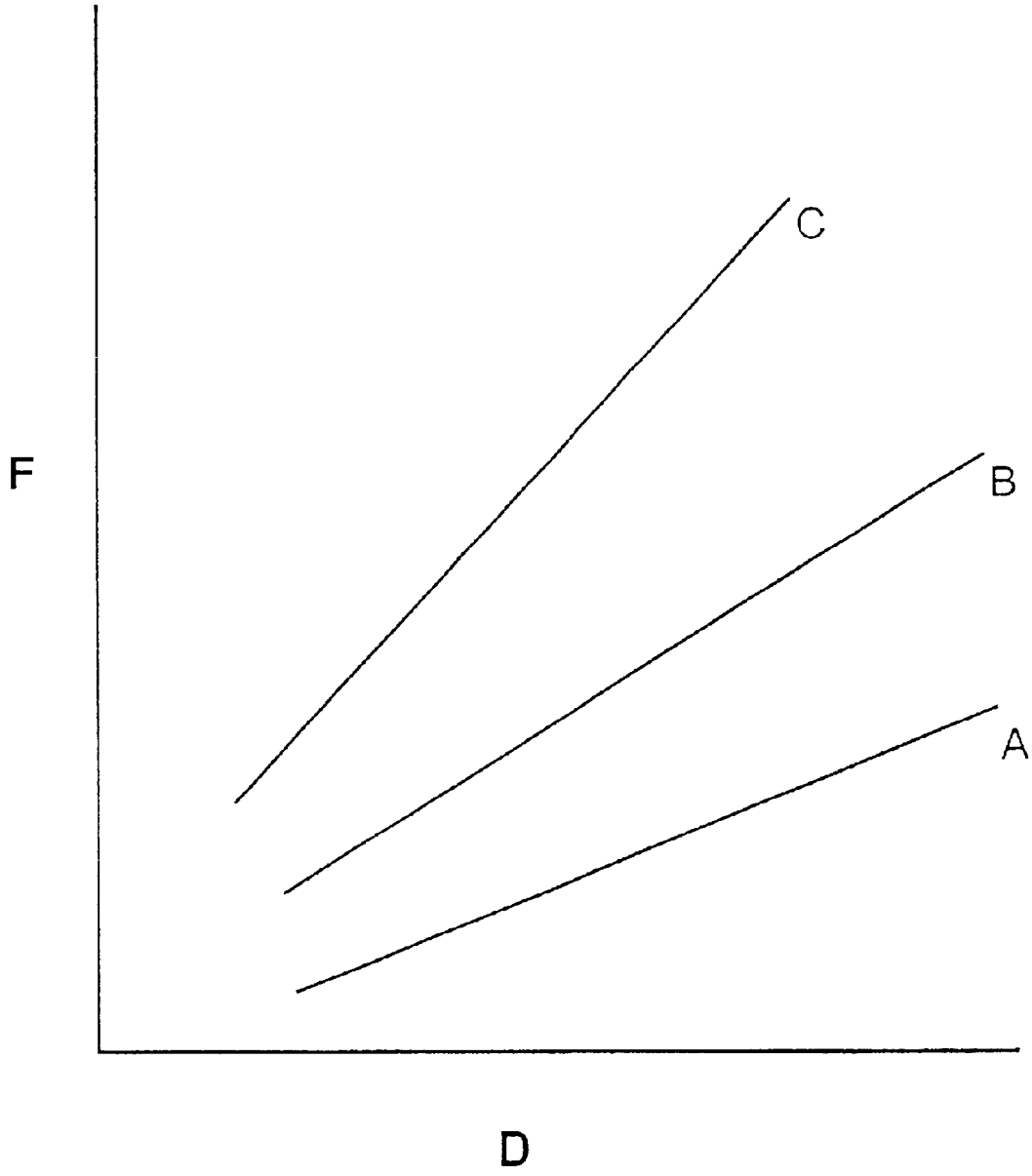
FIG. 24 is a graphical illustration of the change in spring constant as the first line spring of the second embodiment is rotated through the three adoptable spring positions illustrated in FIGS. 19 to 21.

The first recline spring 95 is adjustable to change the spring rate. This is achieved by rotating the first spring 95 about the longitudinal axis of the spring through the use of paddle 99*c* which is fixed onto the spring bar portion 95*a*. It can be seen from the cross-sectional views shown in FIGS. 19 to 21 that the spring portion 95*a* has a thickness and a width dimension, the width dimension being greater than the thickness dimension. In FIG. 19, the spring 95 is oriented so that the width dimension is arranged substantially parallel to the bending axis. This represents the 'easy' spring position. In FIG. 20, the thickness dimension is arranged diagonally to the transverse bending axis. Such an arrangement will present a greater resistance to bending about the transverse axis. This accordingly represents the medium spring position. Furthermore, in FIG. 21, the width dimension is arranged transversely to the bending axis. Such an arrangement presents the greatest resistance to bending and is thus deemed the hard position for the first recline spring 95. The first recline spring 95 is thus adjustable through 90° to provide three adoptable spring positions at each of which the spring exhibits a different spring rate. This is visually depicted in FIG. 24 which illustrates graphically the change in net spring force over distance as the spring is adjusted between easy (A), medium (B) and hard (C). Furthermore, FIG. 18 illustrates the first spring 95 in the easy position whereas FIG. 22 illustrates the first spring 95 in the hard position.

Figure 23:
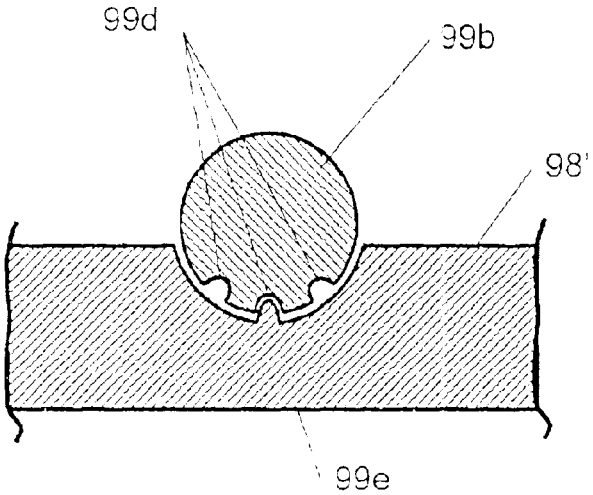
FIG. 23 is a diagrammatic view illustrating engagement between a part of the first recline spring and a part of the main transom.

Referring to FIG. 23, in order to locate the first recline spring 95 in the adoptable spring positions, locators are provided in the form of grooves 99*d* provided in the cylindrical boss 99*b*. A complementary rib 99*e* is disposed in the semi-cylindrical recess of the bearing block 98*a*. The rib 99*e* can engage with any one of the complementary grooves 99*d* to accordingly locate the first spring 95 in that position. It may be necessary to remove most of the loading on the first spring 95 in order to change the spring position. Accordingly, it may be necessary to bring the back portion to the forward active position to achieve this.

Figure 25:
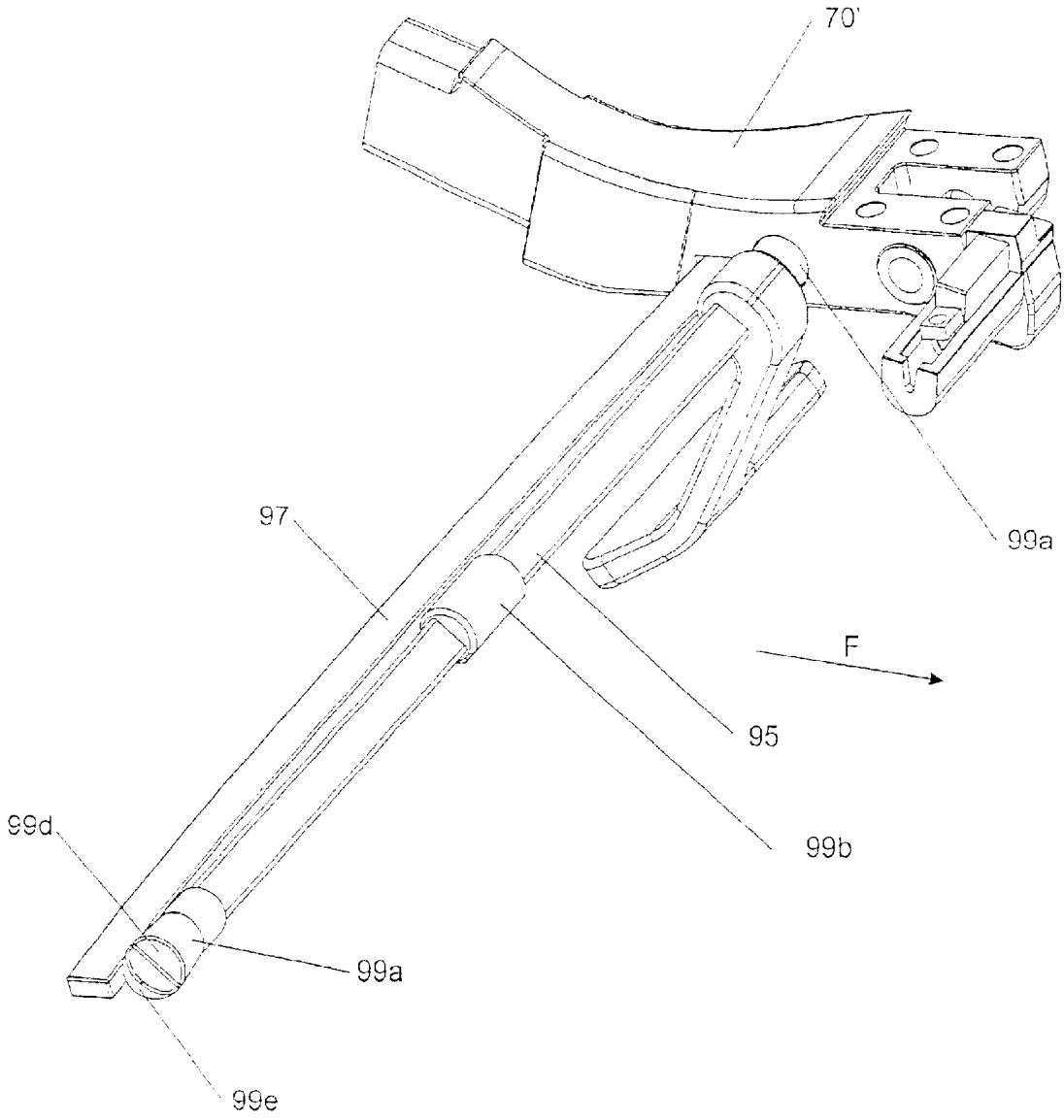
FIG. 25 is a more detailed view of the assembly as in FIG. 18 and 16, with additional parts removed for clarity.
Figure 26:
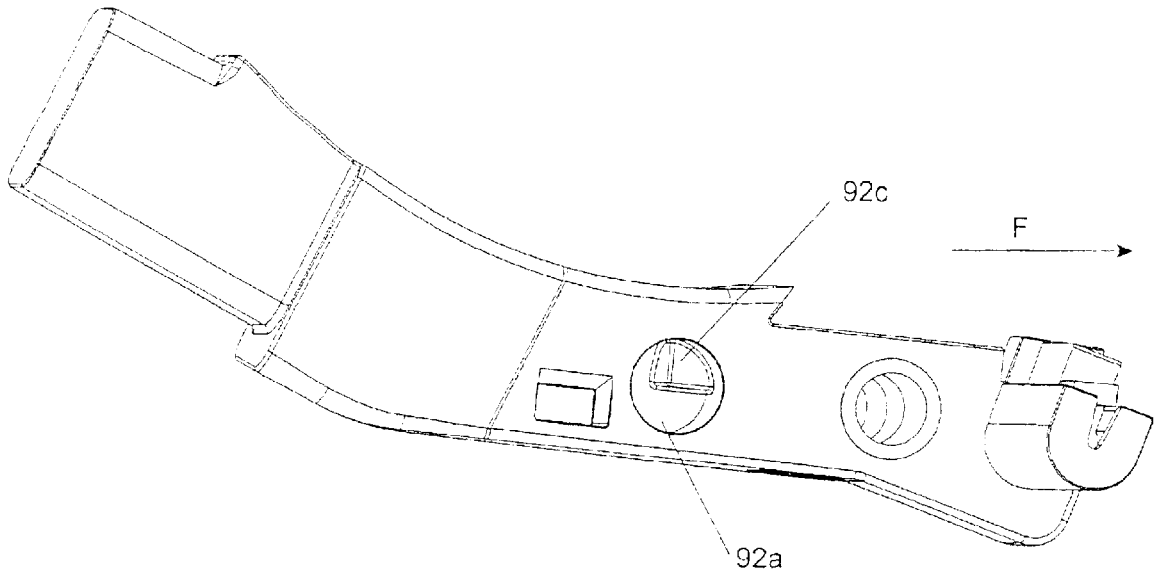
FIG. 26 is a further perspective view of the modified form of the back extension arm 70' of FIG. 13, shown from another angle.

FIG. 25 illustrates in greater detail the form of the cylindrical bosses 99*a* on the first spring 95. The end of each boss is cut away to define a semi-circular rebate 99*d* thereby defining a diametrical abutment face 99*e*. As can be seen in FIG. 26, the end of bore 92*a* is provided with a projecting quadrant 92*c*. With the boss 99*a* assembled in the bore 92*a*, the quadrant 92*c* projects into the semi-circular rebate 99*d*. The spring 95 is rotatable through 90° between a first rotatable limit where one face of the quadrant 92*c* abuts against one half of the diametrical abutment face 99*e* and a second rotatable limit where the other face of the quadrant 92*c* abuts against the other half of the diametrical abutment face 99*e*. The interaction between the quadrant 92*c* and the diametrical abutment face 99*e* limits the rotation of the spring 95 to 90°. In FIG. 26, the two bores 92*a* and 92*b* are shown as formed directly in the sides of the back extension arms 70. It is also envisaged that a plastic insert could be fitted into the side of the arm 70 with the bores 92*a* and 92*b* formed in the insert.

Stiffness Adjustment of Peripheral Frame—First Embodiment

Figure 29:
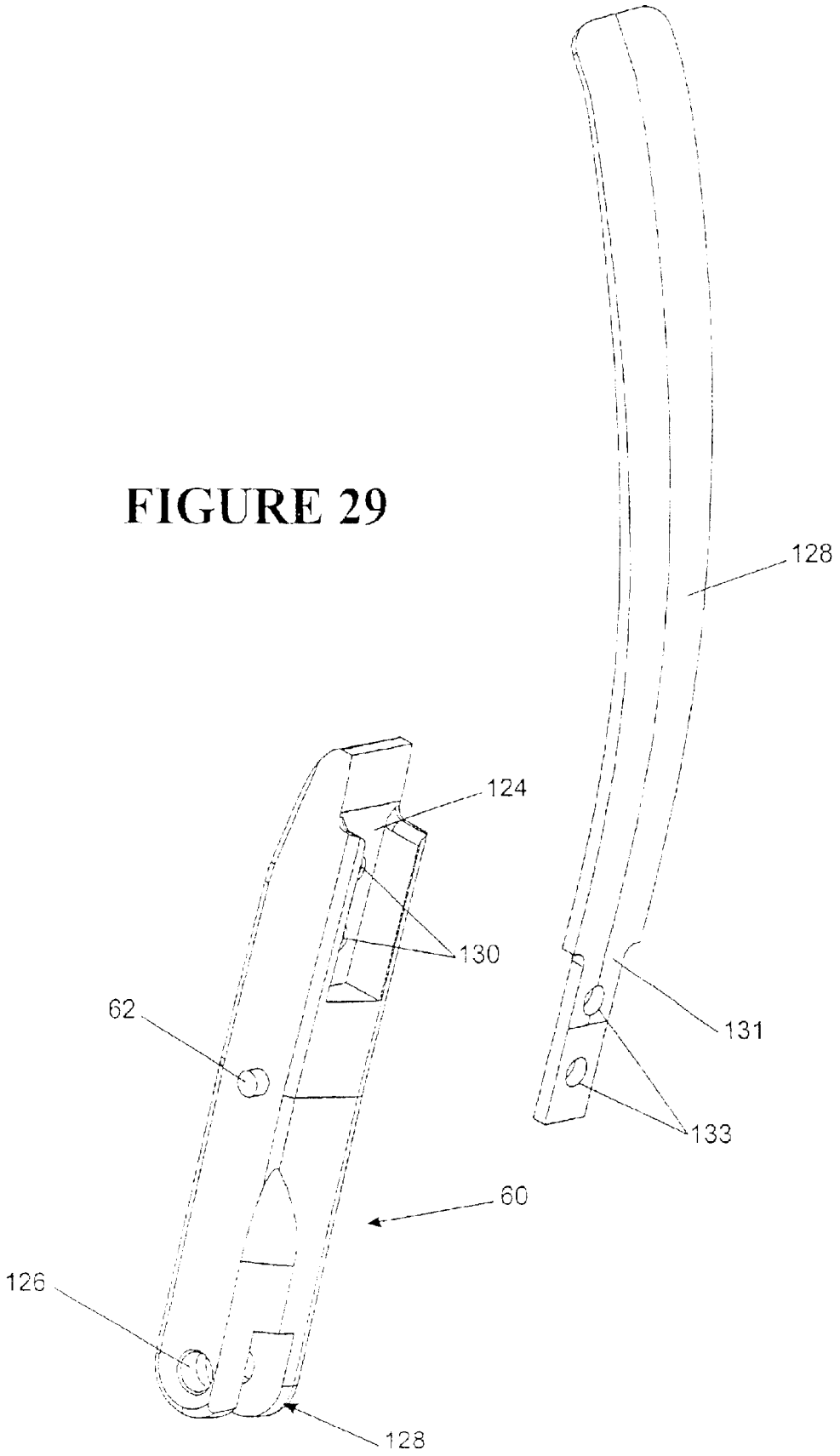
FIG. 29 is a perspective view illustrating in exploded fashion, a spring carrier and a leaf spring as used in the first embodiment.

FIG. 27 illustrates a further exploded view of parts assembled with the peripheral frame 34. As described previously, a back attach casting 48 is fixed to the back of the peripheral frame 34. The back attach casting 48 has two upright channels 64 arranged at either end, each defined by opposed walls 54. The opposed walls 54 have aligned slots 56 arranged therein for receipt of pins 62 provided on a spring carrier 60. The specific form of the spring carrier 60 is illustrated more clearly in FIG. 29. The spring carrier 60 is in the form of an elongate member which is approximately square or rectangular in cross section with the pins 62 being arranged on opposite sides. One end of the member is provided with a rebate 124. The other end of the spring carrier is forked for pivotal connection with another linkage as will subsequently be explained. The forked end has aligned apertures 126.

The rebate 124 has spaced threaded bores 130 provided therein. A leaf spring 128 has a lower end 131 shaped to be received within the rebate 124. The lower end 131 has two spaced apertures 133 provided therein. These apertures 133 align with the threaded bores 130 provided on the spring carrier so that the leaf spring 128 may be securely fastened to the spring carrier 60. From the lower end 131 in the upwards direction, the leaf spring 128 gradually increases in width with a slight tapering in thickness, although overall the leaf spring 128 is of generally elongate configuration as shown. The leaf spring 128 is constructed from high tensile spring steel.

As can be seen in FIG. 27, there are two spring carriers provided on opposite sides of the back portion, each received within a respective one of the channels 64 and mounted for pivotal movement about an axis defined through the bases of the aligned slots 56.

FIG. 28 illustrates the assembled combination whereby each of the leaf springs lie against the back of the peripheral frame 34 in a respective channel 44. As already described the peripheral frame 34 has a degree of flexibility. By rotating the spring carrier about pins 62 so that the forked end 125 moves rearwardly, the leaf spring 128 will be caused to act against the lower portion of the peripheral frame thereby increasing its stiffness against rearward flexing. The two spring carriers act in unison in a manner which will be described in connection with FIGS. 30 to 34. The stiffness of the lower portion of the peripheral frame 34 can thereby be adjusted by adjustment of the position of the spring carrier 60. Further, the channels 64 in which each of the spring carriers 60 are received are closed rearwardly by a rear wall 135 of the back attach casting 48. The rear wall 135 defines a stop against which the forked ends 125 of the spring carriers engage, thereby defining the maximum rotation of the spring carrier 60 and thus the maximum stiffness which can be imparted by the leaf spring 128 to the peripheral frame 34.

Figure 30:
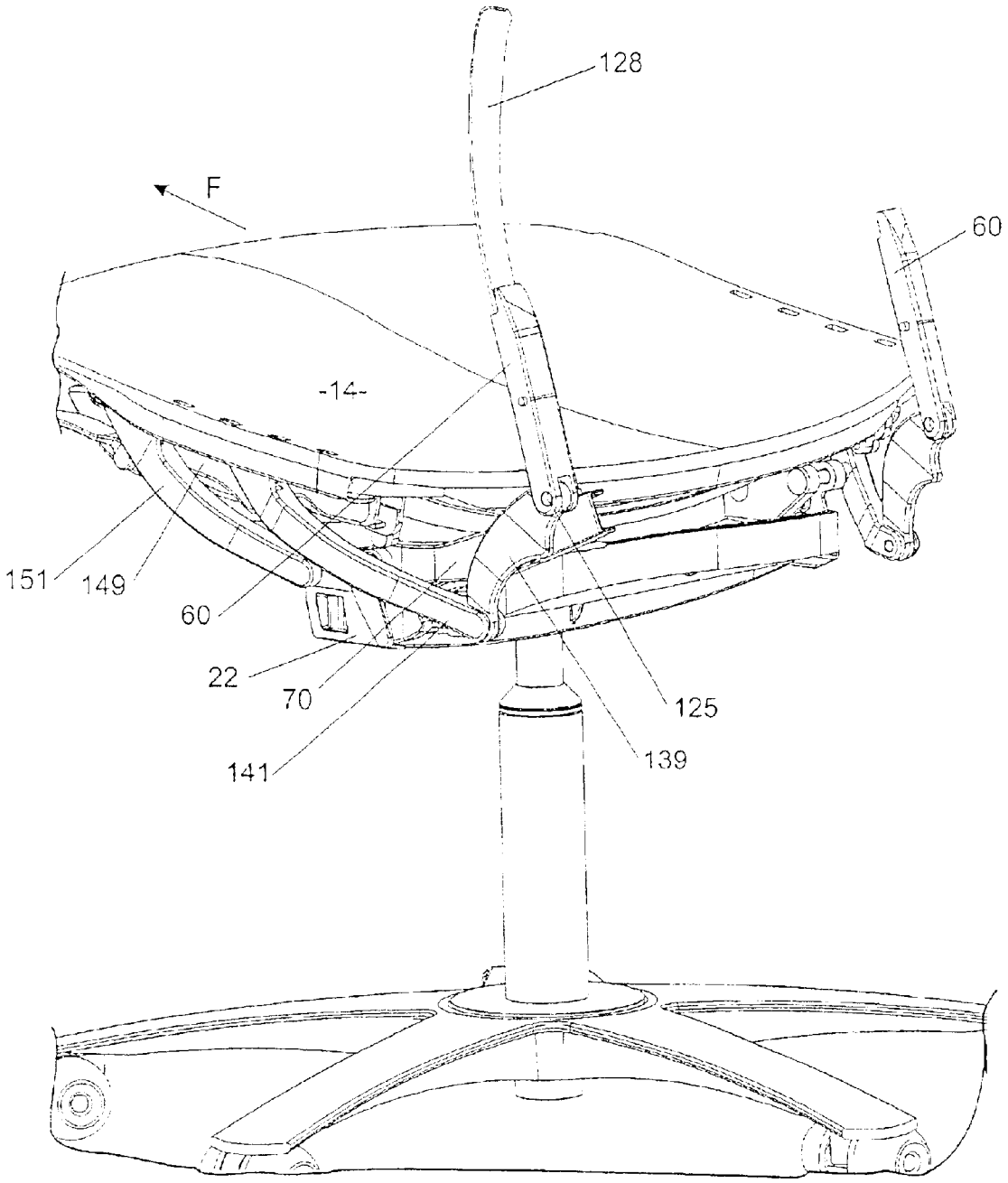
FIG. 30 is a perspective view of the chair of the first embodiment from the side rear, with certain parts removed for clarity.
Figure 31:
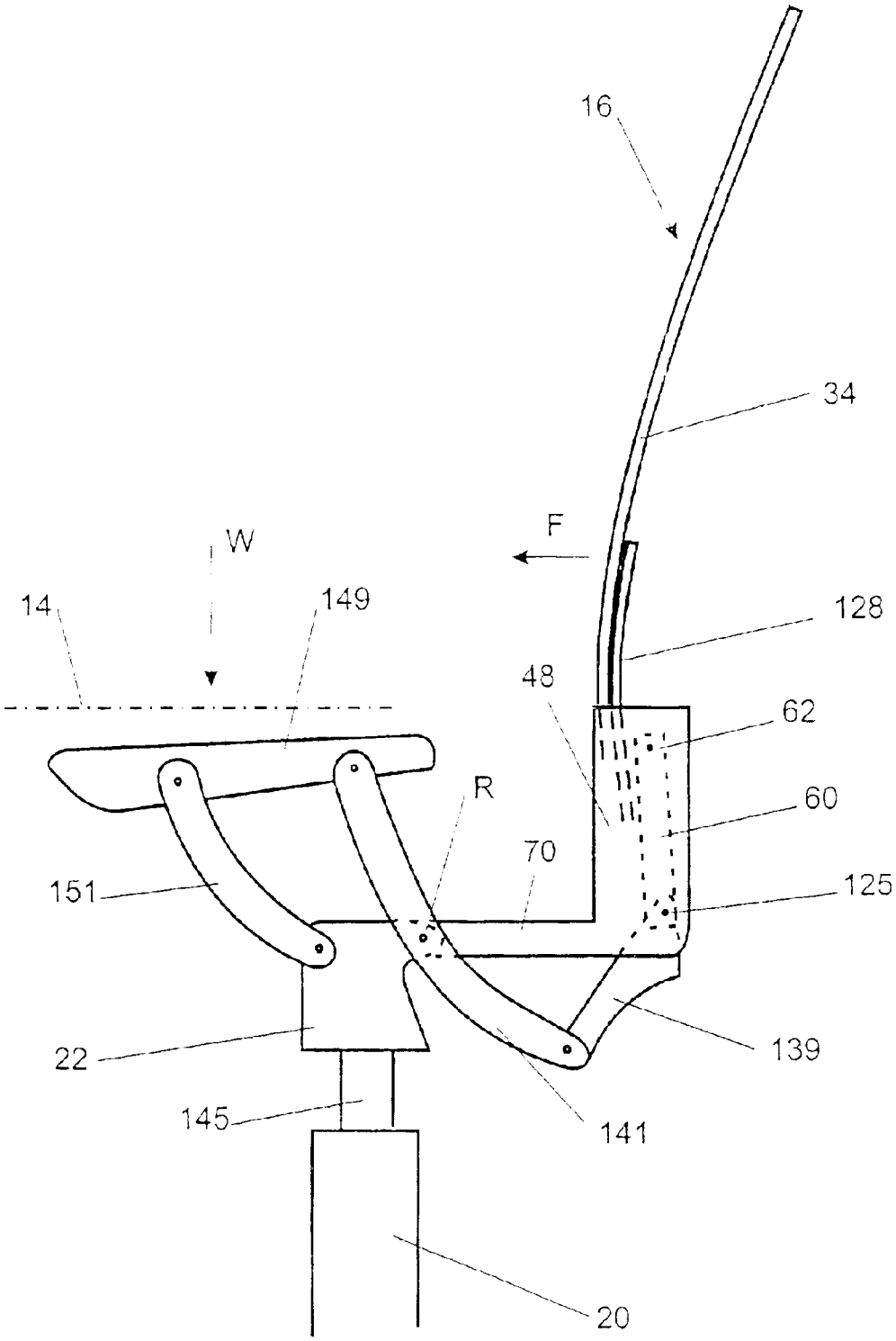
FIG. 31 is a schematic view of the main elements of the recline mechanism of the chair of the first embodiment.

FIG. 30 illustrates the main elements of the recline mechanism. The back attach casting 48 has been removed for clarity, together with the right back extension arm 70. The left back extension arm 70 is shown in position pivotally connected to the main transom 22. The forked end 125 of each spring carrier 60 is connected to a push link 139. Reverting to FIG. 3, it can be seen that the lower portion of the peripheral frame 34 has an access opening 143 to enable the push link 139 to engage with the forked end 125 of the spring carrier 60 disposed within the assembled back attach casting 48. The forward end of the push link 139 is connected to a drive link 141 (see which is one element of a four bar linkage which will be understood more fully from a consideration of the schematic illustration of FIG. 31. FIG. 31 illustrates only one four bar linkage and it will be apparent to the reader that two such four bar linkages are provided, one on each side of the chair 10. The drive link 141 extends at an inclined upwards angle from its connection with push link 139. The drive link 141 is curved along its length with the centre of the curve being disposed rearwardly and upwardly. The drive link 141 is mainly of rectangular cross section.

The drive link 141 is pivotally connected at an intermediate location along its length to the main transom 22 for pivoting motion about the recline axis R. Specifically, the drive link 141 is pivotally connected to lie adjacent to the outer one of the opposed supporting webs 78 of the main transom 22. A common pivot pin (not shown) interconnects both of the opposed supporting webs 78, the back attach arm 70 through aperture 75, and the drive link 141.

The main transom 22 forms another element of the four bar linkage. As has already been explained, the main transom 22 is centrally mounted to the supporting frame at the top of the central support column 20 which incorporates a height adjustable pneumatic spring 145. The height adjustment 145 is selectively operable by the chair occupant. However, the main transom 22 is normally stationary relative to the supporting frame.

The seat portion 14 is slidably mounted to a seat guide 149 in a manner which will be described more fully in connection with FIGS. 55 to 60. The seat guide 149 thereby forms another element of the four bar linkage. The upper end of the drive link 141 is pivotally connected to the seat guide 149. Another link in the form of a front support link 151 interconnects the seat guide 149 and the main transom 22. The front support link 151 is of generally rectangular cross section and, like the drive link 141 is curved along its length with the centre of curvature disposed upwardly and rearwardly.

Figure 32:
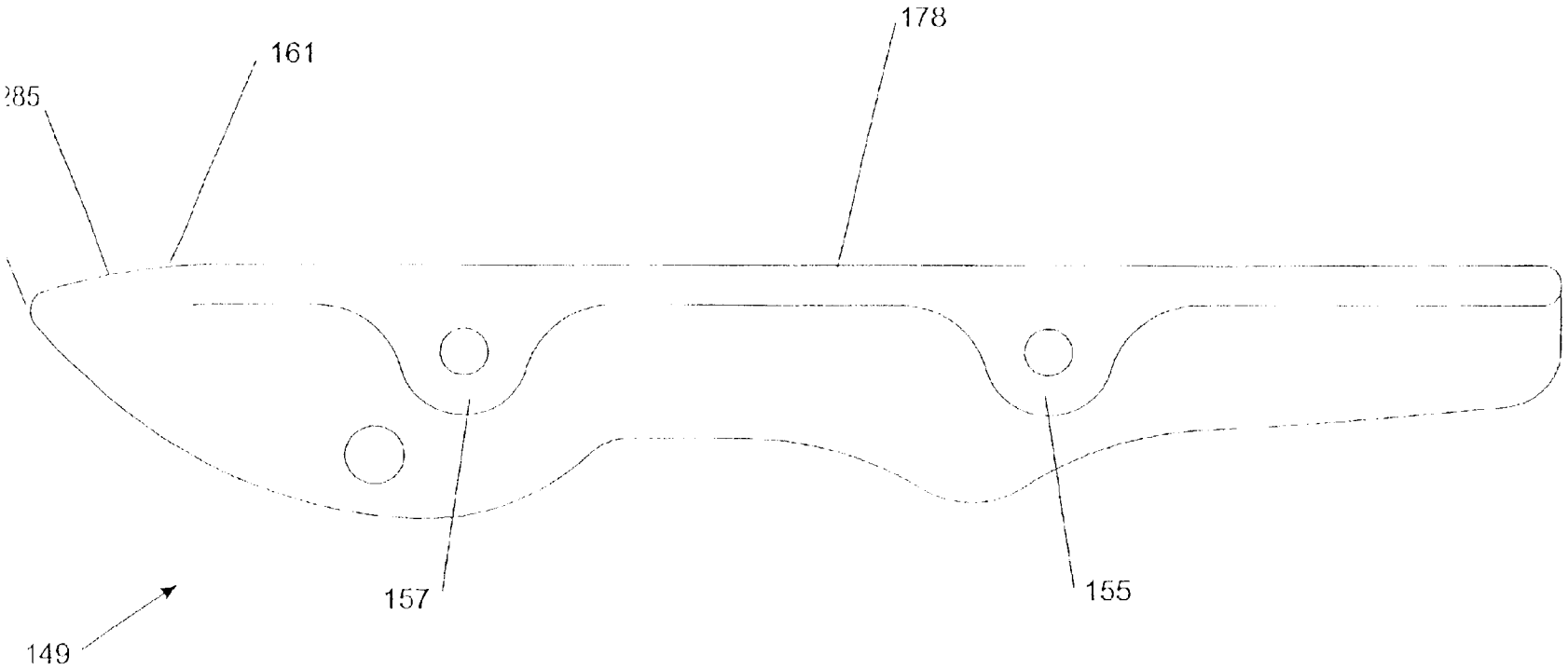
FIG. 32 is a side view of a seat guide, being one of the elements shown in FIG. 31.

From FIG. 30 it can be seen that both ends of the drive link 141 are forked. The lower end is forked to accommodate the lower end of the push link 139. The upper end of the drive link 141 is also forked. The seat guide also has a dependent lobe 155 as shown in FIG. 32. The forked upper ends of drive link 141 are disposed on each side of the lobe 155 and the inner fork is pivotally connected between the lobe 155 and the side wall of the seat guide 149. The outer fork is fanned in shape for aesthetic reasons and the pivotal connection does not extend therethrough. Likewise, the upper end of the front support link 141 is also forked with the inner fork being pivotally connected between a seat guide 149 and another lobe 157 (see FIG. 32), with the outer fork being of fanned shape. The lower end of the front support link 151 is pivotally connected on the outside of the outer one of the opposed supporting webs 78 (see FIG. 4) by means of a pin (not shown) extending through aligned forward apertures 153 on the forward end of the opposed supporting webs 78. It will be appreciated that the connection of the lower end of the drive link 141 and the front support link 151 are blind connections as shown for aesthetic reasons.

Operation of Recline Mechanism

The operation of the recline mechanism will now be explained in connection with FIG. 31. Reference is only made to the four bar linkage elements on one side of the chair. The reader will appreciate that the elements are duplicated on the other side of the chair. As already stated above, the back portion 16 is reclinable about recline axis R. First and second recline springs bias the seat portion 16 into the forward active position. In the unoccupied state, the arrangement of the elements of the four bar linkage is determined by the spring tension of leaf spring 128. The natural resiliency of By the leaf spring 128 will tend to straighten the leaf spring 128 thereby urging the spring carrier 60 in a clockwise direction about the pins 62. This determines the position of the push link in the unoccupied state of the chair. With no force exerted on the seat guide 149, the elements of the four bar linkage will be held in an unoccupied position on account of the natural resiliency of the spring 128 acting through push link 139.

When a user bears weight W against the seat portion 14, this will be taken up by the seat guide 149 whereby the drive link 141 will be driven to rotate in an anticlockwise direction around recline axis R. This will cause the push link 139 to move generally upwardly and rearwardly thereby rotating spring carrier 60 anticlockwise about pivot pins 62. The lower portion of the peripheral frame 34 is rigidly held within back attach casting 48 which is stopped in its forward active position as already explained. With anticlockwise rotation of the spring carrier 60, the leaf spring 128 will be caused to bend with the upper part pushing against the back of the peripheral frame 34. Depending upon the flexibility of the peripheral frame 34, the occupant's weight will be taken up by a spring tension in leaf spring 128 as it flexes against the back of the peripheral frame 34. This has the effect of stiffening the back portion against rearward flexing. It will be appreciated that the tension imparted to leaf spring 128 will depend upon the weight of the user W applied to the seat portion 14. The greater the weight W, the greater the tension taken up by the leaf spring 128 and thus the greater the degree of stiffness imparted to the leaf spring 128 to resist rearward flexing of the peripheral frame 34. Accordingly, the stiffness of the peripheral frame 34 will be adjusted according to the weight W of the chair occupant.

Figure 33:
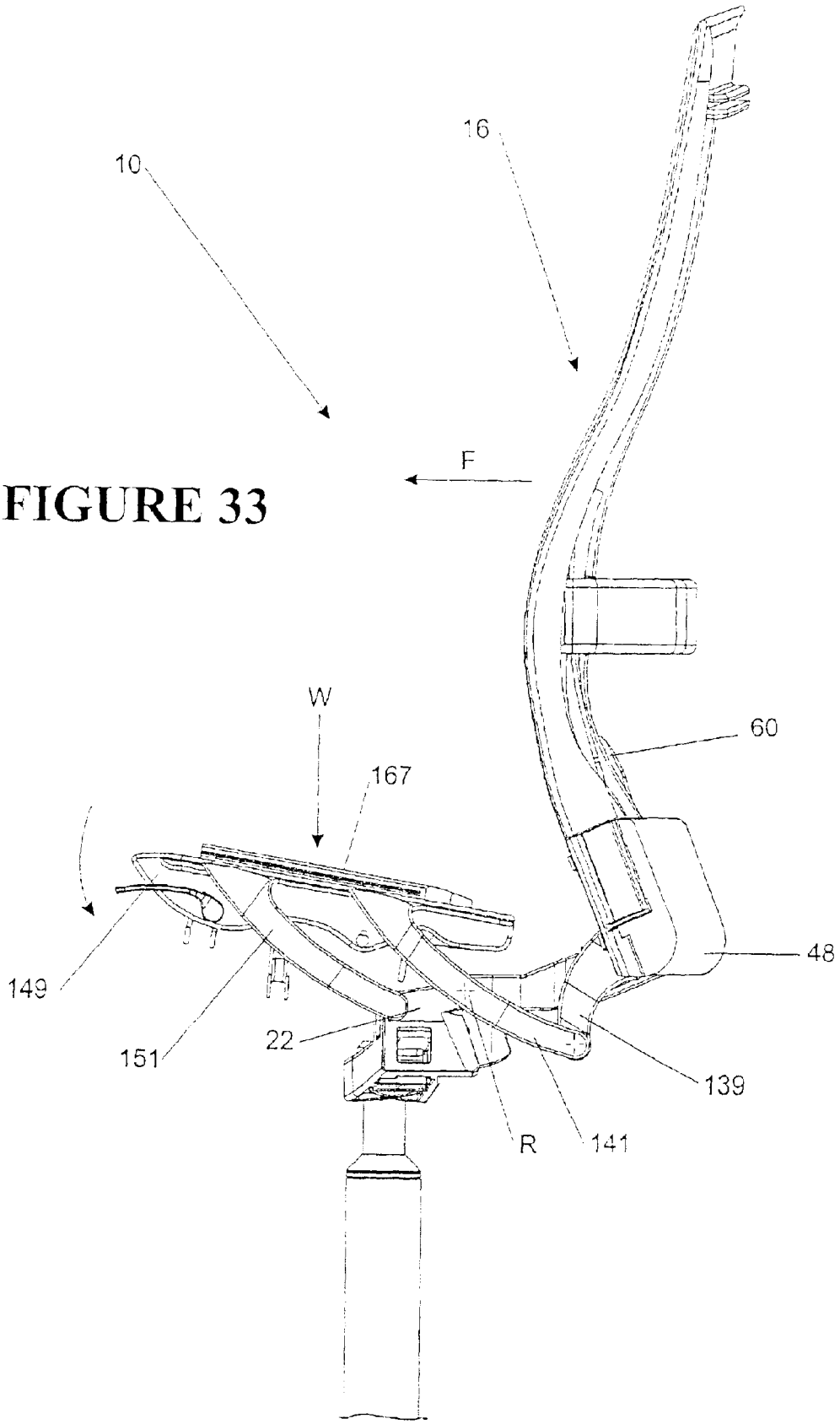
FIG. 33 is a side view of the chair of the first embodiment illustrated in FIG. 1, illustrating the arrangement of the main links with occupant weight applied to the seat portion.
Figure 34:
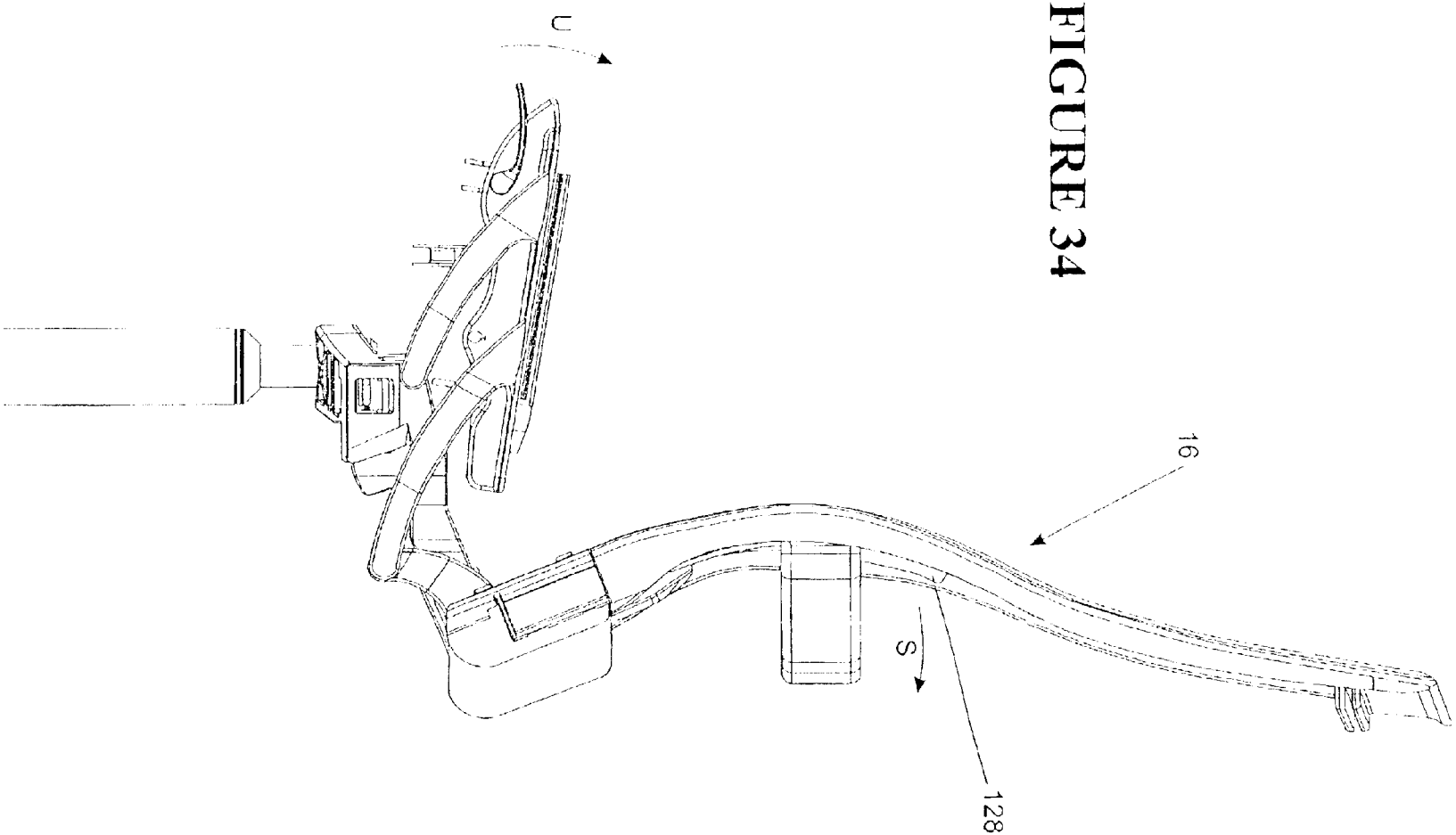
FIG. 34 is a side view as per FIG. 33, except with the occupant weight removed from the seat portion.

If the occupant's weight W exceeds a predetermined level then the leaf spring 128 will be tensioned to a point where the forked end 125 of the spring carrier 60 engages against the rear wall 135 of the back attach casting 48. This provides a limit to the amount of tension imparted to the leaf spring 128. The limit is reached at about 80 kg. FIG. 33 illustrates the downward motion of the seat guide 149 as the user applies weight W. When the occupant alights from the chair, the seat portion 14 will move upwardly as indicated by arrow U in FIG. 34.

As already mentioned, the gentle serpentine shape of the peripheral frame 34 is designed to correspond with the shape of the occupant's spine for the comfort of the occupant. With the flexing action of the back portion, the ergonomics of the chair are further enhanced because this enables the occupant to exercise his spine. The general health of a person's spine is enhanced by movement. The stiffness of the back portion in rearward flexing is adjusted according to the occupant's weight. Therefore, within a certain range, the ease of rearward flexing will correlate to the weight of the occupant. Therefore, a light person will be able to obtain full benefit from the rearward flexing action by applying a light force against the peripheral frame. Also, a heavier person will encounter a greater resistance to flexing, ensuring that the peripheral frame is not too floppy for a large person. The chair is designed so that the occupant will be able to obtain deflection through flexing in the range of 80 mm to 120 mm.

Figure 35:
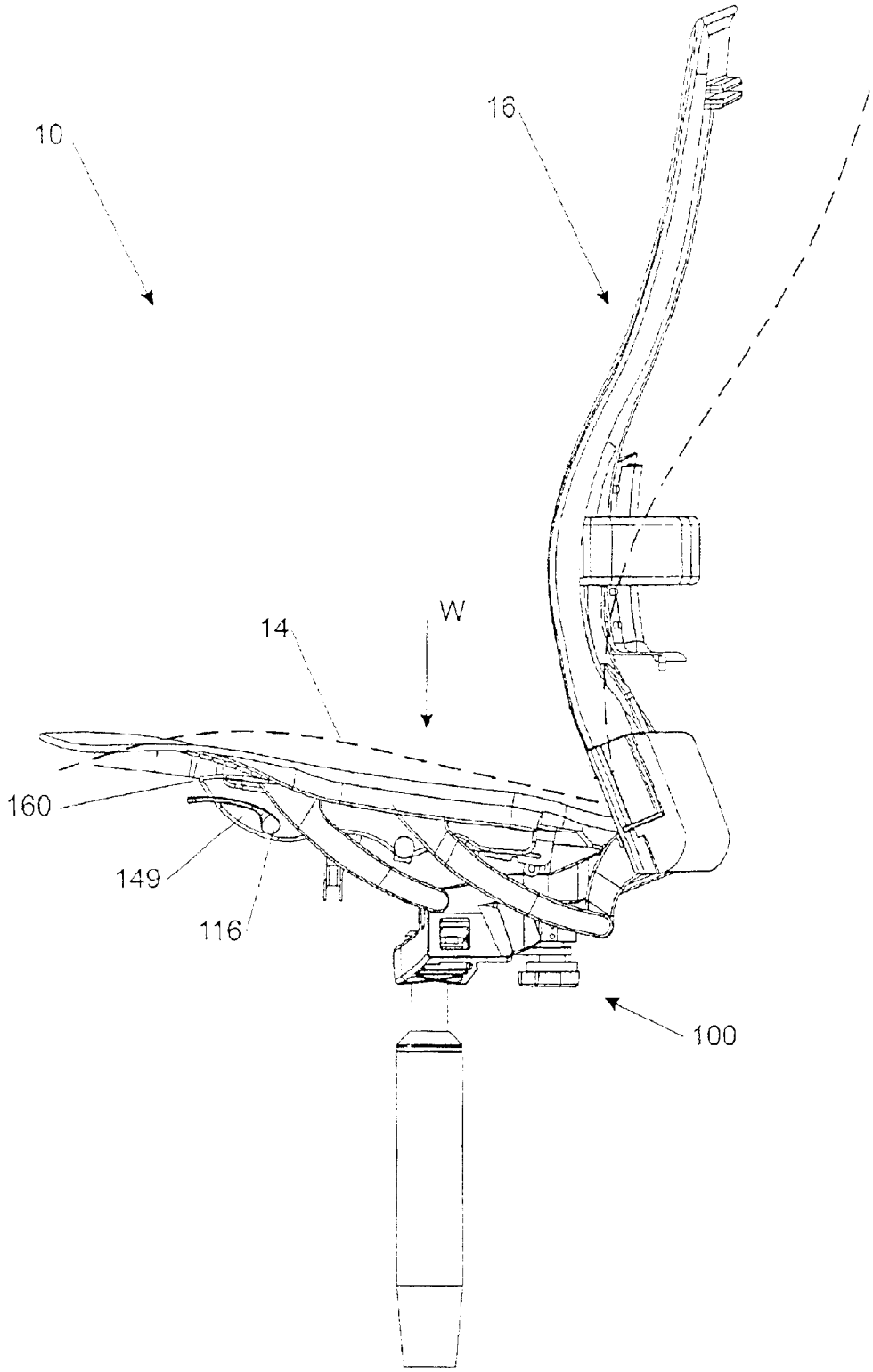
FIG. 35 is a side view of the chair of FIG. 1, illustrating the recline action of the chair.

FIG. 35 illustrates the reclining action of the chair 10. When the user applies their weight to the seat portion 14, the seat portion will move downwardly as already described and adopt a position just above the seat guide 149 as illustrated by the solid lines. Once a user has applied their weight to the seat portion 14, the leaf spring 128 takes up a corresponding amount of spring tension whereupon the spring carrier 60 and the push link 139 will adopt a more or less fixed position relative to the back attach casting 48. Therefore, as the user leans against the back portion 16, the back attach casting 48, spring carrier 60, push link 139 act in unison driving the drive arm 141 to rotate in a clockwise direction through push link 139. The arrangement of the four bar linkage is such that the seat guide 149 will adopt a position with a net increase in height and with an increase in rearward tilt angle compared to the occupied position of the seat guide 149 before recline. In practice, there may be some slight shifting between the leaf spring 128, the spring carrier 60 and the push link 139.

Since the seat portion 14 undergoes a net increase in height with the rearward recline action, the occupant's weight W will be counteracting the recline action, together with the bias applied by the first and second recline springs 94, 96. The weight of the occupant W will therefore be a variable factor in the ease with which the back portion 16 reclines. If the adjustable second recline spring 96 is set at a constant level then a heavier person will encounter a greater resistance to reclining action than a lighter person. This establishes an automatic correlation between the weight of the person and the resistance to the reclining action. For a large proportion of people who fit within physical norms this automatic adjustment may be sufficient. However, people come in all different shapes and sizes and therefore additional adjustment is required through the use of the clamping adjustment as explained previously. For example, a very tall, light person may obtain leverage through their height which makes the back portion 16 fall back too easily against their low weight W.

The net increase in height also has the advantage of raising the occupant during recline so that the eye level of the chair occupant can be maintained even though he is undergoing a reclining action.

Once the chair is fully reclined (as determined by the first abutment surface engaging against second abutment surface 90), the peripheral frame will still be able to flex under additional force applied by the chair occupant. As already mentioned, it is considered that the peripheral frame will be capable of undergoing deflection in the range of 80 mm to 120 mm. During the recline action, it is considered that the weight of the user against the back portion will bring about a deflection of up to 20 mm. Therefore, once the recline limit is reached, the occupant still has further deflection available through flexing of the peripheral frame in the range of 60 to 100 mm.

As explained subsequently in connection with FIGS. 55 to 60, the seat portion 14 is only supported by the seat guide 149 at a rear portion thereof with a forward portion being unsupported. As shown in FIG. 32, a transition point 161 is disposed behind the forward edge 160 of the seat guide 149. The transition point 161 marks the boundary between the planar upper surface 178 of the seat guide 149 and a forwardly inclined lead surface 285. The seat portion 149 is foldable transversely at this location. The transition point 161 hence defines the division between the rearward portion and the forward portion of the seat portion 14. Since the seat portion 14 is slidable forwardly and rearwardly for seat depth adjustment as will be explained in connection with FIGS. 55 to 60, the division between rearward portion and forward portion of the seat will vary as a function of seat depth.

FIG. 35 illustrates the changing curvature of the back portion 16 and seat portion 14 in recline. The solid lines indicate the forward active position in the occupied configuration. The dotted lines illustrate the reclined position. As the back portion 16 reclines, the seat guide 149 attains a net increase in height and an increased rearward tilt. This effectively cups the occupant's derriere, negating any inclination to slide forwardly during the recline action. The seat portion 14 is also flexible and since the occupant's derriere is undergoing a net increase in height together with increased rearward tilt, a greater amount of weight from the occupant's legs will be brought to bear against the forward portion of the seat portion 14. Accordingly, the seat portion 14, will be allowed to fold transversely at the transition point 161 on the seat guide 149. To achieve maximum benefit from the cupping action, the occupant ought to adjust the seat depth so that with his derriere abutting the back portion, transition point 161 approximately corresponds to the gluteal fold of the occupant's derriere. Therefore, during recline, the occupant's derriere will be cupped between the rear portion of the seat portion 14 and a lower region of the back portion 16 while the forward portion of the seat drops forwardly under the weight of the occupant's legs. Locating the transverse fold at the gluteal fold of the occupant ensures that undesirable pressure will not be brought to bear against the back of the occupant's legs.

Modified Form of Back Portion—Second Embodiment

Figure 36:
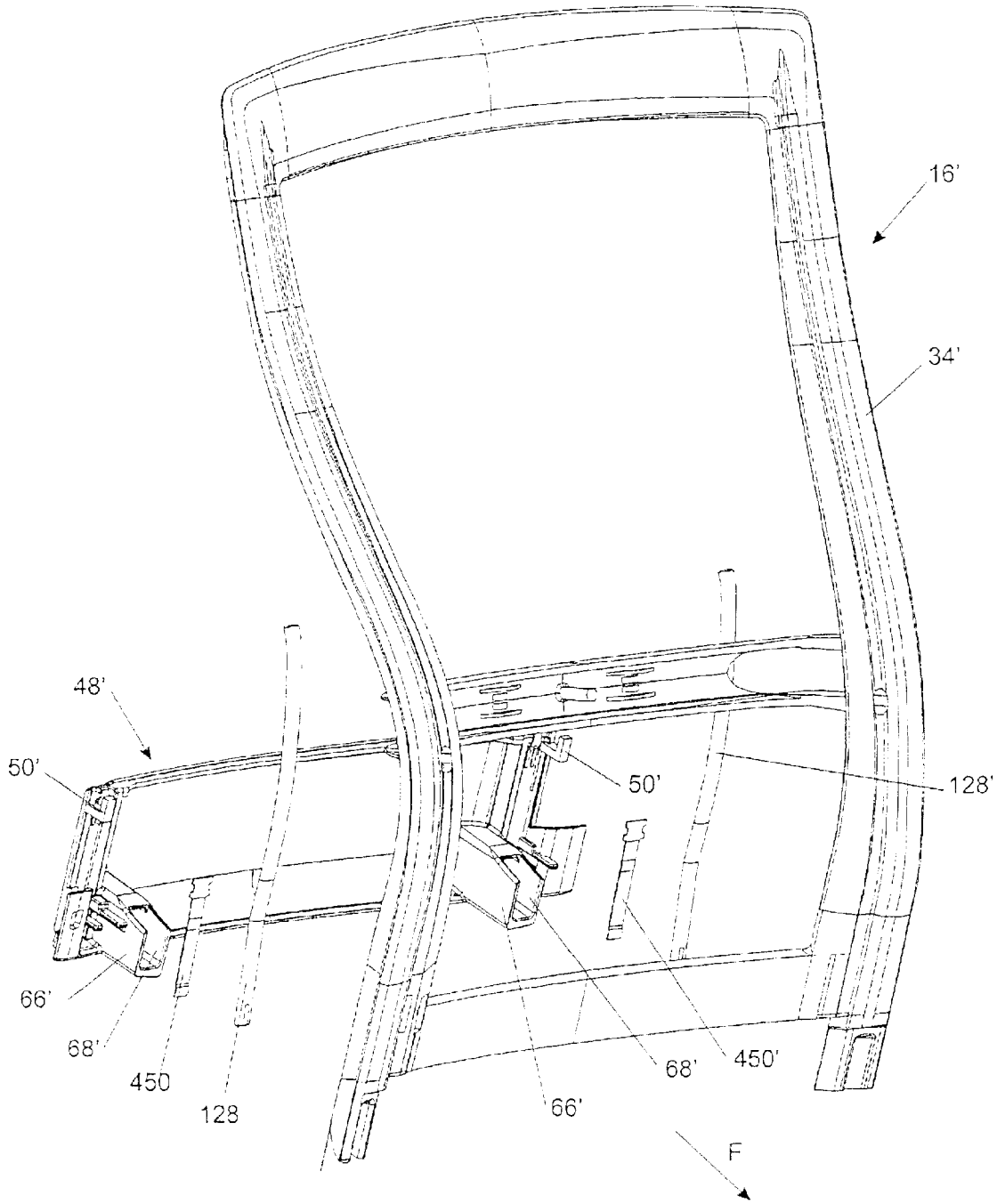
FIG. 36 is an exploded view of the parts making up the back portion according to the second preferred embodiment of the chair.

FIG. 36 illustrates in exploded fashion a modified form of the back portion 16'. As with the previous embodiment, the back portion 16' includes a flexible peripheral frame 34' which is connected to a back attached casting 48'. In this embodiment, the spring carriers have been obviated and instead there are two unitary leaf springs 128' which bear against the back of the peripheral frame 34'. Additionally, two supplementary springs 450 are also provided, the function of which will be explained.

Figure 39A:
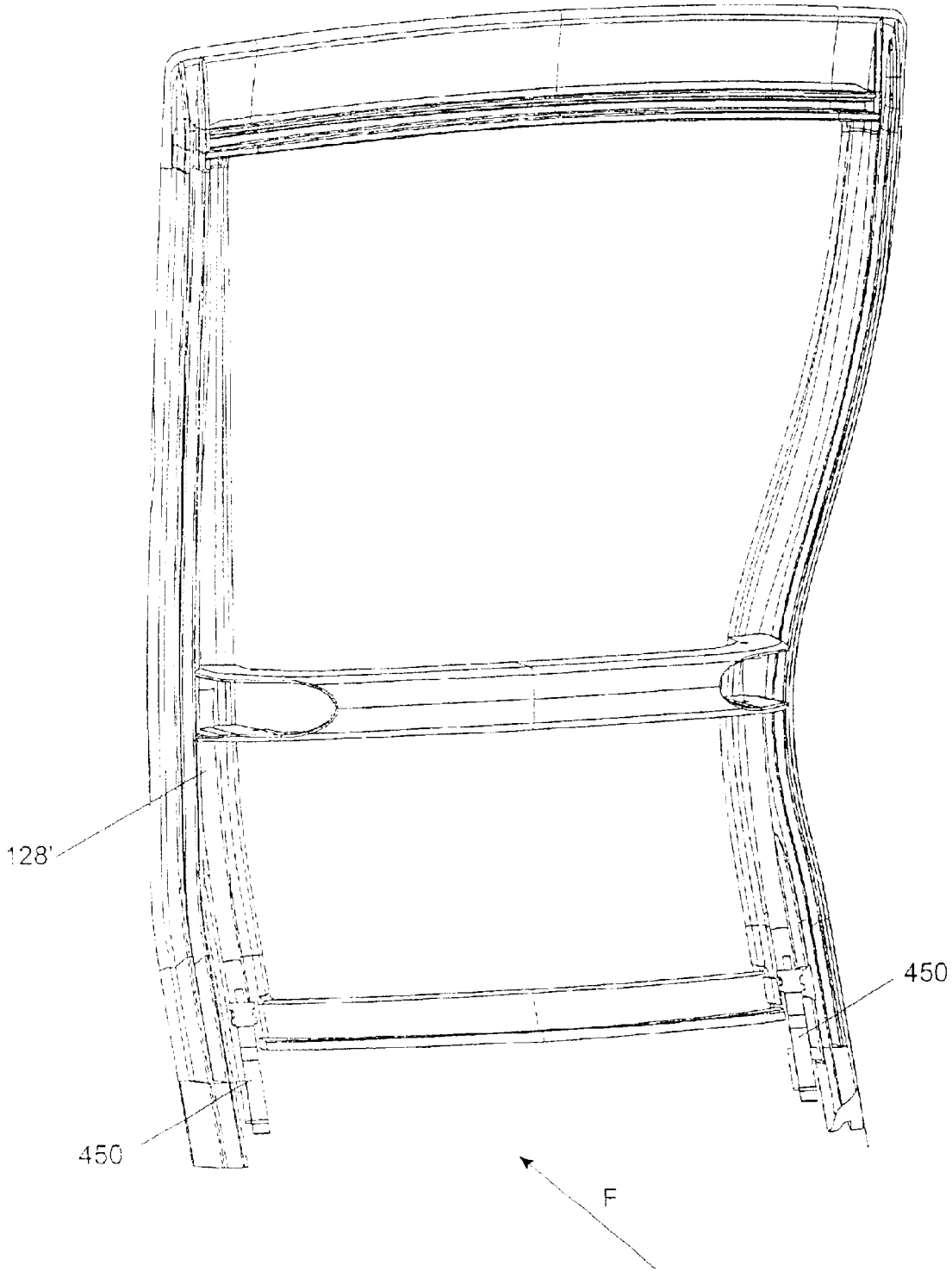
FIG. 39*a* is a rear perspective view of the assembled parts of FIG. 36.
Figure 39B:
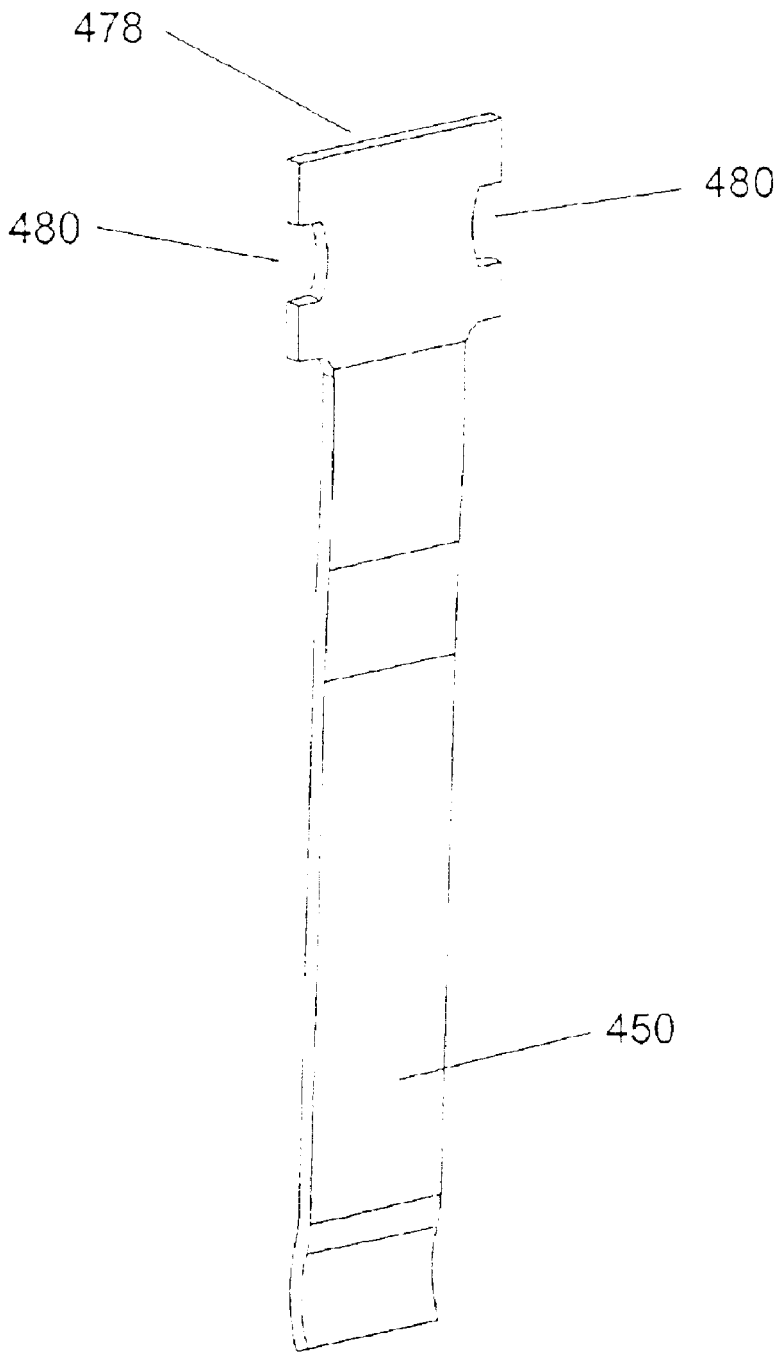
FIG. 39*b* is a perspective view of a supplementary spring forming part of the back portion of the chair.
Figure 39C:
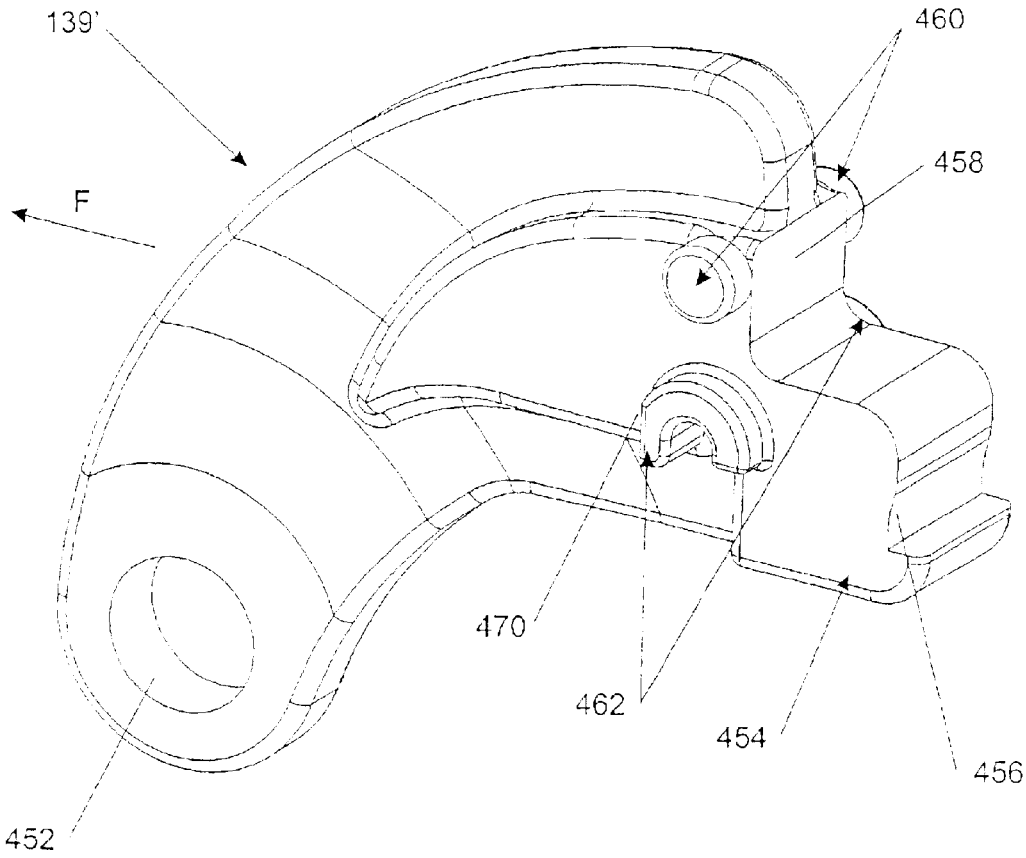
FIG. 39*c* is a perspective view of a push link forming part of the recline mechanism of the second embodiment.

FIG. 39*c* llustrates the modified form of the push link 139'. The push link is arcuate in configuration. At one end, the push link has an aperture 452 to which it can be pivotally connected to drive link 141' (see FIG. 41*a* and 41*b*). At the other end of push link 139' is a stepped region 454 having a first abutment face 456 and a second abutment face 458. Forwardly of the stepped region 454 is a first pair of gliders 460. Each glider of the pair 460 is disposed on opposite side faces of the push link 139'. Disposed directly below the first pair of gliders 460 is a second pair of gliders 462 disposed on opposite side faces of the push link 139'.

Figure 37:
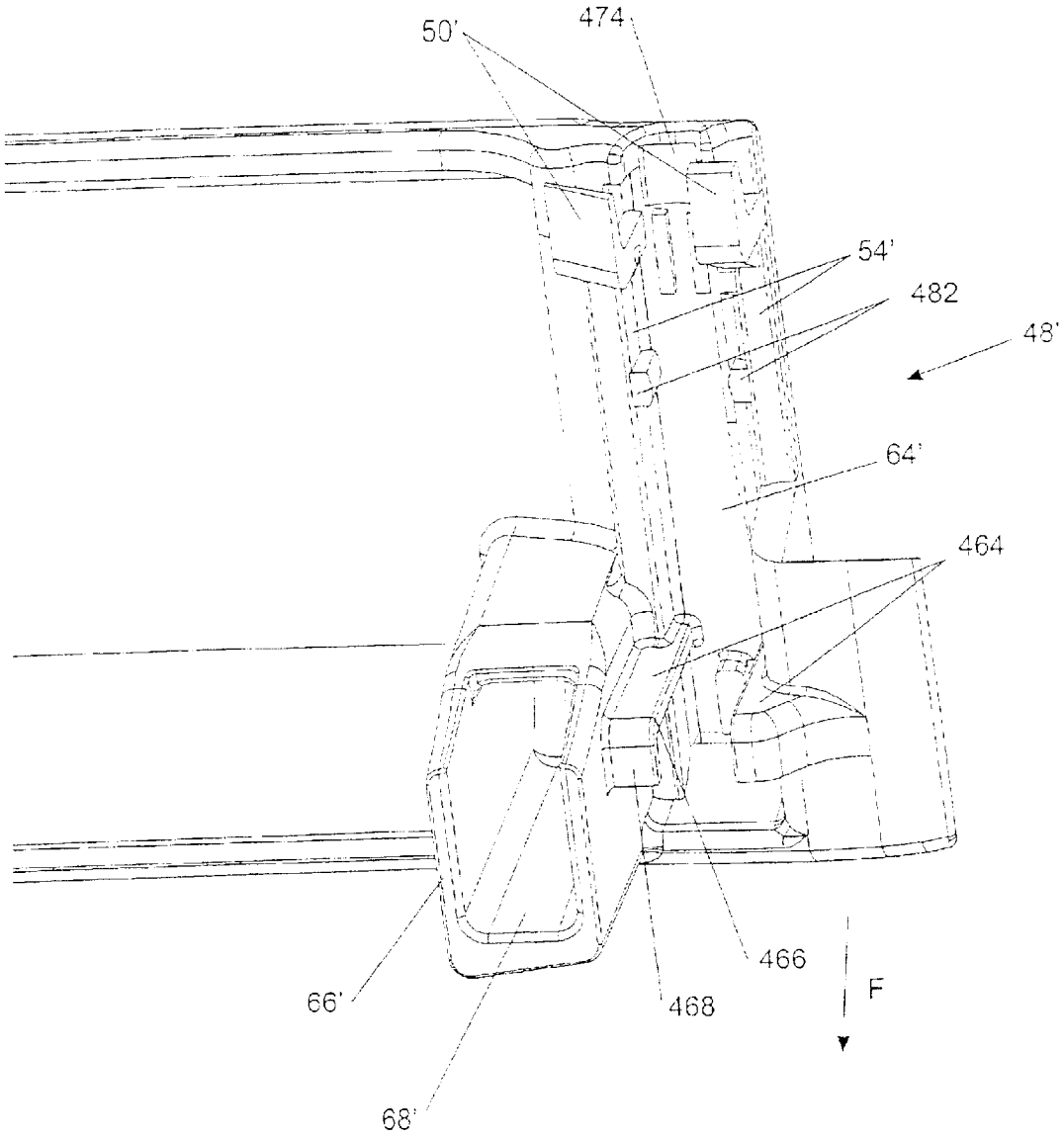
FIG. 37 is a front perspective view of a detail of the back attach casting forming part of the back portion of the chair according to the second preferred embodiment.
Figure 38:
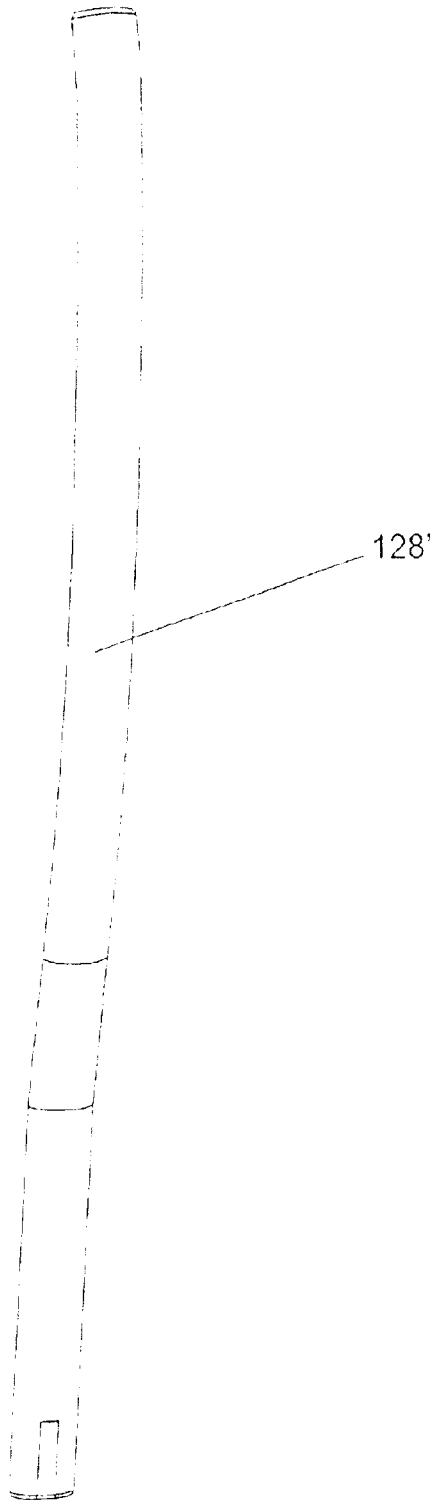
FIG. 38 is a perspective view of the leaf spring as used in the second embodiment.

Referring to FIG. 37, one side of the back attach casting 48' is shown in greater detail. The back attach casting 48' incorporates two pairs of sprigs 50' which engage with aligned apertures (not shown) in the peripheral frame 34' for assembly purposes. As with the previous embodiment, spaced walls 54' define a forwardly extending channel 64' in which the leaf spring 128' is housed in a manner which will be explained. The forwardly extending channel 64' includes two forwardly extending tracks 464 on opposite sides of the channel 64'. The tracks 464 each comprise a substantially horizontal ledge 466 which terminates in a downwardly extending flange 468 in the assembled configuration of the push link 139' and the back attach casting 48', the first pair of gliders 460 are disposed to glide along the top surface of the associated ledges 466 whereas the second pair of gliders 462 passes underneath the bottom surface of the associated ledges 466. As can be seen from FIG. 39*c,* each of the second pair of gliders 462 has a flat abutment surface 470 which abuts against the inside of the downwardly extending flange 468. This defines the forward limit in the sliding movement of the push link 139' relative to the tracks 464.

Figure 39D:
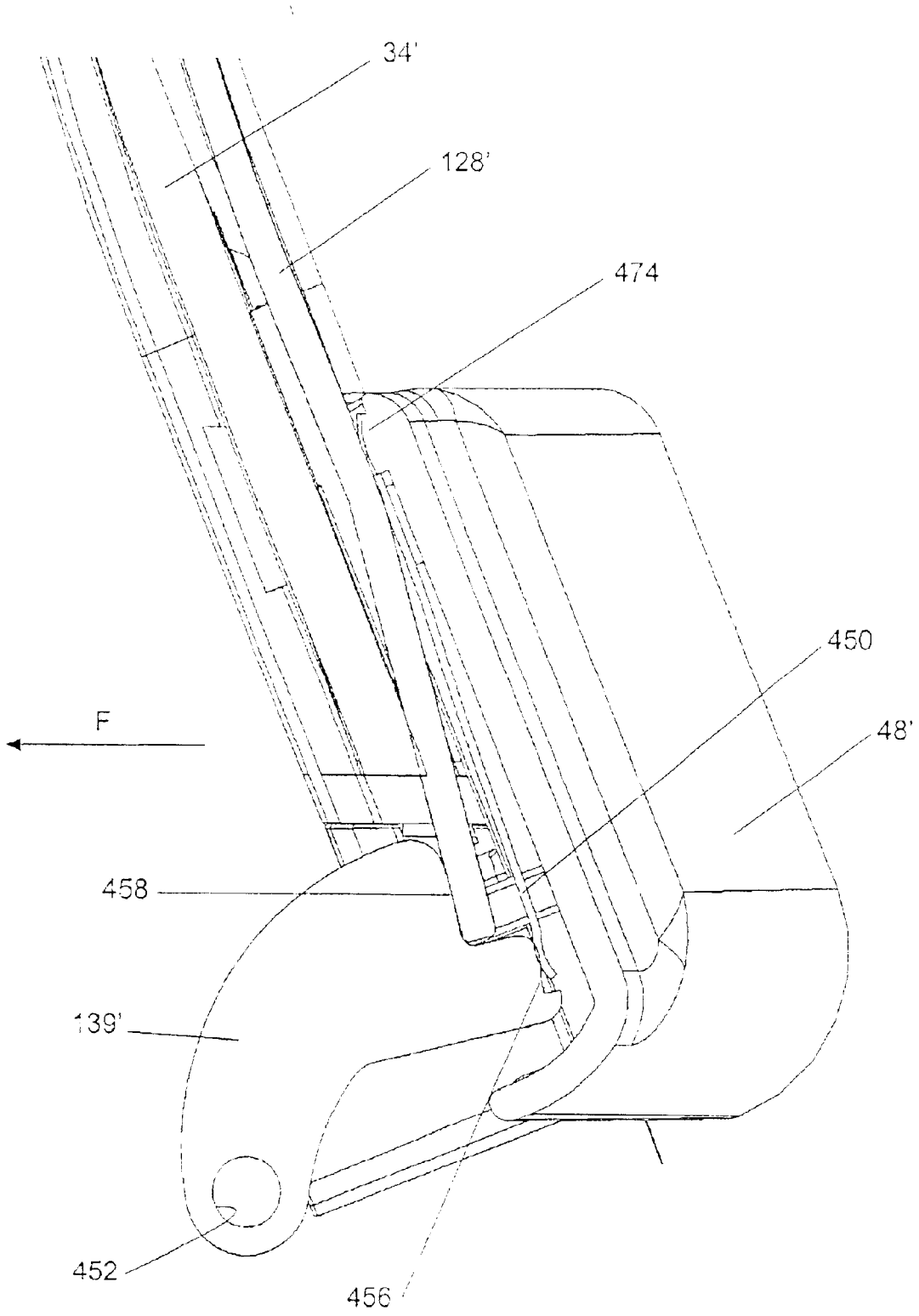
FIG. 39*d* is cross-sectional view of a detail of the back portion assembled with the push link of FIG. 39*c;*
Figure 40:
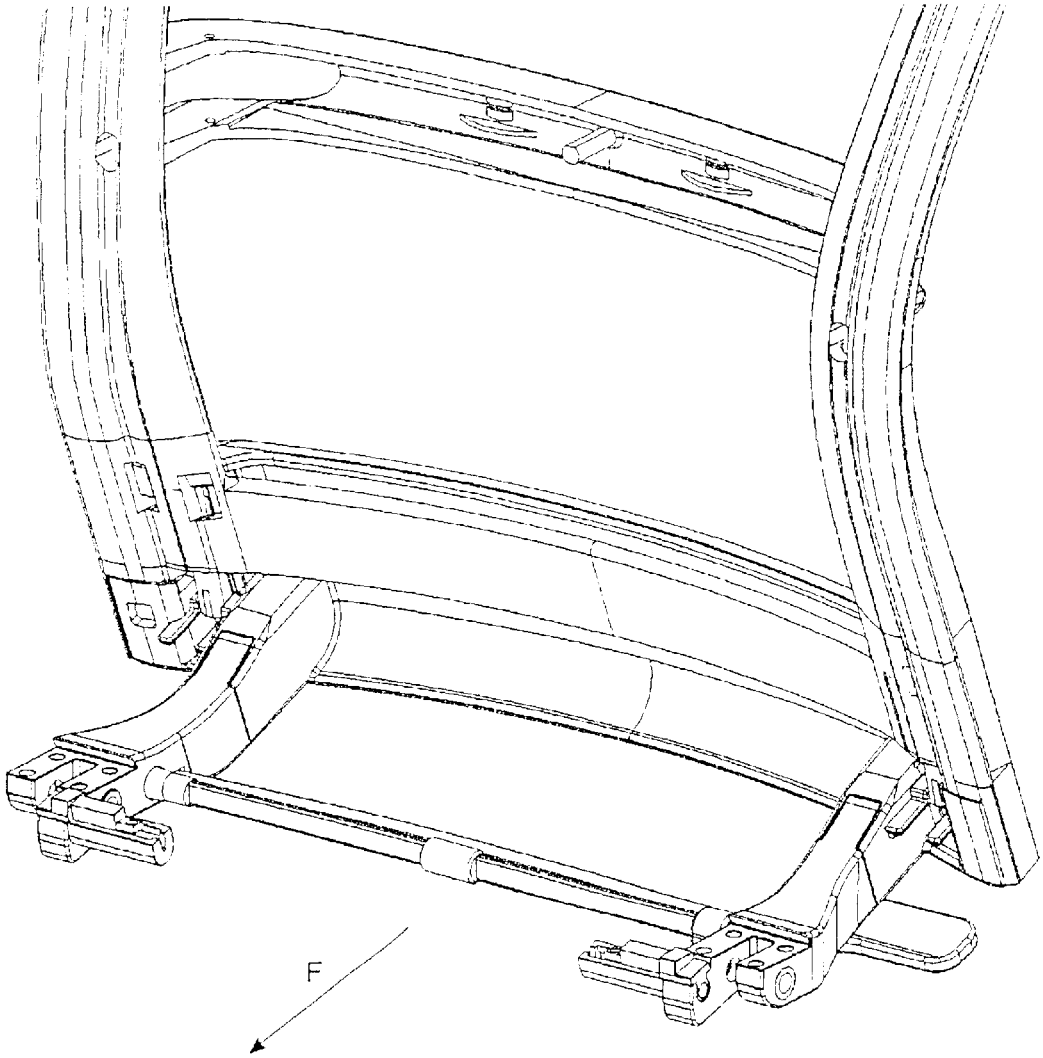
FIG. 40 is a front perspective view of the back frame together with the back extension arms and recline springs of FIG. 25 assembled with the back frame.

FIG. 39*d* illustrates the assembled configuration of the push link 139', the back attach casting 48', the leaf spring 128', the supplementary spring 450 and the peripheral frame 34'.

The operation of the recline mechanism has already been described in connection with FIG. 31 and the operation is not substantially different in the second embodiment and thus can be understood by reference to FIG. 31 already described. When a user's weight bears against the seat portion 14, this will be taken up by the seat guide 149 whereby the drive link 141 will be driven to rotate in an anti-clockwise direction about the recline axis R. In the present embodiment, rotation of the drive link 141 will cause the aperture in the push link 139' to move generally upwardly and rearwardly. This causes a consequent sliding of the first and second pair of gliders 460, 462 along the tracks 464. The supplementary spring 450 and the leaf spring 128' are arranged such that the first abutment face 456 will come into contact with the supplementary spring 450 prior to the second abutment face 458 coming into contact with the leaf spring 128'. This means that up to a predetermined threshold of the user's weight W, the push link 139' will bear against the supplementary spring 450. The supplementary spring 450 does not have a bearing on the stiffness of the peripheral frame 34'. Therefore, up to a predetermined threshold of the users weight W, there will be no stiffening effect on the peripheral frame 34'. After the predetermined threshold is reached, which is about 50 kg, the second abutment face 458 of the push link 139' will come into contact with the leaf spring 128'. The leaf spring 128' has an initial slightly bent configuration as illustrated in FIG. 39*d*. The leaf spring 128' bears against spring seat 474 disposed at the top of the forwardly extending channel 64' as can be seen in FIG. 37. The spring seat 474 is concave from side to side to position the leaf spring 128' while being convex from top to bottom as illustrated in cross section in FIG. 39*d*. By being forwardly convex as illustrated, the spring seat 474 defines a point about which the leaf spring 128 bends as the push link 139' moves rearwardly in its tracks 464. Similar to the first embodiment, as the spring 128' is pushed from its lower end to flex about spring seat 474, above the spring seat 474 it will bear against the back of the peripheral frame 34' thereby increasing the stiffness of the peripheral frame 34'. Furthermore, as with the first embodiment, at a certain point the push link 139' and/or the leaf spring 128' will bear against the back attach casting 48' where upon no further movement will be possible. This will define the tension limit for the leaf spring 128'.

FIG. 39*b* illustrates in greater detail the form of the supplementary spring 450. The supplementary spring is in the form of a leaf spring having an enlarged head formation 478 which includes two bights 480 on opposite edges. The bites 480 cooperate with facing complementary locating blocks 482 disposed on opposite sides of the forwardly extending channel 64.

Figure 41A:
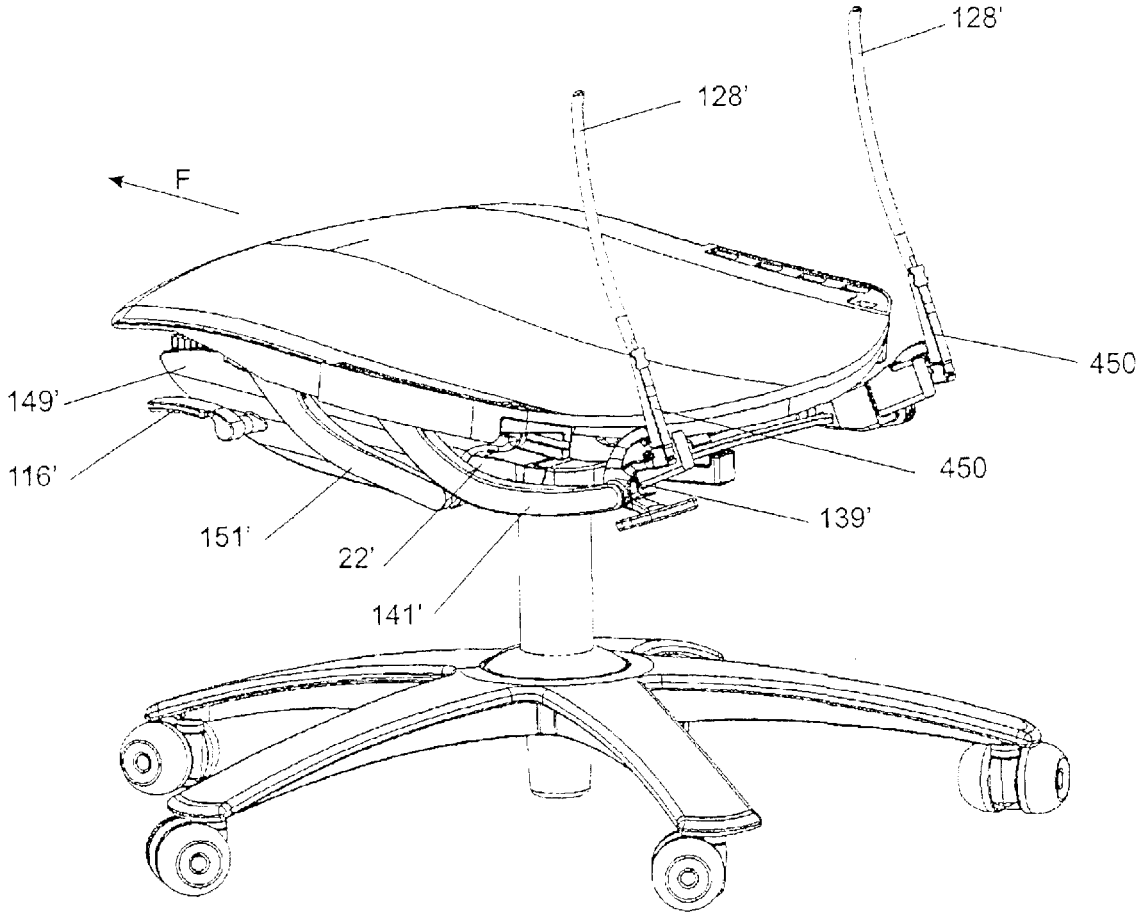
FIG. 41*a* is a perspective view of the chair according to the second embodiment from the rear, with certain parts removed for clarity.
Figure 41B:
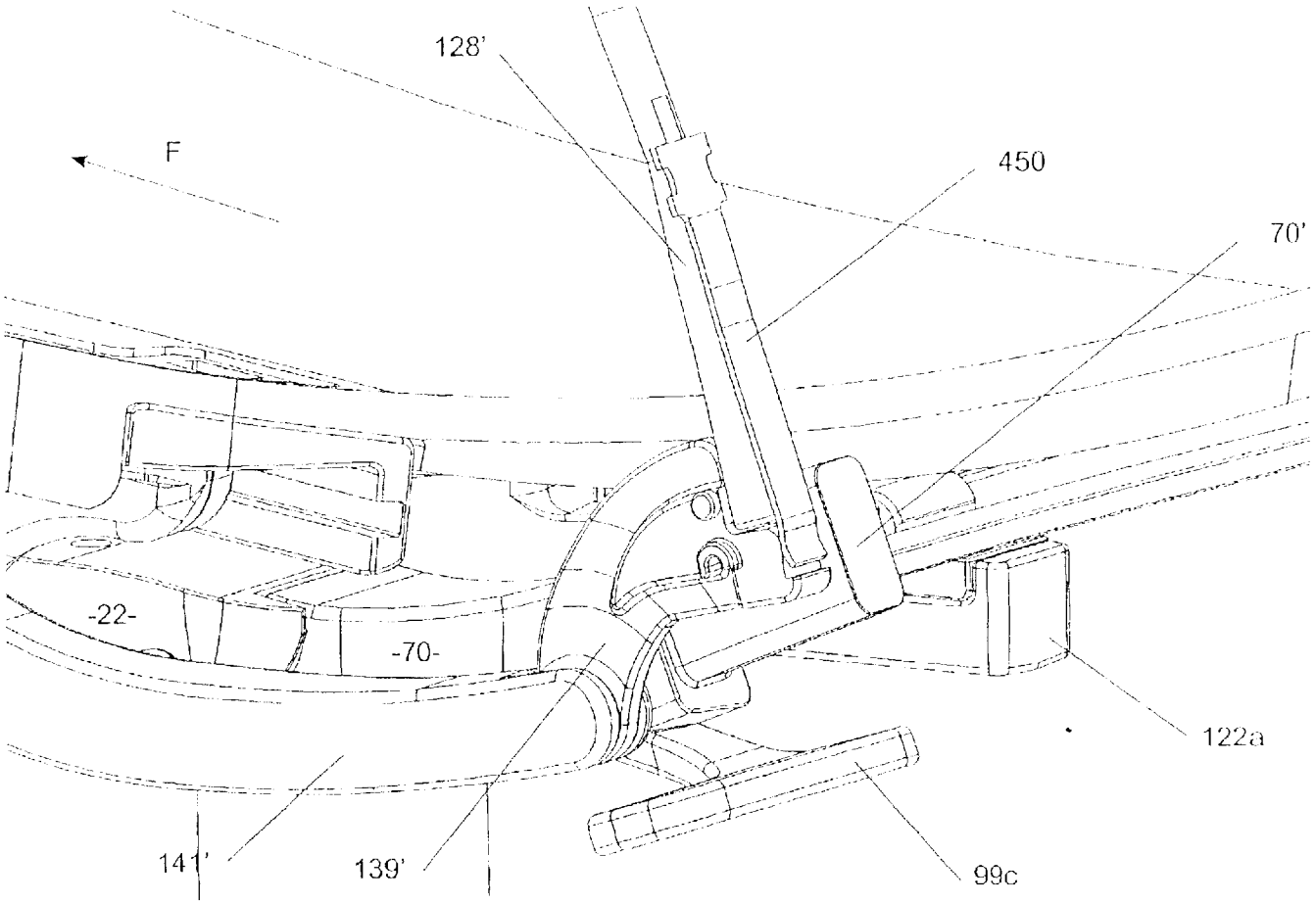
FIG. 41*b* is a perspective view of a detail of FIG. 41*a;*
Figure 42:
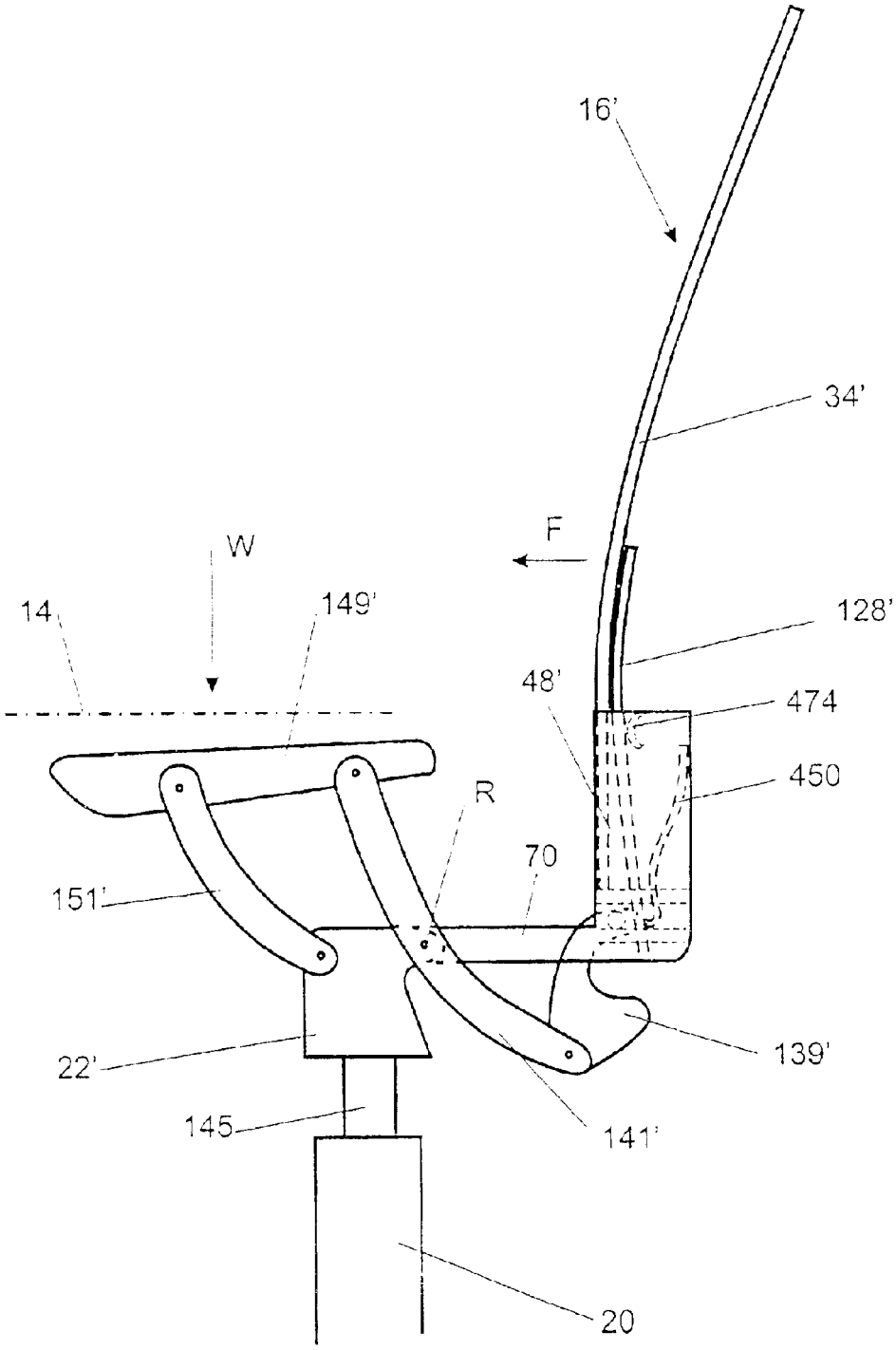
FIG. 42 is a schematic view of the main elements of the recline mechanism of the chair according to the second embodiment.
Figure 43:
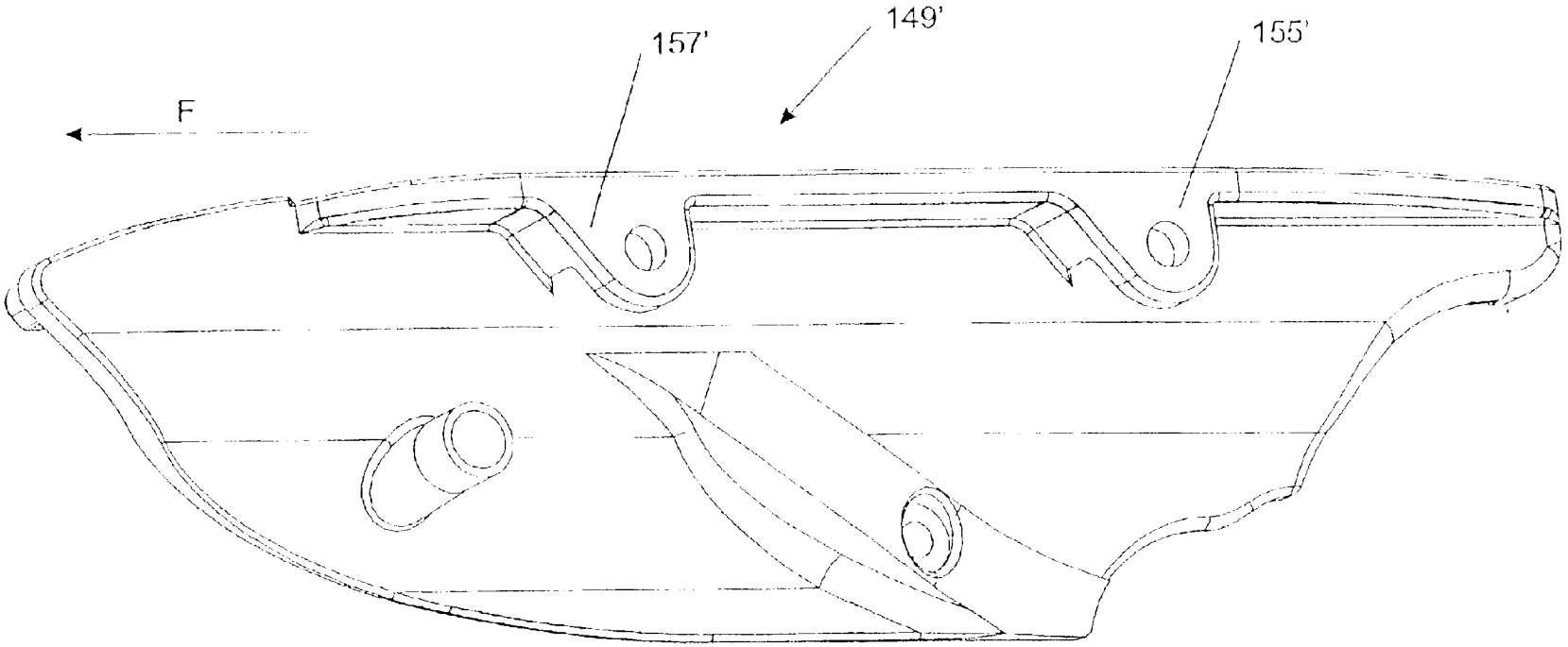
FIG. 43 is a perspective underside view of the seat guide, one of the main elements of the recline mechanism of the chair according to the second embodiment.
Figure 44:
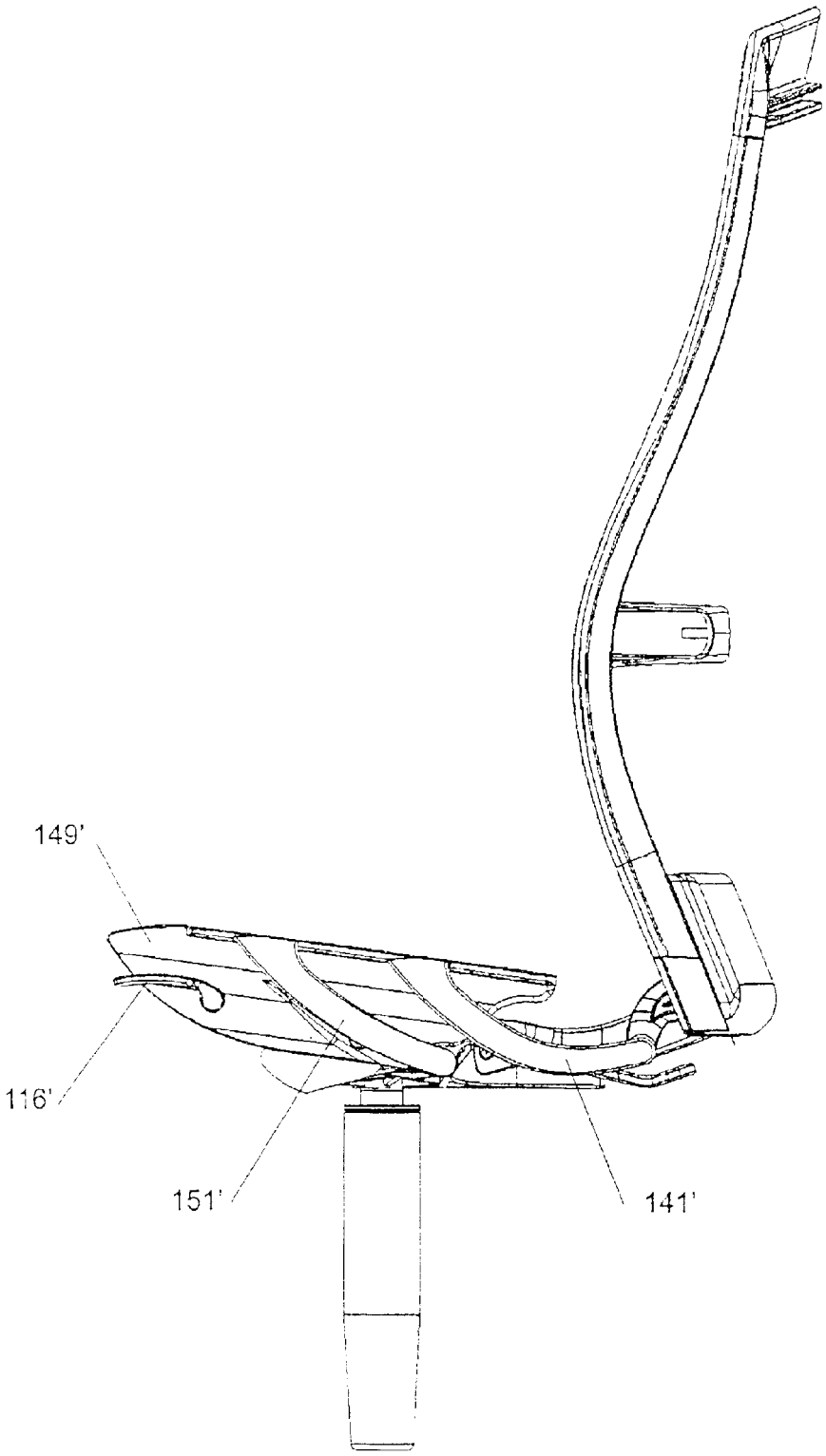
FIG. 44 is a side view of the main parts of the recline mechanism of the chair according to the second embodiment.
Figure 45:
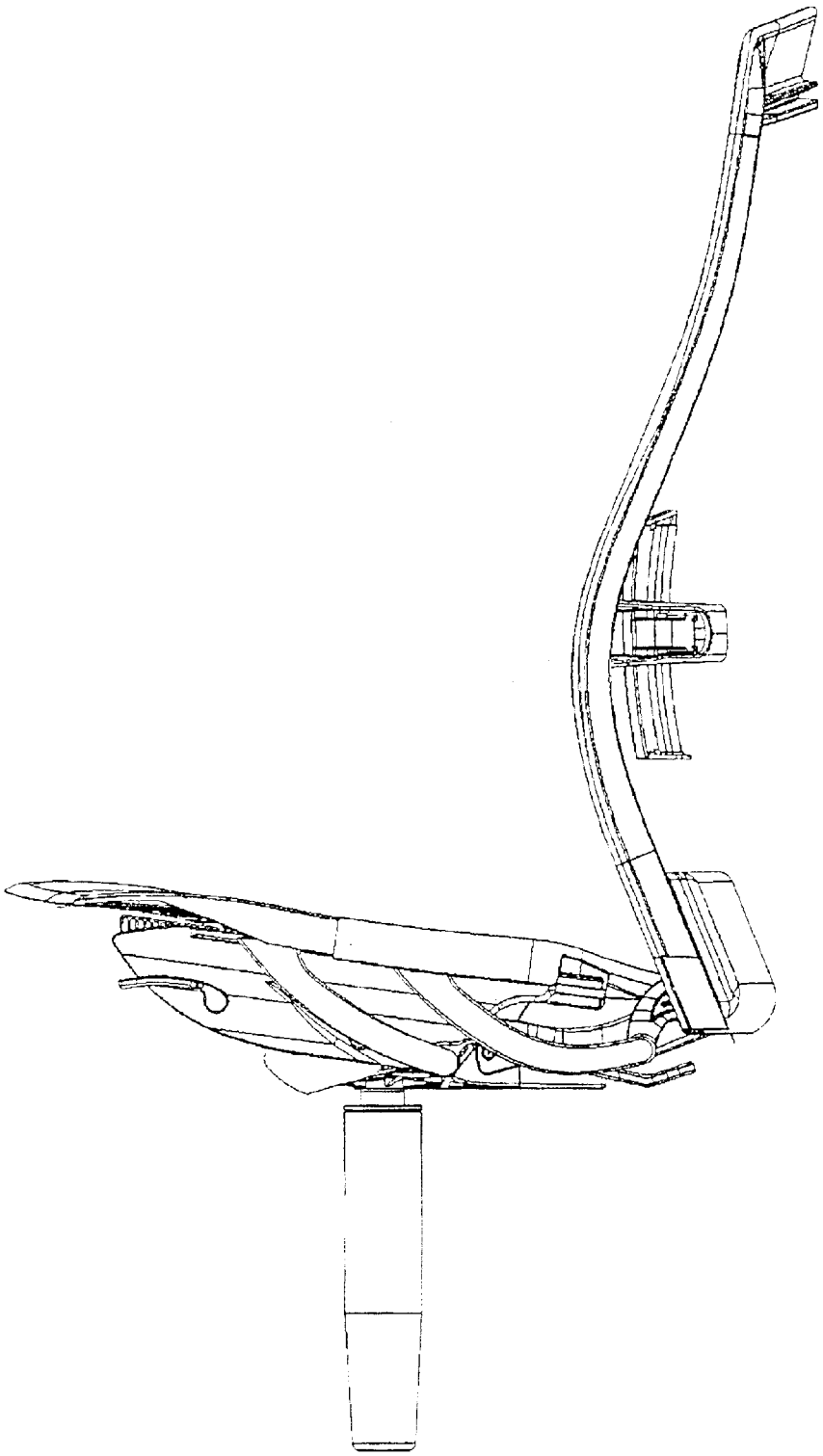
FIG. 45 is a side view as per FIG. 44, except with the seat added.

FIG. 41*a* illustrates certain components of the recline mechanism although the peripheral frame 34' and the back attach casting 48' have been removed for clarity. As in the previous embodiment, the drive link 141' is pivotally mounted to the main transom 22' at an intermediate location. The opposite end of the drive link 141' to that which the push link 139' is attached is pivotally connected with the seat guide 149'. Similarly, the front support link 151' is connected between the seat guide 149' and the main transom 22'. In this embodiment, the drive link 141' and the front support link 151' are also curved about one or more upright axes as well as being curved about a horizontal transverse axis as described with the first embodiment. This renders a more complex shape for the seat guide 149' as depicted in FIG. 43.

Seat Panel—First and Second Embodiments

Figure 46:
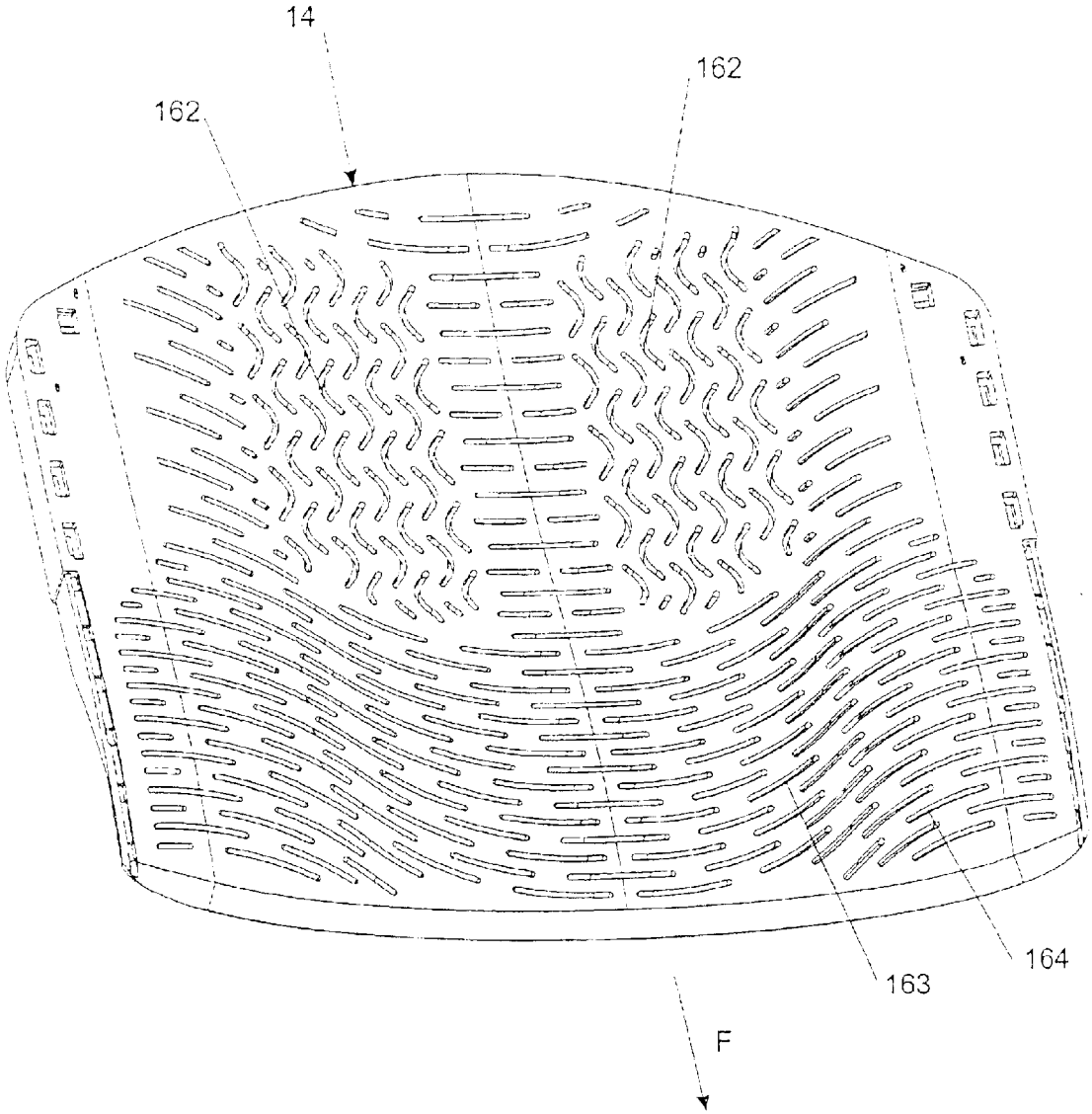
FIG. 46 is a perspective view of a seat panel which may be used with either the first or second embodiment of chair.

FIG. 46 is a perspective view of a preferred form of the seat portion 14 which is appropriate for use with either embodiment of the chair. The seat portion 14 is in the form of a flexible plastic panel, whose flexibility is enhanced by the arrangement of slots as indicated. The plastic panel may be injection moulded plastic such as TPR.

Figure 47:
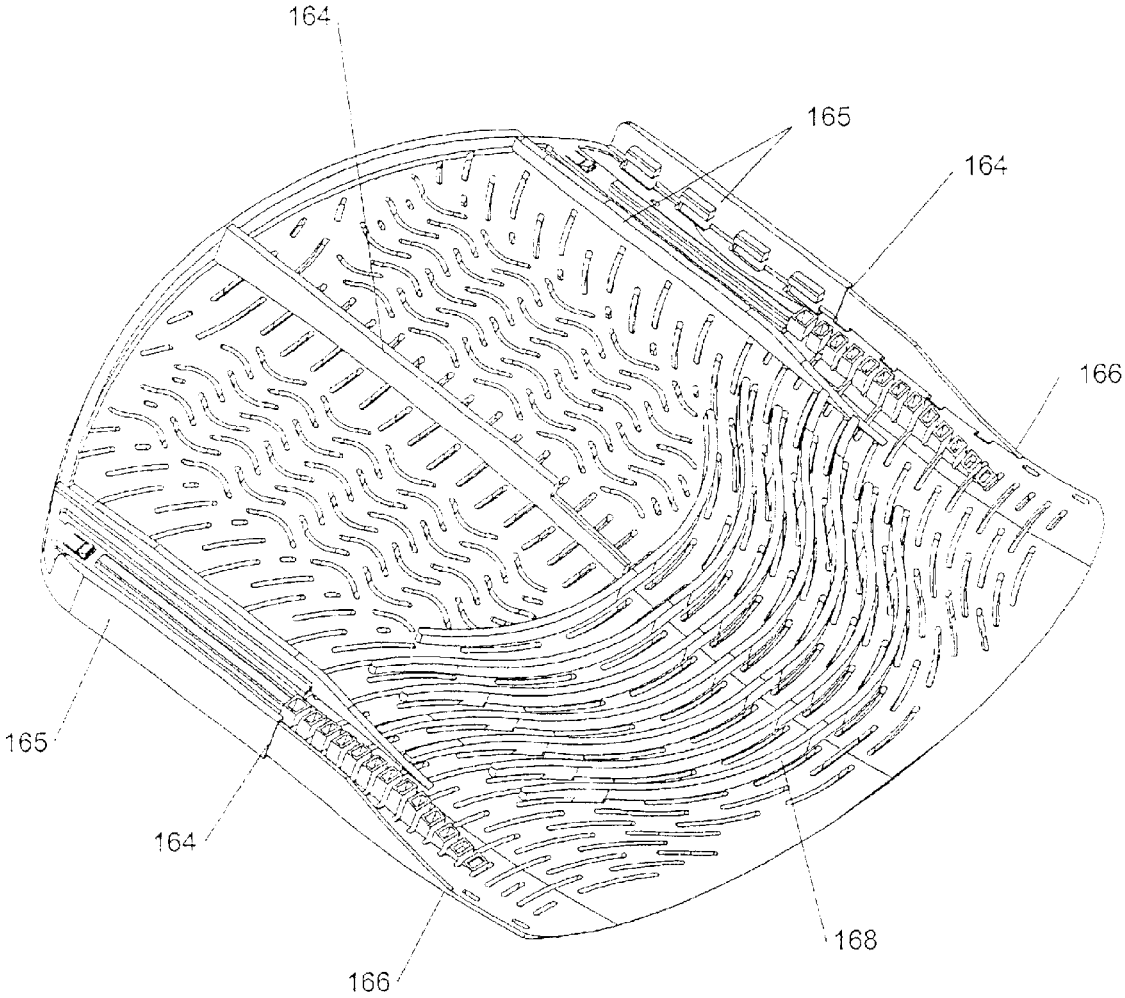
FIG. 47 is a perspective view of the underside of the seat panel shown in FIG. 46.
Figure 48:
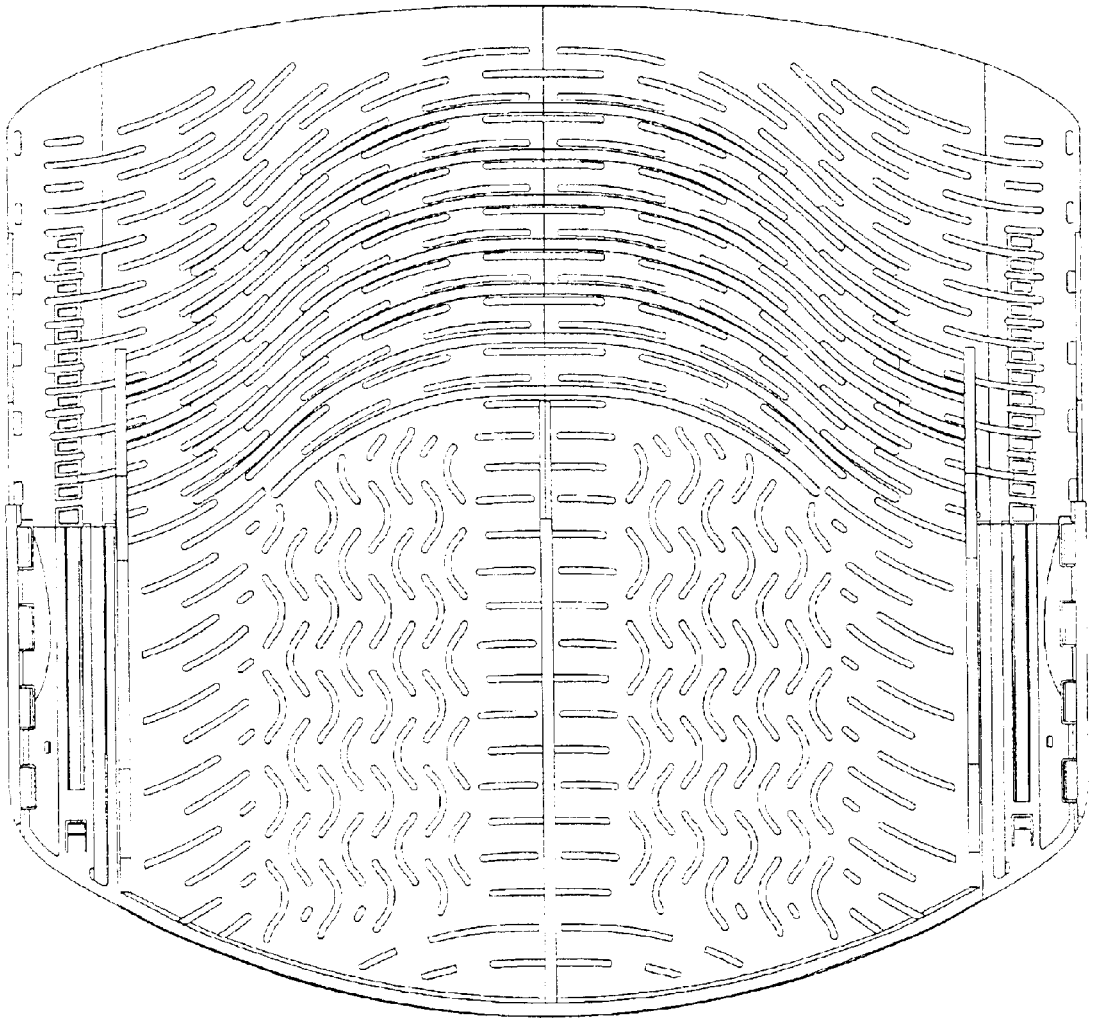
FIG. 48 is a plan view of the underside of the seat panel illustrated in FIG. 46.
Figure 49:
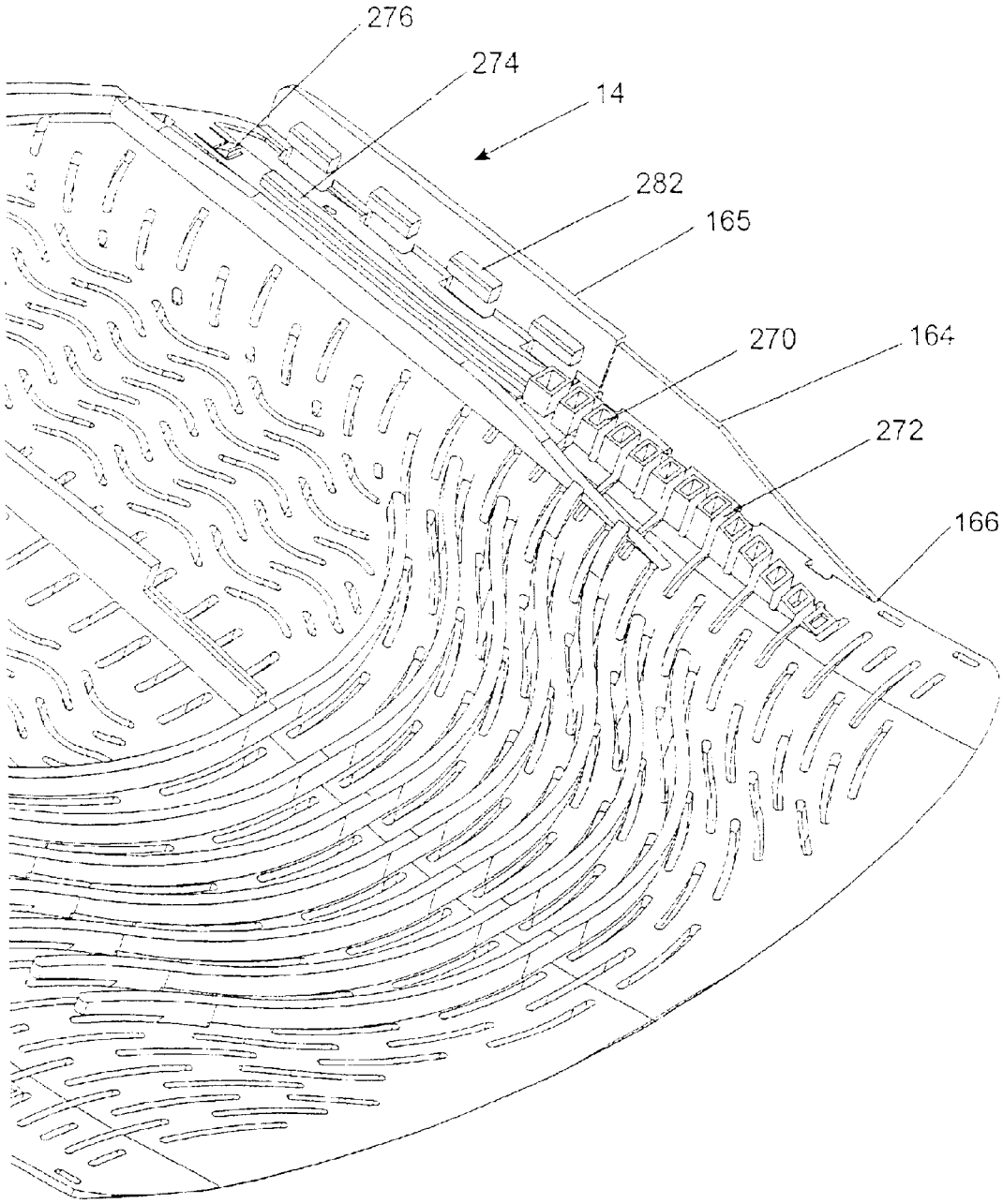
FIG. 49 is a perspective view of a detail of the underside of the seat panel illustrated in FIG. 47.
Figure 50:
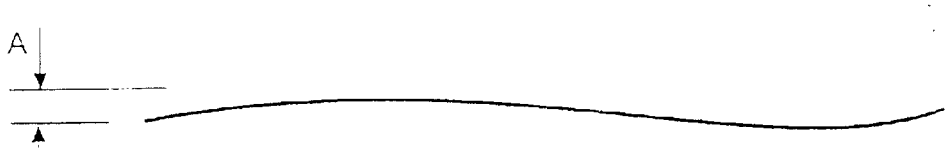
FIG. 50 is a schematic longitudinal sectional view through the middle of the seat panel illustrated in FIG. 46.
Figure 51:
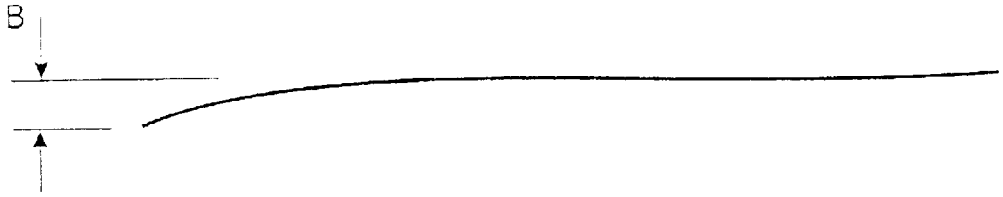
FIG. 51 is a schematic view of the side edge.
Figure 52:
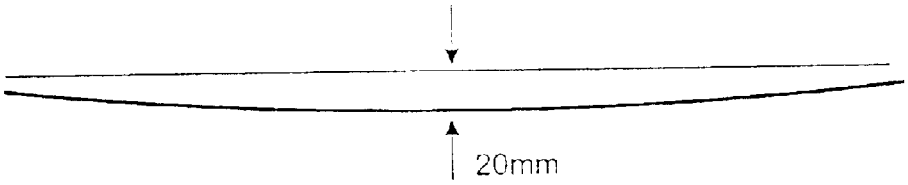
FIG. 52 is a schematic transverse sectional view through the seat panel at approximately 150 mm forward of the rear edge.
Figure 53:
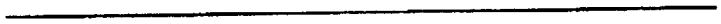
FIG. 53 is a schematic transverse sectional view at approximately 120 mm from the front edge.
Figure 54:
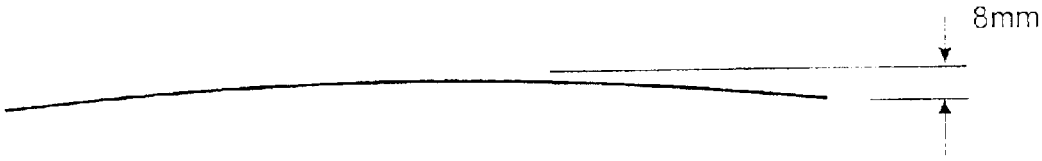
FIG. 54 is a schematic view of the front edge of the seat panel illustrated in FIG. 46.

It will be noted that while the seat panel 14 is depicted in the computer generated drawings of FIGS. 47–49 to be a flat panel, the seat panel is in fact dish shaped as can be seen from the schematic views illustrating the various cross-sections in FIGS. 50 to 54. FIG. 50 is a longitudinal section through the middle of the seat panel 14 illustrating the general curved configuration with a rolled over edge. The edge drops by an amount of dimension A. FIG. 51 illustrates the side edge of the seat panel 14. The side edge is flatter than the middle section. Additionally, the forward edge dips down a dimension B, where B is larger than A. FIG. 52 illustrates a transverse sectional view at about 150 mm from the rear of the seat whereas the view FIG. 53 depicts the transverse cross sectional view 120 mm from the front edge. This is essentially a flat shape. Therefore, the rear part of the seat behind 120 mm from the front edge is essentially dished for user comfort whereas in front of this, the seat portion inclines downwardly in the forward direction. Additionally, as can be seen in FIG. 54, the front edge is also curved so as to incline downwardly toward the sides.

The illustrations in FIGS. 50–54 are merely indicative of the moulded shape of the seat panel 14. The seat panel is also flexible to accommodate the occupant and to respond to movement of the occupant. The arrangement of slots in the seat panel 14 as shown in FIG. 46 is designed to enhance the flexibility of the seat panel 14. The arrangement of slots in the forward half of the panel is designed to facilitate folding along the transverse fold. In particular, it can be seen that the slots are arranged in a series of spaced sinuous lines 163 extending transversely across the seat portion 14 with the central part being shaped convex forwardly with the outer parts being shaped concave forwardly. The lines of slots 163 are discontinuous. As already explained, the seat portion 14 is dished at least in a rearward part. This dishing may be accentuated by the occupant in the seat. The series of spaced sinuous lines 163 enables the seat panel 14 to fold transversely, even though the rear part is dished. Furthermore, at the front corners, the slotted pattern 164 is such as to extend diagonally across the corners following the curvature of the transverse sinuous lines 163. In this way, if the user moves a leg to one of the forward corners then the diagonal arrangement of the slots 164 will enable the forward corner to fold under the weight of the occupant's leg.

In the rear half of the panel, the slots are arranged in a pattern to accommodate the ischial protuberosities of the occupant. In particular, the slotted pattern provides two spaced, approximately rectangular zones 162 whose locations correspond to the ischial protuberosities of the occupant (assuming the occupant is properly seated with an appropriate seat depth adjustment). The two zones 162 interrupt the transverse slot pattern. Each zone is comprised of slots arranged in a series of longitudinally extending, transversely spaced sinuous lines. The lines of slots are discontinuous. The longitudinal arrangement of slots in each zone 162 enables the remaining material between the longitudinal lines of slots to spread apart thereby creating pockets, one for each ischial protuberosity of the seat occupant.

FIG. 47 illustrates longitudinal stiffening webs 165 provided on the underside of seat panel 14. There are five stiffening webs, two disposed along the opposite side edges. A further two are disposed on each side at 60 mm from the corresponding side edge. Another is centrally disposed. The longitudinal stiffening webs are constant in height from the back edge of the seat portion until the taper start point 164 from where they progressively reduce in height until a taper finish point 166. (The central web however terminates early) The seat portion 14 accommodates a depth adjustment as will be explained in connection with FIGS. 55 to 60. The seat portion folds transversely about the transition point 161 on the seat guide 149.

It will be appreciated that if the seat panel 14 is located in a rearward position in order to suit a small person then the depth of the stiffening ribs in the region at the transition point 161 is shallow thereby offering little resistance to flexing. Generally, this suits a small, light weight person. However, for a larger person, the seat panel will be disposed further forwardly in relation to the seat guide 149. The depth of the stiffening ribs in the location of the transition point 161 will be deeper, thereby offering increased resistance to bending. This suits a larger, heavier person.

The start taper point 164 is at a position which corresponds to the transition point 161 when the seat is at its full forward position to suit a large person. The taper finish point 166 is at a position corresponding to the transition point on the seat guide 149 with the seat in the rear most position to suit a small person. The taper start point 164 and the taper finish point 161 define a transition zone therebetween. The transverse fold may be disposed at a range of positions within the transition zone, dependent on seat depth adjustment. The pattern of transversely extending sinuous lines of slots extends for at least the transition zone.

FIG. 47 also illustrates transverse stiffening webs 168. The stiffening webs 168 follow the pattern of the transversely arranged sinuous slots 163. As already explained, the seat panel is moulded in a dished shape. However, it is desirable to limit curvature, especially about a longitudinal axis at the front part of the seat portion. Accordingly, the transverse stiffening webs 168 help to retain the shape of the front part without inhibiting the transverse folding action under the weight of the user. Additionally, a back web is provided along the back of the seat panel 14 on the underside as shown in FIG. 47.

FIG. 49 illustrates in greater detail the arrangement of features along one side edge. Between the two longitudinal webs 165 is a series of spacer blocks 270 extending in a line between the taper start point 164 and the taper finish point 166. Between each of the spacer blocks 270 is a wedge-shaped gap 272 widening towards the top. As will be explained in connection with FIGS. 55 to 60, the seat panel 14 sits atop a seat carriage 167. Depending upon the position of the seat carriage 167 relative to the seat guide 149, there will normally be a forward portion of the seat guide 149 (including the lead surface 285) in front of the seat carriage 167. A rear part of the seat panel 14 is secured atop the seat carriage 167 so that forwardly of the seat carriage 167 there will be a gap between the seat guide 149 and the seat panel 14. The spacer blocks 270 extend into this gap. As the seat panel 14 folds, the spacer blocks 270 bear against the top of the seat guide 149. It can be seen that the spacer blocks 270 also taper off in height as shown. Furthermore, the spacer blocks 270 will define the maximum curvature of the seat panel along the transverse fold since once the side walls of the wedge-shaped gaps 272 engaged with each other, further curvature will be prevented. A guard also extends alongside the spacer blocks 270 to provide a barrier against the user's fingers being trapped.

Seat Depth Adjustment Mechanism

Figure 55:
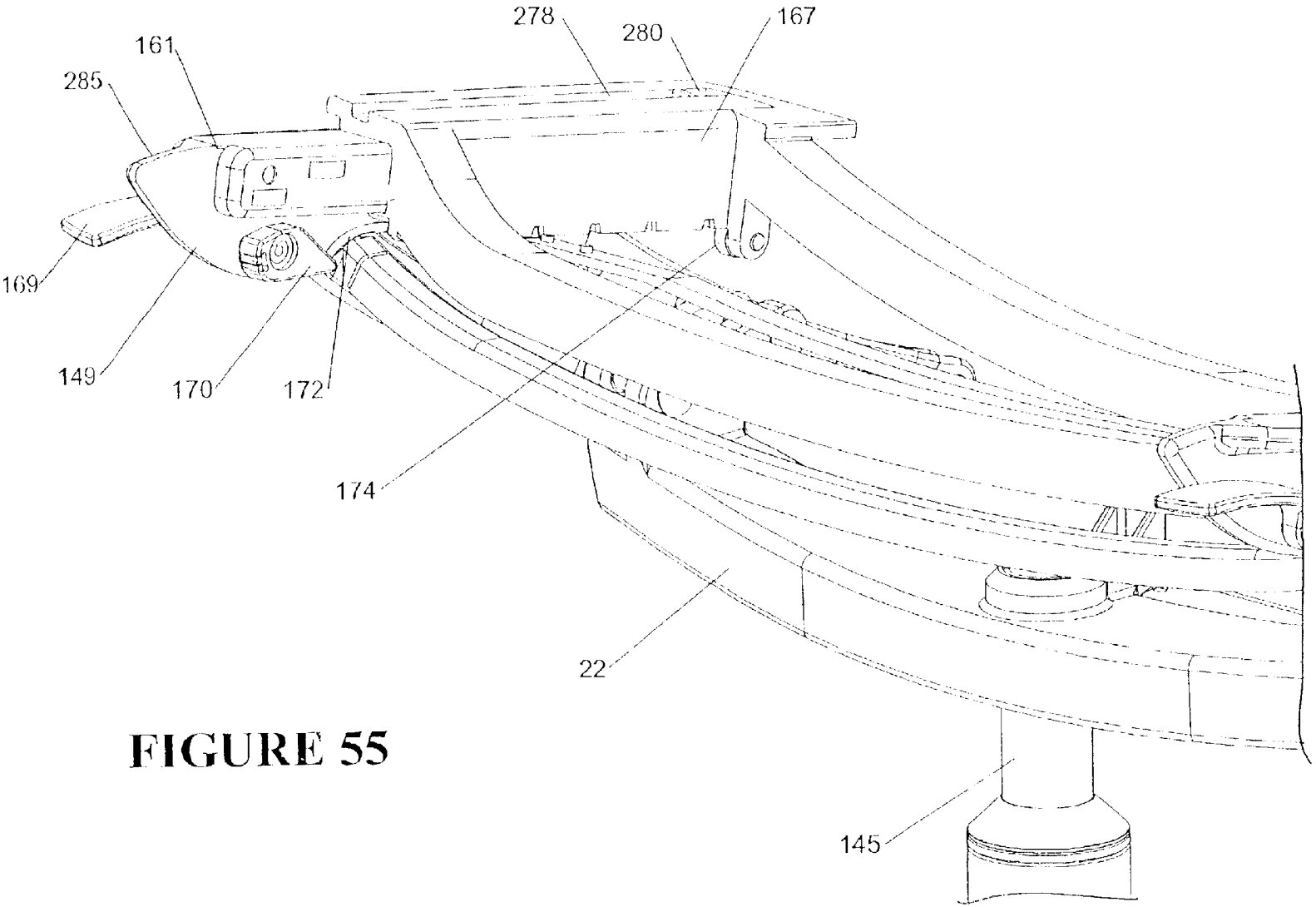
FIG. 55 is a perspective view of the chair according to the first embodiment with the seat panel removed to show a seat depth adjustment mechanism.

FIG. 55 illustrates the main elements of the seat depth adjustment mechanism. The seat guide 149 is one of the elements of the four bar linkage discussed previously. There are two seat guides 149 disposed on opposite sides of the chair. The two seat guides 149 provide a guide for a slidable seat carriage 167. A rear part of the seat panel 14 illustrated in FIGS. 47–54 is attached to the carriage 167. The rear half only of the seat panel 14 is attached to the seat carriage 167. The seat panel 14 may be moved forwardly and rearwardly by the sliding action of the seat carriage 167 on the seat guide 149.

As shown in FIG. 49, rearwardly of the spacer blocks 270 on the underside of the seat panel 14 is a longitudinally extending rib 274 and then a short tab 276 spaced rearwardly of the longitudinally extending rib 274. The rib 274 engages within a channel 278 (see FIG. 55) of the seat carriage 167 and the tab 276 is a snap fit connection within the recess 280 located rearwardly on the seat carriage 167. Furthermore, four spaced retention tabs 282 engage against soffit 284 of the carriage 167. The retention tabs 282 retain the seat panel 14 engaged with the seat carriage 167 while the longitudinal rib is the main load bearing part.

FIG. 55 also illustrates the controls for the height adjustable pneumatic spring 145. A height adjustment control lever 169 is mounted for pivotal motion on the outside of the right hand seat guide 149. The pivotal motion of the height adjustment control lever 169 is replicated by the height adjustment control actuator 170 which is connected to one end of a control cable 172. The other end of the control cable 172 is connected to the top end of pneumatic gas spring 145. As the user lifts the height adjustment control lever 169, the control cable 172 releases the gas spring in the conventional known manner and the chair occupant adjusts the height of the seat portion 14 to suit his requirements.

Figure 56:
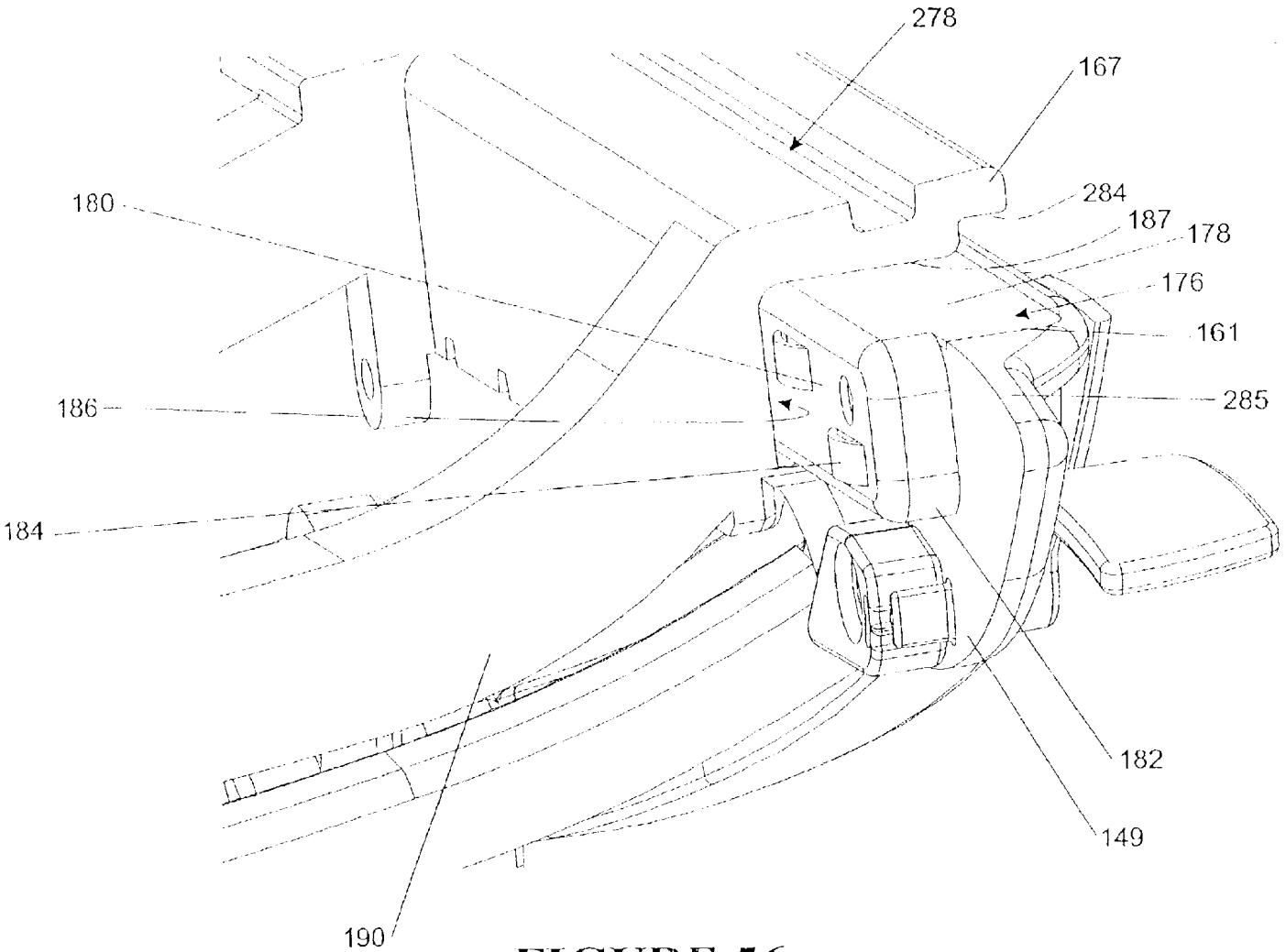
FIG. 56 is a perspective view showing similar detail to FIG. 55.

FIG. 56 is a further detailed view of the left side of the seat carriage 167. The seat guide 149 includes a plastic seat guide liner 176. The seat guide liner is of elongate configuration with an upper glide surface 178 and an inner glide surface 180. The inner glide surface 180 is spaced from the inner side of the metal part seat guide 149 with a peripheral wall 182 maintaining the inner glide surface 180 in spaced configuration therefrom. The seat guide liner 176 is thereby hollow behind the inner glide surface 180. The upper glide surface 178 is received within a rebate in the upper surface of the metal part of the seat guide 149 in order that the upper glide surface 178 is contiguous with the upper surface of the metal part of the seat guide 149. The seat guide liner 176 provides a bearing surface for easy sliding of the seat carriage 167. As such, the seat guide liner 176 may be comprised of nylon or acetal. The reader will appreciate that a symmetrical arrangement is provided on the right hand side of the chair.

The seat carriage 167 is of unitary cast aluminium construction and comprises two spaced slides, each of which engages with a respective seat guide 149. Each slide is of a generally L-shaped configuration having an upright glide surface 186 on an inner wall for sliding engagement with the inner glide surface 180 and a horizontal glide surface 187 for engaging with the upper glide surface 178. The carriage is of a symmetrical configuration about a central upright longitudinally extending plane of the chair. The two slides provided on the right and left are thereby of opposite configuration. The two slides are joined by transversely extending bearers 190.

The inner glide surface 180 is moulded with a series of archlets which extend from the inner glide surface 180. The archlets 184 protrude inwardly (relative to the chair as a whole) to bear against the upright glide surface 186 of the seat carriage 167. The archlets may be arranged in any pattern but preferably they are staggered along the length of the inner glide surface 180. Both of the seat guide liners 176 have inwardly extending archlets bearing against the associated upright glide surfaces of 186 of the carriage 167. The archlets 184 thereby act against the carriage to centre the carriage 167 centrally between the two seat guides 149. Furthermore, in the event that the parts are not accurately tooled, the resilient archlets 184 will take up any slack between the upright glide surface 186 and the inner glide surface 180. This assists to prevent jamming of the carriage 167 within the seat guides 149.

Figure 57:
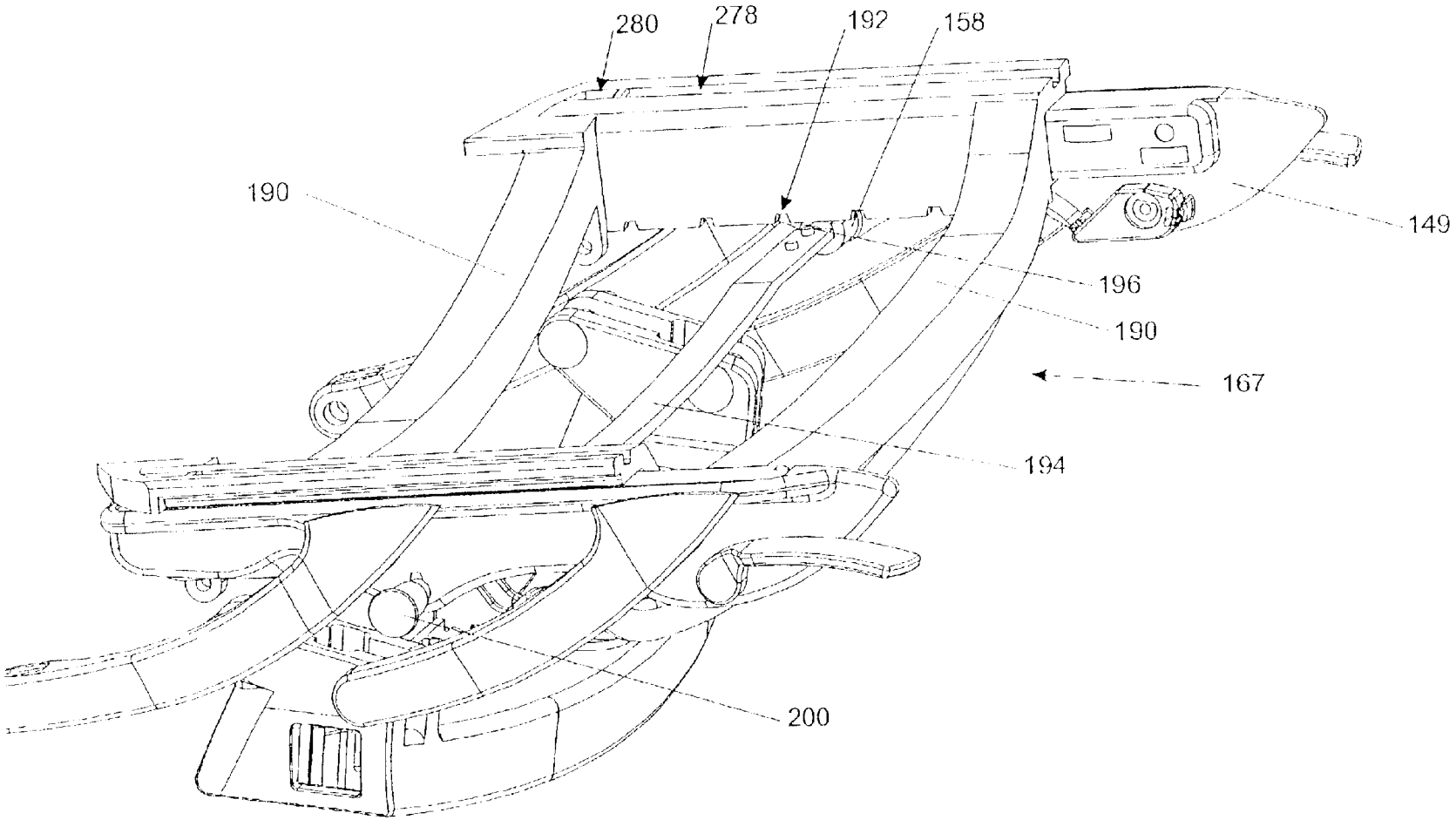
FIG. 57 is a perspective view with the seat panel removed, showing the workings of the seat depth adjustment mechanism.

FIG. 57 illustrates the control for seat depth adjustment. The inner wall of both slides 185 have a lower edge with a series of spaced notches 192. A seat depth adjustment bar 194 has two teeth 196, each arranged at opposite ends of the bar 194. The seat depth adjustment bar 194 is moveable between a latched position in which the teeth 196 engage in a respective one of the notches 192 and an unlatched position in which the carriage 167 is free to slide along the seat guide 149. The seat depth adjustment bar 194 is controlled by a seat depth adjustment button 200. The seat depth adjustment button 200 is moveable from the latched position against the bias of a spring (not shown) to move the seat depth adjustment bar 194 into the unlatched position whereby the teeth 196 no longer engage in the notches 192. The seat carriage 167 can then be slid to an appropriate seat depth whereupon the occupant releases the seat depth adjustment button 200 to enable the teeth 196 to engage with the closest of the notches 192.

A seat depth stop 174 (FIG. 55) formed as a dependent projection from the seat carriage 167 determines the forward position of the seat carriage 167 as it engages with the adjustment bar 194 or sleeves 158 receiving the ends of the adjustment bar 194. The rear limit is defined by a pin (not shown) extending inwardly from the seat guide 149 to engage within a slot of the seat carriage 167. The slot is machined to define a stop to engage with the join in the rear most position of the seat portion.

Figure 58:
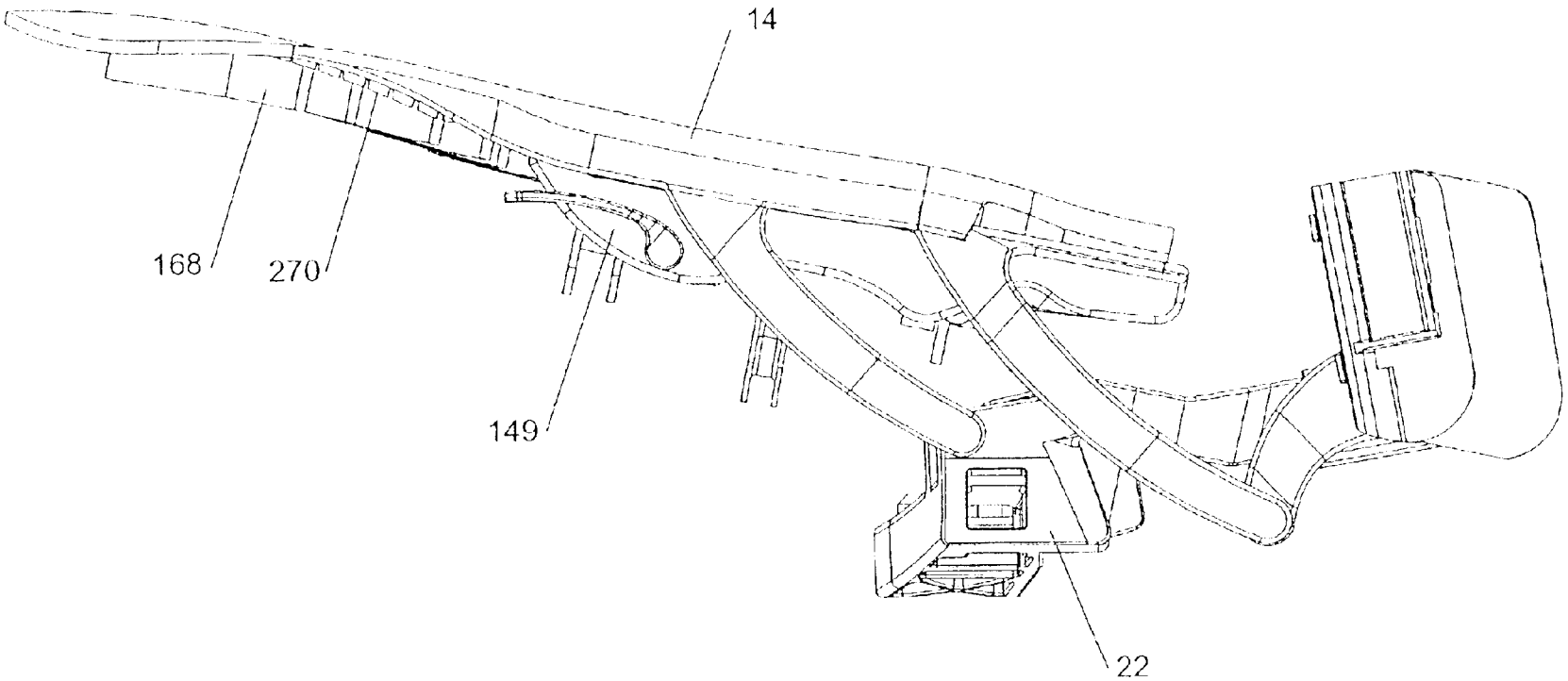
FIG. 58 is a side view of a portion of the chair with the seat panel in an extended position.
Figure 59:
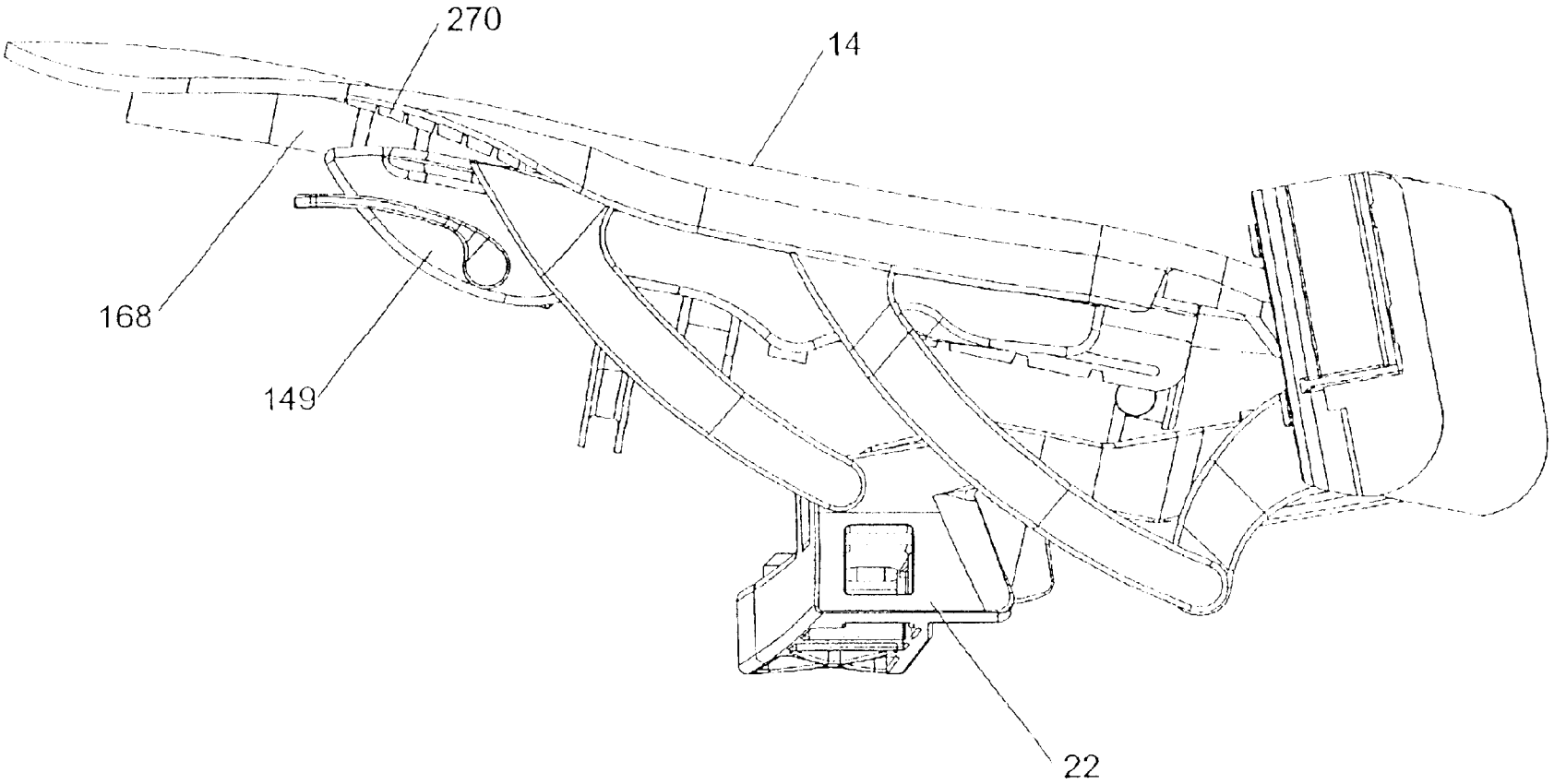
FIG. 59 is a side view of a portion of a chair illustrated in FIG. 58 with the seat panel in a retracted position.
Figure 60:
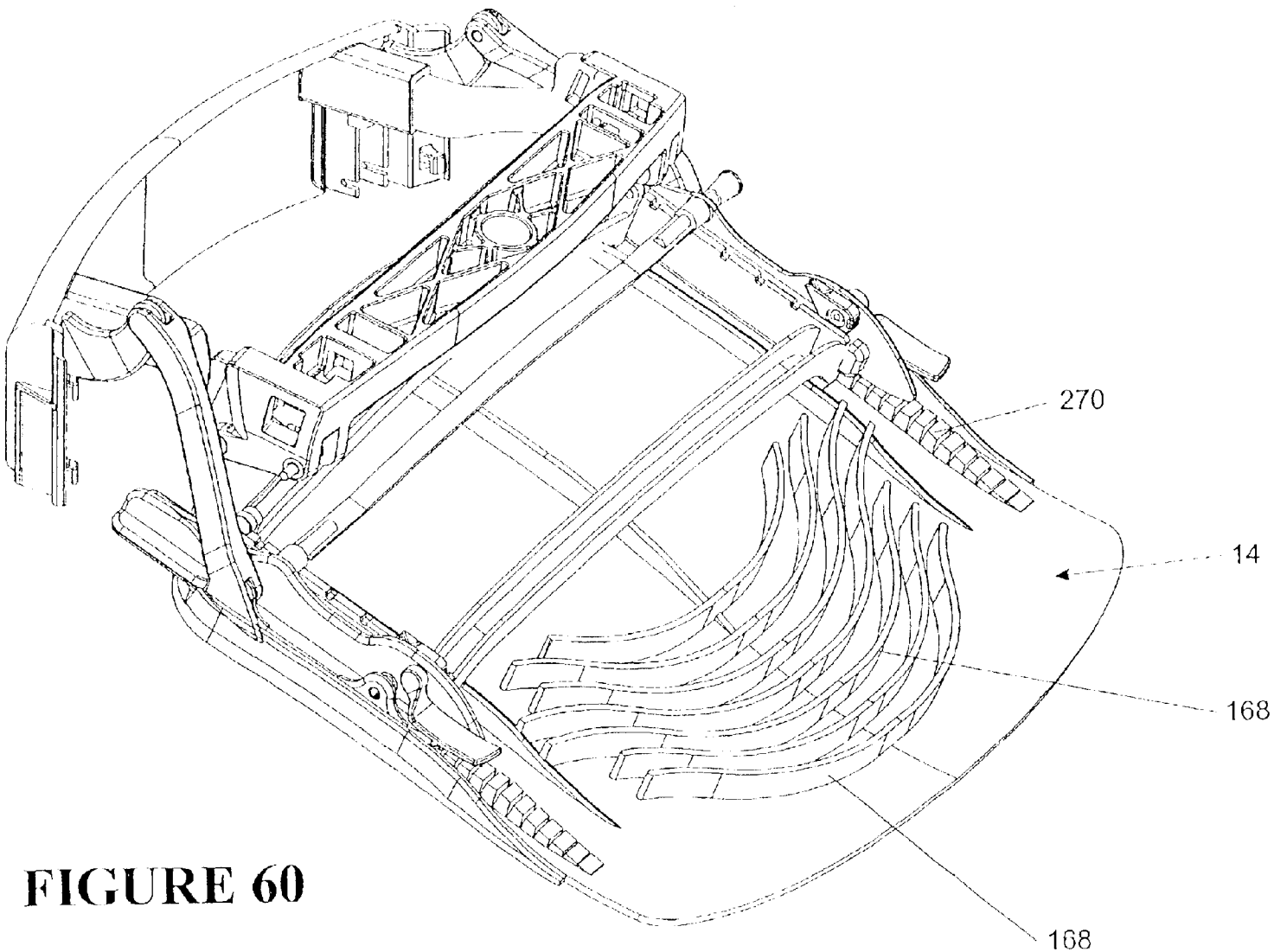
FIG. 60 is an underside perspective view of the portion of the chair illustrated in FIGS. 58 and 59 illustrating the seat depth adjustment mechanism.

FIGS. 58 and 59 illustrate the extended and retracted positions respectively of the seat portion 14.

Seat Depth Adjustment—Second Embodiment

Figure 61:
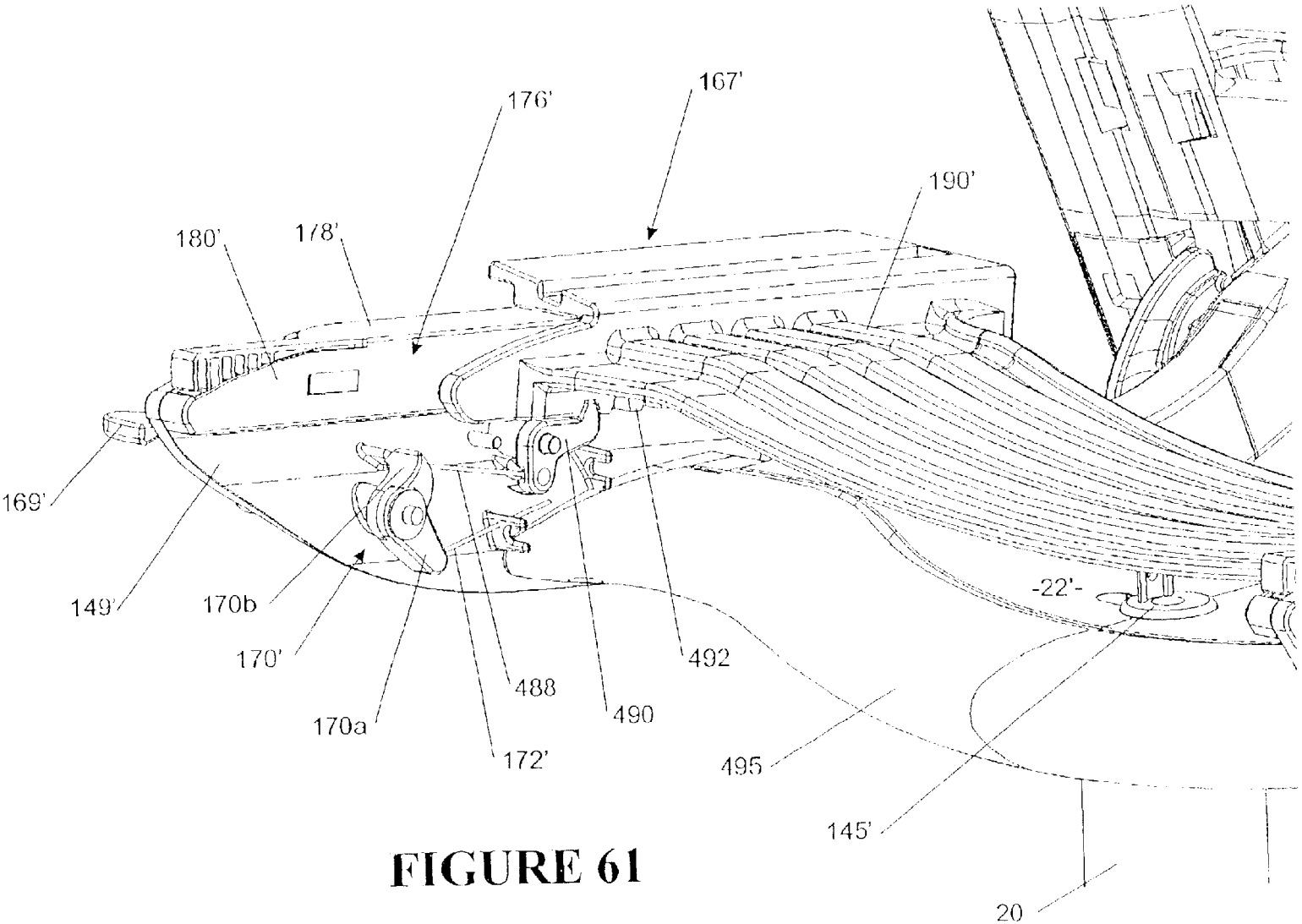
FIG. 61 is a perspective view of the chair according to a second embodiment with the seat panel removed to show a seat depth adjustment mechanism.
Figure 62A:
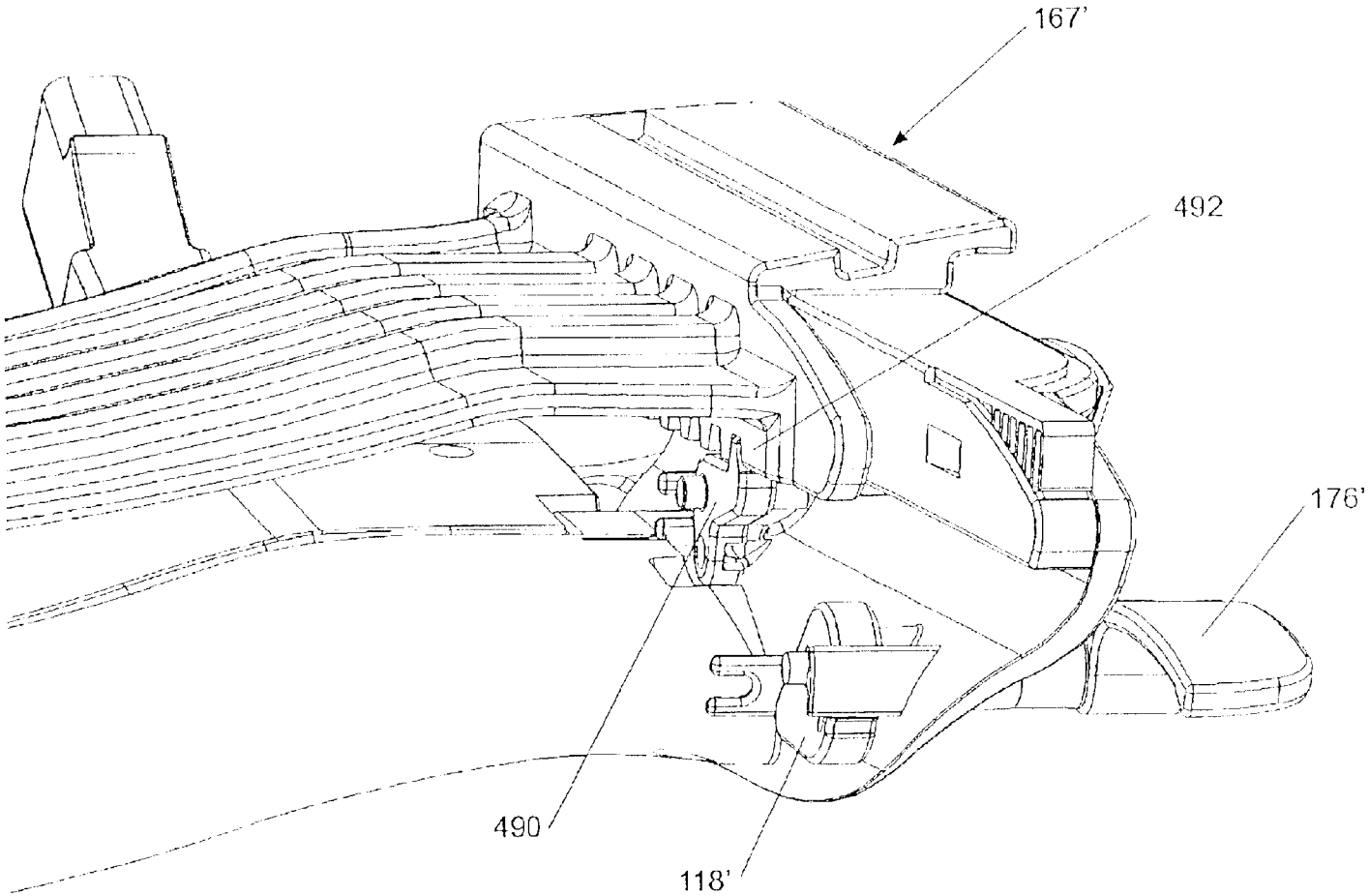
FIG. 62*a* is a different perspective view showing a similar detail to FIG. 61.

FIG. 61 and 62 illustrate a modified form of the seat carriage 167' and the seat guide 149'. The seat carriage 167' is a unitary cast aluminium construction with two spaced slides as explained with the first embodiment, each of which engage with a respective seat guide 149'. The two slides are joined by a unitary deck construction having a series of transversely extending ribs as shown.

As with the previous embodiment, the seat guides 149' include seat guide liners 176' having an upper glide surface 178' and an inner glide surface 180' to slidably engage with the respective slide of the seat carriage 167'. The seat guide liners 176' will be described in greater detail in connection with FIG. 62*b* and 62*c*.

As shown in FIG. 61, the second embodiment of the chair includes a control lever 169' on the right hand side (left hand side of the figure). This lever 169' is a dual actuator for both the seat height adjustment and seat depth adjustment. The control lever 169 is mounted for pivotal motion on the outside of the right hand seat guide 149'. The control lever 169' effects the operation of a dual actuator 170' mounted on the inside of the right hand seat guide 149'. The actuator 170' includes a first actuator portion 170*a* and a second actuator portion 170*b*. The first actuator portion 170*a* is connected to cable 172' which connects to the top end of a pneumatic gas spring 145'. As the user raises the control lever 169', the control cable 172' releases the gas spring in the conventional known manner and the chair occupant adjusts the height of the seat portion 14 to suit his requirements.

The second actuator portion 170*b* is connected via cable 488 to a pivotable pawl 490. The pawl is engageable between any one of a plurality of teeth provided on a rack 492 formed on the underside of the seat carriage 167'. The pawl and rack arrangement 490, 492 is also duplicated on the other side of the seat carriage 167' as shown in FIG. 62. The cable 488 passes from the right hand pawl 490 around to the other side of the seat carriage 167' for simultaneous operation of the two pawls 490. The user depresses the control lever 169' to operate the second actuator portion 170*b* to pivot the two pawls against a bias out of engagement with the teeth of the associated rack 492. The seat carriage 167' can then be slid to an appropriate seat depth where upon the occupant releases the control lever 169' to enable each of the pawls 490 to engage with the associated rack 492.

FIG. 61 also illustrates a forward cover 495 which is shaped in a serpentine manner for aesthetic purposes to extend in front of the main transom 22'. The cover 495 is joined to the seat guides 149' on each side through the use of integrally formed bosses 497 which can be seen in FIG. 62*b* and FIG. 62*c*.

Figure 62B:
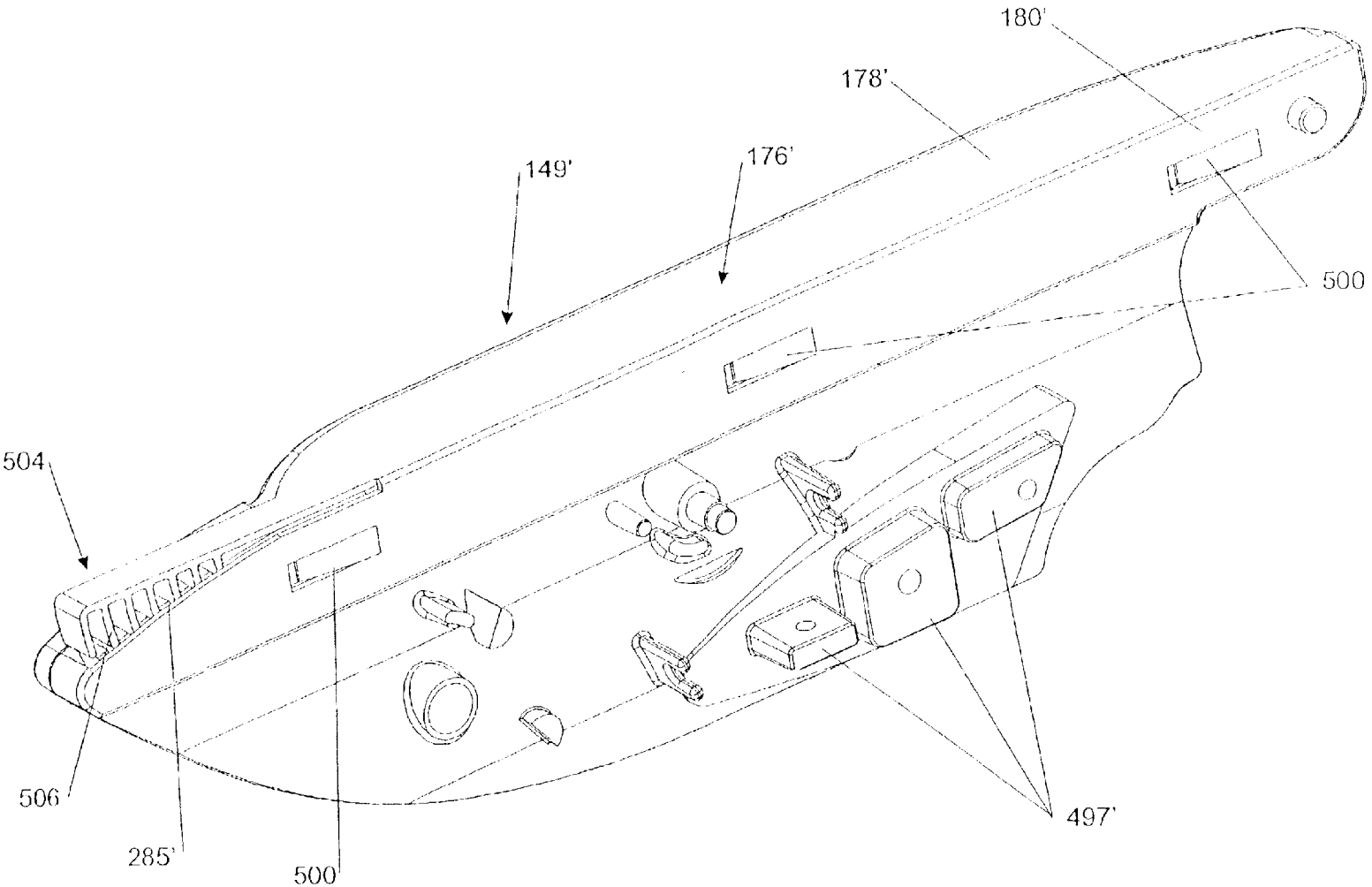
FIG. 62*b* is a perspective view of the opposite side the seat guide to that shown in FIG. 43.
Figure 62C:
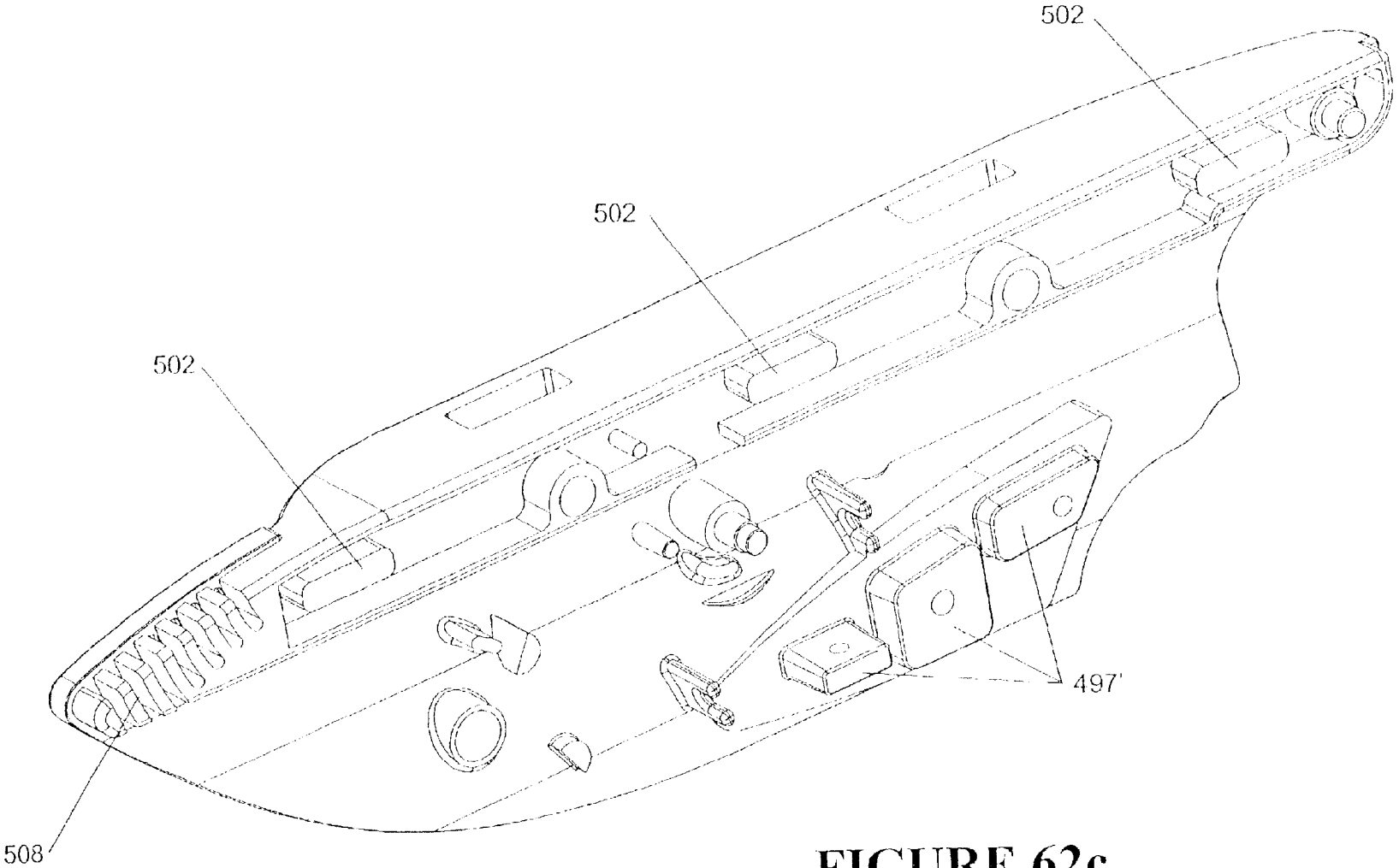
FIG. 62*c* is a perspective view of the seat guide as shown in FIG. 62*b* except with a portion removed.

As already explained, the seat guide 149' illustrated in FIG. 62*b* includes a seat guide liner 176'. The seat guide liner 176' includes an upper glide surface 178' and an inner glide surface 180'. Thus, the seat guide liner 176' is essentially L-shaped in configuration. The inner glide surface 180 is formed with a series of spaced integral resilient projections 500. The integral resilient projections 500 are directed inwardly. The seat guide liner 176' is supported on a metal supporting part of the seat guide liner as shown in FIG. 62*c*. The inner glide surface 180 is disposed in spaced configuration from the inside of the supporting part of the seat guide 149'. Additionally, the supporting part of the seat guide 149' includes three spaced rests 502. The integral resilient projections 500 are shaped like ramps, the ends of which engage against the associated rest 502. The majority of the inner glide surface 180' is thereby resiliently held in spaced configuration from the supporting part of the seat guide 149'.

It can been seen in FIG. 59 of the first embodiment that a gap exists between the top surface of the seat guide 149 and the spacer blocks 270 which extend from the seat panel 14. This gap might be one in which the occupant can get their fingers caught. Accordingly, a movable comb like formation 504 is incorporated into the seat guide liner 176' as shown in FIG. 62*b*. The comb like formation 504 has an upper surface continuous with the upper glide surface 178' and dependent prongs 506 which extend downwardly. The prongs are receivable into a series of corresponding pits 508 formed in the metal supporting part of the seat guide 149'. The movable comb like formation 504 is resiliently flexible and would normally extend to fill the gap between the leading edge 285 of the seat guide 149' and the dependent spacer blocks 270'. For instance, see FIG. 63 although in FIG. 63, the occupant's weight is not yet bearing on seat panel 14 and thus the seat panel 14 has not yet come to rest on top of the comb like formation 504. Additionally, the dependent spacer blocks are not visible in this view because the seat panel 14 has a peripheral guard to prevent jamming of fingers in the V-shaped gaps of the spacer blocks 270'. When the user's weight bears forwardly of the seat panel 14, the spacer blocks 270' will come to bear against the comb like formation 504 which will deflect as the seat portion 14 folds about the transverse fold. In this way, the comb like formation 504 presents an additional guard to mitigate the likelihood of user's fingers being caught between the seat panel 14 and the seat guide However, the comb like formation 504 does not interfere with the transverse folding of the seat panel 14.

Figure 63:
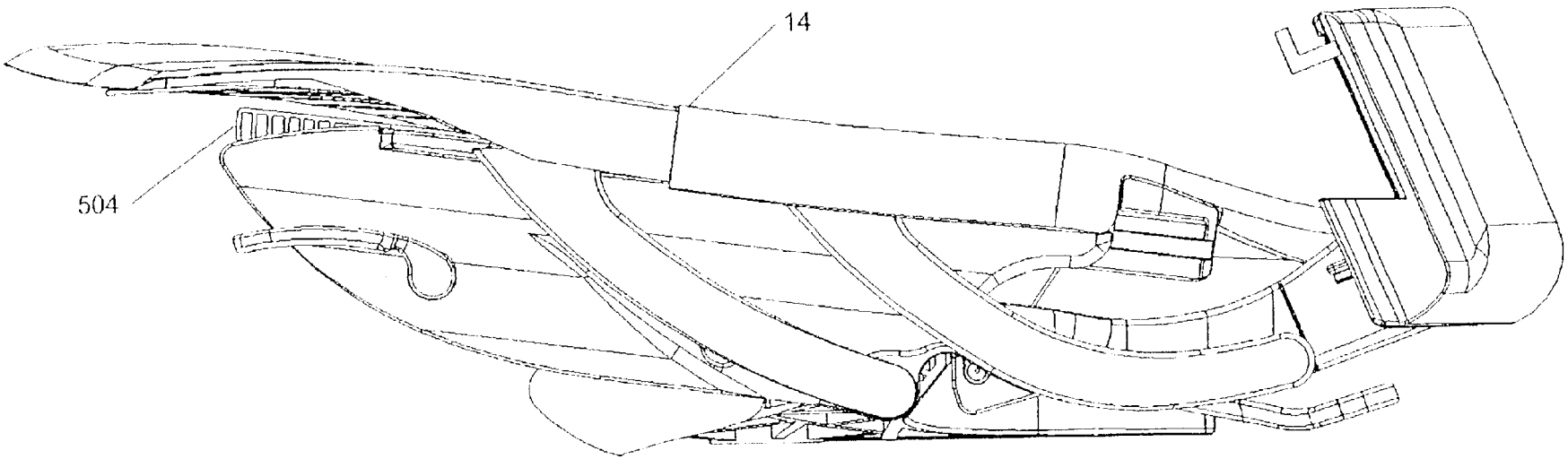
FIG. 63 is a side view of a portion of the chair with the seat panel in a retracted position.
Figure 64:
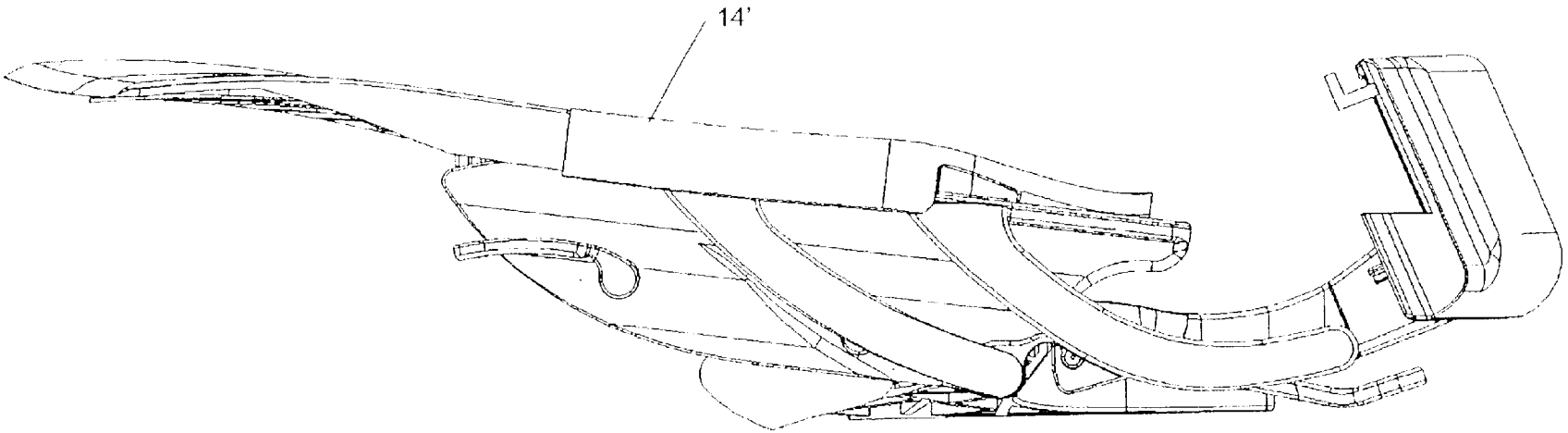
FIG. 64 is a side view of the portion of the chair of FIG. 63 with the seat panel in an extended position.
Figure 65:
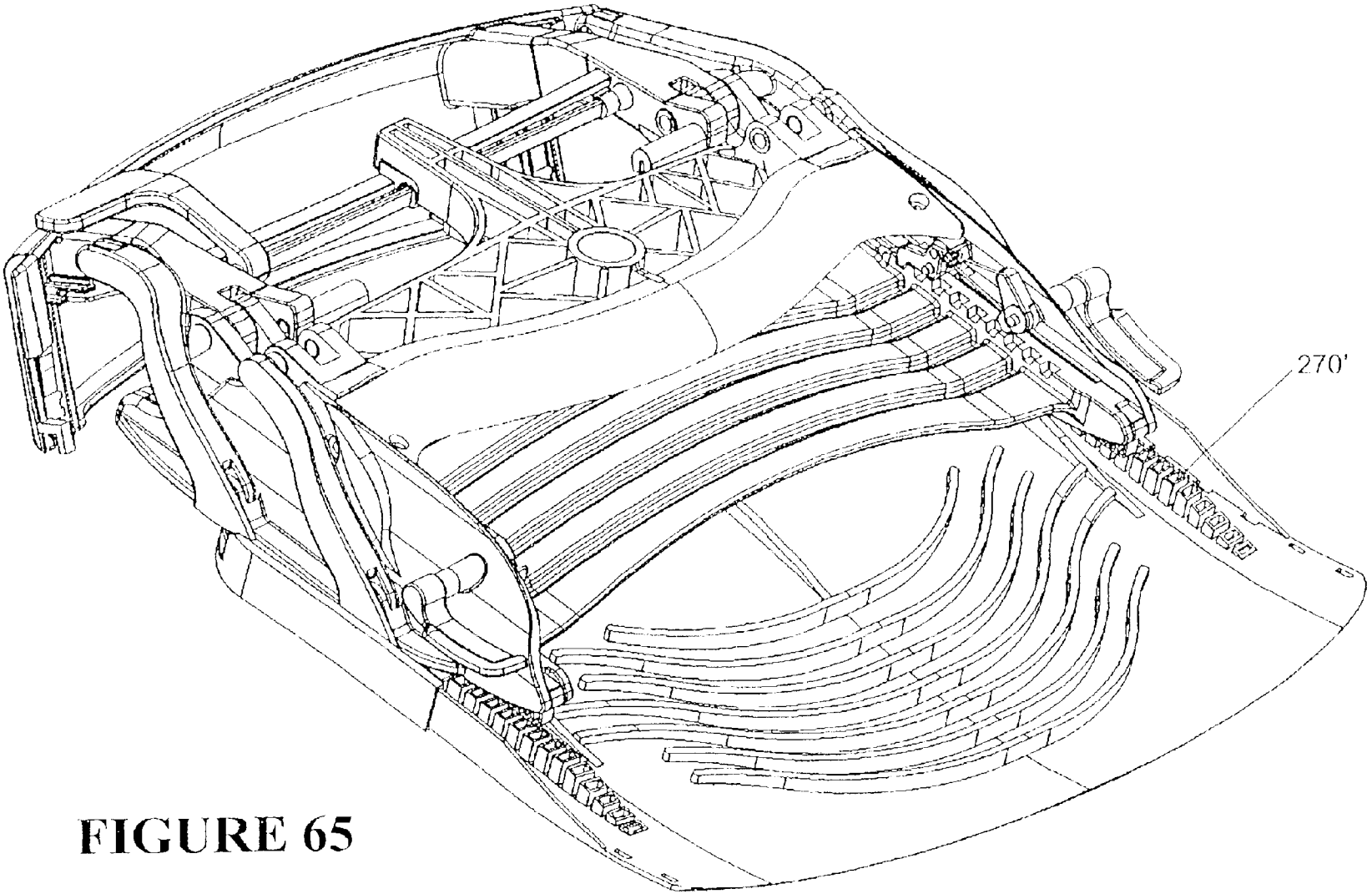
FIG. 65 is an underside view of the portion of the chair illustrated in FIGS. 63 and 64 illustrating the seat depth adjustment mechanism.

FIG. 63 illustrates the seat panel 14 in its inward retracted position whereas FIG. 64 illustrates the seat panel 14 located in its outer most extended position.

Lumbar Support Mechanism

Figure 66:
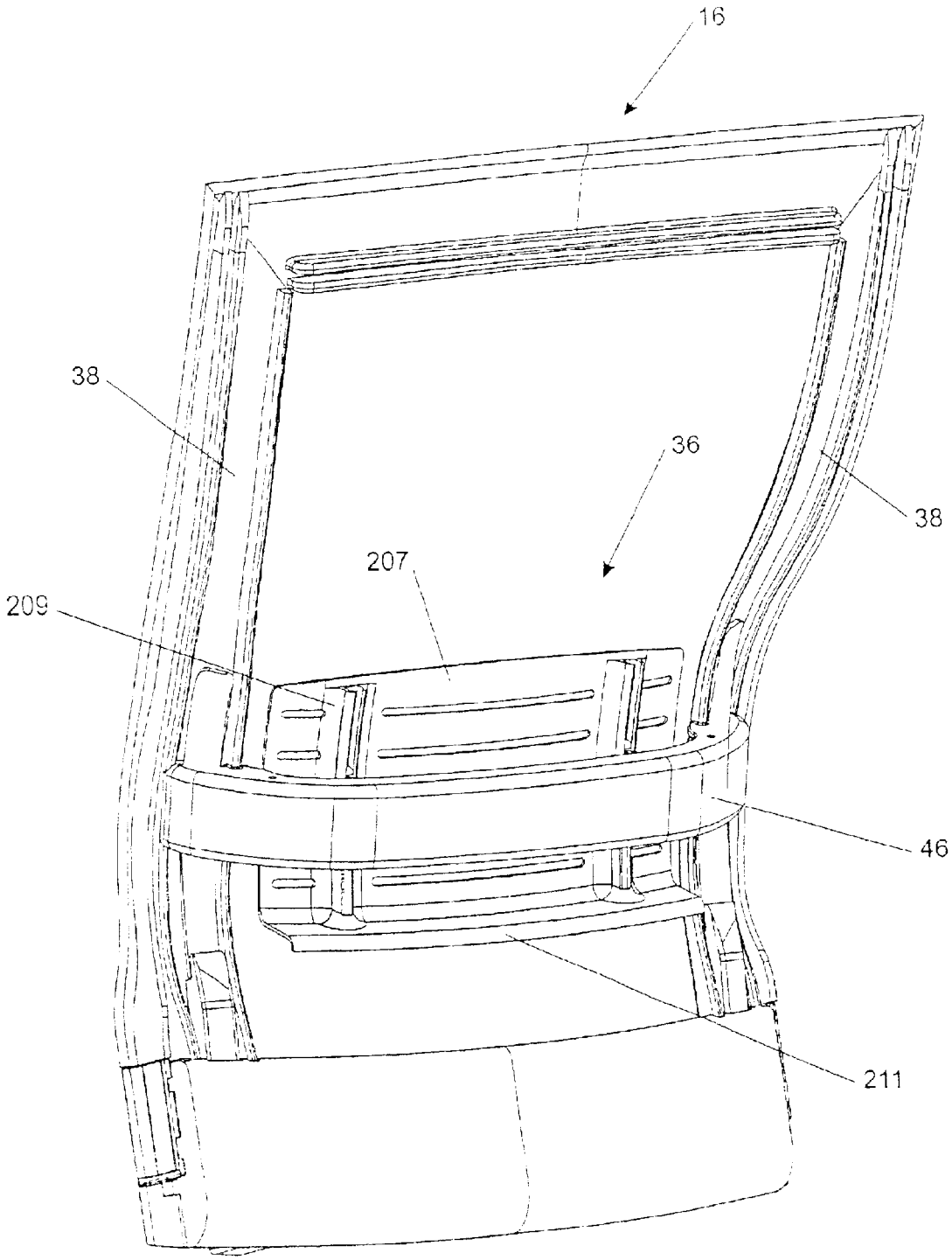
FIG. 66 is a perspective view of the back portion of the chair according to the first embodiment of FIG. 1 with an assembled lumbar support mechanism.

FIG. 66 is a perspective view of the back portion 16 illustrating the main components of a lumbar support mechanism 36. The lumbar support mechanism 36 includes a lumbar support panel 207. The lumbar support panel 207 is provided with two-spaced upright tracks in the form of C-shaped channels 209. It can be seen that the lumbar support panel 207 is provided with horizontal slots extending in the horizontal direction. However, in another embodiment, (not shown) the slots may extend vertically. The lumbar support panel 207 is provided with a grab bar 211 to enable height adjustment by the chair occupant. The lumbar support panel 207 is integrally moulded of plastic material such as nylon.

Figure 67:
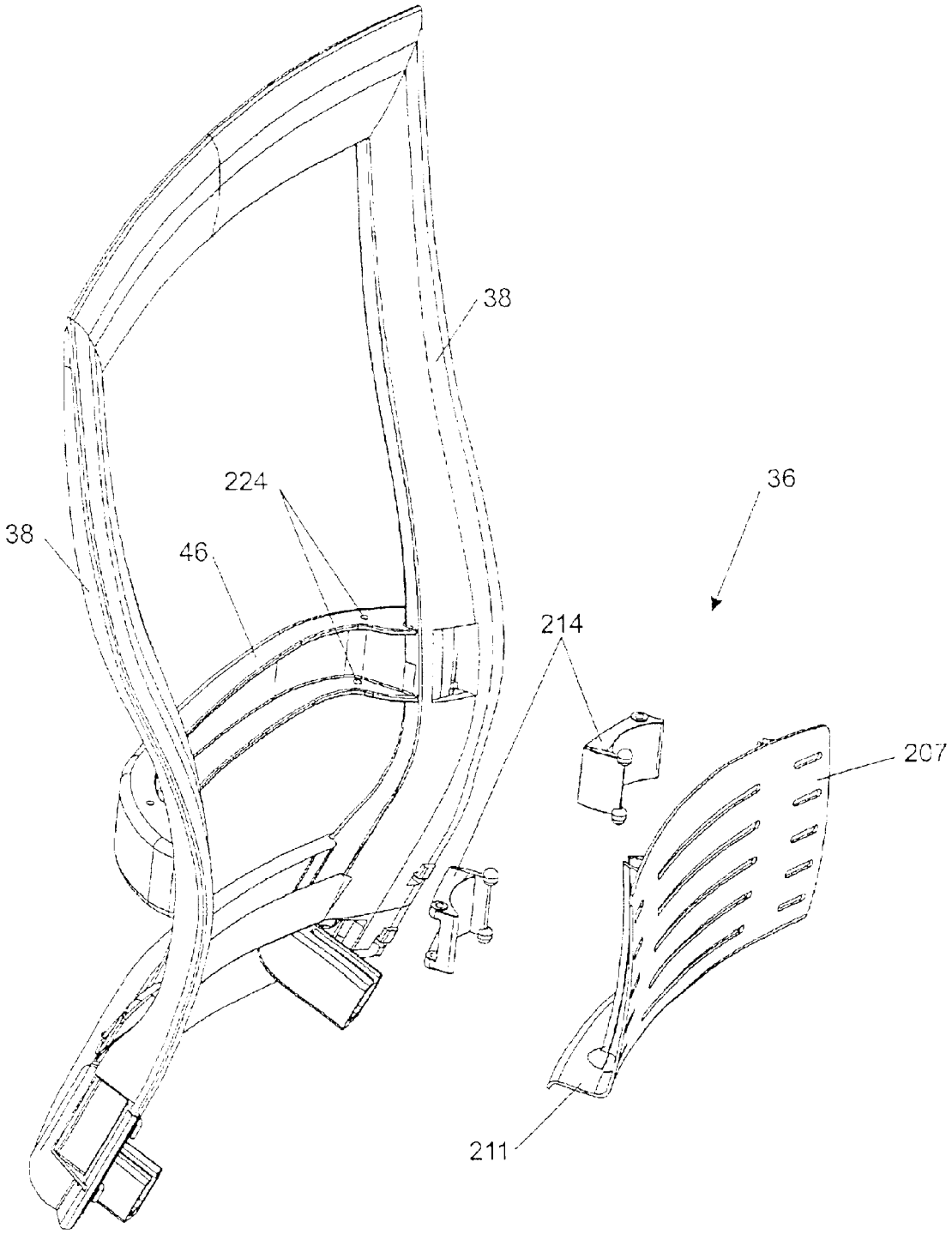
FIG. 67 is a perspective view of the back portion of FIG. 66, with the elements of the lumbar support mechanism illustrated in exploded configuration.
Figure 68:
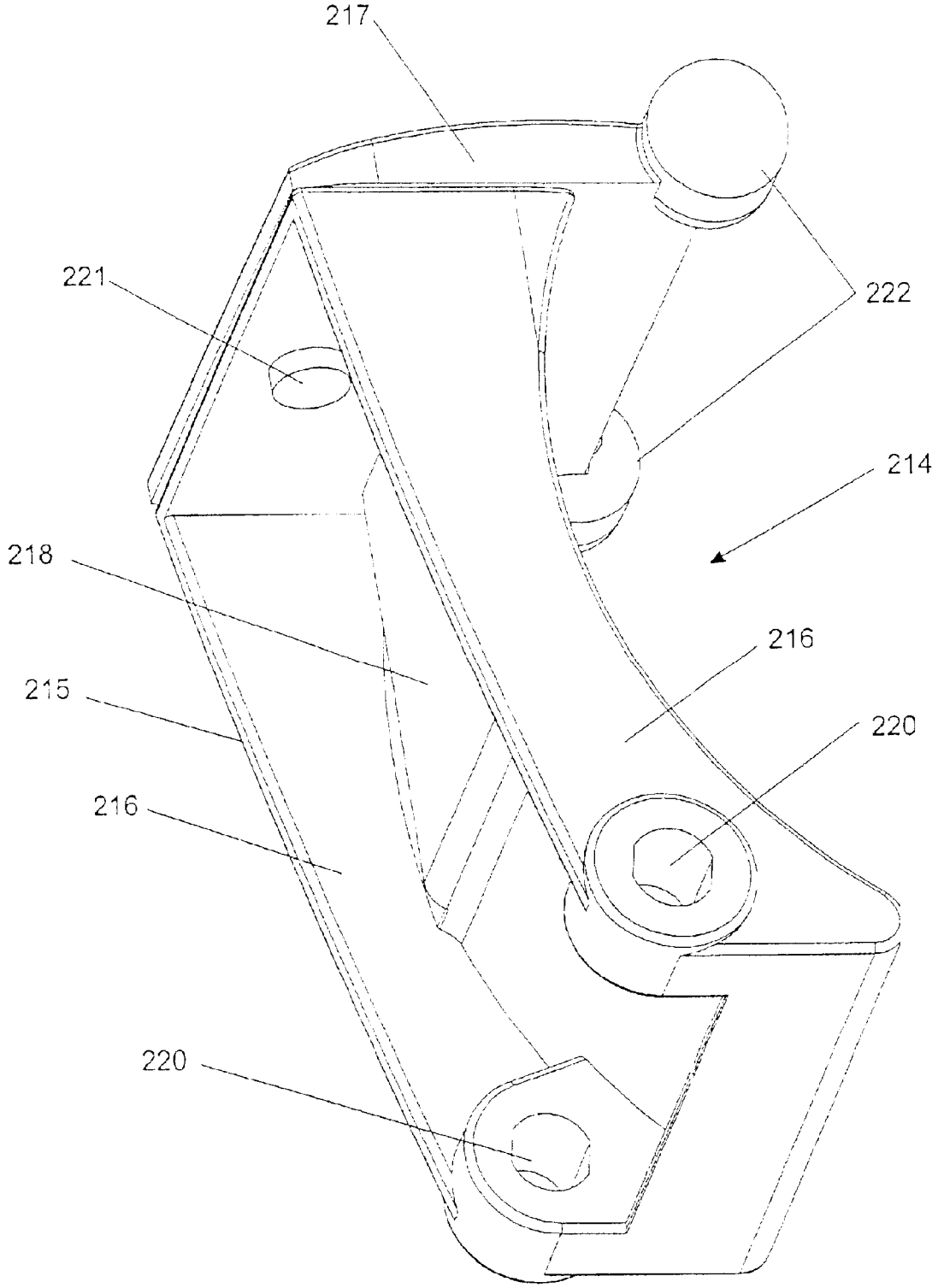
FIG. 68 is a perspective view of a part of the lumbar support mechanism illustrated in FIG. 67.

As can be seen more clearly in FIG. 67, mounted to the back beam 46 is a pair of hinges 214. The hinges 214 are mounted at spaced locations along the back beam 46, one to the left hand side and one to the right hand side. FIG. 68 illustrates in greater detail the form of the hinges 214. The hinge 214 is a two piece component comprised of a short arm 215 to which a swivel 217 is pivotally mounted. The short arm 215 is an integrally cast metal component in the form comprising side walls 216 and an intermediate web 218. At one end of the short arm, the side walls 216 are provided with aligned apertures 220. The side walls 216 are fortified within the region of the aligned apertures 220. The apertures 220 are not circular in form but of slightly elongate configuration for effective operation of the lumbar support mechanism as will be understood.

At the other end of the short arm, the swivel 217 is pivotally mounted about pivot 221. The swivel 217 includes a plate-like member and two ball-like formations 222, protruding from the end of the short arm. The ball-like formations 222 are shaped to engage within the same channel 209 provided on the rear of the lumbar support panel 207. Each of the hinges 214 is connected to the back beam 46 by the use of a pin (not shown) extending through the aligned apertures 220 as well as two aligned apertures 224 provided on the back beam 46. The apertures 224 are circular and the pin is also of circular cross-section. This enables the hinges 214 to pivot as well as to achieve a translatory movement within a small range defined by the shape of the aligned apertures 220.

Figure 69:
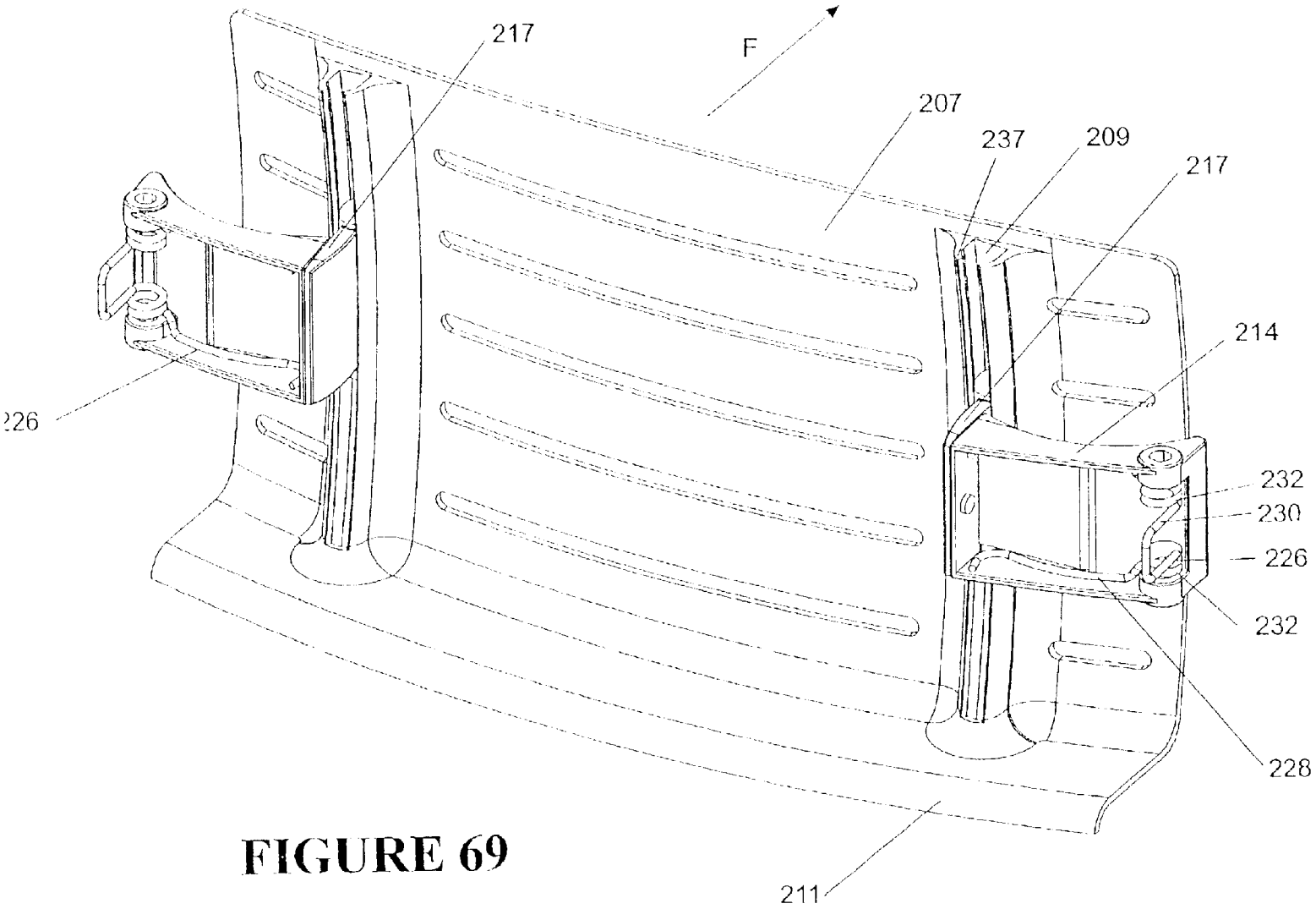
FIG. 69 is a further view of a portion of the lumbar support mechanism illustrated in FIG. 67.

As shown in FIG. 69, the two ball-like formations 222 of each hinge are received in a one of the channels 209. The lumbar support panel 207 is thereby slidable on the hinges 214. The chair occupant can adjust the position of the lumbar support panel 207 by grabbing the grab bar 211 and physically sliding the panel 207 up or down.

The panel 207 abuts against the top of the back attach casting 48 to stop it from sliding down until the balls disengage from the channel. Additionally caps (not shown) close the top of the channels 209.

Also illustrated in FIG. 69 is a preferred form of a biasing device in the form of spring unit 226. Each hinge 214 has a spring unit 226 associated with it for biasing the associated hinge 214 and the lumbar support panel 207 in the forwards direction. The spring unit 226 includes two first bars 228 (only one of which is can be seen in FIG. 69). The first bars 228 are received between the side walls 216 of the hinge 214. Two second bars 230 bear against the back beam 46. Two spring portions 232 bias the two first bars 228 away from the two second bars 230 in order to bias the lumbar support panel 207 forwardly of the chair. Each spring unit 226 is of integral construction made from spring wire.

The lumbar support panel 207 is of generally curved configuration as illustrated in FIG. 67 to conform with the shape of the occupant's spine. In the completed chair, the peripheral frame 34 of the back portion has a mesh fabric stretched taut across the opening, thereby defining the forward surface of the back portion 16. The lumbar support panel 207 is suitably provided with padding (not shown) on its forward surface. The forward surface of the lumbar support panel 207 or that of the padding (where appropriate) lays behind the mesh fabric. As the user leans against the chair back, some stretching of the mesh fabric will envitably occur and the occupant's lumbar spine region will be supported by the lumbar support panel 207 against the bias of the spring units 226. This offers the chair occupant a small force exerted on the lumbar region of the spine being in the vicinity of about 5 kg. This is considered to be comfortable to the chair's occupant. The lumbar support panel 207 thereby offers a floating support to the occupant of the chair. The hinges will to an extent be able to pivot about aligned apertures 220 independently of each other, depending on which side of the back portion the occupant is leaning against. Additionally, the lumbar support panel can also pivot about a horizontal axis between the two pivots 221.

Figure 70:
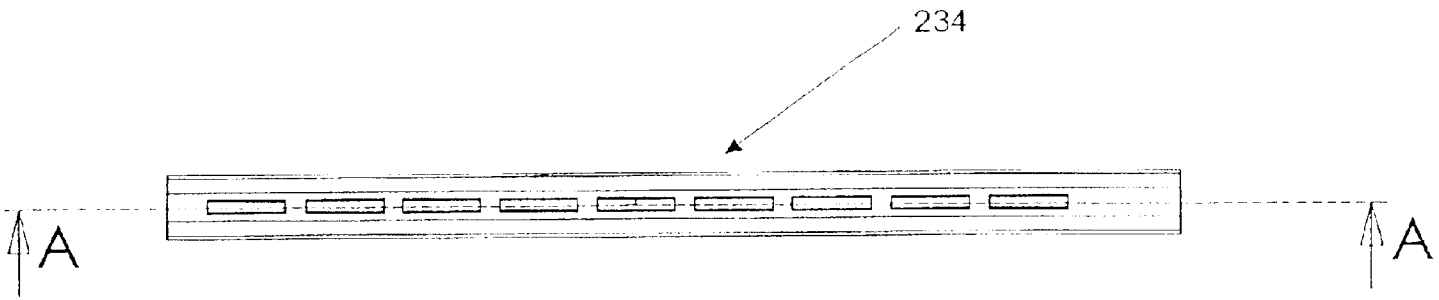
FIG. 70 is a plan view of a ripple strip, forming part of the lumbar support mechanism illustrated in FIG. 67.
Figure 71:
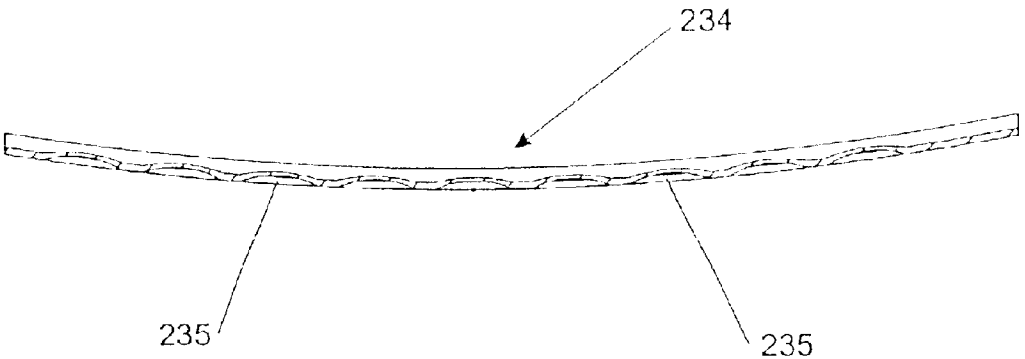
FIG. 71 is a cross-sectional view of the ripple strip illustrated in FIG. 31 along A—A.

FIGS. 70 and 71 illustrate the form of a ripple strip which may be embedded at the base of the channels 209. The ripple strip is of unitary moulded plastics construction. The upper surface of the ripple strip is undulating with the dips in the undulations serving to locate the ball-like formations 222 of the hinges 214. The ball-like formations are held within the channels 209 by inwardly directed lips 237 at the edges of the channels 209. The ripple strip is comprised of a resilient plastics material. The rises 235 of the ripple strip must undergo deformation to enable each ball-like formation 222 to move along the channel 209 over the rise 235. The ripple strip 234 may be glued into position in the base of the channel 209. Alternatively, the profile of the ripple strip may be integrally moulded into the base of the channel 209.

Figure 72:
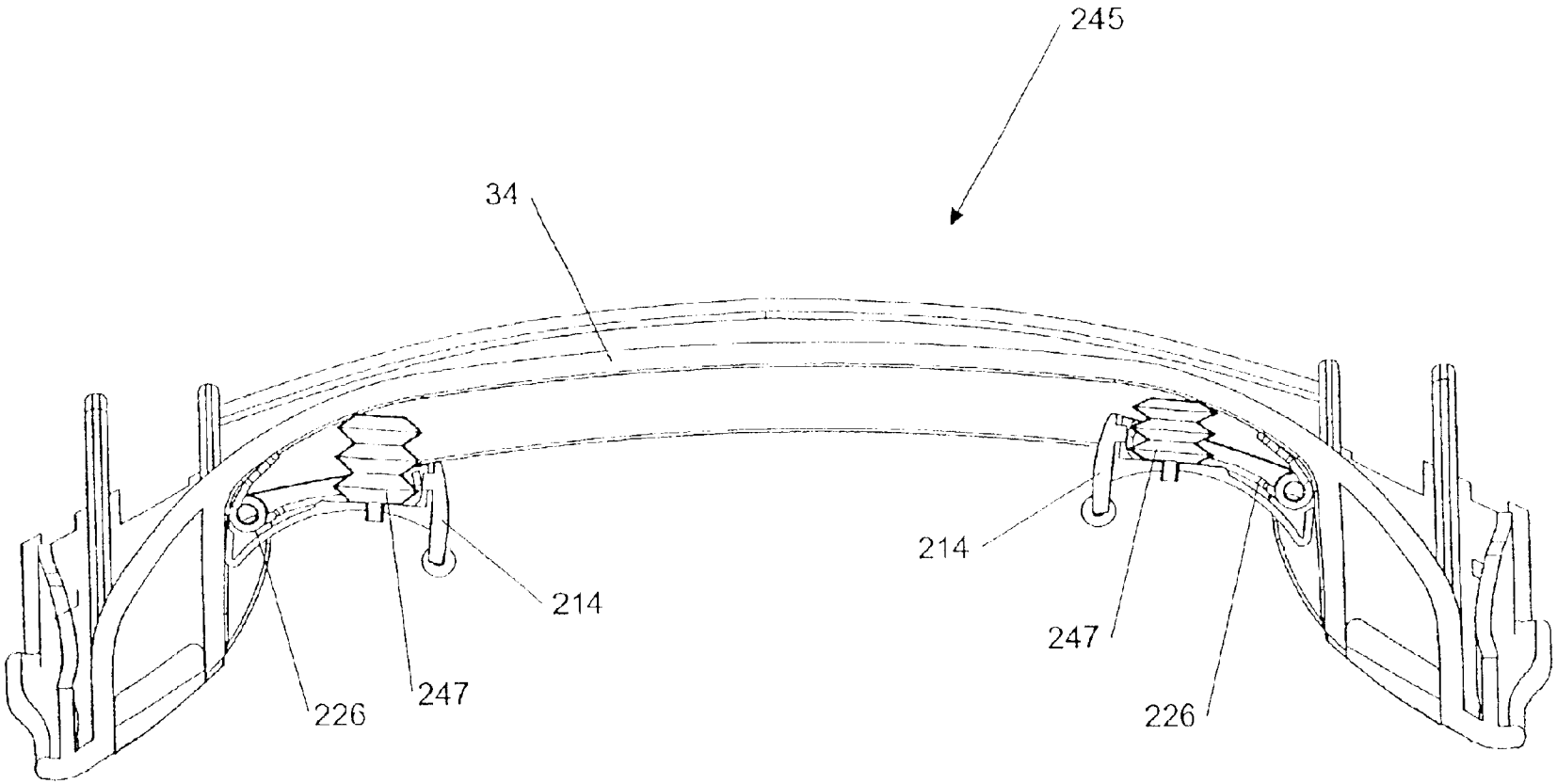
FIG. 72 is a cross-sectional view illustrating a modified form of the lumbar support mechanism.
Figure 73:
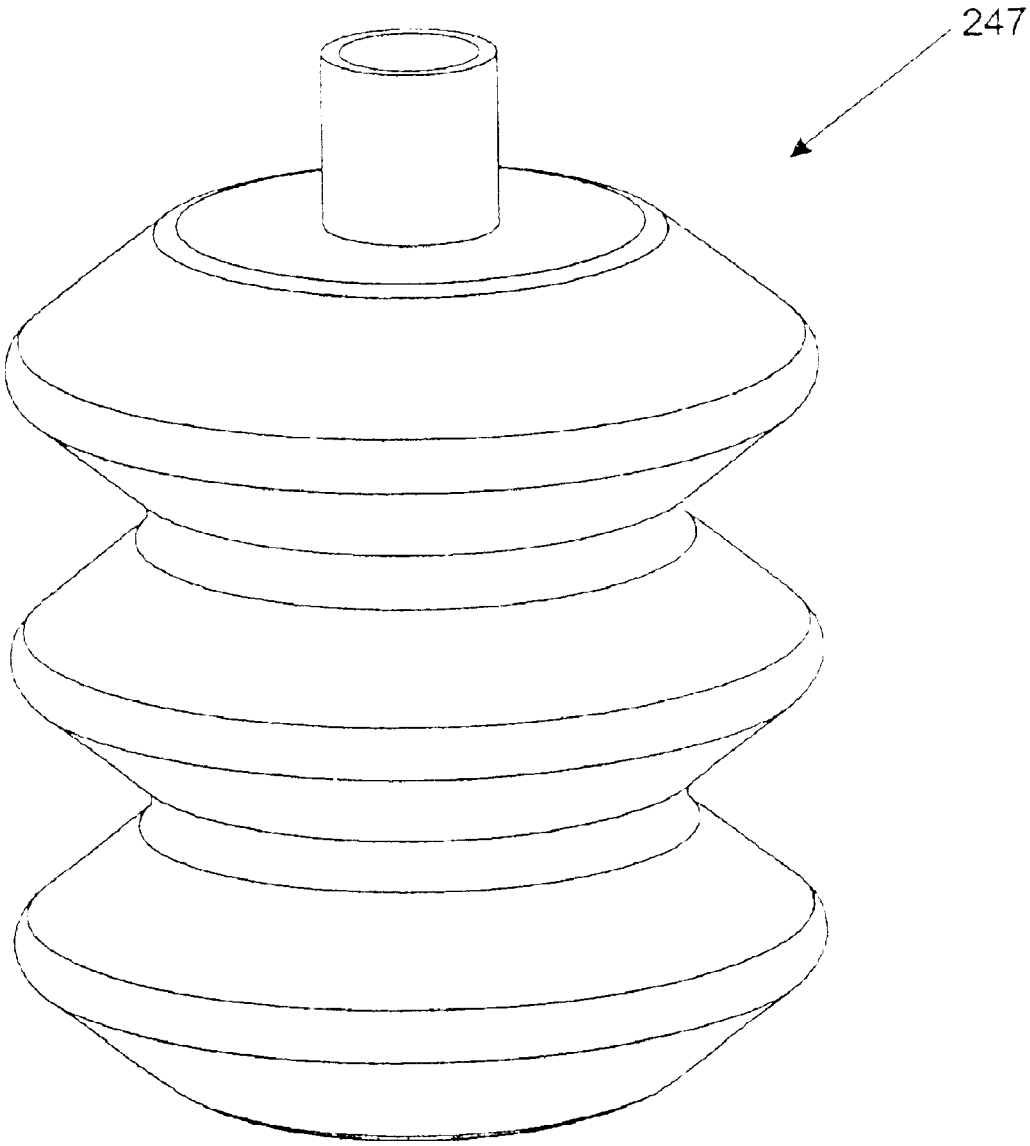
FIG. 73 is a perspective view of a bellows for use in the modified form of the lumbar support mechanism illustrated in FIG. 72.
Figure 74:
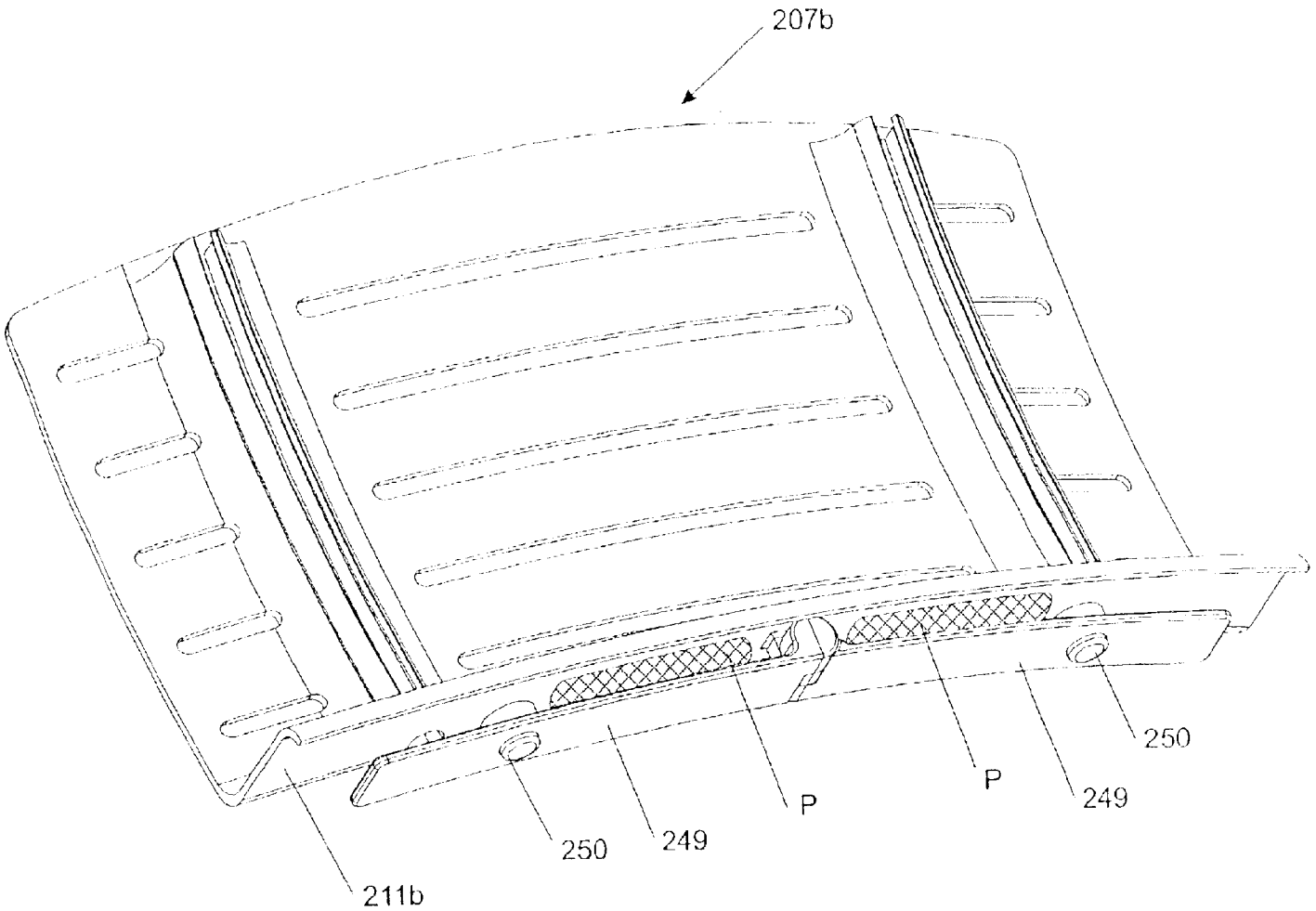
FIG. 74 is a perspective view of a modified form of the lumbar support panel illustrated in FIG. 69.
Figure 75:
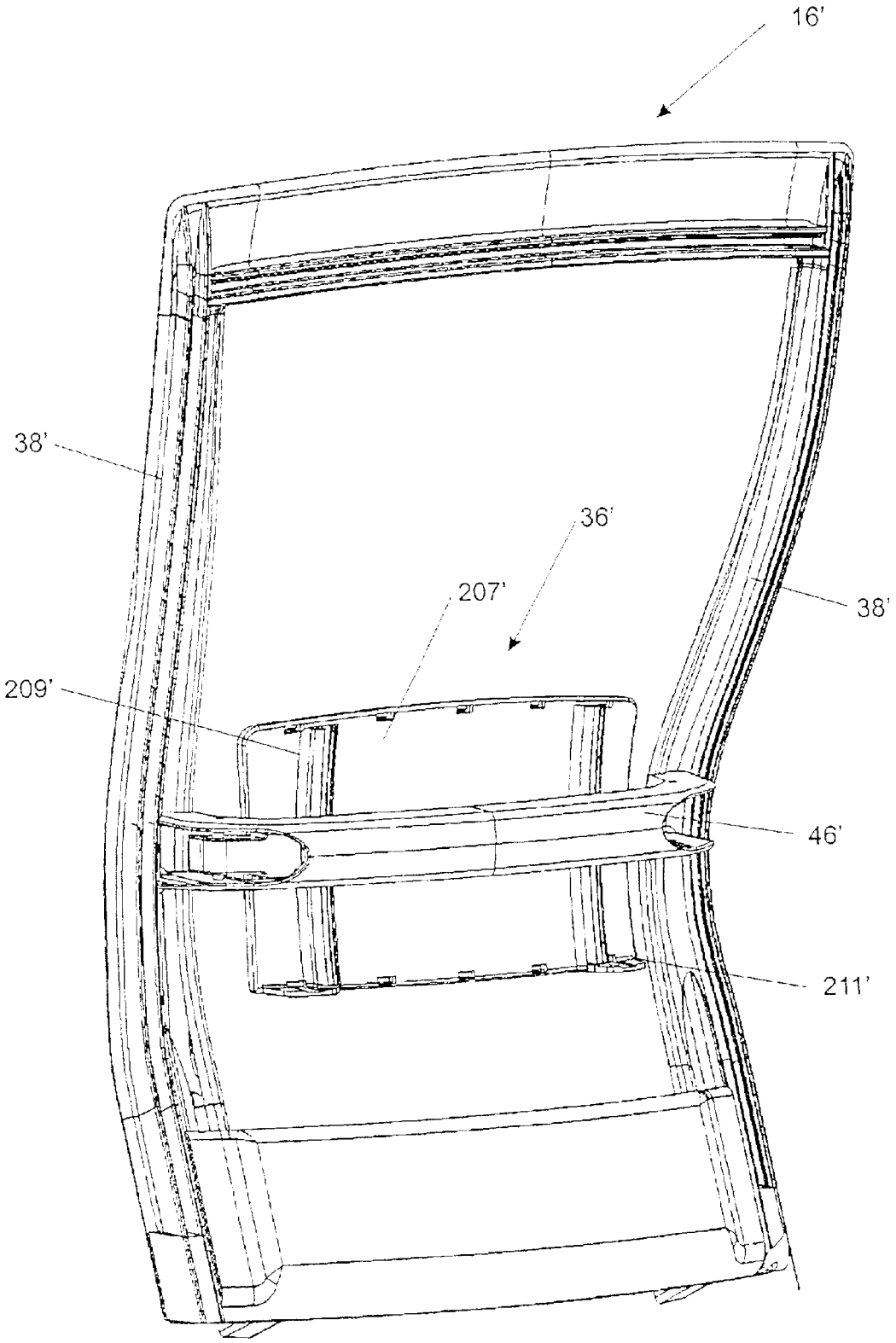
FIG. 75 is a perspective view of a back portion of the chair according to the second embodiment assembled with a modified form of a lumbar support mechanism.
Figure 76:
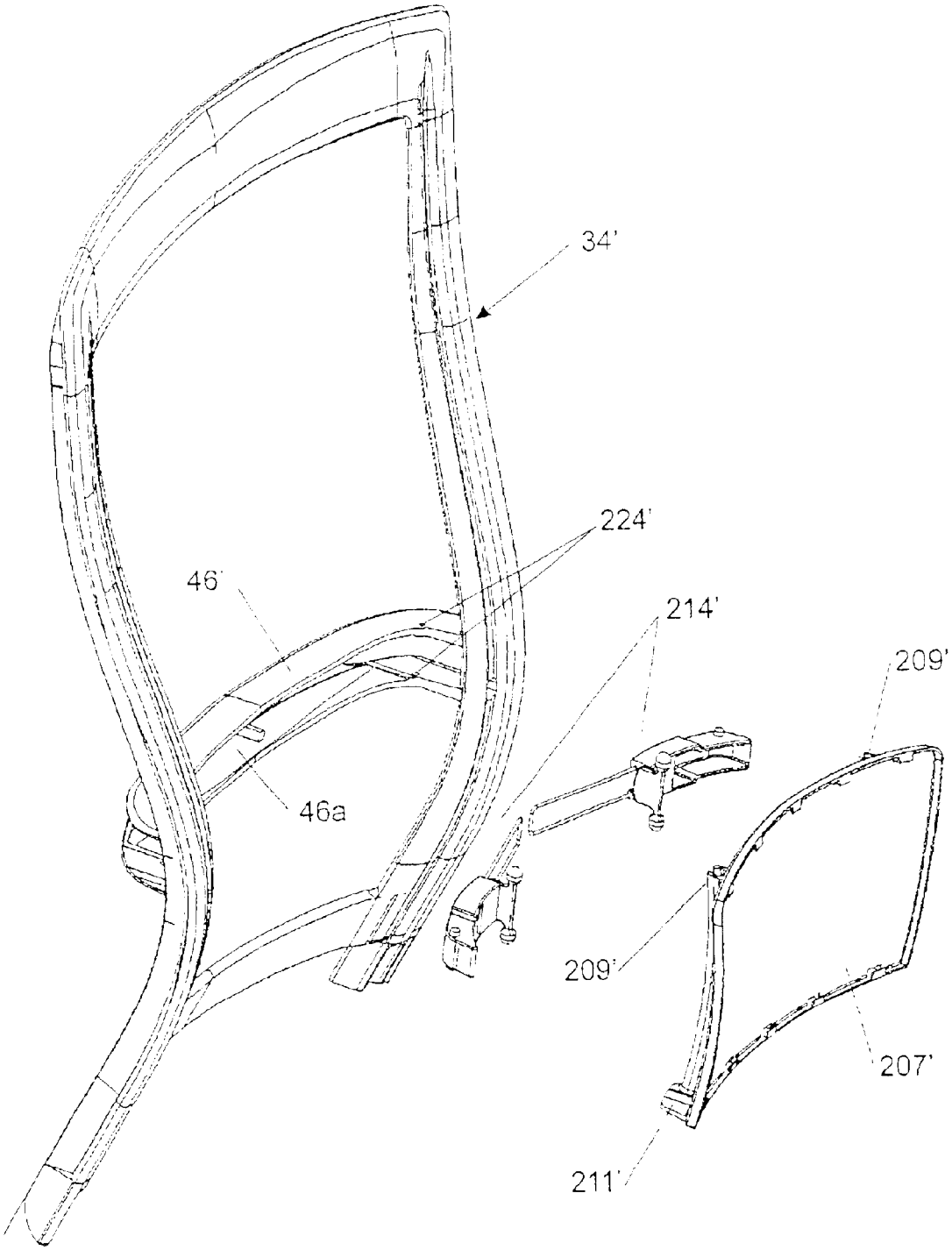
FIG. 76 is an exploded view of the lumbar support mechanism of FIG. 75.
Figure 77:
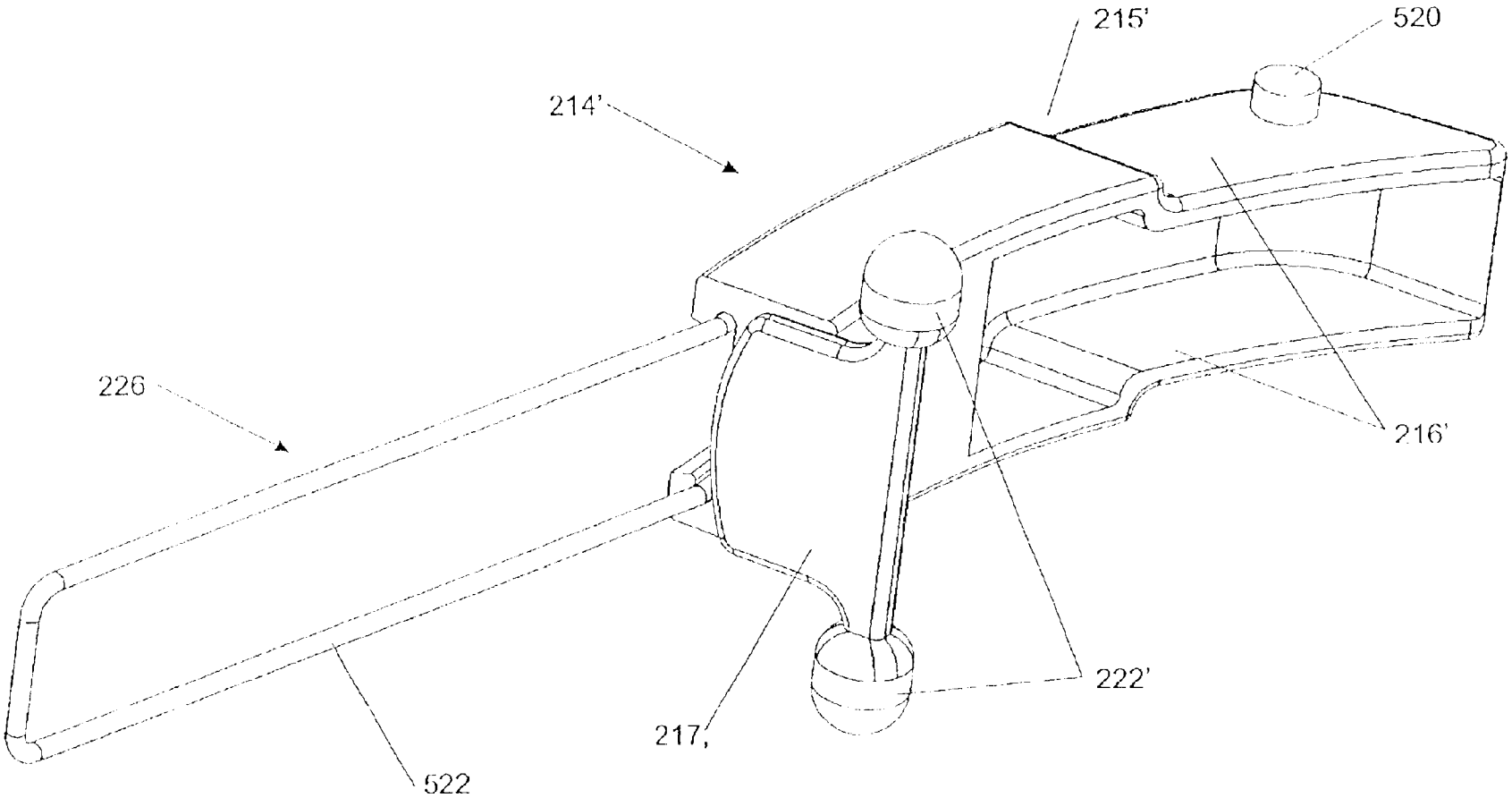
FIG. 77 is a perspective view of a part of the lumbar support mechanism illustrated in FIG. 76.

FIG. 72 illustrates a modified form of the lumbar adjustment mechanism 245 which, in addition to the spring units 226, includes user adjustable bladder units 247. The spring units 226 may be substituted for lighter spring units. Alternatively, bladder units may be used in lieu of the spring units 226. The bladder units are each in the form of an inflatable bellows as illustrated in FIG. 73. Each bellows 247 is disposed between the back beam and a corresponding hinge 214. The rear of the web 218 of each hinge 214 includes a circular recess (not shown) to accommodate the bellows 247. Both bellows 247 are linked to a user actuable pump (not shown) disposed on the underside of the grab bar 211*b* as shown in FIG. 74 which shows a slightly modified form of a lumbar support panel. An appropriate pump can be obtained from Dielectrics Industries of Massachusetts. See for example U.S. Pat. No. 5,372,487 which describes an appropriate user actuable pump. The pump P is connected to both bellows 247 by means of conduits. Both of the bellows 247 are linked by a T-connection to equalise the inflation of the bellows 247.

While the pumps are not shown in FIG. 74, depressible levers 249 which operate the pumps are illustrated on the underside of the grab bar 211*b*. The depressible levers 249 are pivotally mounted about a common pivot centrally disposed on the underside of the grab bar 211*b*. Each of the pumps P is positioned where indicated between an associated lever 249 and the underside of the grab bar 211*b*. To operate the pumps P, the occupant depresses the outer end of the either lever 249 and pumps the pumps P to inflate the bellows 247. If the amount of air in the bellows is too great causing the lumbar support panel to extend too far forwardly, the occupant of the chair can release some of the pressure by actuating a pressure release 250 associated with each lever 249. Each pressure release 250 is associated with a valve in the conduits leading to the bellows 247 to release pressure from the bellows 247.

Therefore, the occupant of the chair can adjust the forward position of the lumbar support panel 207*b* by adjusting the inflation of the bellows 247. Since the bellows 247 are air-filled they will possess a natural resiliency because the air can be compressed in the bellows 247 as the chair occupant pushes against the lumbar support panel 207*b*.

Lumbar Support—Second Embodiment

As shown in FIG. 75 through 79, the lumbar support mechanism 36' for use in the second embodiment of the chair is not substantially different from that described in connection with FIGS. 66 through 71. Therefore, where the parts are substantially the same in function, the parts will be represented by like numerals with the addition of the prime symbol (')). Therefore, the second embodiment lumbar support mechanism will not be described in intricate detail. As can be seen from inspection of FIG. 76 and 77, one of the main points of difference is the configuration of the hinges 214. Instead of being pivotally mounted by means of a pin, each hinge includes two spigots 520 extending from the side walls 216 of the arm portion 215' of the hinge 214'. Accordingly, the apertures 224' on the back beam 46' may be elongate to enable the hinges 214' to achieve a translatory movement as well as a pivoting movement.

Furthermore, the configuration of the spring units 226' is changed compared to the first embodiment. The spring units 226 still function in the same manner to bias the hinges 214' forwardly. However, the hinge unit 226' includes an elongate U-shaped spring portion 522. As can be appreciated from the exploded view in FIG. 76, the hinge units 214' are arranged on opposite sides of the back beam 46' so that the two elongate U-shaped spring portions 522 extend inwardly towards the centre of the back beam 46'.

Figure 78:
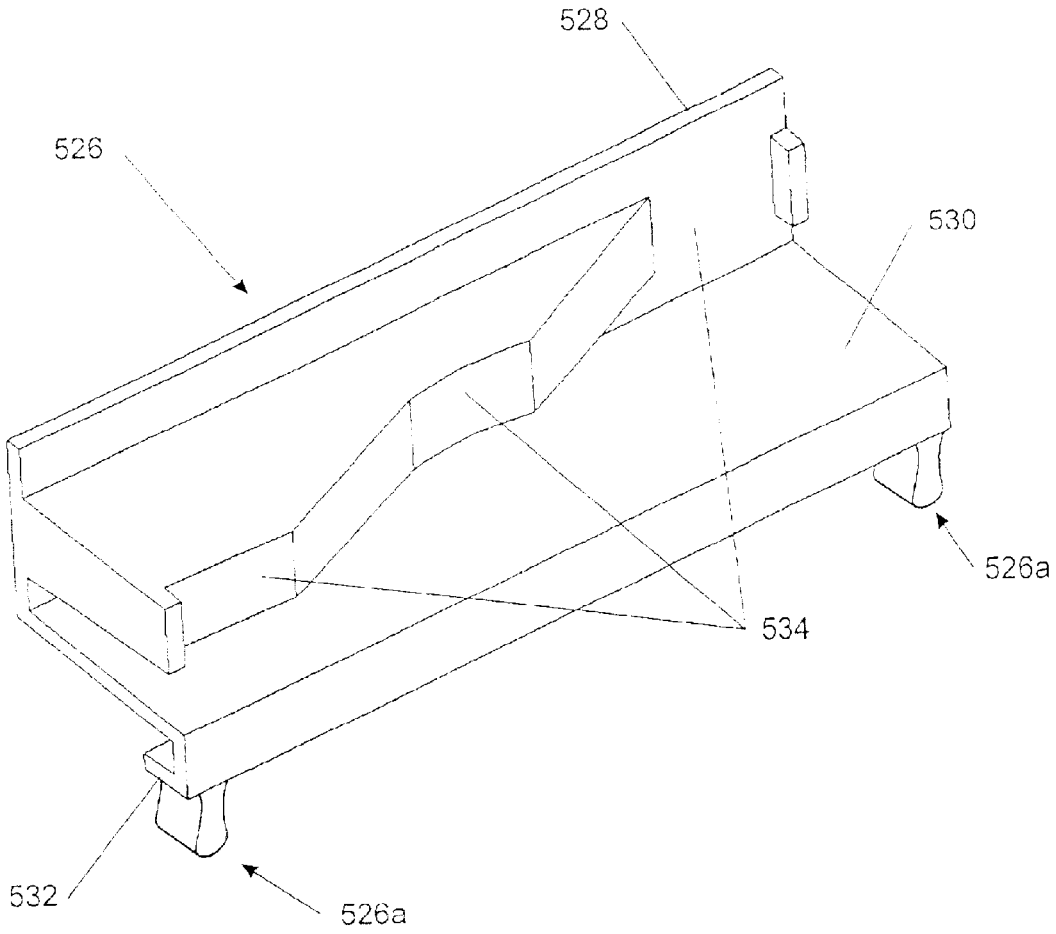
FIG. 78 is a perspective view of another part of the lumbar support mechanism illustrated in FIG. 76.

The back beam 46' mounts a lumbar preference control device 526 as shown in FIG. 78 on the forward side thereof. The lumbar preference control device 526 includes a back wall 528 and a base wall 530 with a return flange 532. The return flange 532 engages with the forward edge of the base 46*a* of the back beam to control sliding movement of the lumbar preference control there along. The lumbar preference control device 526 can slide transversely along the back beam 46'. The lumbar preference control device 526 further includes a series of three spaced flats 534 which vary in their forward spacing from the back wall 528. The remote ends of the U-shaped spring portions 522 terminate at a common point on the lumbar preference control device 526. Depending upon the transverse positioning of the lumbar preference control device 526, the remote ends of the U-shaped spring portions 522 will be located together at any one of three of the flats 534. The positioning of the remote ends of the U-shaped portions 522 on the flats 34 will determine the spring tension on each of the spring units 226' thereby determining the forward bias on the hinges 214' and consequently the lumbar support panel 217'.

The lumbar preference control device 526 includes a pair of position adjustment protrusions 526*a,* either or both of which may be gripped by a user to slide the preference control device 526 along the back beam 46'.

Figure 79:
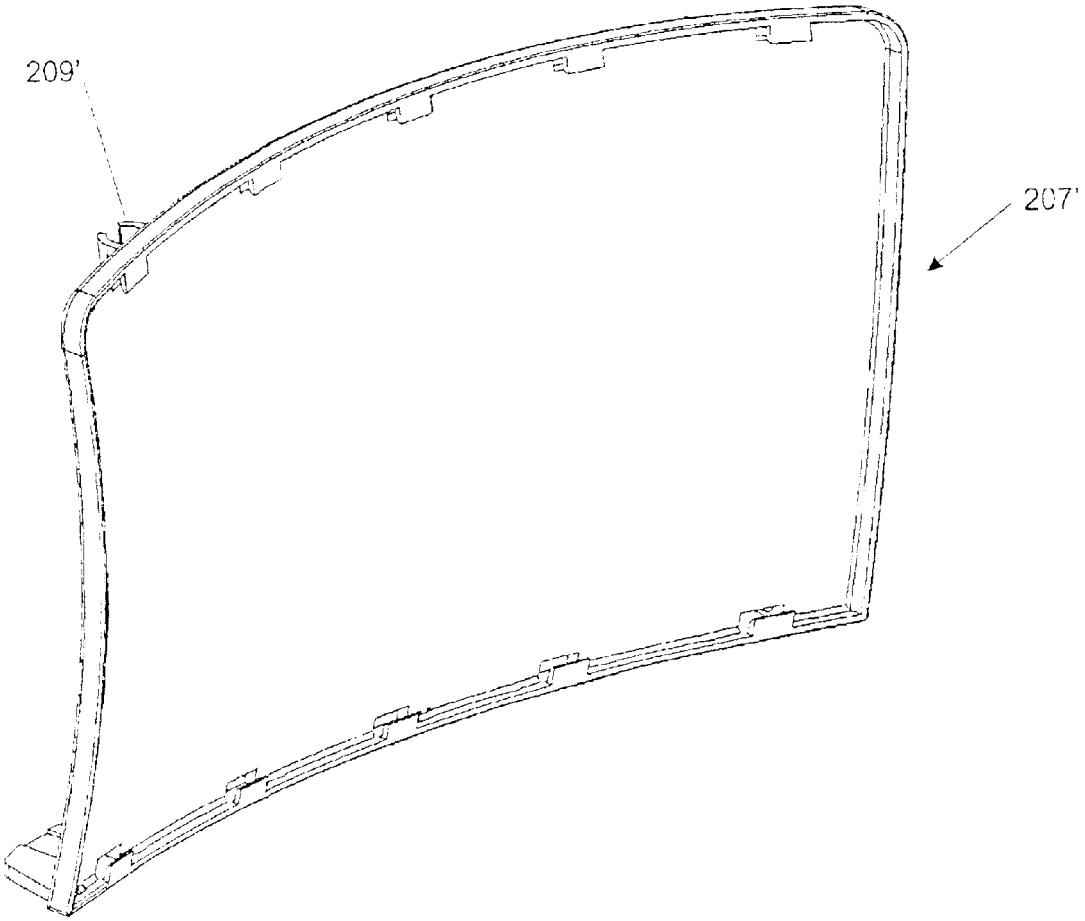
FIG. 79 is a perspective view of a lumbar support panel forming part of the lumbar support mechanism illustrated in FIG. 76.

A ripple strip similar to that described above with reference to FIGS. 70 and 71 may be embedded in the base of the channels 209' of the lumbar support panel 207' illustrated in FIG. 79. The lumbar support panel 207' may be made from a translucent material.

Figure 80:
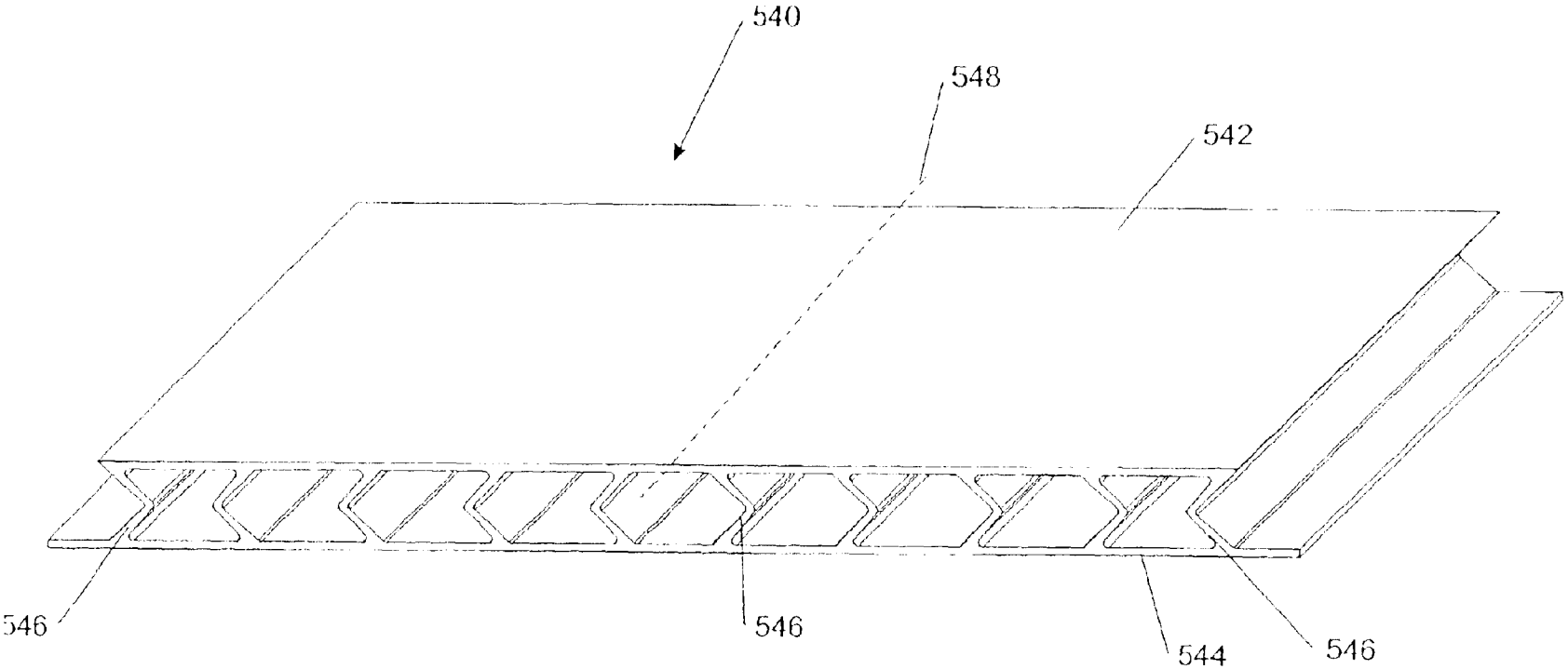
FIG. 80 is a perspective view of a lumbar cushion for use with the lumbar support mechanism illustrated in FIG. 76.

FIG. 80 illustrates the form of a lumbar cushion 540 which is attached to the forward face of the lumbar support panel 207' illustrated in FIG. 79. The lumbar cushion 540 is constructed of resiliently flexible material. The lumbar cushion 540 comprises a first sheet 542 spaced in substantially parallel configuration from a second sheet 544. The first sheet and the second sheet 542, 544 are of substantially equal size and arranged in a superimposed configuration. The first sheet 542 and the second sheet 544 are separated by spaced webs 546 which are arrow-like in formation as shown. The lumbar cushion 540 has a transverse centre line 548. The majority of the webs on either side of the transverse centre line 548 point away from the transverse centre line 548. The only exception to this are the two webs 546 at each end which point towards the transverse centre line 548.

The webs 546 are of a resiliently flexible nature and thus create a cushioning between the first sheet 542 and the second sheet 544. Additionally, the arrow-like formation of the webs 546 means that the buckling resistance of the webs 546 is already overcome. In contrast, if the webs had been straight then there would be an initial buckling resistance to overcome thereby resulting in a more jerky movement as the first sheet 542 is pushed towards the second sheet 544. The arrow like formations 546 thus creates a softer more comfortable cushioning effect.

Upholstery

Figure 81:
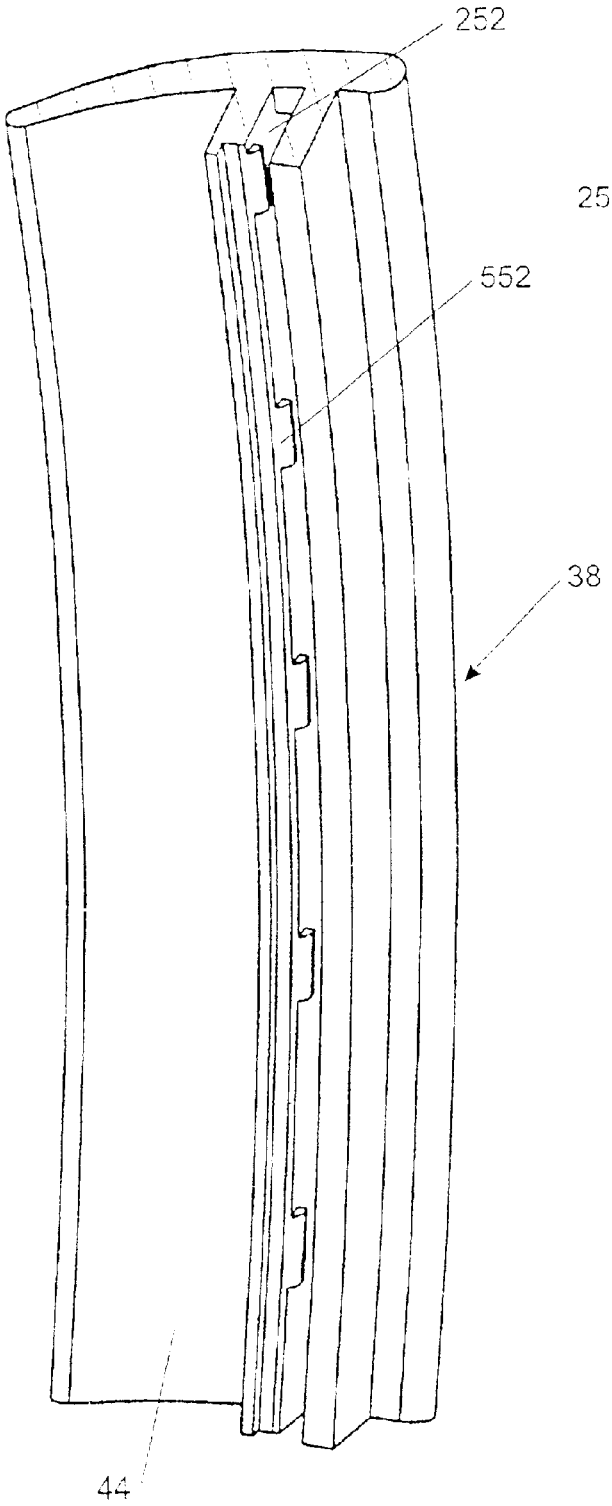
FIG. 81 is a perspective view of an upright member of the back frame, cutthrough to show the cross-section.

FIG. 81 illustrates the preferred cross section for the upright members 38 of the peripheral frame 34.

As has been described previously, the uprights of the peripheral frame each include a rearwardly open channel 44 in which the leaf spring 128 resides as has been explained previously. The upright member 38 also includes a second rearwardly open channel 252 of much narrower configuration than the first mentioned rearwardly open channel 44. The second rearwardly open channel 252 receives an attachment strip 254. The attachment strip 254 is of extruded resilient plastics material in the form shown. The attachment strip 254 has a longitudinal extending lip 550 which engages with retainer portions 552 provided along one of the walls of the channel 252 to assist in holding the attachment strip 254 within the channel 252. The attachment strip 254 also includes a part 258 which extends over the edge of the channel 252 when the lip 550 is engaged with retainer portions 552. The mesh fabric 260 is sized so that with the attachment strip 254 secured within the second rearwardly open channel 252 on both sides of the back portion 16, the mesh fabric 260 will be relatively taut across the peripheral frame. The top of the mesh fabric 260 is also held within a top rearwardly open channel 253, in the same manner. The bottom of the mesh fabric 260 is held within a bottom rearwardly open channel 255 in the same manner. The attachment strip 254 is a unitary strip extending around the entire periphery of the peripheral frame 34.

As already explained, the peripheral frame 34 is of flexible construction, particularly around the region corresponding to the lumbar region of the occupant. Additionally, the mesh fabric is drawn taut across the peripheral frame 34. It is important that the frame does not flex so as to draw in the upright members 38 of the peripheral frame 34 due to the tautness of the mesh fabric 260. Accordingly, the back beam 46 is positioned so as to correspond approximately with the lumbar region of the seat occupant. This maintains the spacing of the upright members 38, particularly in the lumbar region where the frame 34 bends. The bending of the peripheral frame 34 close to the lumbar region of the occupant is encouraged by the serpentine shape of the peripheral frame 34 as well as being encouraged by the cantilevered connection of the peripheral frame 34.

The mesh fabric 260 may have a degree of resiliency but this is somewhat limited. It is preferable that the mesh fabric should be able to maintain tension over a reasonably long period of time. It is desirable that the mesh fabric 260 is not overly stretched. For this reason, it is desirable that the neutral axis of bending be close to the front surface of the upright members 38 of the peripheral frame 34. Accordingly, the cross section of the peripheral frame 34 is designed to have the bulk of material on the forward face so that bending occurs as close as possible toward the forward face of the upright member 38. In bending, there will be some compression of the walls defining the channel 252 in the lumbar region. Additionally, there may be some flexing of the two walls of the channel 252 towards each other.

Topper Pad Assembly

Figure 88:
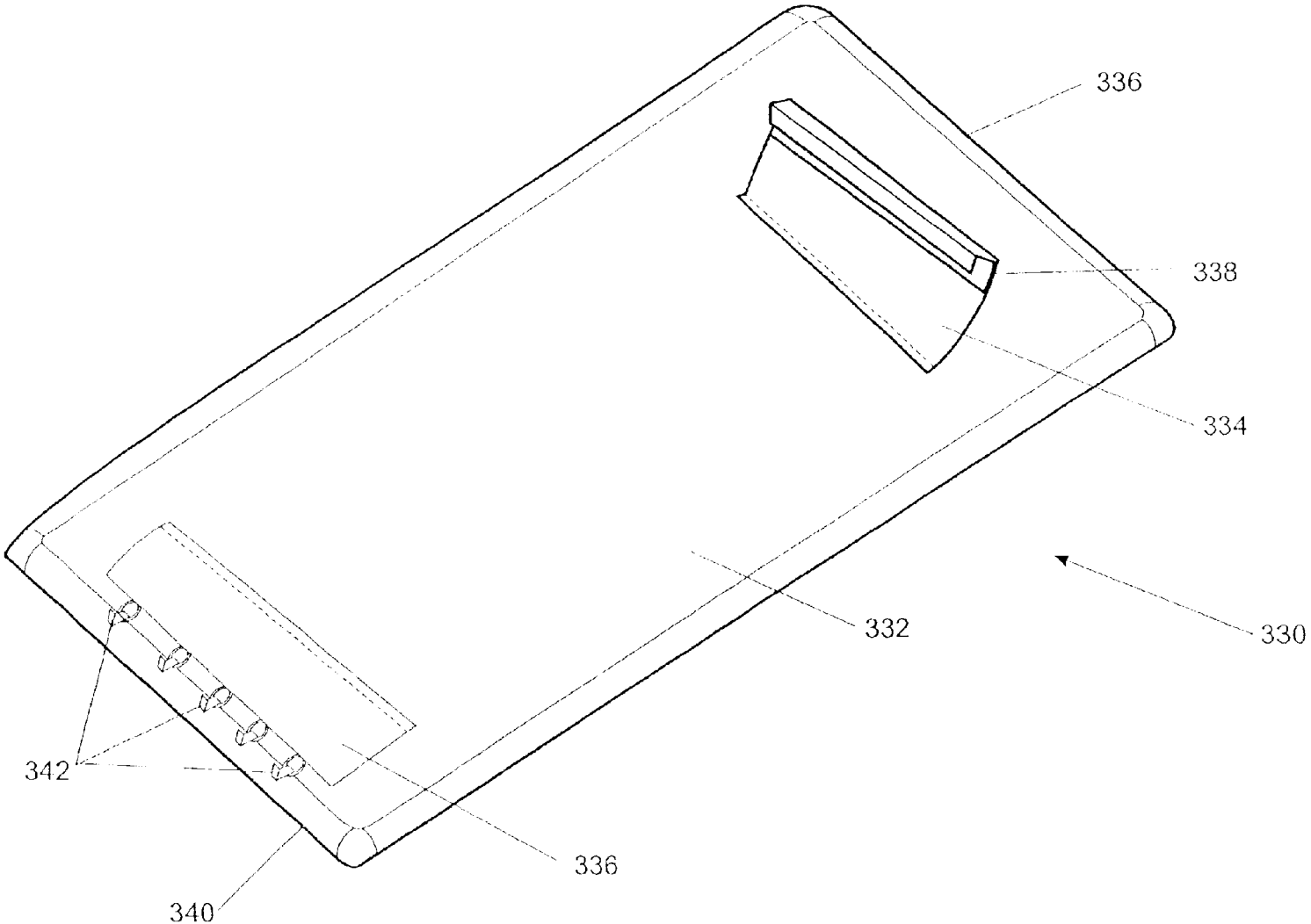
FIG. 88 is a perspective view of a topper pad.

Despite the fact that the seat panel 14 and the back portion 16 have been designed with a view to the occupant's comfort, a chair's appearance of comfort is also important. As the occupant approaches, a chair with soft padded upholstery will be visually more comfortable compared to a chair with a panel for a seat and taut mesh for the back portion, even if both chairs have the same comfort performance over time. Accordingly, a topper pad 330 has been developed as shown in FIG. 88. The topper pad 330 wraps over the back portion 16 of the chair, covering the mesh fabric 260. The topper pad 330 may be assembled with the chair. Alternatively, the topper pad may be retrofitted to an existing chair. The topper pad 330 is in the form of an upholstered pad formed of two sheets of fabric, e.g., leather, sewn together in a conventional manner to form a pocket open at one end. A pad such as a layer of foam is inserted in through the open end and then that end is sewn up in the conventional manner. On the rear side 332 the topper pad has first upper connection flap 334 and a second lower connection flap 336. The upper connection flap is in the form of a transverse flap substantially shorter than the transverse width of the topper pad 330. The upper flap 334 is sewn along one edge to the rear side 332 of the topper pad 330 at approximately ⅕ along the length of the topper pad 330 from the upper end 336. The upper flap incorporates a metal channel section 338 at its free end. In use, the rear side 332 of the topper pad 330 is placed against the front of the back portion 16 with the top ⅕ of the topper pad 330 overhanging the top of the back portion 16. The upper flap 334 also hangs over the top beam 40 with the channel section 338 tucking under the lower edge of the top beam 40. Accordingly, the channel section 338 is shaped to snugly engage under the lower edge of top beam 40.

The lower flap 336 is sewn across its upper edge at about approximately ⅛ from the bottom edge 340 of the topper pad 330. The lower flap 336 extends transversely across the width of the topper pad but is substantially shorter than the width of the topper pad. Both the lower flap 336 and the upper flat 334 are centrally located about the longitudinal centreline of the topper pad. At the lower edge of the lower flap 336 are a series of spaced spring clips 342 which comprise a loop of elastic material to which a metal L-section bracket is attached. The L-section bracket engages on the underside of the bottom beam 42. When the peripheral frame 34 is engaged with the back attach casting 48, the metal brackets will be held therebetween to securely fix the bottom of the topper pad 330 to the peripheral frame 34 of the chair. Additionally, the upper edge 336 of the topper pad which depends below the top beam 40 is secured in place. This may be achieved through the use of hook and loop pile fasteners (not shown).

Wheeled Base

Figure 84:
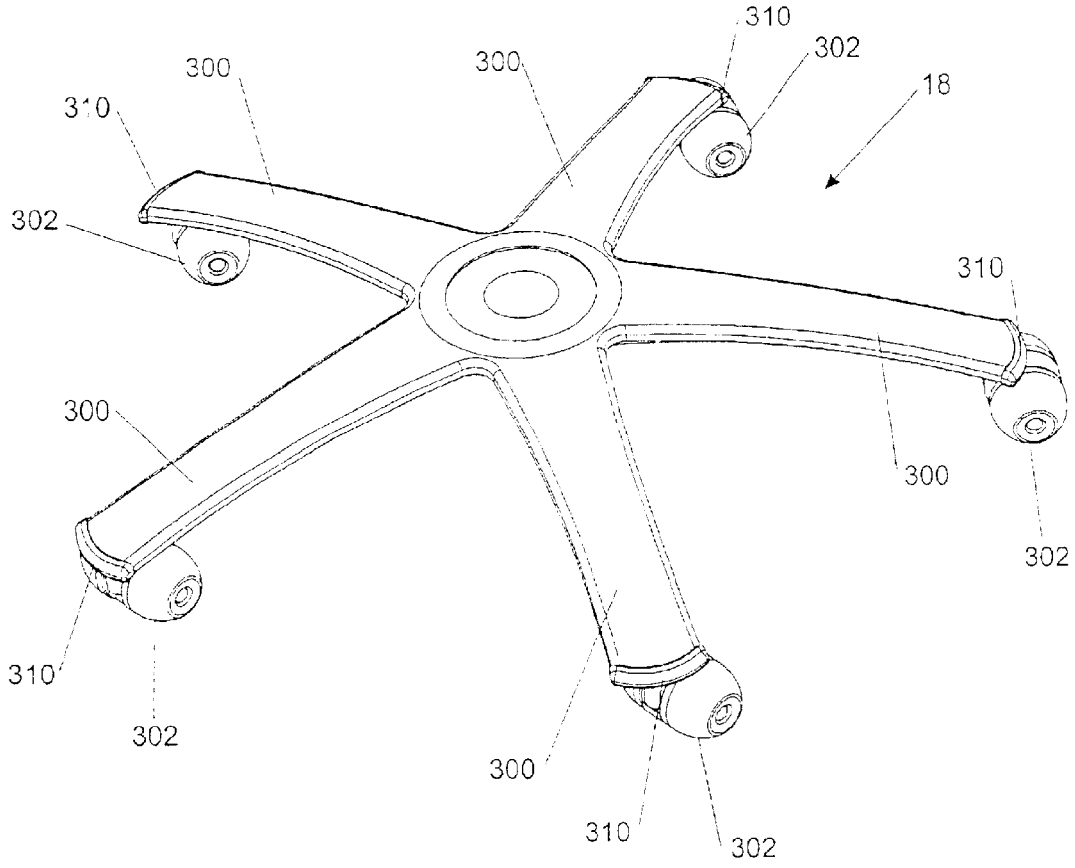
FIG. 84 is a perspective view of a preferred form of a wheeled base.
Figure 85:
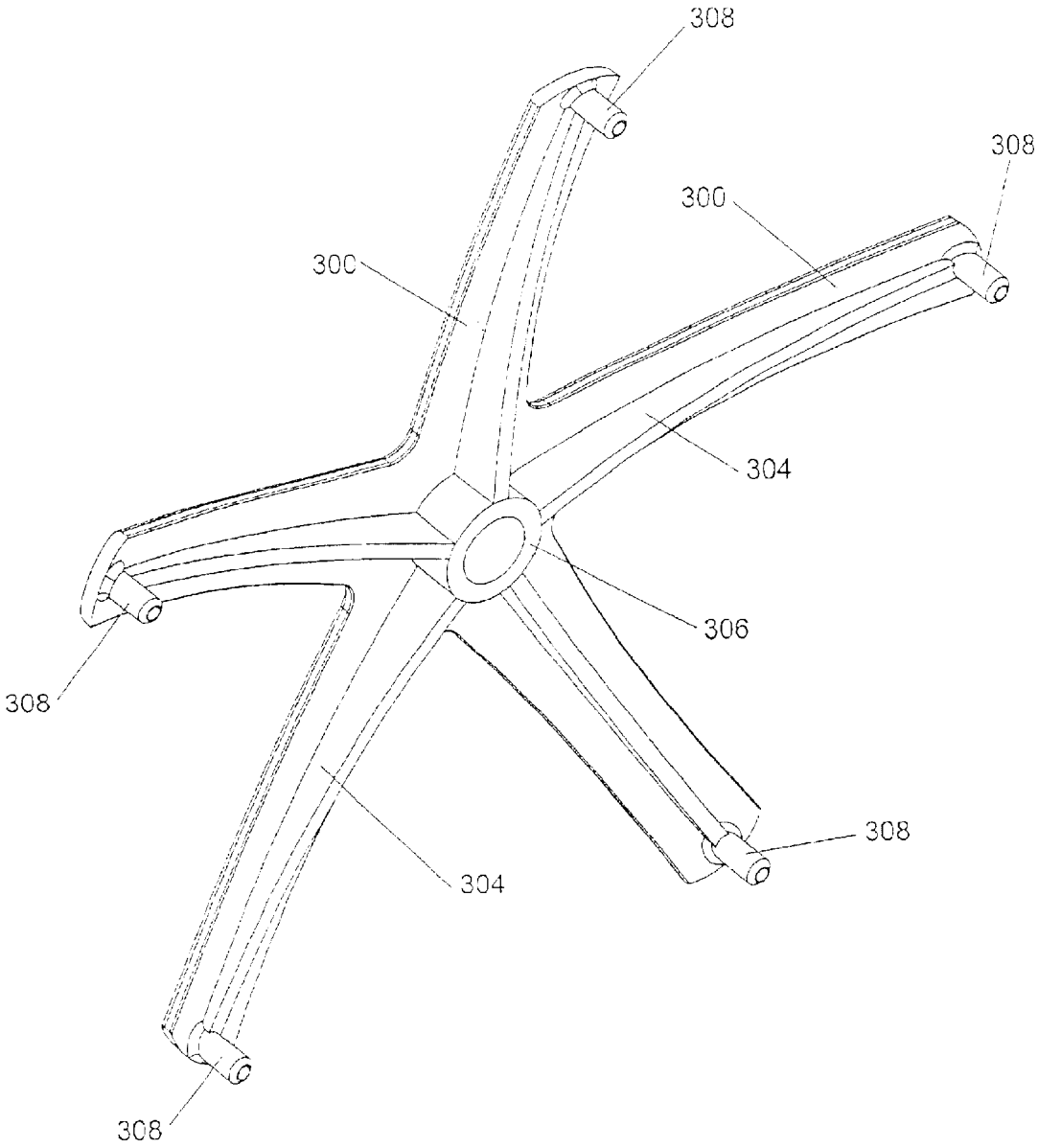
FIG. 85 is an underside perspective view of the leg assembly forming part of the wheeled base illustrated in FIG. 84.

FIG. 84 illustrates a preferred form of the wheeled base 18. The wheeled base includes five radially extending legs 300. Each of the legs is supported by a respective castor 302. As more clearly illustrated in FIG. 85, the five legs 300 make up an unitary cast leg assembly. Each leg is elongate and substantially plate-like in thickness, strengthened by a strengthening web 304 extending longitudinally along each leg 300. The strengthening webs 304 terminate at their inner ends at a centrally disposed annular boss 306. At their outer ends, each of the legs 300 is provided with an integrally formed dependent connector 308. Each dependent connector 308 is in the form of a socket or sleeve. As the legs are substantially plate-like in configuration, the end of each leg 300 terminates in a clip-on bumper 301 comprised of resilient plastic or rubber material.

Figure 86:
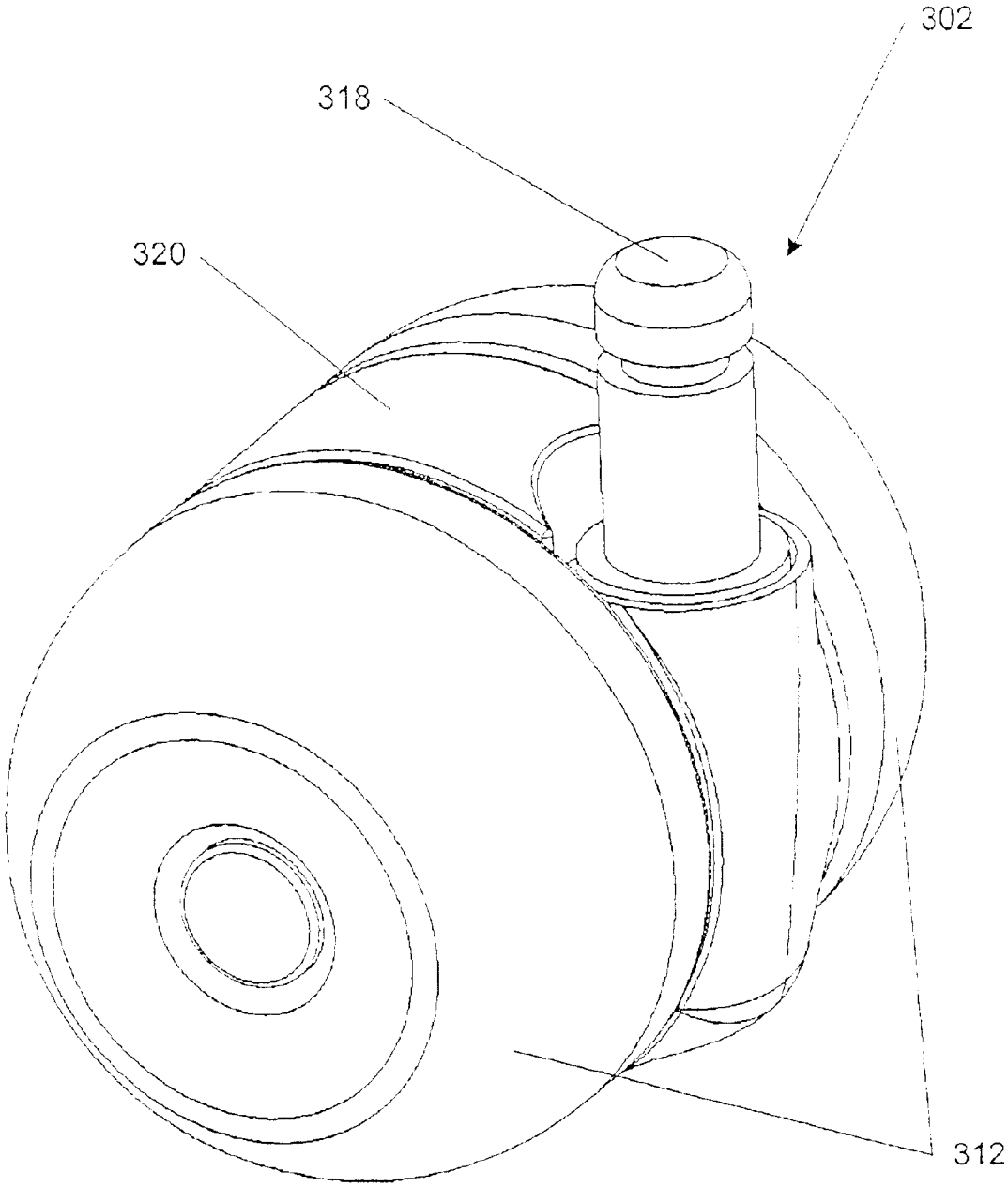
FIG. 86 is a perspective view of a castor forming part of the mobile base illustrated in FIG. 84.
Figure 87:
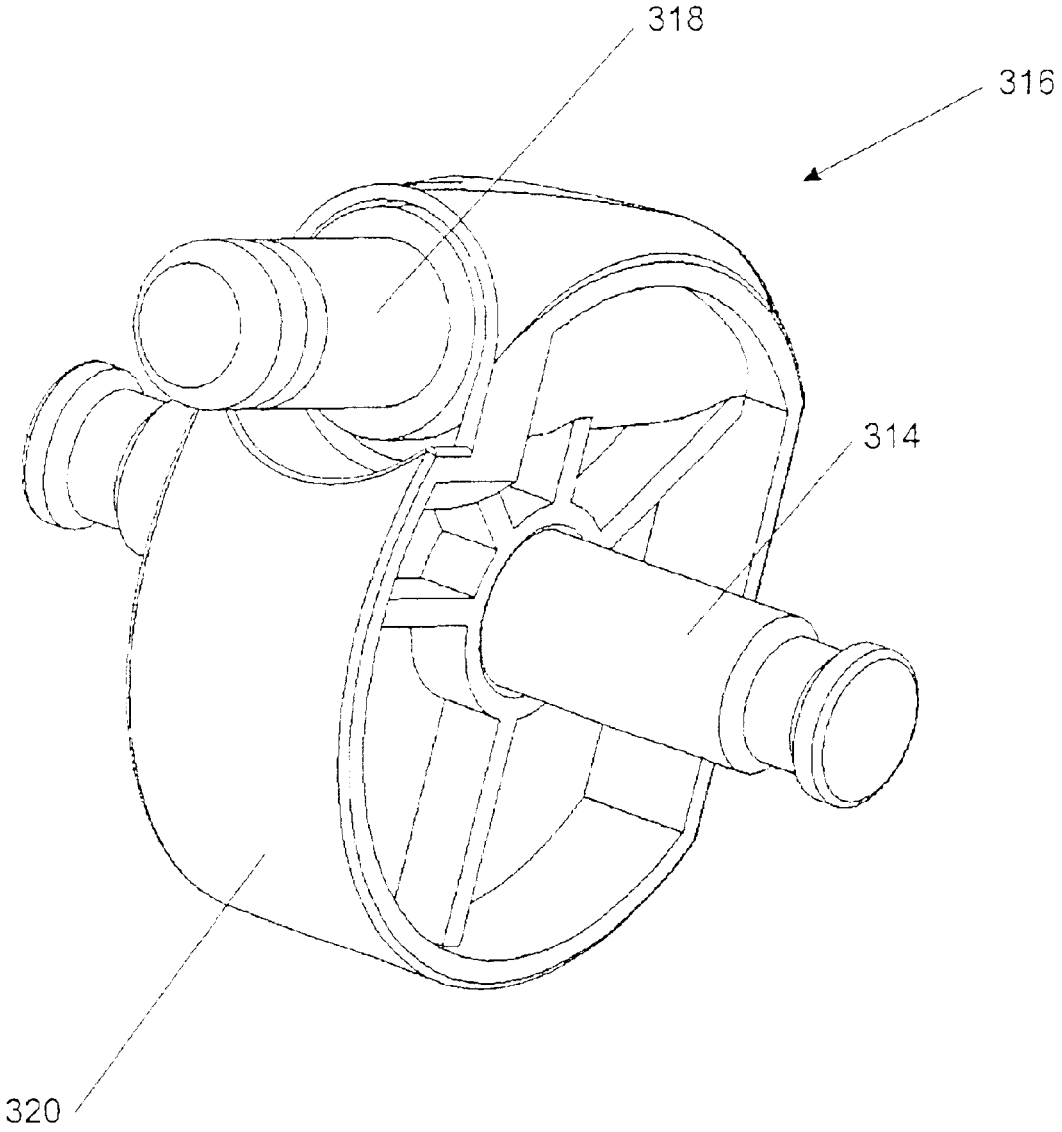
FIG. 87 is a perspective view of an axle assembly forming part of the castor illustrated in FIG. 86.

FIG. 86 illustrates the form of the castor 302. Each castor 302 comprises two spaced wheel portions 312. The wheel portions 312 are rotatably mounted on an axle 314 forming part of an axle assembly 316 illustrated in FIG. 87. The axle assembly 316 incorporates the axle 314, a connector pin 318 and an intermediate body portion 320 interconnecting the axle 314 and the connector pin 318. The wheel portions 312 are received on opposite ends of the axle 314 and rotatably held there by means of a snap-fitting. In the assembled configuration illustrated in FIG. 86, the connector pin 318 is disposed between the two wheel portions 312. Furthermore, there is a further gap provided between the connector pin 318 and the wheel portions 312 to receive at least part of the dependent connector 308. The connector pin 318 releasably engages with the dependent connector 308 enabling the pin to rotate within the dependent connector 308 about the longitudinal axis of the pin 318. A snap-fit connection may be provided therebetween. In assembled configuration of the leg 300 and the castor 302, only a small clearance need be provided between the underside of the leg 300 and the top of the castor 302. This provides for a compact arrangement of low height (typically less than 65 mm), causing minimal disruption to the movement of the chair occupant's feet under the seat portion.

Figure 89:
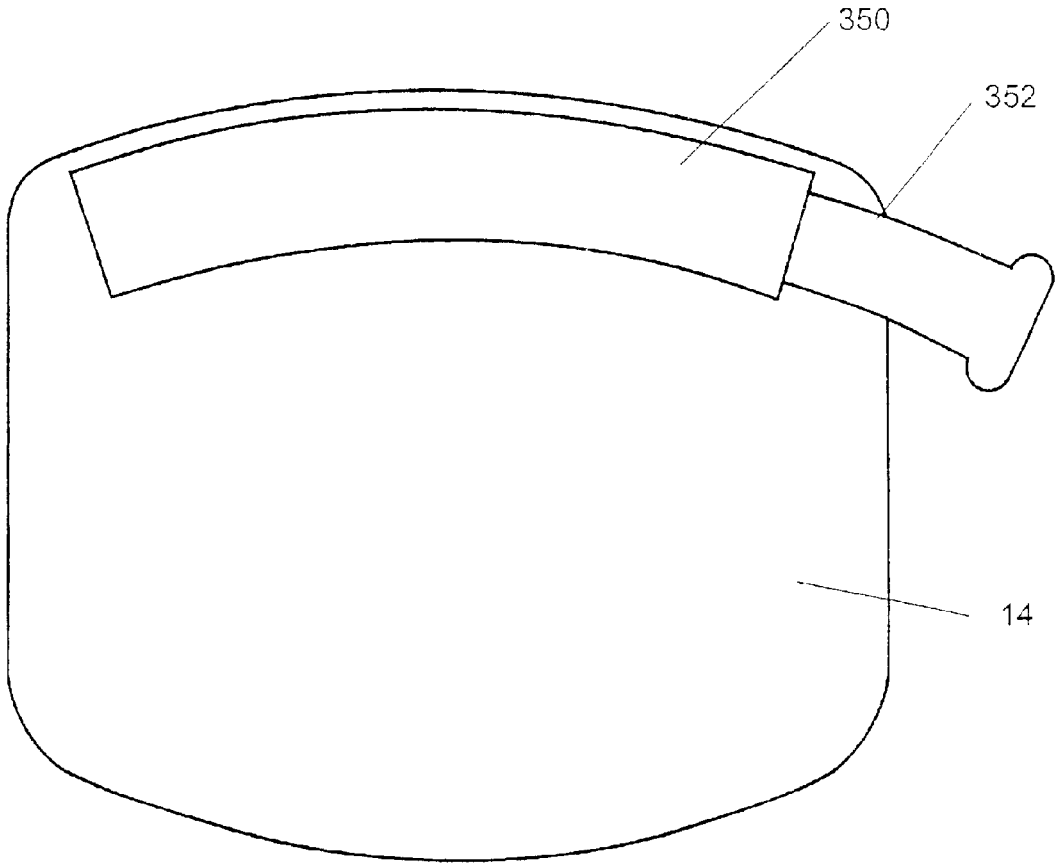
FIG. 89 is a schematic bottom view of a slightly modified form of the seat panel.
Figure 90:
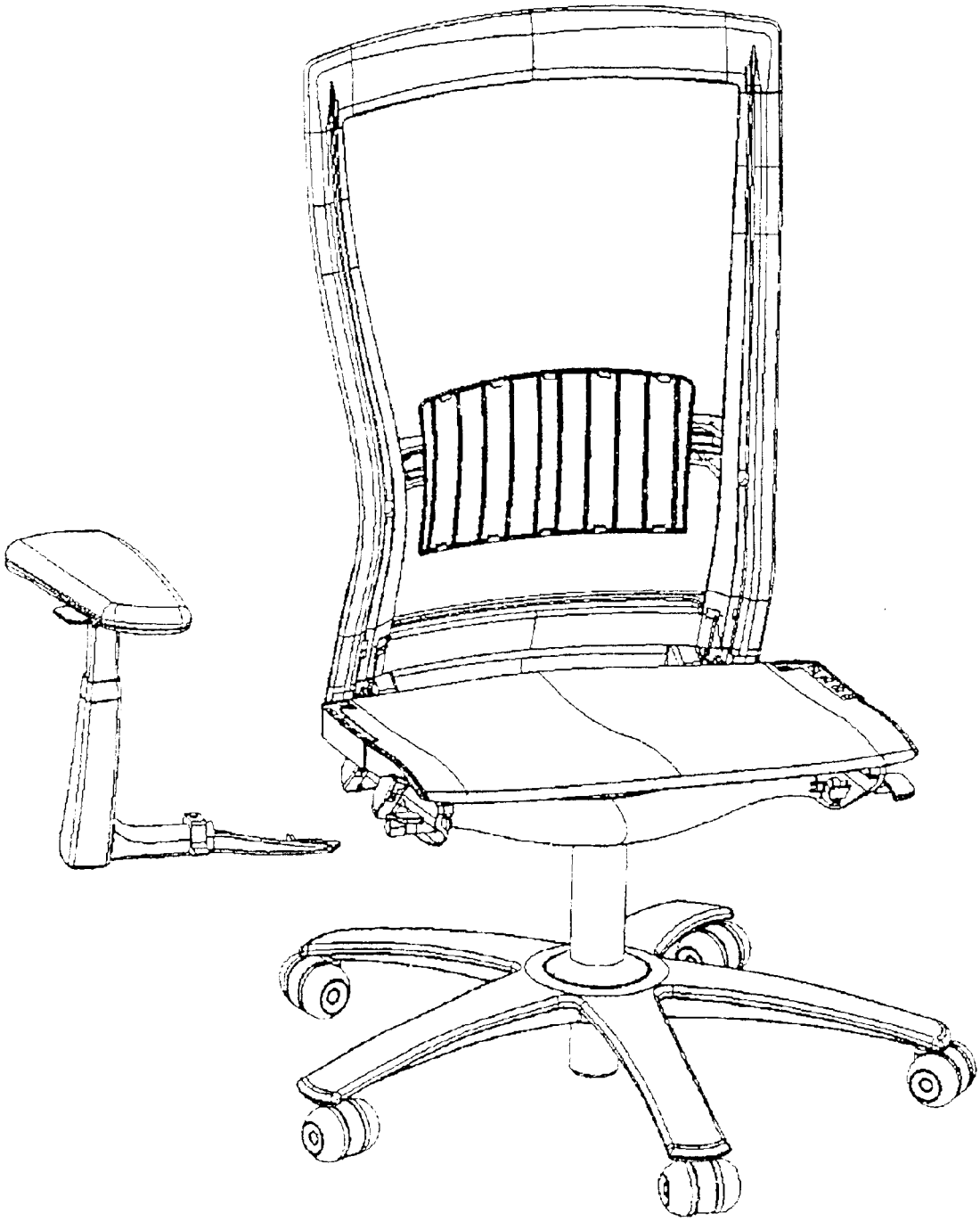
FIG. 90 is a perspective, partly exploded view of a chair in accordance with the second preferred embodiment of the chair.

FIG. 89 illustrates in schematic form, the underside of the slotted seat panel 14. Mounted to the underside of the seat panel 14 is a scabbard which is curved in form. The scabbard 350 houses an instruction slide 352 which is also curved and slides in and out of the scabbard at one end. From above, the instruction slide 352 has printed indicia thereon providing user instructions to the seat occupant.

The foregoing describes only embodiment of the present invention and modifications may be made thereto without departing from the spirit of the invention.

What is claimed is:

1. A chair comprising:

a supporting frame;

a seat portion supported above the supporting frame;

a back portion which is resiliently flexible at an intermediate lumbar region of the back portion; and a tensionable biasing device which operates on the intermediate lumbar region of the back portion and is mechanically interconnected with the seat portion, which seat portion is moveable on the application of weight from an occupant and to an extent dependent on the weight of the occupant, so that the mechanical interconnection to the seat portion and the tensionable biasing device act to increase or decrease flexibility of the back portion at the intermediate lumbar region of the back portion as a function of the weight of the occupant on the seat portion.

2. The chair as claimed in claim 1 wherein the flexible portion of the back portion corresponds to the lumbar region of an adult occupant of the chair.

3. The chair as claimed in claim 2 wherein the back portion comprises a flexible frame and other portions of the frame beyond the portion corresponding to the lumbar region are flexible.

4. The chair as claimed in claim 1 wherein the flexibility adjustment takes place automatically in response to the weight imparted by the occupant on the seat portion with, at least beyond a predetermined threshold in weight, the larger the weight, the greater the stiffiaess imparted to the back portion.

5. The chair as claimed in claim 1 wherein the tensionable biasing device comprises at least one leaf-type spring lying against the back portion at a lower region thereof.

6. The chair as claimed in claim 5 further including a recline mechanism embodying a four bar linkage comprising four elements as follows:

a main support forming part of the supporting frame;

a second linkage comprising the seat portion or a guide relative to which the seat portion is selectively movable;

a front support linkage extending between the main support and the second linkage; and a drive linkage wherein the drive linkage is pivotable about a drive axis through the main support, the drive linkage being connected to the second linkage; and further wherein an interconnecting linkage interconnects the leaf-type spring with the drive linkage such that, at least beyond the predetermined threshold, the weight on the seat causes the leaf-type spring to flex against the back portion to impart greater stiffness thereto.

7. The chair as claimed in claim 6 wherein a supplementary spring is provided, whereby weight on the seat portion up to the predetermined threshold causes flexing of the supplementary spring.

8. The chair as claimed in claim 6 wherein two four bar linkages are defined on opposite sides of the chair, there being two such leaf-type springs on opposite sides of the chair with two such interconnecting linkages, wherein each interconnecting linkage is disposed directly between the associated leaf-type spring and the associated drive link.

9. The chair as claimed in claim 8 wherein the four bar linkages tilt the seat portion synchronously with back recline.

10. The chair as claimed in claim 1 wherein a tension limit is provided to prevent over-tensioning of the tensionable biasing device.

11. The chair as claimed in claim 10 wherein the tension limit is in the form of a physical stop which acts against the leaf-type spring.

* * * * *

UNITED STATES PATENT AND TRADEMARK OFFICE

CERTIFICATE OF CORRECTION

PATENT NO. : 6,817,667 B2
DATED : November 16, 2004
INVENTOR(S) : Pennington et al.

It is certified that error appears in the above-identified patent and that said Letters Patent is hereby corrected as shown below:

Title page,
Item [56], References Cited, U.S. PATENT DOCUMENTS,
after "4,552,406 A 11/1985" change "Ohl" to -- Ohi --.
FOREIGN PATENT DOCUMENTS, add the following missing documents:
-- WO WO 01/03548 Al 1/2001
WO WO 01/39633 Al 6/2001 --.

Column 2,
Line 13, after "such adjustment" change "mechanism" to -- mechanisms --.

Column 3,
Lines 14-15, after "folding" change "in the directly rearwardly" to -- in the rearward direction --.
Line 41, change "rearward recline action" to -- rearward reclining action --.
Line 51, before "one or more springs." remove "a".

Column 4,
Line 50, after "interconnecting linkage" change "which" to -- which, --.

Column 5,
Line 37, after "interconnected by" remove "a".
Line 43, after "increased tension" change "of" to -- on --.

Column 6,
Line 5, after "reclinable back" change "portion;" to -- portion, --.
Line 64, after "In accordance" insert -- with --.

Column 7,
Line 57, after "width dimension" change "diagonally" to -- diagonal --.
Line 64, after "a flat bar" insert -- , --.

Column 8,
Line 62, after "The invention consists" change "in" to -- of --.

Column 9,
Line 19, before "illustrated in FIG. 4;" remove "on".
Line 57, after "as the first" change "line" to -- recline --.

Column 10,
Line 57, after "second embodiment of" insert -- the --.

UNITED STATES PATENT AND TRADEMARK OFFICE

CERTIFICATE OF CORRECTION

PATENT NO. : 6,817,667 B2
DATED : November 16, 2004
INVENTOR(S) : Pennington et al.

It is certified that error appears in the above-identified patent and that said Letters Patent is hereby corrected as shown below:

Column 11,
Line 31, after “the opposite side” insert -- of --.

Column 13,
Line 5, change “Ann Assembly” to -- Arm Assembly --.

Column 15,
Line 43, after “This is considerably” change “lesser” to -- less --.

Column 16,
Lines 10-11, change “in which is it” to -- in which it is --.

Column 17,
Line 57, after “the right fork 93c” insert -- , --.

Column 18,
Line 60, change “98'and” to -- 98' and --.

Column 20,
Line 51, after “drive link 141” change “(see” to -- (see FIG. 30) --.

Column 21,
Line 19, after “the drive link 141” insert -- , --.
Line 55, before “the leaf spring 128” remove “By”.
Line 65, change “an anticlockwise” to -- a counterclockwise --.

Column 22,
Line 57, before “push link 139” insert -- and --.

Column 24,
Line 42, change “casting 48', the” to -- casting 48'. The --.

Column 25,
Line 25, after “474” insert -- , --.
Line 36, change “bites 480” to -- bights 480 --.

Column 26,
Line 60, after “(The central” change “web however” to -- web, however, --.

UNITED STATES PATENT AND TRADEMARK OFFICE

CERTIFICATE OF CORRECTION

PATENT NO. : 6,817,667 B2
DATED : November 16, 2004
INVENTOR(S) : Pennington et al.

It is certified that error appears in the above-identified patent and that said Letters Patent is hereby corrected as shown below:

Column 30,
Line 44, after "see FIG. 63" insert -- , --.
Line 45, after "FIG. 63" remove ",".
Line 57, change "guide However," to -- guide. However, --.

Column 31,
Line 47, after "Additionally" insert -- , --.
Line 54, after "one of which" remove "is".

Column 32,
Line 4, change "envitably" to -- inevitably --.
Line 12, change "will to an extent" to -- will, to an extent, --.

Column 33,
Line 12, after "second embodiment" insert -- of the --.

Column 36,
Line 41, change "embodiment" to -- embodiments --.

Column 37,
Line 5, change "stiffiaess" to -- stiffness --.

Signed and Sealed this

Eighteenth Day of October, 2005

JON W. DUDAS
*Director of the United States Patent and Trademark Office*